US008328324B2

(12) United States Patent
Miyazawa

(10) Patent No.: US 8,328,324 B2
(45) Date of Patent: Dec. 11, 2012

(54) MAINTENANCE DEVICE FOR LIQUID EJECTION HEAD

(75) Inventor: Hisashi Miyazawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 1482 days.

(21) Appl. No.: 11/783,511

(22) Filed: Apr. 10, 2007

(65) Prior Publication Data

US 2008/0012897 A1 Jan. 17, 2008

(30) Foreign Application Priority Data

Apr. 10, 2006 (JP) ..... P2006-108088
Apr. 9, 2007 (JP) ..... P2007-101354

(51) Int. Cl.
*B41J 2/165* (2006.01)

(52) U.S. Cl. ..... 347/33
(58) Field of Classification Search ..... 347/33
See application file for complete search history.

(56) References Cited

U.S. PATENT DOCUMENTS 7,575,296 B2 * 8/2009 Yoshida ..... 347/33

FOREIGN PATENT DOCUMENTS

| | | |
|---|---|---|
| JP | 06-191061 | 7/1994 |
| JP | 08-281968 | 10/1996 |
| JP | 11-115275 | 4/1999 |
| JP | 2002-210983 | 7/2002 |
| JP | 2002-264350 | 9/2002 |
| JP | 2003-127434 | 5/2003 |
| JP | 2004-330495 | 11/2004 |
| JP | 2006076203 | 3/2006 |

* cited by examiner

*Primary Examiner* — Kevin S Wood
(74) *Attorney, Agent, or Firm* — Sughrue Mion, PLLC

(57) ABSTRACT

A maintenance device that is mounted in a printer, which has a recording head including nozzles ejecting ink, and maintains the recording head is provided. The maintenance device includes a plurality of wipers capable of wiping a nozzle forming surface of the recording head, an electric motor that drives each of the wipers movably in a wiping direction, and a selecting portion. The selecting portion selects at least one of the wipers and causes the selected wiper to wipe the nozzle forming surface when the wiper moves in the wiping direction.

10 Claims, 60 Drawing Sheets

MAINTENANCE DEVICE FOR LIQUID EJECTION HEAD

CROSS-REFERENCE TO RELATED APPLICATIONS

This application is based upon and claims the benefit of priority from prior Japanese Patent Application No. 2006-108088, filed on Apr. 10, 2006 and No. 2007-101354, filed on Apr. 9, 2007, the entire content of which is incorporated herein by reference.

BACKGROUND

1. Technical Field

The present invention relates to a maintenance device for a liquid ejection head provided in a liquid ejection apparatus such as a printer, which performs maintenance for the liquid ejection head.

2. Background Art

A liquid ejection apparatus such as a printer includes, for example, a liquid ejection head (which is, for example, a recording head) having nozzles through which liquid is ejected. The apparatus performs printing by ejecting the liquid through the nozzles. As methods of printing employed by a recording head, there are scanning methods and non-scanning methods. In the scanning method, a recording head performs printing by ejecting droplets while being moved. The non-scanning method involves use of an elongated line head or a multiple head. The line head includes nozzle rows defined in the entire range corresponding to the maximum printing width. The multiple head is formed by a plurality of recording heads in which nozzle rows are provided over the aforementioned range. In the non-scanning method, a recording medium is transported in printing while the recording heads are fixed.

If ejection of ink through a liquid ejection nozzle is suspended for an extended period of time, the ink may become viscous or fixed in the nozzle and thus clog the nozzle. Thus, the printers disclosed in Japanese Laid-Open Patent Publication No. 8-281968, Japanese Patent No. 3155871, Japanese Laid-Open Patent Publication No. 2003-127434, Japanese Laid-Open Patent Publication No. 11-115275, Japanese Laid-Open Patent Publication No. 2002-264350, Japanese Laid-Open Patent Publication No. 2002-210983, and Japanese Laid-Open Patent Publication No. 2004-330495 include a maintenance device that performs maintenance for a recording head.

The maintenance device includes a cap and a suction pump. The cap is capable of sealing a surface (hereinafter, referred to as a "nozzle forming surface") of the recording head in which nozzle openings are defined by contacting the nozzle forming surface in such a manner as to encompass the nozzle openings. The suction pump performs suction through the cap when the cap seals the nozzle forming surface, or generates negative pressure in the space sealed by the cap. This causes suction cleaning (suction recovery) in which ink (liquid) is drawn from the nozzles. In this manner, viscous ink and bubbles of ink are removed from the nozzles and the nozzles are recovered to a state in which the nozzles are capable of effective ink ejection. Further, the maintenance device has a wiper that wipes the nozzle forming surface. After the suction cleaning is completed, the wiper wipes the nozzle forming surface to remove ink or paper particles from the nozzle forming surface. Such wiping also functions to maintain the forms of meniscuses (hereinafter, referred to as "nozzle meniscuses") of ink in the nozzles. Variation of the forms of the nozzle meniscuses causes variation of the amounts of liquid ejection and thus the sizes of printing dots, which lowers printing quality. However, by maintaining the nozzle meniscuses through wiping, desirable printing quality is saved.

For example, Japanese Laid-Open Patent Publication No. 8-281968 describes a maintenance device having caps arranged in correspondence with nozzle rows each of which ejects ink of a color. Ink suction is thus performed through the separate caps on the nozzle rows each of which ejects ink of a different color from the other nozzle rows. Further, in a maintenance device disclosed in Japanese Laid-Open Patent Publication No. 8-281968, a recording head for color inks and a recording head for black ink are wiped by separate wipers. Each of the wipers wipes the corresponding group of the recording heads when the recording head is moved in the scanning direction. When such wiping is performed, each wiper is raised to a wiping position and, in this state, the corresponding recording head is moved in the scanning direction relative to the wiper in such a manner that the nozzle forming surface of the recording head slides on the wiper.

Further, although suction cleaning is carried out usually as periodical cleaning that is repeatedly performed each time a constant time period elapses, defective ejection may be caused by a nozzle prematurely. Thus, it is desirable that a defective ejection nozzle be detected even before the periodical cleaning and cleaning be performed if a defective ejection nozzle is detected. As a device that detects such a defective ejection nozzle, a device using a laser beam described in Japanese Laid-Open Patent Publication No. 2002-210983 and a device detecting reflected light of light radiated onto a printed pattern disclosed in Japanese Laid-Open Patent Publication No. 2004-330495 are known.

However, the technique described in Japanese Laid-Open Patent Publication No. 8-281968 is inapplicable to wiping of a non-scanning type liquid ejection head such as a line head or a multiple head, since this type of liquid ejection head cannot be subjected to wiping involving movement of a recording head in a scanning direction.

If a defective ejection nozzle is detected by the detection device described in Japanese Laid-Open Patent Publication No. 2002-210983 or Japanese Laid-Open Patent Publication No. 2004-330495, the nozzle row including the detected nozzle is selected and subjected to suction cleaning. This reduces the consumption amount of the ink wasted through cleaning, not through printing. However, in this case, if wiping is carried out on the liquid ejection head by a single wiper as described in Japanese Laid-Open Patent Publication No. 8-281968, effectively operating nozzle rows that have not been subjected to suction cleaning are also wiped by the wiper. That is, idle wiping is performed on these effectively operating nozzle rows, urging the atmospheric air to enter the nozzles from between the distal end of the wiper and the nozzle meniscuses. The atmospheric air entering the nozzles cause pressure acting to deform the nozzle meniscuses, which induces defective ejection by the nozzles.

SUMMARY

Accordingly, it is an objective of the present invention to provide a maintenance device for a liquid ejection head of a liquid ejection apparatus that includes a plurality of wipers for wiping the liquid ejection head and is used in wiping of a non-scanning type liquid ejection head while suppressing occurrence of unnecessary idle wiping.

To achieve the foregoing objective and in accordance with one aspect of the present invention, a maintenance device mounted in a liquid ejection apparatus having a liquid ejection head including nozzles that ejects liquid is provided. The maintenance device maintains the liquid ejection head. The device includes a plurality of wipers, a driver, and a selecting portion. The wipers are capable of wiping a nozzle forming surface of the liquid ejection head in which the nozzles are formed. The driver drives the wipers movably in a wiping direction parallel with the nozzle forming surface. The selecting portion selects at least one of the wiper and causes the selected wiper to wipe the nozzle forming surface when the wiper moves in the wiping direction.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DESCRIPTION OF THE EXEMPLARY EMBODIMENTS

A maintenance system and a maintenance device according to one embodiment of the present invention will now be described with reference to FIGS. 1 to 64. The maintenance system and the maintenance device are used for performing maintenance for a liquid ejection head of a liquid ejection apparatus.

<Maintenance System>

Figure 3:
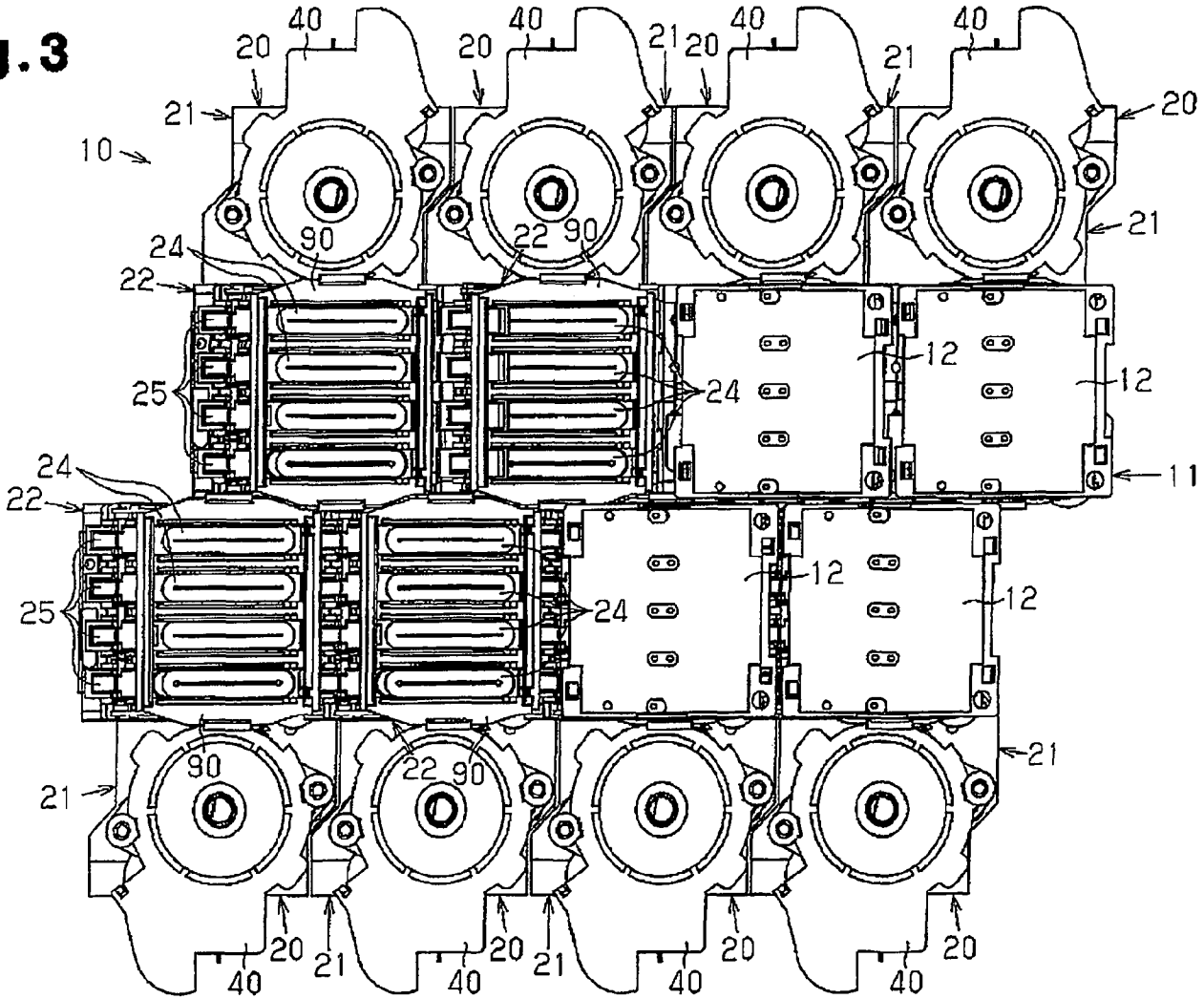
FIG. 3 is a plan view showing the maintenance system.
Figure 4:
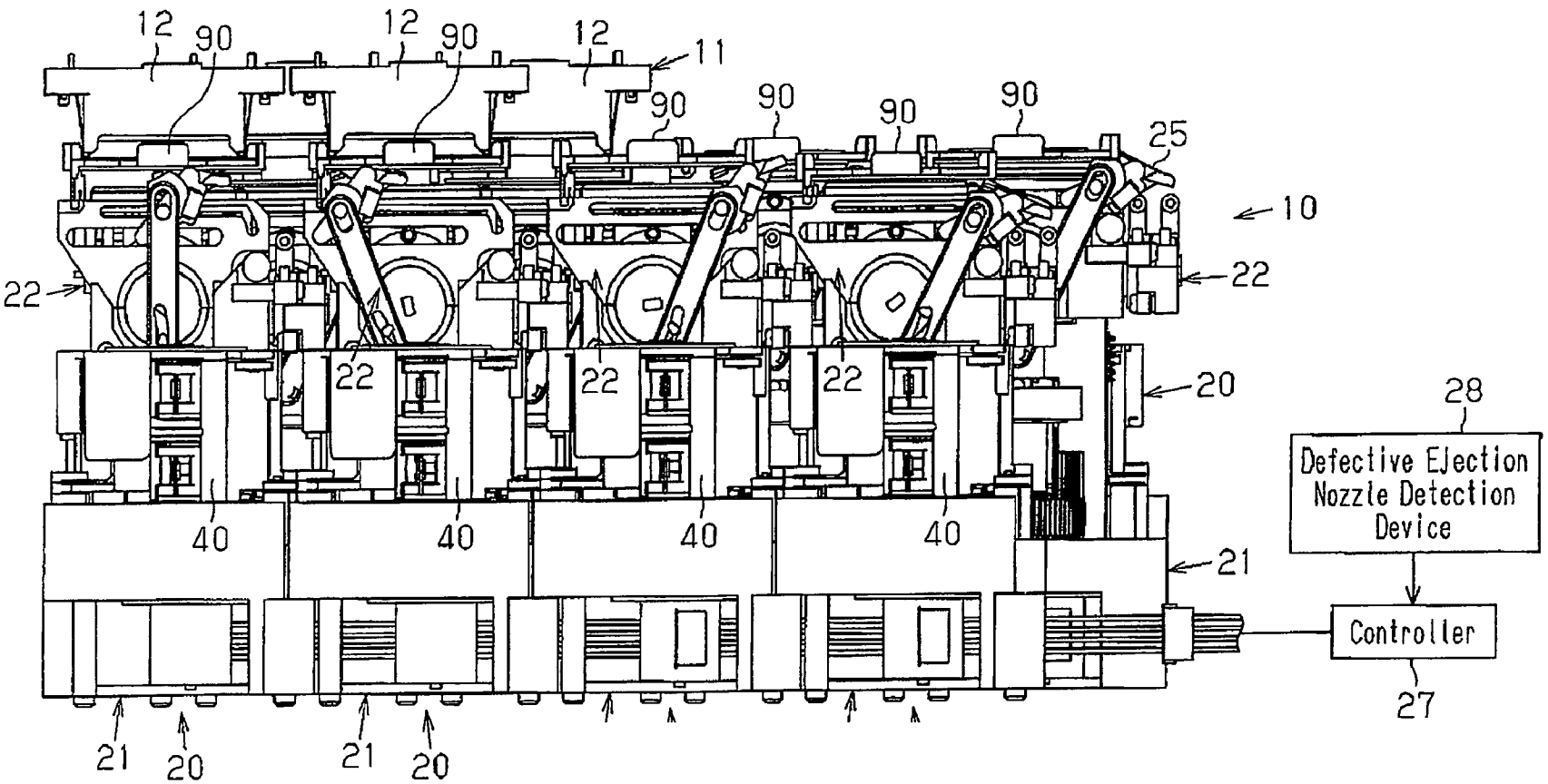
FIG. 4 is a side view showing the maintenance system.
Figure 5:
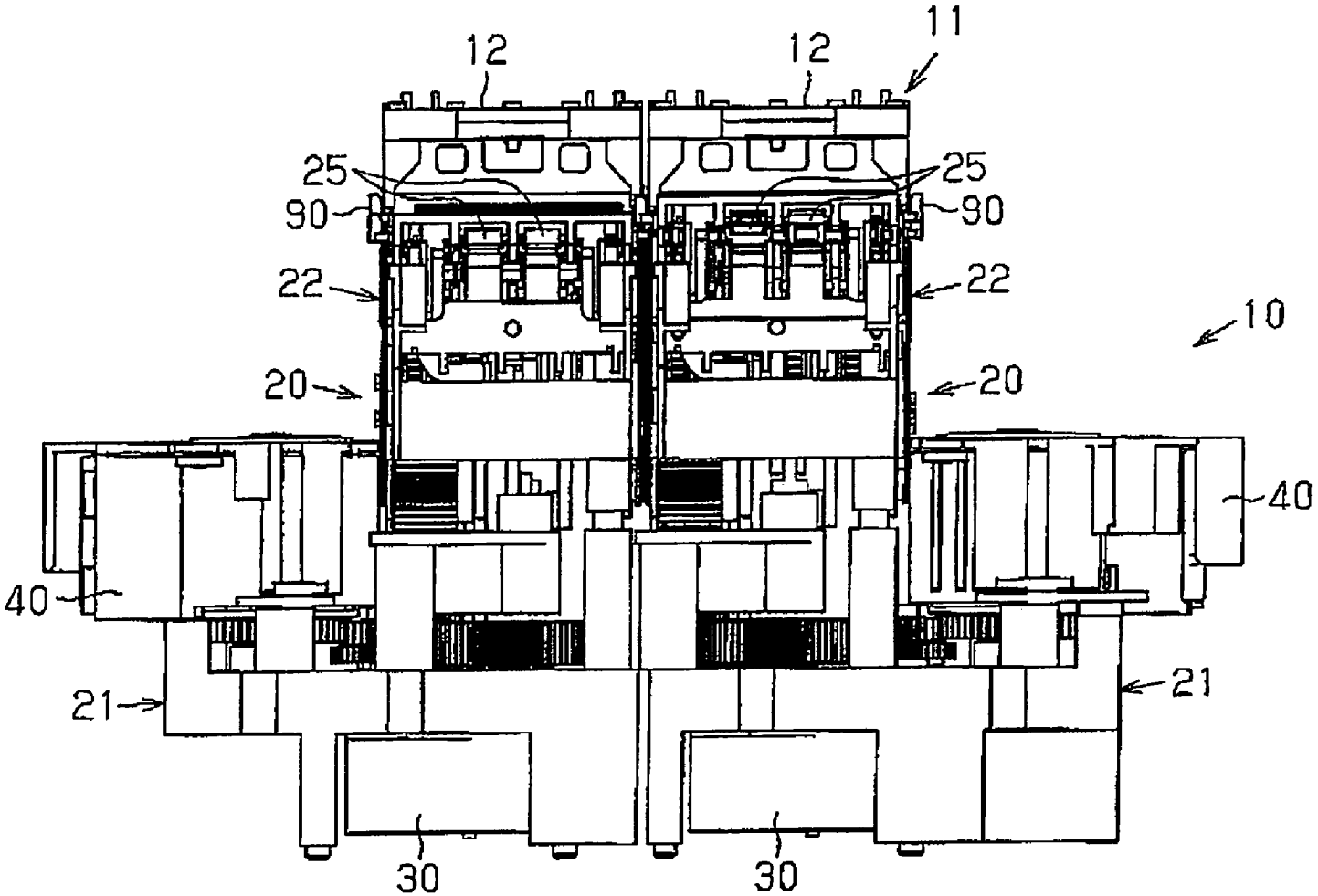
FIG. 5 is a front view showing the maintenance system.

First, the maintenance system will be explained referring to FIGS. 1 to 5. FIG. 1 is a perspective view showing a maintenance system (a multiple head cleaning system) that is used in a multiple head mounted in a multiple head type printer having a plurality of recording heads, together with a recording head system. FIG. 2 is a perspective view showing the maintenance system. FIG. 3 is a plan view showing the maintenance unit together with a portion of the recording head system. FIG. 4 is a side view showing the maintenance system, also together with a portion of the recording head system. FIG. 5 is a front view showing the maintenance system.

FIGS. 1 to 5 show a multiple head system having the multiple recording heads and the maintenance system in states located at predetermined relative positions to perform maintenance.

An inkjet type printer (hereinafter, referred to as a "printer", not shown), or a liquid ejection apparatus, includes a recording head system 11 having a plurality of (in the illustrated embodiment, eight) recording heads 12. If the printer employs a scanning method in printing, or performs printing by ejecting droplets while moving recording heads, the recording heads 12 are provided in the body of the printer movably in the main scanning direction (hereinafter, referred to also as "direction X"). In this case, a sheet of paper serving as a recording medium is transported in the sub scanning direction (hereinafter, referred to also as "direction Y") perpendicular to direction X. If the printer employs a non-scanning method in printing, or performs printing only by moving the sheet of paper, or the recording medium, while performing maintenance for a recording head in a fixed state, the recording heads 12 are provided along the entire width of the maximum sheet size in direction Y indicated in FIGS. 1 and 2. In this case, the sheet of paper, or the recording medium, is transported in direction X indicated in FIGS. 1 and 2.

Figure 1:
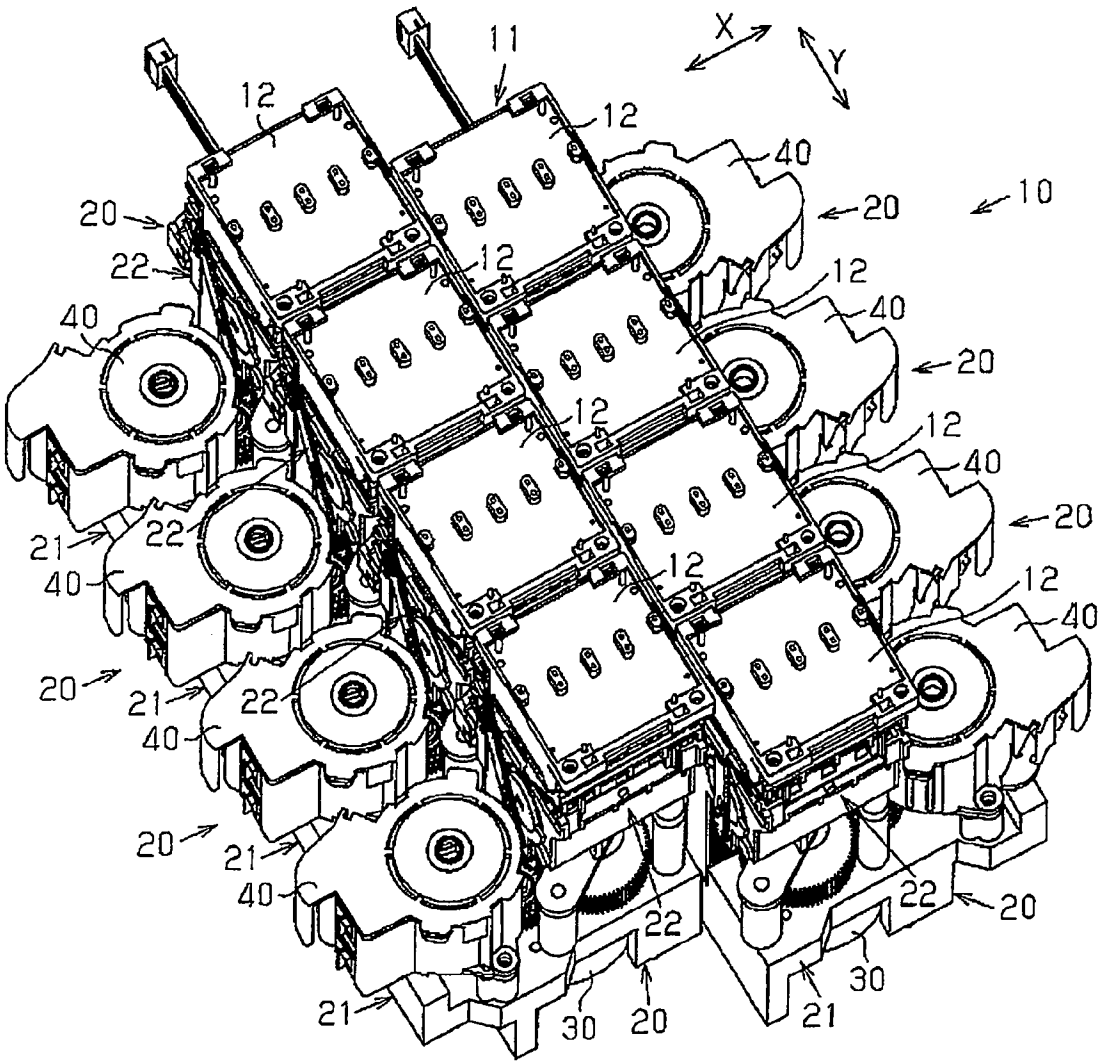
FIG. 1 is a perspective view showing a maintenance system together with a recording head system according to a first embodiment of the present invention.
Figure 2:
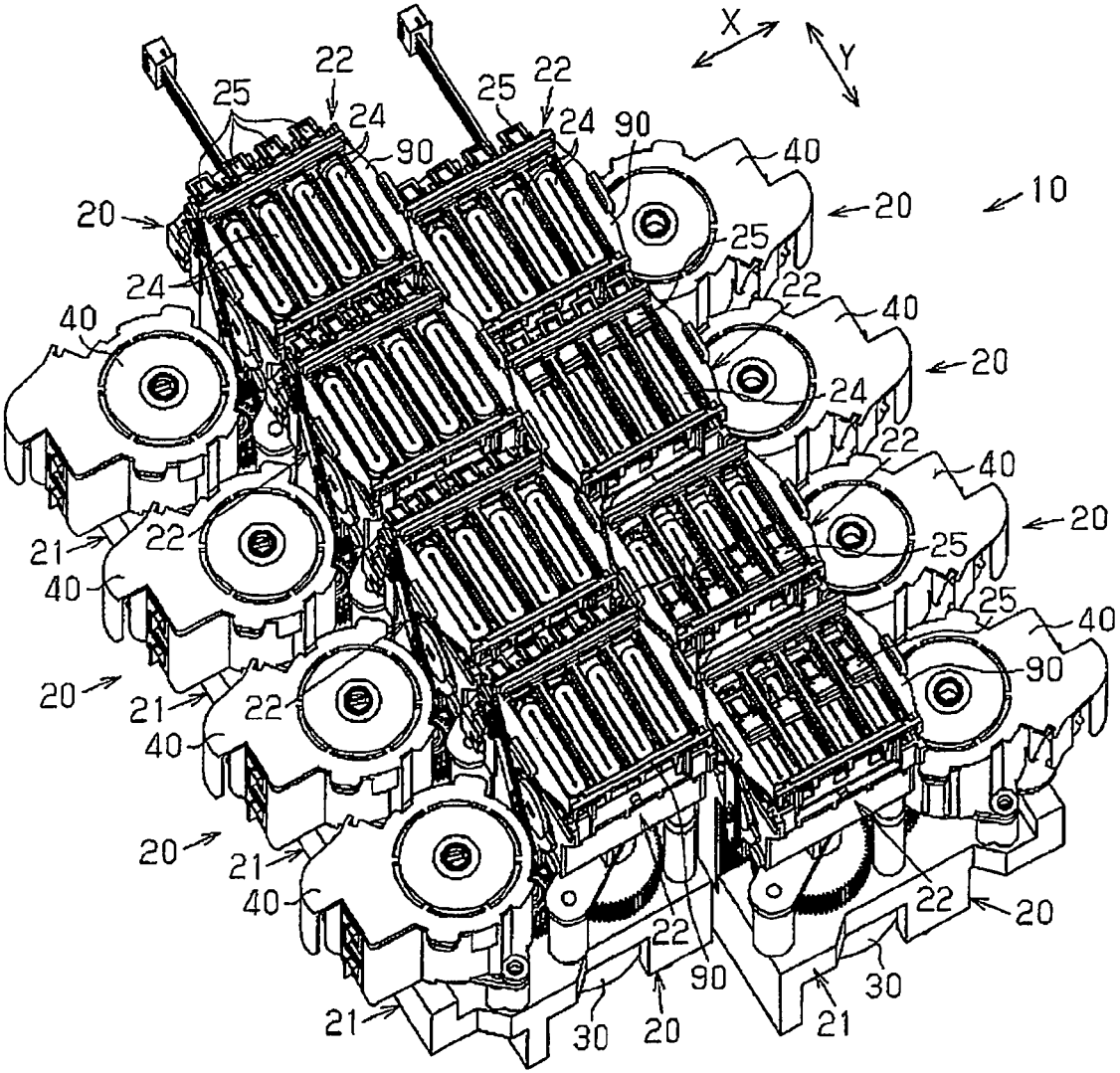
FIG. 2 is a perspective view showing the maintenance system.

As shown in FIGS. 1 and 2, the recording heads 12 are arranged adjacently in a zigzag manner along directions X and Y. A maintenance system 10, which performs maintenance of the recording heads 12 to prevent or relieve nozzle clogging, includes maintenance devices 20 provided by the number equal to the number of the recording heads 12. In other words, a plurality of (in the first embodiment, eight) maintenance devices 20 are arranged adjacently in such a manner that cleaning mechanisms 22 are each located immediately below the corresponding recording head 12.

The maintenance system 10 and the recording head system 11 are arranged at the predetermined positions in FIGS. 1 and 2 relative to each other at least when the maintenance is performed. Specifically, at least one of the recording head system 11 and the maintenance system 10 is moved until the recording head system 11 and the maintenance system 10 are located at the positions shown in FIG. 1.

The positions of the recording heads 12 are adjusted in a vertical direction (an up-and-down direction) by a non-illustrated platen gap adjustment mechanism, which adjusts the gap (hereinafter, referred to as a "platen gap") between a nozzle forming surface 12*a* (shown in FIG. 6) of each recording head 12 and a non-illustrated platen located below and opposed to the nozzle forming surface 12*a* when printing is carried out. If the platen gap adjustment mechanism is an automatic adjustment type operated by, for example, a controller 27 (shown in FIG. 4), the platen gap is automatically adjusted through adjustment of the heights of the recording heads 12 in correspondence with the thickness of a recording paper sheet, which is indicated by printing setting information. In this manner, the gap between the recording heads 12 and the surface of the paper sheet is maintained constant regardless of the thickness of the paper sheet. Thus, if the height of the recording head system 11 is (the heights of the recording heads 12 are) changed by the platen gap adjustment mechanism, the distance between the maintenance system 10 (the maintenance devices 20) and the recording head system 11 (the recording heads 12), which are located at the predetermined relative positions for the maintenance, is changed in a direction in which the maintenance system 10 and the recording head system 11 oppose each other. Alternatively, the platen gap adjustment mechanism may be manually operated by the user in correspondence with the thickness of the paper sheet. The platen gap adjustment mechanism may be, for example, an automatic adjustment type described in Japanese Laid-Open Patent Publication No. 11-115275 or a manually operable type disclosed in Japanese Laid-Open Patent Publication No. 2002-264350.

<Multiple Head System>

Figure 6A:
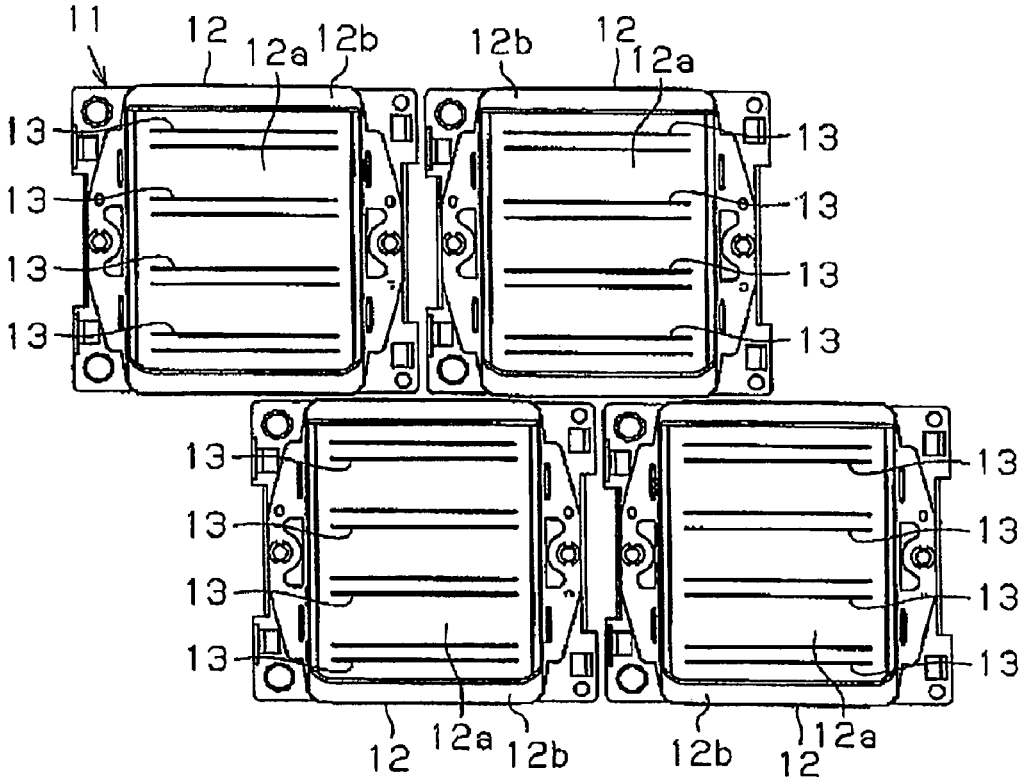
FIG. 6A is a bottom view showing the recording head system.
Figure 6B:
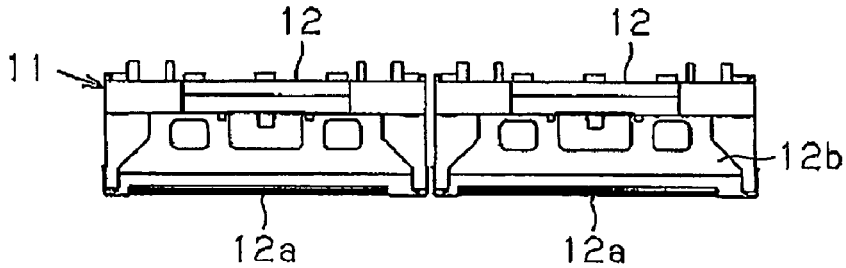
FIG. 6B is a front view showing the recording head system.

FIG. 6 shows a recording head system (a multiple head system) having a plurality of recording heads. FIG. 6A is a bottom view and FIG. 6B is a front view. In FIG. 6, only some of the eight recording heads 12 are shown.

As shown in FIG. 6A, a surface (a bottom surface) of each recording head 12 opposed to the recording medium in printing is the nozzle forming surface 12*a*. Four pairs of nozzle row 13 are provided in the nozzle forming surface 12*a*. Each pair of the nozzle rows 13 is defined by two nozzle rows located close to each other. Each of the nozzle rows includes, for example, 180 nozzles.

Four color inks, which are inks of, for example, cyan (C), magenta (M), yellow (Y), and black (K), are supplied to the recording heads 12 of the first embodiment. Thus, in each of the recording heads 12, the two nozzle rows of each of the four pairs of the nozzle rows 13 eject (discharge) the ink of the same color. That is, each recording head 12 ejects the four color inks.

If the printer employs a non-scanning method in printing, the recording heads 12 and the recording medium (the recording paper sheet) move relative to each other in direction X perpendicular to the extending direction of each nozzle row 13. In each row of the recording heads 12, a space is provided between the nozzle rows 13 of each of these recording heads 12 and the nozzle rows 13 of the adjacent one of the recording heads 12 in direction Y, or the extending direction of each nozzle row. However, the remainder of the recording heads 12 are arranged adjacently in direction X perpendicular to each nozzle row in a zigzag manner. Thus, the nozzle rows 13 of the recording heads 12 that are aligned in another row are located at the positions corresponding to the aforementioned spaces. That is, through the zigzag arrangement of the recording heads 12, the nozzle-rows 13 corresponding to the same colors are provided continuously between different ones of the recording heads 12 in the left-and-right direction in FIG. 6A. In this manner, printing is carried out over the entire area covering the maximum width range of the paper sheet, or the recording medium.

In each recording head 12, piezoelectric oscillators (piezoelectric oscillation elements) are aligned at the positions corresponding to the 180 nozzles, which form each of the nozzle rows 13. A drive voltage pulse is provided to those of the piezoelectric oscillators corresponding to the nozzles through which ink is to be ejected to oscillate the piezoelectric oscillators. This expands and compresses ink chambers communicating with the nozzles. In this manner, some of the ink that has flown into the ink chambers in expansion is ejected from the associated nozzles in compression of the ink chambers. The piezoelectric oscillators to which the drive voltage pulse must be provided are selected based on printing data. The ink is thus ejected selectively from the nozzles corresponding to the positions at which the dots are to be formed. Printing is thus performed in accordance with the printing data.

Referring to FIGS. 1 and 2, the eight cleaning mechanisms 22, each of which forms the corresponding one of the eight maintenance devices 20, are arranged in a zigzag manner and immediately below the associated recording heads 12, which are arranged also in a zigzag manner. As viewed from above, the components of each cleaning mechanism 22 are located in the range corresponding to the associated recording head 12. In other words, in the first embodiment, the lengths of the two sides of the cleaning mechanism 22, which has a substantially rectangular shape, in directions X and Y are substantially equal to the lengths of the corresponding two sides of the recording head 12 in directions X and Y, as viewed from above. When the cleaning mechanisms 22 are arranged in a zigzag manner, three of the four sides of each cleaning mechanism 22, as viewed from above, must be located adjacent to the corresponding sides of the adjacent cleaning mechanism 22. Thus, to allow the zigzag arrangement of the cleaning mechanisms 22 immediately below the recording heads 12, which are provided in the zigzag manner, each of the maintenance devices 20 is formed in a shape in which the components of the maintenance device 20 do not project outwardly from the aforementioned three sides.

However, at the remaining one side of each cleaning mechanism 22, which is free from shape limitations necessary for the zigzag arrangement of the cleaning mechanisms 22, some of the components including a suction pump 40 project outwardly from the range corresponding to the cleaning mechanism 22. This restricts the height of the cleaning mechanism 22 to a certain extent. As long as the zigzag arrangement of the cleaning mechanisms 22 is ensured, the structure and the shape of each cleaning device may be set as desired.

In the eight maintenance devices 20, four of the cleaning mechanisms 22 are aligned in a row with the remaining four aligned in another row. The sides of the cleaning mechanisms 22 corresponding to the suction pumps 40 face outward. The rows of the cleaning mechanisms 22 oppose each other and are located offset from each other at half of a pitch in direction Y. As a result, the multiple (eight) cleaning mechanisms 22 are arranged in the zigzag manner adjacently in directions X and Y at the positions immediately below the associated recording heads 12, which forms a multiple head structure and are arranged in the zigzag manner.

<Selection Cleaning Mechanism>

Each of the maintenance devices 20 performs suction cleaning and wiping as maintenance. Specifically, in such suction cleaning, the nozzle forming surface 12*a* of the corresponding recording head 12 is maintained in a capping state by a cap 24 held in contact with the nozzle forming surface 12*a* in such a manner as to encompass the nozzle rows 13. The interior of the cap 24 is then subjected to suction by the associated suction pump 40 to generate negative pressure in the cap 24. The ink is thus forcibly drawn from the nozzles (not shown). Wiping is carried out by a wiper 25 wiping the nozzle forming surface 21*a* after the suction cleaning is accomplished. Through the suction cleaning, clogging of the nozzles is relieved and viscous ink is removed from inside the nozzles. Through the wiping, the ink or undesirable objects such as dust are wiped off the nozzle forming surfaces 12*a* and the meniscuses of the ink in the nozzles are maintained.

As shown in FIGS. 2 and 3, a head guide unit 90 is arranged at an upper end of each cleaning mechanism 22, which opposes the associated recording head 12. Four caps 24 are provided to face the openings of a grid-like shape of the head guide unit 90. Each of the four caps 24 is capable of capping by separately sealing the corresponding one of the four pairs of the nozzle rows defined on the nozzle forming surface 12*a* of the associated recording head 12. Four wipers 25 are provided at the positions corresponding to the four caps 24. The retreat positions of the wipers 25 are located outwardly from the caps 24 in the longitudinal directions of the caps 24 and the extending directions of the nozzle rows. The four wipers 25 are connected together by a common shaft. Each of the wipers 25 is capable of reciprocating above the associated one of the caps 24 and along the longitudinal direction of the cap 24. Each wiper 25 moves in the extending direction of each nozzle row along the corresponding one of the four pairs of the nozzle rows to wipe the associated nozzle forming surface 12*a*.

In each of the recording heads 12 that form the recording head system 11, each nozzle row is defined over a length that covers a maximal range in the extending direction of the nozzle row on the nozzle forming surface 12*a*. The size of the space between the edge of each recording head 12 and the end of each nozzle row 13 in the nozzle row extending direction thus becomes relatively small. Thus, when each wiper 25 is arranged at a wiping start position at which wiping of the nozzle rows 13 is started, the wiper 25 may easily hit the edge of the recording head 12. However, in the first embodiment, since each wiper 25 is prevented from hitting the edge of the associated recording head 12, the portion of the edge extending perpendicular to the nozzle rows 13 is not protected by a cover head 12*b*, as shown in FIGS. 6A and 6B.

As illustrated in FIG. 4, a defective ejection nozzle detection device 28 is electrically connected to the controller 27. The defective ejection nozzle detection device 28 detects a defective ejection nozzle in which clogging has been brought about from a number of nozzles provided in the nozzle forming surfaces 12*a* of the recording heads 12. When a defective ejection nozzle is detected, one of the nozzle rows 13 including the defective ejection nozzle (a defective ejection nozzle row) is subjected to cleaning selectively from the multiple nozzle rows 13 (shown in FIG. 6) defined in the nozzle forming surfaces 12*a* of the recording heads 12. The defective ejection nozzle detection device may employ a laser method in which a droplet ejected from a nozzle is detected through radiation of a laser beam. Alternatively, the defective ejection nozzle detection device may optically inspect a prescribed pattern printed on a testing sheet of paper. In this case, if there is a nozzle that has not ejected a droplet or the diameter of the droplet is less than an acceptable value, such nozzle is detected as a defective ejection nozzle. As the laser method, for example, the technique described in Japanese Laid-Open Patent Publication No. 2002-210983 may be employed. As the pattern inspecting method, the technique described in Japanese Laid-Open Patent Publication No. 2004-330495 may be used.

In the first embodiment, selective suction is performed through generation of negative pressure solely in the space sealed by the cap corresponding to the defective ejection nozzle row selected from the four caps 24 in capping. Selective wiping can also be carried out on the wiper 25 corresponding to the nozzle rows that have been subjected to the selective suction, which is selected from the four wipers 25. In such selective wiping, wiping pressure (which is, the wiping force that allows wiping of the nozzle forming surface 12*a*) is applied only to the selected wiper 25. If idle wiping is performed on the nozzle rows that have not been subjected to suction cleaning, the meniscuses of ink in the nozzles may be deformed. Thus, such idle wiping is prevented from being carried out on the nozzle rows that have not been subjected to the suction cleaning to prevent deformation of the meniscuses, which adversely influences ink ejection performance. Wiping devices that selectively cause the four wipers 24 to wipe will be described in detail later.

Capping by the caps 24 and wiping by the wipers 25 are carried out with the cleaning mechanisms 22 positioned with respect to the recording heads 12 by the head guide units 90. Thus, regardless of that cleaning targets are divided in correspondence with the nozzle rows, cleaning is performed appropriately with improved position accuracy. Selection means (selecting portion) and operation means (driver) such as the caps 24 and the wiper 25 are incorporated in each cleaning mechanism 22. A base unit 21 includes an electric motor 30, or a drive source for driving the selection means and operation means, and a suction pump 40, which produces negative pressure in the caps 24 to perform suction cleaning. In each maintenance device 20, the cleaning mechanism 22 and the suction pump 40 are provided in the base unit 21 adjacently with each other. The electric motor 30 is located downward from the plane on which the cleaning mechanism 22 is located.

<Maintenance Device>

The maintenance devices will hereafter be explained in detail.

Figure 7:
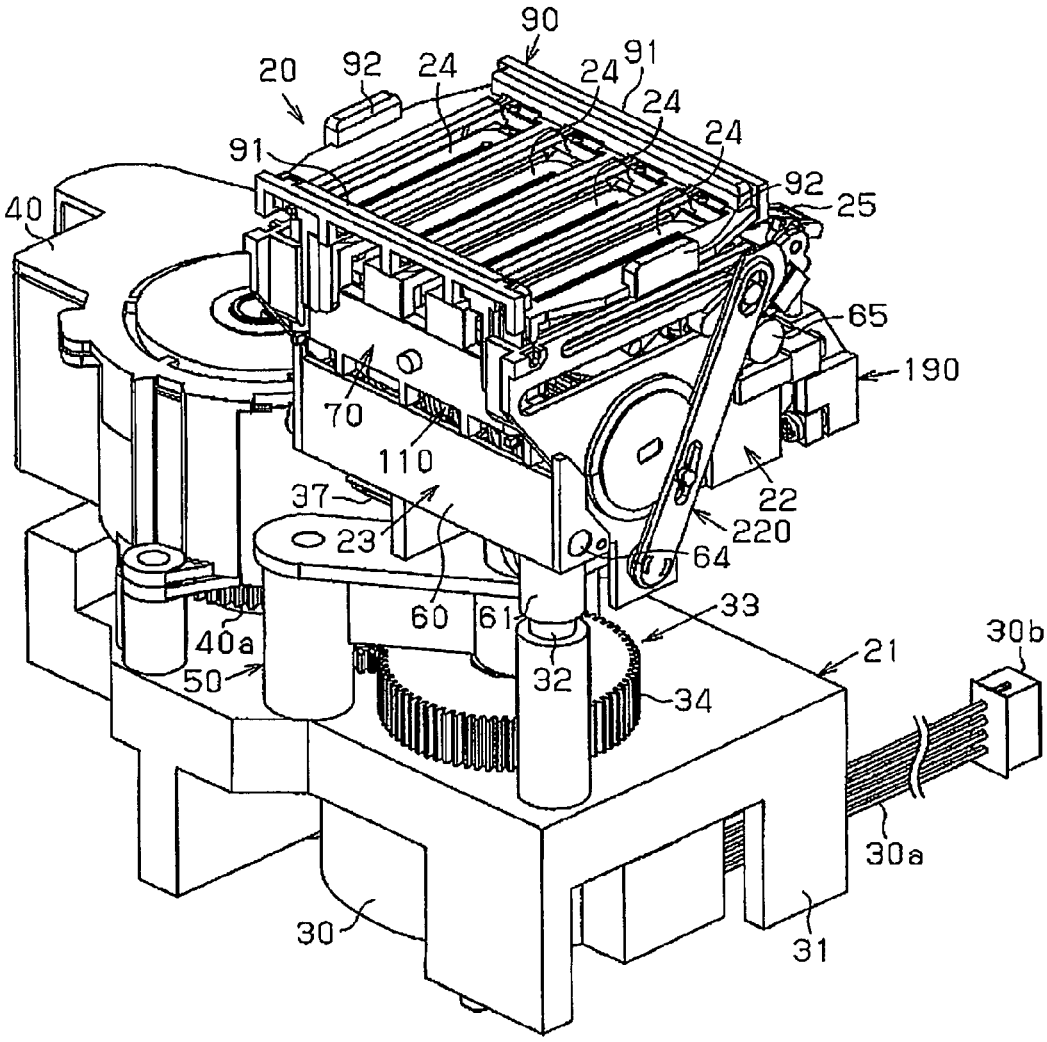
FIG. 7 is a front perspective view showing a maintenance device.
Figure 8:
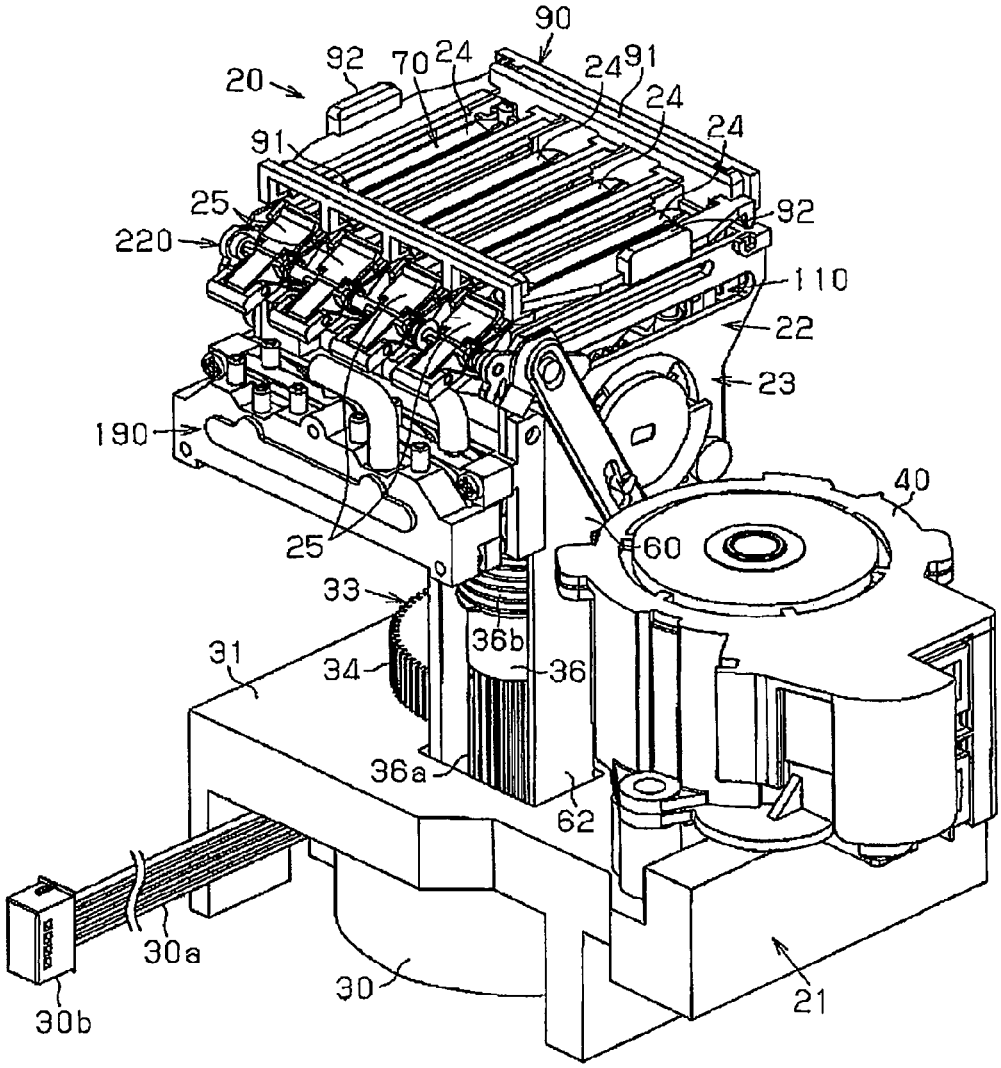
FIG. 8 is a rear perspective view showing the maintenance device.

FIG. 7 is a front perspective view and FIG. 8 is a rear perspective view, each showing one of the maintenance devices.

Each maintenance device 20 has the base unit 21 and the cleaning mechanism 22, which is the component that performs maintenance mainly. The cleaning mechanism 22 is arranged at the position corresponding to the associated recording head 12 to carry out selective cleaning on the nozzle rows of the recording head 12. The cleaning mechanism 22 is supported by the base unit 21 in such a manner that the cleaning mechanism 22 is movable (in this embodiment, capable of raising and lowering) in directions in which the cleaning mechanism 22 approaches and separates from the recording head 12.

The electric motor 30 is provided at the backside of a base frame 31, which forms each of the base units 21. The suction pump 40 is fixed to the upper surface of the base frame 31 at the position adjacent to the cleaning mechanism 22. The suction pump 40 is threaded to a plurality of ribs and slightly spaced from the upper surface of the base frame 31. A pump gear 40*a*, which is shown in FIG. 7, is arranged in the space between the suction pump 40 and the base frame 31. A power transmission mechanism 33, which transmits the drive force of the electric motor 30 to the pump gear 40*a* of the suction pump 40 and the cleaning mechanism 22, is provided on the upper surface of the base frame 31.

A connector 30*b*, which is connected to a cable 30*a* extending from each of the electric motors 30, is electrically connected to the controller 27 shown in FIG. 4. The electric motor 30 is a motor capable of rotating in a forward direction and a reverse direction. Rotation of the electric motor 30 is controller by the controller 27.

Each cleaning mechanism 22 has a holder 23 and a head guide unit 90. The holder 23 accommodates a selection unit 110 (shown in FIGS. 7 to 11), which selects a row corresponding to a defective ejection nozzle row. The head guide unit 90 is secured to an upper portion of the holder 23. The drive force of the electric motor 30 is transmitted to the selection unit 110 in the holder 23 through the power transmission mechanism 33. The drive force is used as the power for raising and lowering of the cleaning mechanism 22, selection of rows of the caps 24 and the wipers 25, and suction of the caps 24 and wiping of the wipers 25 on the selected row. A guide rod 32 projects from an end of the upper surface of the base frame 31 and a raising and lowering unit 50 is supported by another end of the upper surface of the base frame 31.

The guide rod 32 is passed through a guide cylinder 61 projecting downward from the holder 23. The upper end of the raising and lowering unit 50 is operably connected to the selection unit 110 incorporated in the holder 23. The cleaning mechanism 22 is thus supported by the base frame 31 through the raising and lowering unit 50 and the guide rod 32 in such a manner that the cleaning mechanism 22 is capable of rising and lowering. A guide frame 62 accommodating a rod gear 36 shown in FIG. 8, which forms a portion of the power transmission mechanism 33, projects downward from the holder 23. A lower portion of the guide frame 62 is received in a recess defined in the upper surface of the base frame 31 slidably in an up-and-down direction.

The four caps 24 are arranged on the upper surface of the holder 23 in such a manner that the longitudinal directions of the caps 24 extend parallel with one another. The caps 24 are spaced at equal intervals in a direction perpendicular to the longitudinal directions of the caps 24. The upper portion of the holder 23 including the four caps 24 forms a cap unit 70. When the cleaning mechanism 22 is raised or lowered, the four caps 24 on the holder 23 correspondingly approach or space from the recording head 12.

The head guide unit 90 is secured to the holder 23 in such a manner that the head guide unit 90 is movable in the up-and-down direction relative to the holder 23 and urged upward. The standby position of the head guide unit 90 is a position spaced upward from the holder 23 at a predetermined distance. The head guide unit 90 is shaped like a rectangular grid-like plate and has openings at positions opposed to the four caps 24. The head guide unit 90 has two pairs of guide portions 91, 92 projecting upward from the portions corresponding to the four sides of the head guide unit 90. When the cleaning mechanism 22 rises, the two pairs of guide portions 91, 92 become engaged with the corresponding side surfaces of the recording head 12. The cleaning mechanism 22 is thus positioned with respect to the recording head 12. This permits the head guide unit 90 and the cleaning mechanism 22 to move horizontally in accordance with the position of the recording head 12.

When the cleaning mechanism 22 is raised, the head guide unit 90 becomes engaged with the side surfaces of the recording head 12 and positioned with respect to the recoding head 12. The holder 23 is then further raised and positioned with respect to the head guide unit 90. Afterwards, the caps 24 projecting through the openings of the grid of the head guide unit 90 contact the nozzle forming surface 12*a*. Each of the four caps 24 thus seals the corresponding pair of the nozzle rows 13. Specifically, through engagement between the head guide unit 90 and the side surfaces of the recording head 12, the caps 24 are positioned to reliably seal the corresponding nozzle rows 13 on the nozzle forming surface 12*a*.

The retreat positions of the four wipers 25 are located at the side corresponding to the backside of the upper portion of the holder 23 as viewed in FIG. 7. Each of the wipers 25 reciprocates along the longitudinal direction (or, the extending direction of each nozzle row) of the associated one of the caps 24, which is located on the same row as the wiper 25, and above the cap 24. A wiper drive unit 220, which drives the four wipers 25, is incorporated in the holder 23. When wiping is to be performed, the wiper drive unit 220 receives assisting force from the selection unit 110 in the holder 23 and becomes engaged with a gear of the power transmission mechanism 33. The drive force is thus transmitted to the wiper drive unit 220 through the power transmission mechanism 33 to allow the power transmission mechanism 33 to reciprocate the four wipers 25. In reciprocation, the wipers 25 wipe the portions including the corresponding nozzle rows 13 on the nozzle forming surface 12*a* when moving along a return path. That is, in the first embodiment, the wiping device provided in each maintenance device 20 is a self-actuated type in which the wipers 25 are moved along the nozzle forming surface 12*a* of the recording head 12 by the power of the electric motor 30. Thus, the wiping device of the first embodiment may be used to wipe, for example, a fixed type recording head 12.

Referring to FIG. 7, a valve unit 190, which is arranged at the backside of the holder 23, is located in a tube connecting the suction pump 40 to the four caps 24. The valve unit 190 incorporates four passage valves corresponding to the four caps 24. Each of the passage valves includes at least a valve that selectively opens and closes the associated one of the passages connecting the caps 24 to the suction pumps 40. The passage valves are separately operated by the selection unit 110 of the holder 23 in such a manner as to open the one of the four passage valves corresponding to the selected row. This allows communication between the associated one of the passages and the suction pump 40.

The selection unit 110 of the holder 23 has four sets of cam mechanisms, which are capable of rotating in correspondence with the rows of the caps 24 and the wipers 25 and supported coaxially. When the cleaning mechanism 22 is raised, the controller 27 executes necessary control procedures of rotation of the electric motor 30 including selective control of the cams. In this manner, a selected row on which suction and wiping is to be carried out is determined. That is, using the single electric motor 30, raising and lowering of the cleaning mechanism 22, selection of suction by the caps 24 (switching of the passage valves of the valve units 190), driving of the suction pump 40, selection of the wipers 25, wiping of the wipers 25 are brought about through the common drive source.

Hereinafter, a series of control procedures executed through rotation of the electric motor 30 will be explained briefly. First, the electric motor 30 is rotated in a forward direction to raise the cleaning mechanism 22 to perform capping, or cause the caps 24 to contact the nozzle forming surface 12*a*. In raising of the cleaning mechanism 22 for such capping, row selection by the selection unit 110 is performed to exclusively subject a defective ejection nozzle row to cleaning. Through such row selection, the passage valve of the valve unit 190 corresponding to the selected row that is to be opened and the one of the wipers 25 corresponding to the selected row are selected. The selected wiper 25 is then switched to an upright posture, in which the wiper 25 is allowed to selectively wipe the nozzle forming surface 12*a*, in wiping.

After such capping is accomplished, the suction pump 40 is actuated to generate negative pressure in the cap 24 to perform suction cleaning, or forcibly draw the ink from the nozzles of the recording head 12. After such suction cleaning, the selection unit 110 is operated to switch the passage valve of the valve unit 190 corresponding to the selected row to an open state in which the interior of the cap 24 is exposed to the atmospheric air and communicates with the suction pump 40. In this state, idle suction is performed by the suction pump 40 operated to recover the ink from the cap 24 and the associated tube into a non-illustrated waste liquid tank.

After such idle suction is completed, the electric motor 30 is rotate in a reverse direction to lower the cleaning mechanism 22 to separate the cap 24 from the nozzle forming surface 12*a*. after the cleaning mechanism 22 reaches the lowered position (second position), the power transmission path from the electric motor 30 is switched from the path to the selection unit 110 to the path to the wiper drive unit 220 in the holder 23. This causes wiping of the wiper 25 corresponding to the selected row, which has been switched to the upright posture that allows the wiper 25 to reciprocate along the predetermined path above the cap 24 and perform wiping when the wiper 25 moves along the return path. In such wiping, a portion of a drive mechanism of the wiper drive unit 220 contacts the head guide unit 90 and raises the head guide unit 90 to the position at which the head guide unit 90 becomes engaged with the recording head 12. The wiping is thus carried out with the wiper 25 positioned with respect to the recording head 12. After reciprocation of the wiper 25 is completed, the head guide unit 90 is lowered to the original position and the wiper 25 is returned to the retreat position shown in FIG. 8. In this manner, a cycle of cleaning, which involves capping, selective suction cleaning, selective idle suction, and selective wiping in this order, is accomplished.

Figure 9:
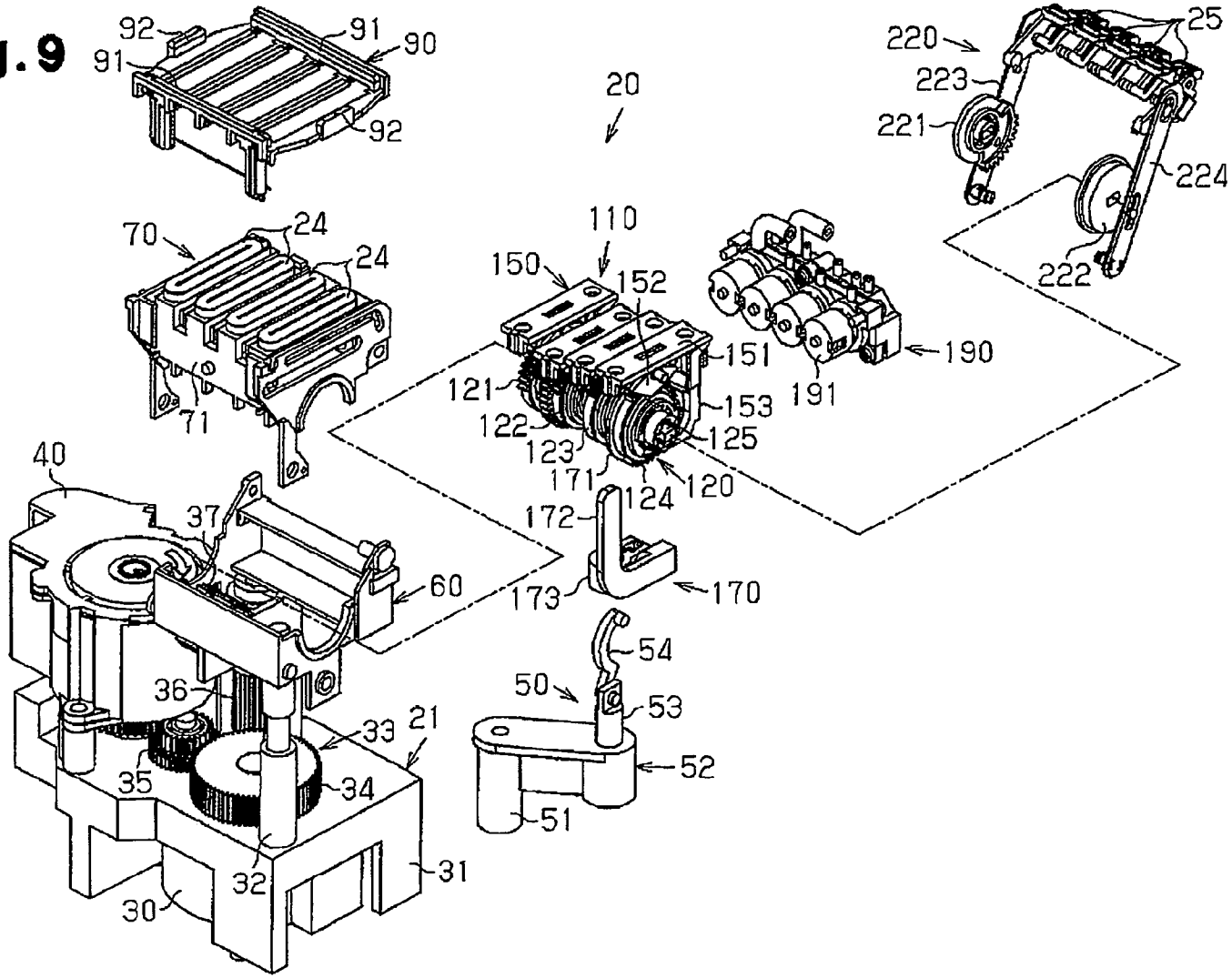
FIG. 9 is an exploded perspective view showing the maintenance device.

FIG. 9 is an exploded perspective view showing the maintenance device.

The maintenance device 20 has the base unit 21, the support holder 60 supported by the base unit 21 in such a manner as to allow the support holder 60 to ascend and descend, the cap unit 70 forming the upper portion of the holder 23 and having the multiple (four) caps 24 provided on an upper portion of the cap unit 70, and the head guide unit 90. Further, the maintenance device 20 has the selection unit 110 accommodated in the holder 23 to perform selective suction of the cap 24 and selection of the wiper 25 to be operated to wipe, the valve unit 190, the wiper drive unit 220, the raising and lowering unit 50, and the lock mechanism 170. In the following, the units and the mechanisms will be described.

In the valve unit 190, the open/closed states of the four incorporated passage valves are switched separately in correspondence with the depression amount of a valve pressurizing body 191 operated by a valve lever 153 (in a three-stepped manner). Specifically, each of the passage valves includes a suction passage valve and an atmospheric air passage valve. The suction passage valve selectively opens and closes a suction passage that communicates with the suction pump 40. The atmospheric air passage valve selectively opens and closes an atmospheric air passage exposed to the atmospheric air. One is selected from three forms of combinations of the open/closed states of the suction passage valve and the atmospheric air passage valve in correspondence with which suction, non-suction, and idle suction through the caps 24 is selected. In other words, when a lift plate base 151 is not lifted (the lift amount is "0"), the open/closed states of the valves correspond to that of the non-suction. When the lift plate base 151 is lifted, the open/closed states of the valves correspond to that of the suction. When the lift plate base 151 is lifted by a maximum lift amount, the open/closed states of the valves correspond to that of the idle suction.

The wiper drive unit 220 includes a wiper drive gear 221, a wiper drive wheel 222, and two wiper drive levers 223, 224. The wiper drive gear 221 and the wiper drive wheel 222 are each connected to the corresponding one of the opposite ends of a selection cam shaft 125. The drive force transmitted through an intermediate selection gear 37 drives the wiper drive gear 221 to reciprocate in a predetermined angular range. This pivots each of the wiper drive levers 223, 224 about the lower end of the wiper drive lever 223, 224. Through pivoting of the wiper drive levers 223, 224 in accordance with a cycle of reciprocation, the four wipers 25 are reciprocated in the longitudinal directions of the caps 24. Specifically, if any one of the lift plate bases 151, which are movable bodies, is lifted, the corresponding one of the wipers 25 contacts the upper surface of the lift plate bases 151 and thus receives the force acting to press the wiper 25 upward. This switches the wiper 25 to the upright posture. Contrastingly, as long as the lift plate bases 151 are not lifted, the wipers 25 do not receive such upward pressing force from the upper surfaces of the lift plate bases 151. In this manner, wiping is performed on the selected one of the nozzle rows 13 but not on the non-selected ones of the nozzle rows 13.

Figure 10B:
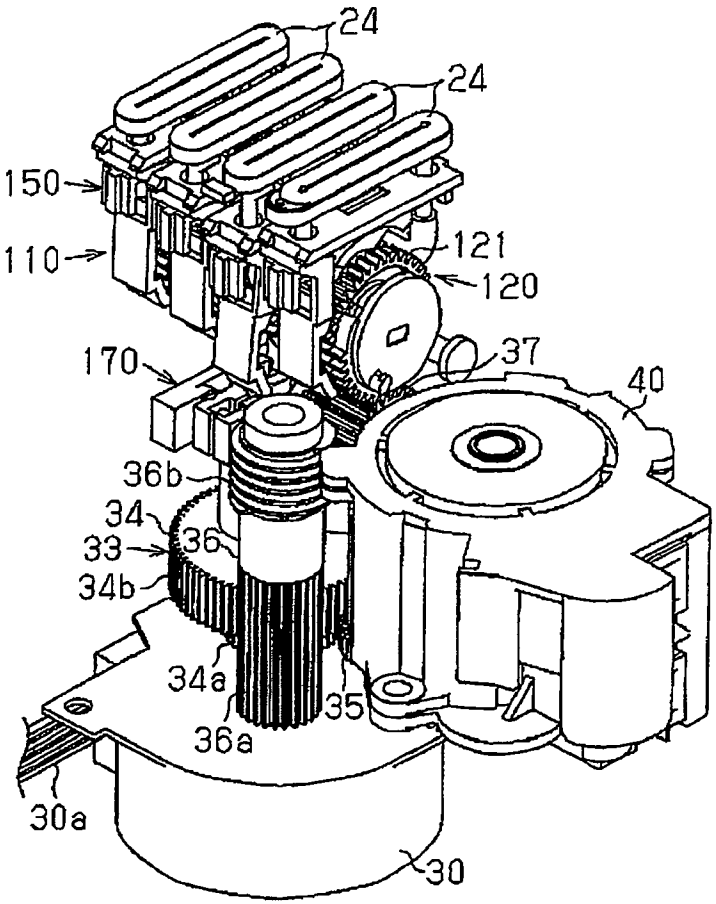
FIGS. 10A and 10B are perspective views each showing a main portion of a base unit.
Figure 10A:
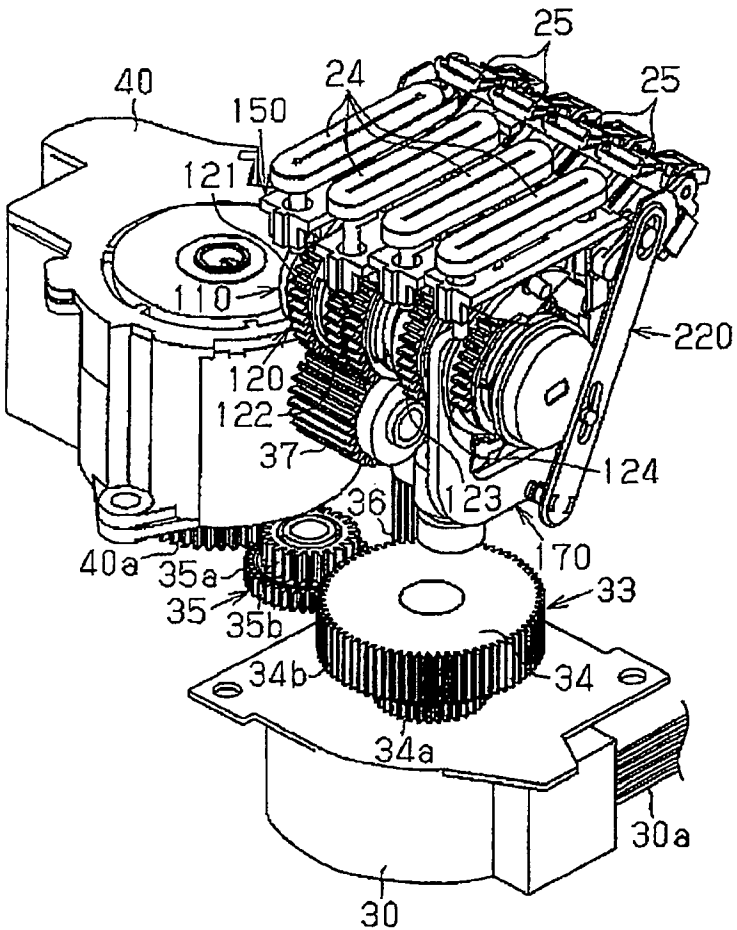

FIGS. 10A and 10B are perspective views each showing a portion of the power transmission mechanism 33, which forms the base unit 21. The power transmission mechanism 33 is formed by a double gear 34, an intermediate gear 35, a rod gear 36, and the intermediate selection gear 37. The double gear 34 is rotatably supported by the base frame 31. A small gear portion 34*a* of the double gear 34 is engaged with a pinion gear secured to the drive shaft of the electric motor 30. A large gear portion 34*b* of the double gear 34 is engaged with a large diameter portion 35*a* of the intermediate gear 35. A small tooth portion 35*b* of the intermediate gear 35 is engaged with the pump gear 40*a*. When the electric motor 30 is rotated in the forward direction, the suction pump 40 is actuated to perform suction by generating negative pressure. When the electric motor 30 is rotated in the reverse direction, the suction pump 40 is released and stops generating the negative pressure. The suction pump 40 of the first embodiment is a publicly known tube pump. When the tube pump is rotated, a tube wound around an incorporated wheel is squeezed in one direction to press the gas and liquid out from the tube. This produces suction force (negative pressure) at an upstream end of the tube. Specifically, a tube pump mechanism (not shown), which is rotatable integrally with the pump gear 40*a*, is incorporated in the suction pump 40 in two-stepped arrangement along the drive shaft of the suction pump 40. The suction pump 40 has two suction pipe connecting portions. A delay mechanism is also incorporated in the suction pump 40. Thus, after the rotational direction of the pump gear 40*a* is switched from the reverse direction to the forward direction, the delay mechanism causes rotation by a predetermined rotation amount that is less than one cycle of rotation before the pump gear 40*a* becomes engaged with the internal drive shaft. Accordingly, after such switching of the rotating direction of the pump gear 40*a* from the reverse direction to the forward direction, pump actuation is started after idle rotation by a predetermined rotation amount.

As shown in FIG. 8, the rod gear 36 is passed through a shaft (not shown) of the base frame 31 and received by a plate-like guide frame 62, which extends downward from the support holder 60 by a predetermined length, in such a manner as to allow rotation of the rod gear 36 about the axis. A spline gear portion 36*a* and a worm gear portion 36*b* are provided in a lower portion and an upper portion, respectively, of the rod gear 36. Referring to FIG. 10B, the spline gear portion 36*a* is engaged with the large gear portion 34*b* of the double gear 34. The worm gear portion 36*b* is engaged with the intermediate selection gear 37.

Thus, when the electric motor 30 is rotated in the forward direction, the rotational force of the electric motor 30 is rotationally transmitted to the double gear 34 and the rod gear 36. This rotates the rod gear 36 about the axis and rotation of the rod gear 36 is transmitted to the intermediate selection gear 37 engaged with the worm gear portion 36*b*, or the upper portion of the rod gear 36. The intermediate selection gear 37 is engaged with one of four selection cams (rotational cams) 121 to 124, which form the selection unit 110. The spline gear portion 36*a* is formed in the lower portion of the rod gear 36 and ensures engagement between the rod gear 36 and the double gear 34 regardless of which position the rod gear 36 is located while being raised or lowered together with the cleaning mechanism 22.

Figure 11:
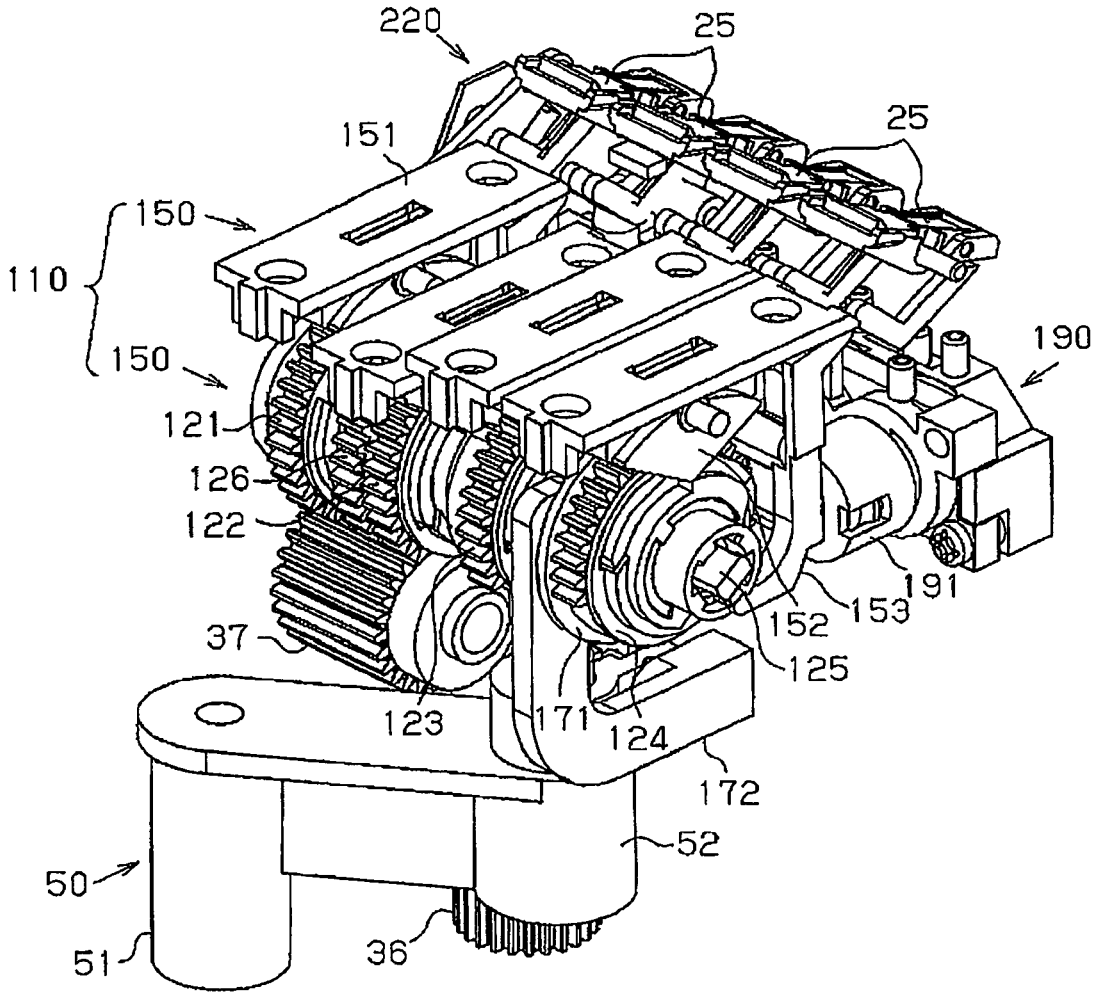
FIG. 11 is a perspective view showing a main portion of the maintenance device.

FIG. 11 is a perspective view showing a main portion of the maintenance device including the selection unit and the valve unit. The selection unit 110 has a selection gear unit 120 and a lift unit 150. The selection gear unit 120 includes a cam mechanism. A cam follower of the lift unit 150 is guided by a cam of the selection gear unit 120 and thus raised. The selection gear unit 120 has four selection cams 121 to 124, which are rotatably supported by the selection cam shaft 125. The four selection cams 121 to 124 correspond to the four rows of the caps 24 and the wipers 25 and have identically shaped cams formed on the side surfaces of the selection cams 121 to 124. The selection cam shaft 125 is passed through the selection cams 121 to 124 in such a manner as to allow integral rotation of the selection cams 121 to 124 while maintaining the circumferential phases of the cams in states offset by a predetermined angle. As needed in the following description, the selection cams 121 to 124 will be referred to as a first selection cam 121, a second selection cam 122, a third selection cam 123, and a fourth selection cam 124. The four selection cams 121 to 124 will be collectively referred to as a selection cam set 135. The intermediate selection gear 37 is engaged with the selection cam 121 and a friction gear 126, which form the selection gear unit 120. The friction gear 126 is engaged with the side surface of the second selection cam 122.

The selection unit 110 selects the lift amount of the lift plate base 151 through a lift cam movable plate 152 engaged with each of the selection cams 121 to 124. In this manner, the pressing amount of each of the valve levers 153 is selected. Wiping is selected when the lift amount of any one of the lift plate bases 151 is great. In this case, the associated valve lever 153 becomes inclined to press the valve pressurizing body 191, in such a manner as to allow generation of negative pressure in the corresponding cap 24. Meanwhile, the cap 24 that is to be subjected to suction cleaning is also selected.

Figure 12:
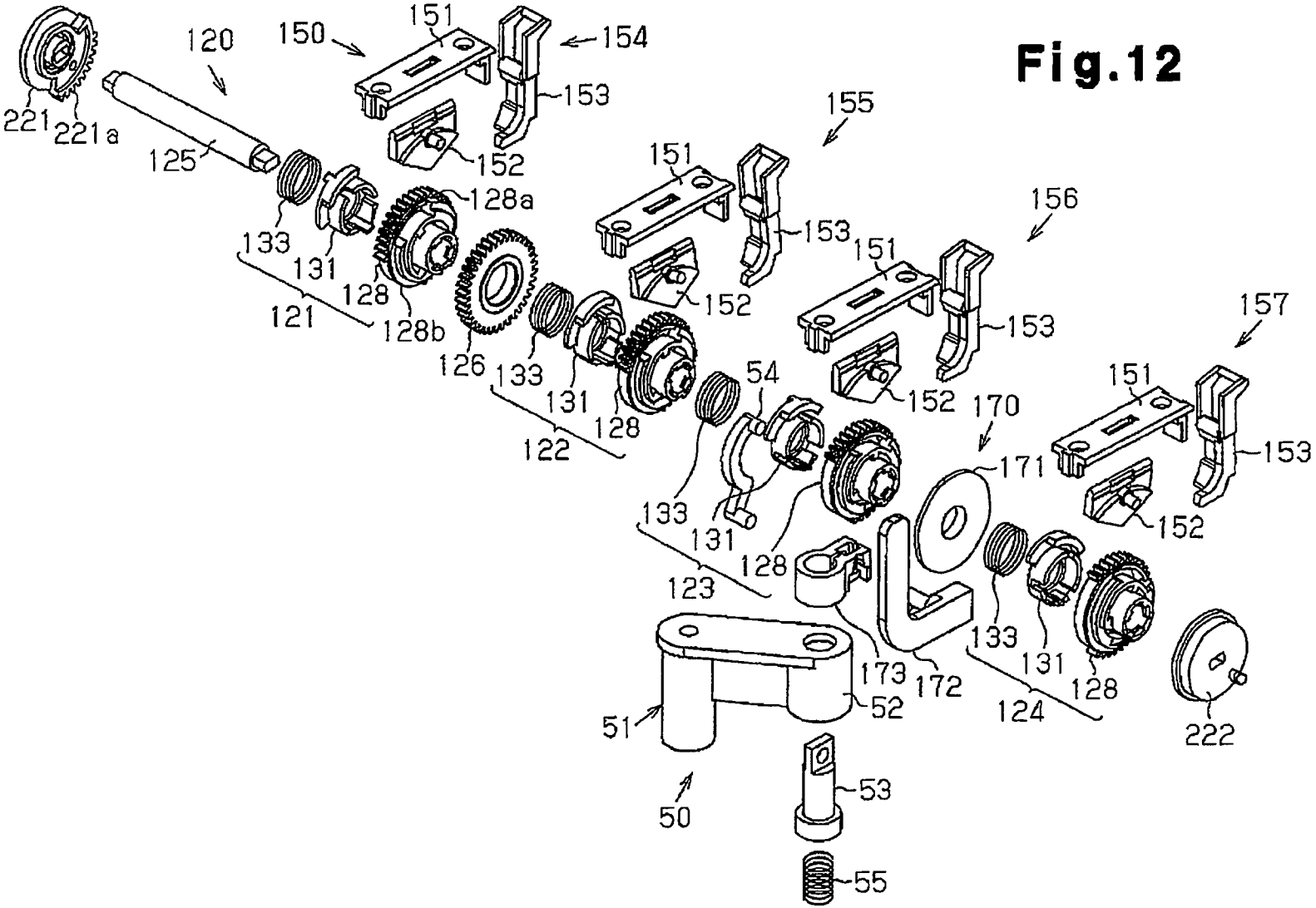
FIG. 12 is an exploded perspective view showing a selection unit as viewed from above.
Figure 13:
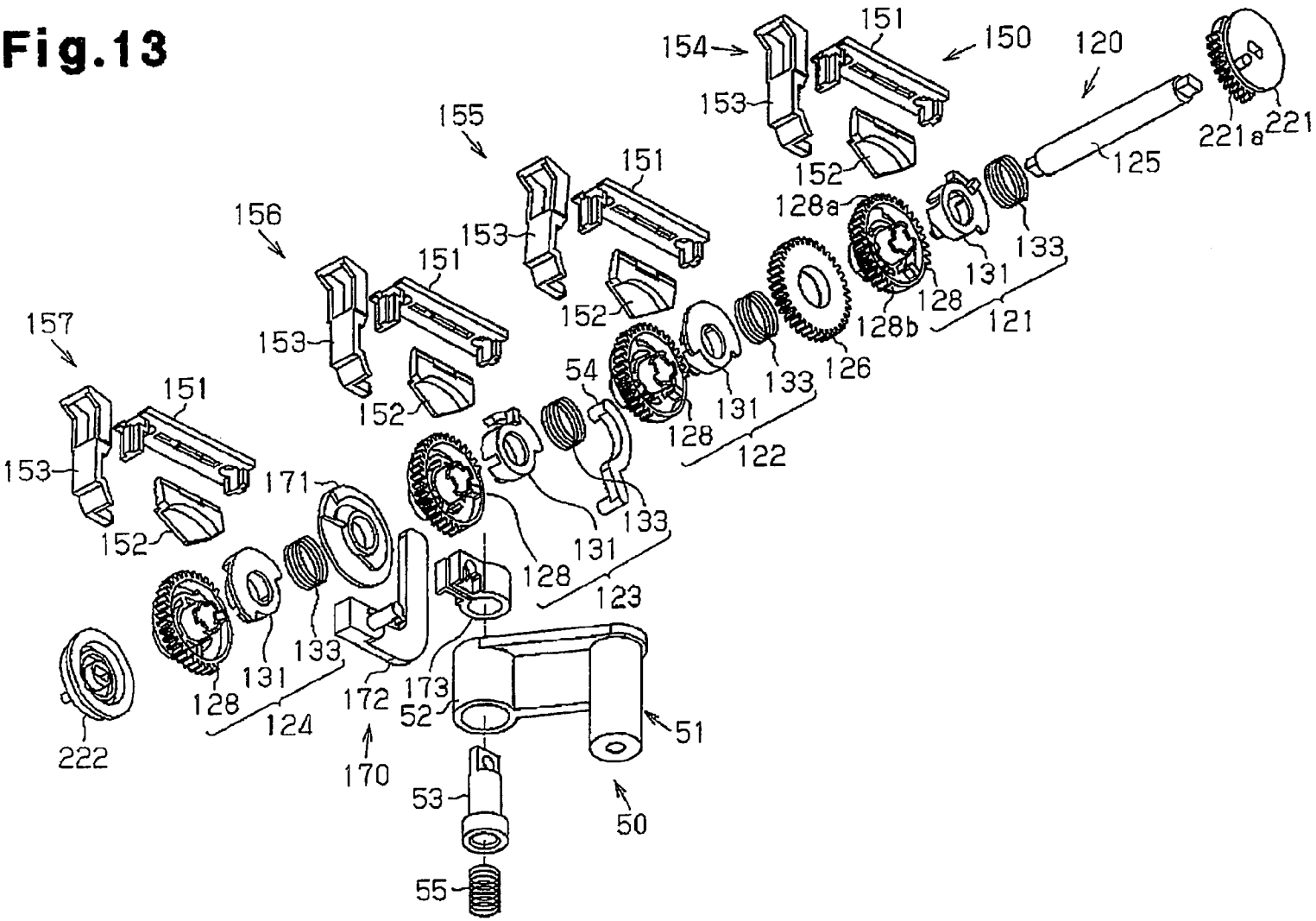
FIG. 13 is an exploded perspective view showing the selection unit as viewed from below.

FIGS. 12 and 13 are exploded perspective views showing the selection unit, the raising and lowering unit, and the lock mechanism. FIG. 12 is a perspective view from above and FIG. 13 is a perspective view from below. As shown in FIGS. 12 and 13, each of the selection cams 121 to 124 has a cam body 128, a cam assisting plate 131, and a compression spring 133. The cam assisting plate 131 is joined integrally with the cam body 128 in such a manner that relative rotation between the cam assisting plate 131 and the cam body 128 is prohibited and in a state urged by the compression spring 133 in the direction in which the cam assisting plate 131 is fitted in the cam body 128. The selection cams 121 to 124, which have the identical cam shapes, are connected as an integral body in a state in which the phases of the cams are circumferentially offset by 20 degrees. The selection cam shaft 125 is passed through the selection cams 121 to 124 in such a manner as to allow relative rotation of the selection cams 121 to 124 and the selection cam shaft 125. A distal end of a lift lever 54 of the raising and lowering unit 50 is engaged with the third selection cam 123 at an eccentric position. A stopper cam 171 of the lock mechanism 170 is assembled with the selection cams 121 to 124 in an integrally rotatable manner and held between the third selection cam 123 and the fourth selection cam 124.

The raising and lowering unit 50 has a support portion 51, a pressure adjustment shaft 53, and the lift lever 54. The pressure adjustment shaft 53 is passed through and supported by a pressure adjustment shaft holder 52 formed in the support portion 51 in an upwardly urged state. The proximal end of the lift lever 54 is connected to the pressure adjustment shaft 53 and the distal end of the lift lever 54 is engaged with the selection cam 123 of the selection gear unit 120. As the selection cam 123 is raised while pivoted about the position at which the selection cam 123 is engaged with the distal end of the lift lever 54 as a point of support, the cleaning mechanism 22 is raised. As the selection cam 123 is lowered and pivoted about the engagement position, the point of support, in the direction opposite to that of a raising stage, the cleaning mechanism 22 is lowered. In these manners, the cleaning mechanism 22 is selectively raised and lowered through pivoting of the selection cam 123 in a reciprocating manner. The pressure adjustment shaft 53 supports the cleaning mechanism 22 in a floating state.

The lock mechanism 170 has the support portion 51 including the pressure adjustment shaft holder 52 formed at the distal end of the support portion 51, the pressure adjustment shaft 53, a compression spring 55, the stopper cam 171, a stopper lever 172, and a choke member 173. The pressure adjustment shaft 53 is joined with the pressure adjustment shaft holder 52 in a state urged by the compression spring 55 in the direction in which the pressure adjustment shaft 53 projects from the pressure adjustment shaft holder 52. The choke member 173 is fixed to the upper end surface of the pressure adjustment shaft holder 52 and loosely engaged with the distal end of the pressure adjustment shaft 53 from outside the pressure adjustment shaft holder 52. As the selection cam 121 to 124 is pivoted, the raising and lowering unit 50 raises the cleaning mechanism 22 to the raised position. At this stage, the stopper cam 171 inclines the stopper lever 172 to cause the stopper lever 172 to decrease the inner diameter of the ring of the choke member 173, which is operably connected to the stopper lever 172. This chokes and locks the pressure adjustment shaft 53, which supports the cleaning mechanism 22 in a state passed through the ring of the choke member 173.

The lift unit 150 includes the four lift plate bases 151. Four lift cam movable plates 152 have cam followers engaged with the cams of the corresponding selection cams 121 to 124. Each of the lift plate bases 151 is lifted through the corresponding one of the lift cam movable plates 152. That is, the lift cam movable plate 152 are guided by the cam surfaces of the selection cams 121 to 124 to lift the lift plate bases 151. Specifically, each valve lever 153 is inclined by the pressing amount corresponding to the lift amount of the associated lift plate base 151. This causes the valve lever 153 to operate the valve pressurizing body 191 to select ink suction, non-suction, and idle suction to be performed by the cap 24. Also, by raising the lift plate base 151, wiping force (wiping pressure) is provided to the associated wiping means to allow the wiping means to perform wiping.

<Selection Unit>

Figure 14A:
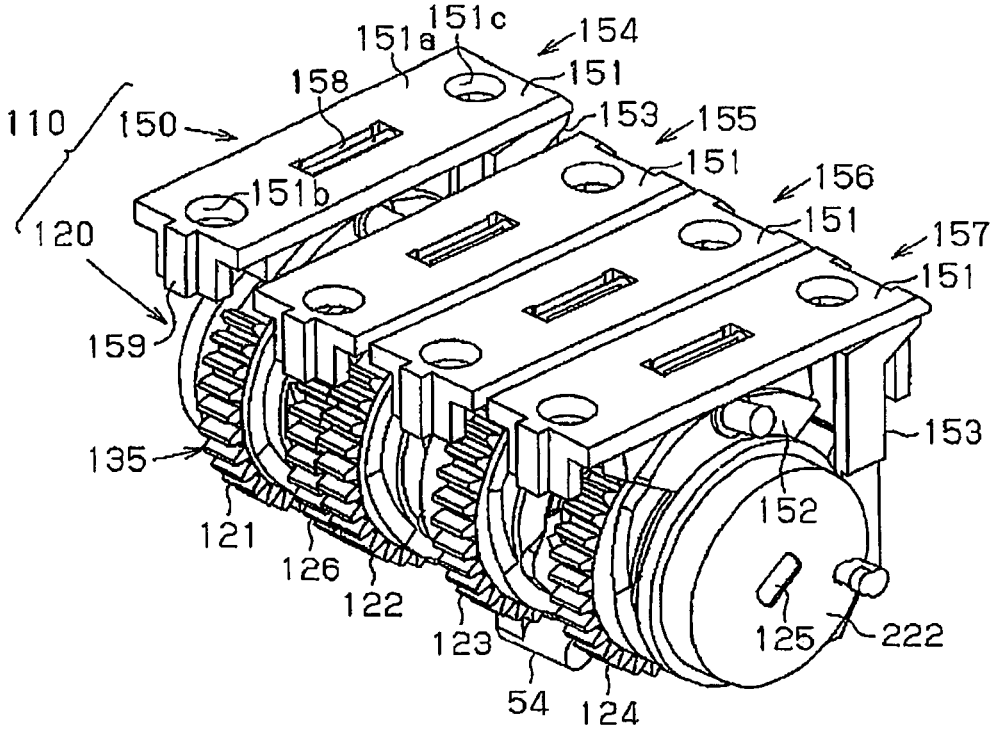
FIG. 14A is a front perspective view showing the selection unit.
Figure 14B:
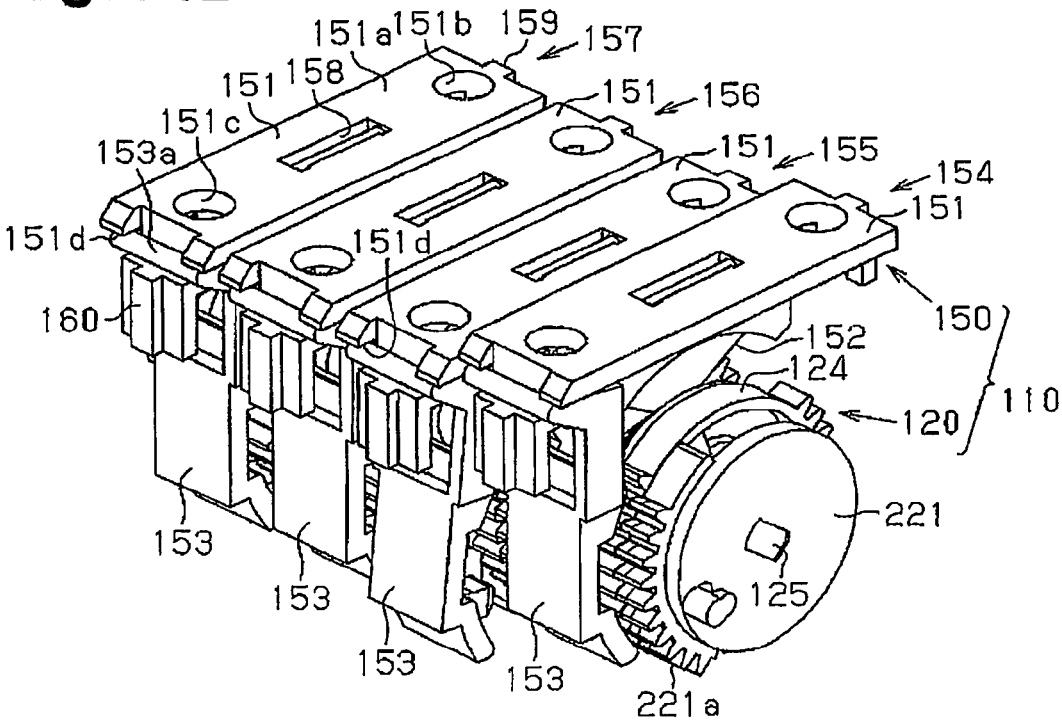
FIG. 14B is a rear perspective view showing the selection unit.
Figure 15:
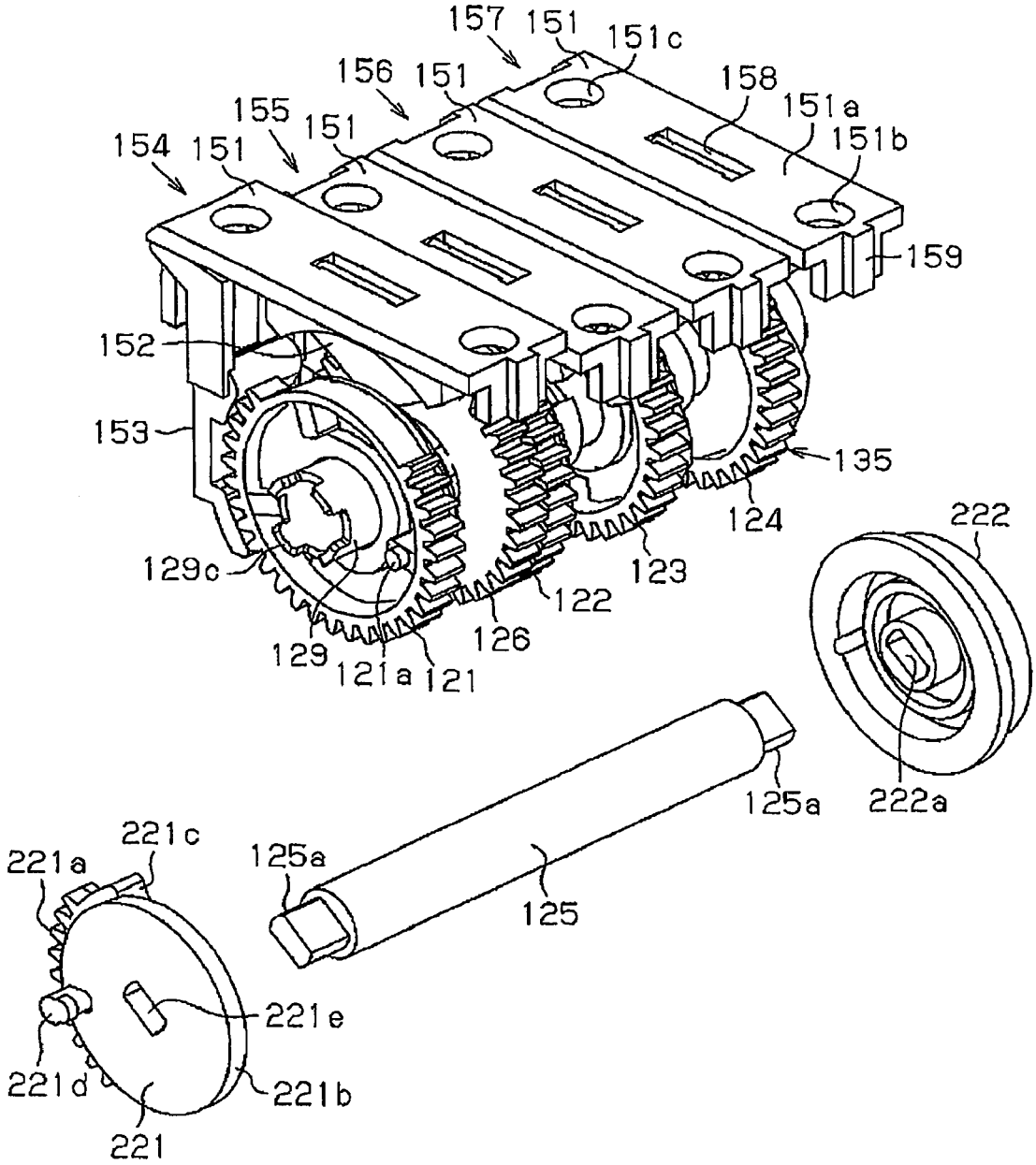
FIG. 15 is an exploded perspective view showing the selection unit.
Figure 16A:
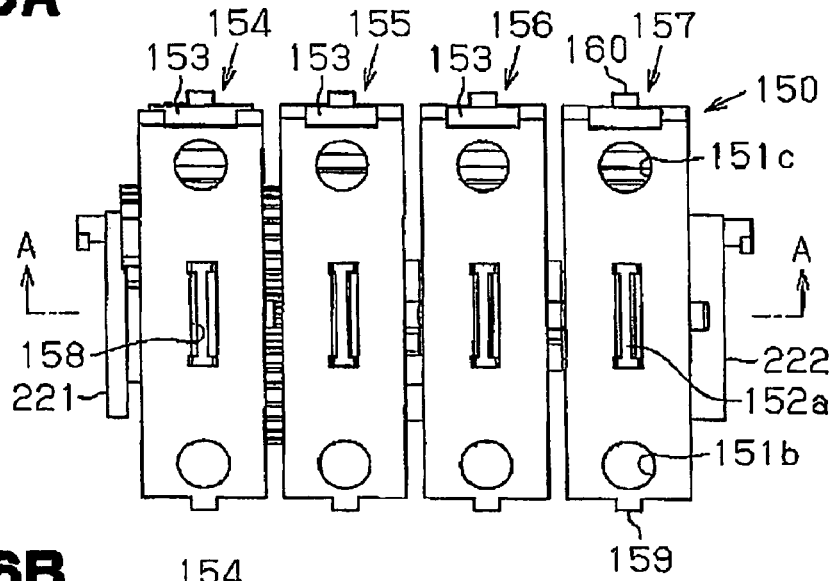
FIG. 16A is a plan view showing the selection unit.
Figure 16B:
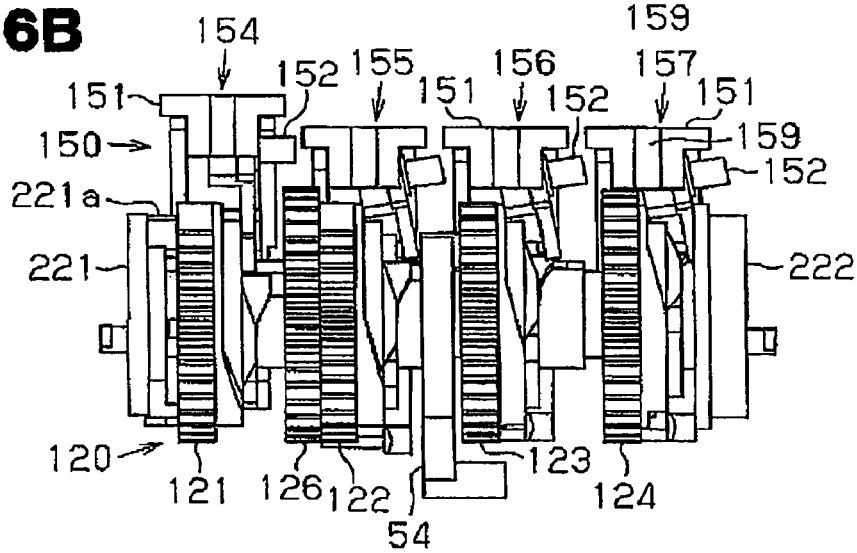
FIG. 16B is a front view showing the selection unit.
Figure 16C:
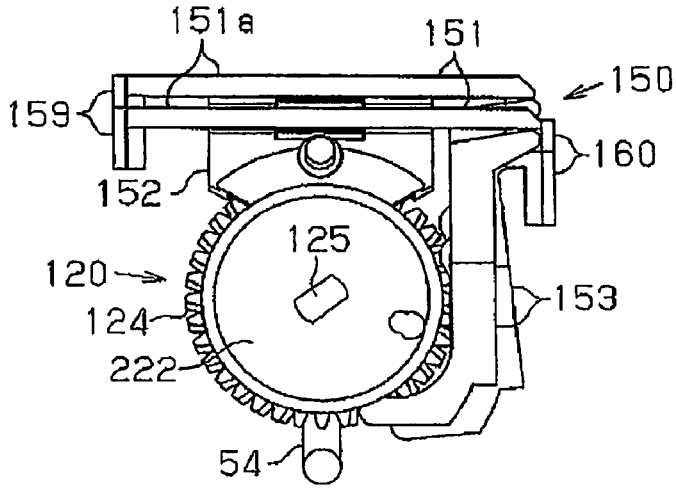
FIG. 16C is a side view showing the selection unit.
Figure 17:
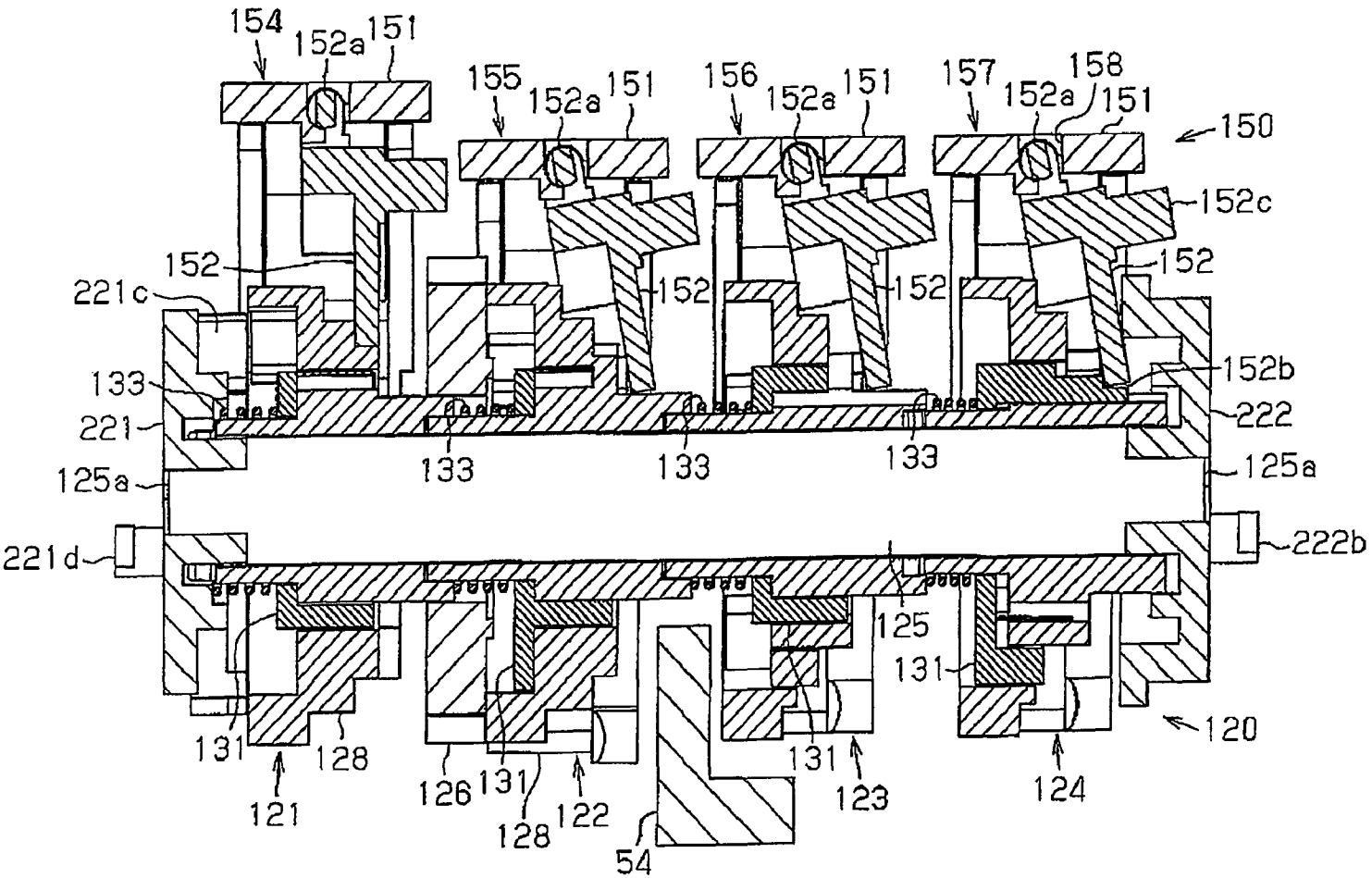
FIG. 17 is a cross-sectional view showing the selection unit taken along line A-A of FIG. 16.

FIG. 14 shows the selection unit. Specifically, FIG. 14A is a front perspective view and FIG. 14B is a rear perspective view, each showing the selection unit. FIG. 15 is an exploded perspective view showing the selection unit without the selection cam shaft. FIG. 16A is a plan view showing the selection unit. FIG. 16B is a front view. FIG. 16C is a side view. FIG. 17 is a cross-sectional view taken along line A-A of FIG. 16A.

The selection cam shaft 125 is passed through the four selection cams 121 to 124. Each of the selection cams 121 to 124 has a cam portion formed at one side of the selection cam 121 to 124. The cam surfaces of the cam portions are identically shaped. The selection cams 121 to 124 are connected rotate integrally in such a manner that the phases of the cam surfaces become offset by 20 degrees in the rotation direction.

The friction gear 126 is located adjacently to the second selection cam 122 with the side surface of the friction gear 126 frictionally engaged with the side surface of the second selection cam 122. In this state, the friction gear 126 is rotatable about the selection cam shaft 125. As illustrated in FIG. 11, the intermediate selection gear 37 is engageable with the first selection cam 121, the friction gear 126, and the wiper drive gear 221. Normally, when raising of the lift unit 150 is selected, the selection cam shaft 125, the wiper drive gear 221, and the wiper drive wheel 222 are prevented from rotating but solely the selection cam set 135, which is provided on the selection cam shaft 125, is allowed to rotate. Each of the lift cam movable plates 152 is engaged with and supported by the associated one of the lift plate bases 151 in such a manner that the lift cam movable plates 152 are inclined in directions approaching and separating from the side surfaces of the selection cams 121 to 124.

Next, a mechanism by which each of the lift plate bases is raised or lowered as guided by the cam surface of the associated one of the selection cams will be explained. The structures of the selection cams will be first explained. Since the basic structures of the selection cams 121 to 124 are identical, only the first selection cam 121 will be described by way of example. FIG. 18 shows the selection cam. Specifically, FIG. 18A is an exploded perspective view showing the selection cam and FIG. 18B is a perspective view showing the selection cam.

Figure 18A:
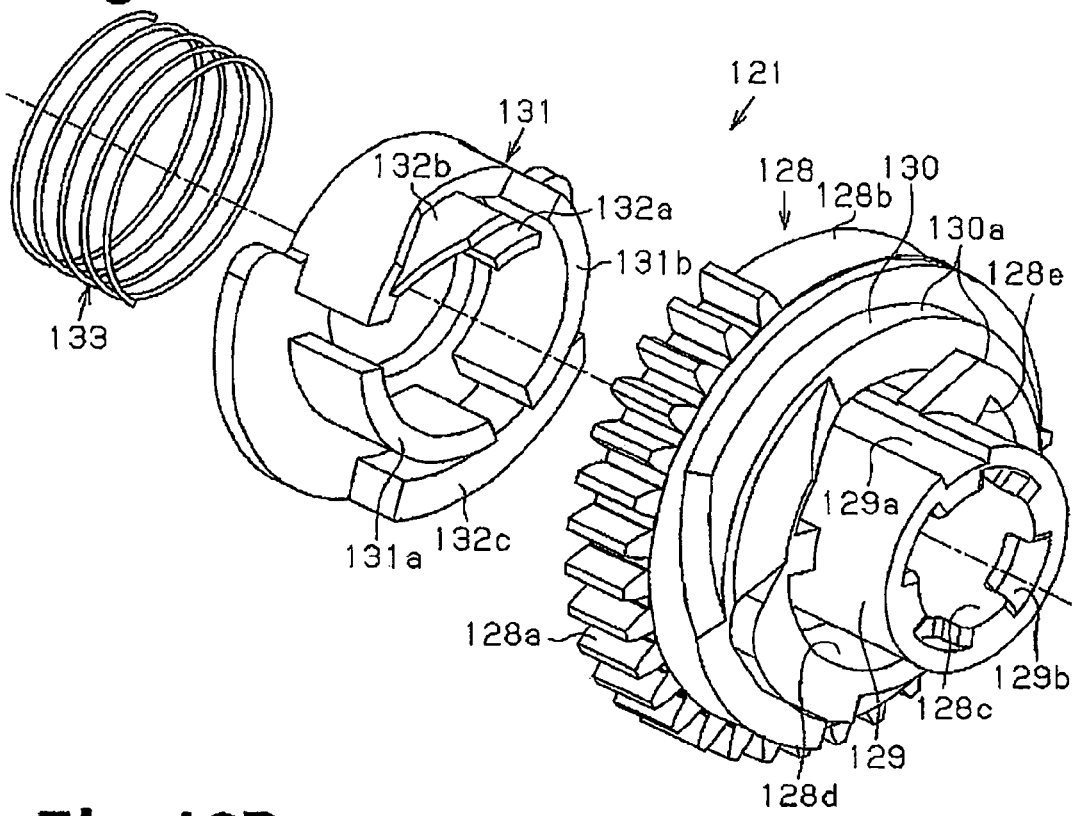
FIG. 18A is an exploded perspective view showing a selection cam.
Figure 18B:
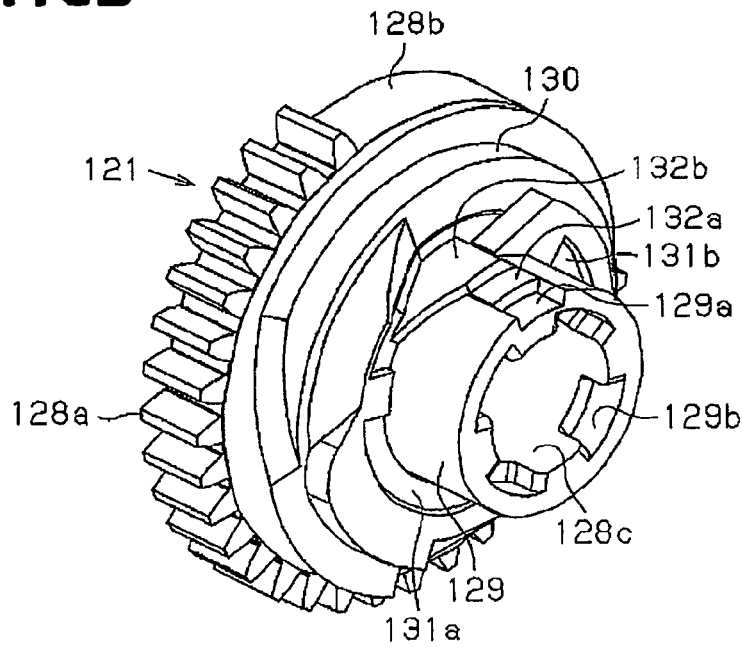
FIG. 18B is a perspective view showing the selection cam.

Referring to FIG. 18A, the selection cam 121 has the cam body 128 formed by a sector gear, the cam assisting plate 131, and the compression spring 133. The cam assisting plate 131 is joined with the cam body 128 in a state passed through the cam body 128. The compression spring 133 urges the cam assisting plate 131 to project toward the side surface of the cam body 128 in which a cam portion 130 is formed. The cam portion 130 is provided on the side surface of the cam body 128 and extends along the entire circumferential direction. The cam portion 130 includes a cam surface defining a plurality of steps (in the first embodiment, three steps including the outer circumferential surface of a shaft portion 129) in the axial direction. The multiple stepped cam surface will be explained later.

A first cam portion 132*a*, a second cam portion 132*b*, and a third cam portion 132*c*, which form a cam, project from the cam assisting plate 131. When the cam assisting plate 131 is urged by the compression spring 133 and thus passed through the cam body 128, the first cam portions 132*a* and the second cam portions 132*b* are joined with the cam portion 130 of the cam body 128 to form a continuous cam surface, with reference to FIG. 18B. The cam assisting plate 131 is joined with the cam body 128 in such a manner that the cam assisting plate 131 becomes movable along the selection cam shaft 125. The cam assisting plate 131 is allowed to return to the normal position (the projecting position) by the compression spring 133. When the cam assisting plate 131 is pressed in the direction opposite to the direction of the urging force of the compression spring 133, the cam assisting plate 131 is retracted into the interior of the cam body 128 to decrease the projecting amount of the cam assisting plate 131. The cam assisting plate 131 is axially movable in the cam body 128 in a range of, for example, approximately 1 mm.

Semi-circular restriction walls 131*a*, 131*b* project sideways from the cam assisting plate 131. The restriction wall 131*a* and the restriction wall 131*b* are engaged with a through hole 128*d* and a through hole 128*e*, respectively, which are defined in the cam body 128. The first cam portion 132*a* and the second cam portion 132*b* of the cam assisting plate 131 are engaged with an engagement groove 129*a*, which is defined in the outer circumferential surface of the shaft portion 129 of the cam body 128 and extends axially. The cam assisting plate 131 is thus joined with the cam body 128 in such a manner that the cam assisting plate 131 is prohibited from rotating relative to the cam body 128. An axial end surface (hereinafter, referred to as an "axially forward side") of the shaft portion 129 projects from the side surface of the cam body 128 in which the cam portion 130 is formed. Referring to FIG. 15, this end surface has a cross-shaped engagement projection 129*c*, which is formed by four projecting portions of the wall of a shaft hole 128*c*. Each of the engagement grooves 129*b*, which is defined in one end surface of the shaft portion 129 of the associated cam body 128, is engaged with the engagement projection 129*c* (shown in FIG. 15) projecting from an opposite end surface of the shaft portion 129 of the cam body of the axially adjacent selection cam, with reference to FIG. 13. This connects the four selection cams 121 to 124 together in such a manner that the selection cams 121 to 124 are prohibited from relatively rotating and in a state in which the phases of the selection cams 121 to 124 are sequentially offset by 20 degrees. Each of the first to fourth selection cams 121 to 124 is an intermittent gear with a toothless portion 128*b* defined in a portion of the outer circumferential surface of the selection cam 121 to 124. A tooth portion 128*a* is formed in the range of approximately 270 degrees of the outer circumferential surface of each selection cam 121 to 124. The selection cams 122, 123 and 124, or the selection cams other than the first selection cam 121 engaged with the intermediate selection gear 37, do not necessarily have to function as a tooth portion. Thus, instead of the tooth portion 128*a*, the selection cams 122 to 124 may include a circumferential surface with a diameter equal to the outer diameter of the tooth portion 128*a*.

<Lift Unit>

As shown in FIGS. 14 to 17, the lift unit 150 has four sets of lift mechanisms 154 to 157 corresponding to the four selection cams 121 to 124. Each of the lift mechanisms 154 to 157 includes the lift plate base 151, the lift cam movable plate 152, and the valve lever 153. The lift plate base 151 has rail portions 159, 160 extending from the opposing longitudinal ends of the lift plate base 151 in a manner bent at a substantial right angle. The rail portions 159, 160 of the lift plate base 151 are engaged with and guided by non-illustrated rail grooves defined in corresponding portions of inner side surfaces of the holder 23. This supports the lift mechanisms 154 to 157 in such a manner that the lift mechanisms 154 to 157 are separately allowed to rise and lower in the holder 23. An engagement hole 158 having a substantially rectangular shape is defined in the center of the lift plate base 151. Two circular holes 151*b*, 151*c* are defined in the opposing longitudinal ends of the lift plate base 151. Two connection pipes 24*c*, 24*d* (shown in FIG. 25), which project from the backside (the lower surface) of the associated cap 24, are passed through the corresponding circular holes 151*b*, 151*c*. Tubes 218A, 218B (shown in FIG. 47), which will be described later, connect the cap 24 to the associated valve unit 190. An end of each of the tubes 218A, 218B is connected to the corresponding one of the connection pipes 24*c*, 24*d*. Referring to FIG. 14B, an engagement recess 151*d* is defined in an end of the lift plate base 151 at the side corresponding to the rail portion 160. An engagement shaft portion 153*a*, which is formed at the upper end of each valve lever 153, is engaged with and connected to the engagement recess 151*d*. In this state, the valve lever 153 is allowed to incline about the engagement shaft portion 153*a* at the upper end of the valve lever 153. One of the selection cams and the associated one of the lift mechanisms corresponding to the nozzle rows 13 form one lift unit. Since the four lift units basically have identical structures, the basic structures of the lift units will be explained in the following with reference to the unit including the first selection cam 121.

Figure 19:
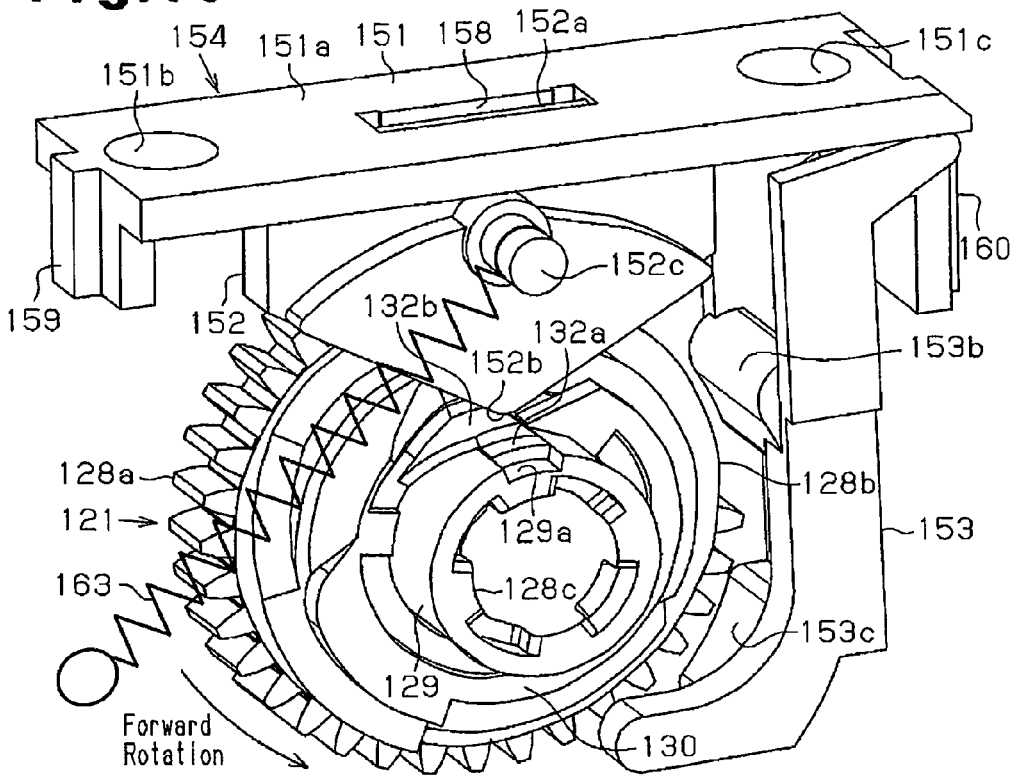
FIG. 19 is a perspective view showing the selection cam and a lift mechanism.

FIG. 19 is a perspective view showing the selection cam and the lift mechanism.

The lift cam movable plate 152, which forms the lift mechanism 154, is a substantially pentagonal plate. The upper end of the lift cam movable plate 152 is engaged with and supported by the engagement hole 158 of the lift plate base 151 in a state in which a cam follower portion 152*b* forming an obtuse angle is located downward. In other words, the pillar-like engagement shaft portion 152*a* (see FIG. 17), which is engageable with the engagement hole 158, projects from the upper end of the lift cam movable plate 152. Therefore, through engagement of the engagement shaft portion 152*a* with the engagement hole 158, the lift cam movable plate 152 is supported in a manner inclinable about the engagement portion between the engagement shaft portion 152*a* and the engagement hole 158 as a point of support in the axial direction of the selection cams 121 to 124 (the left-and-right direction as viewed in FIG. 17). With reference to FIG. 19, the lift cam movable plate 152, which has the substantially pentagonal plate-like shape, is located at the side corresponding to the cam portion 130 with respect to the selection cam 121. The lift cam movable plate 152 is arranged in a state in which the cam follower portion 152*b*, which is the projecting end of the lift cam movable plate 152, is held in contact with the cam surface of the selection cam 121.

Figure 20:
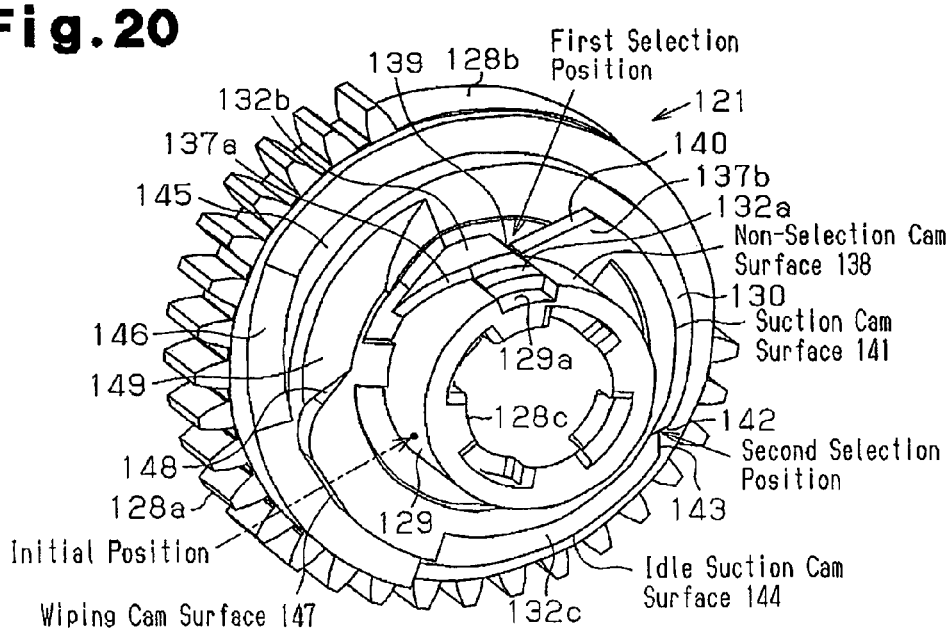
FIG. 20 is a perspective view showing the selection cam.
Figure 21:
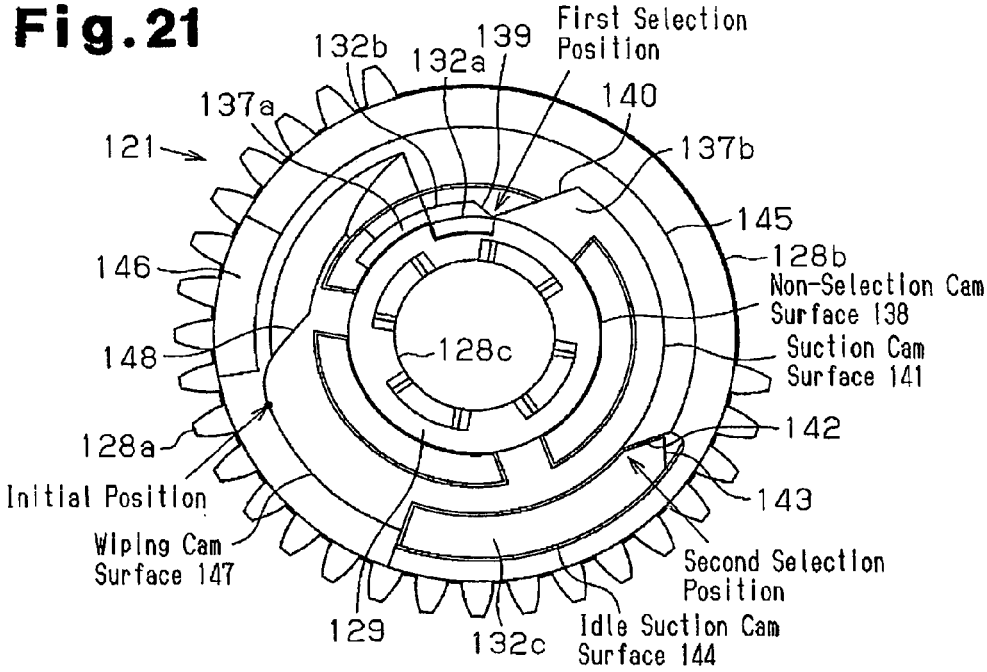
FIG. 21 is a side view showing the selection cam.
Figure 22:
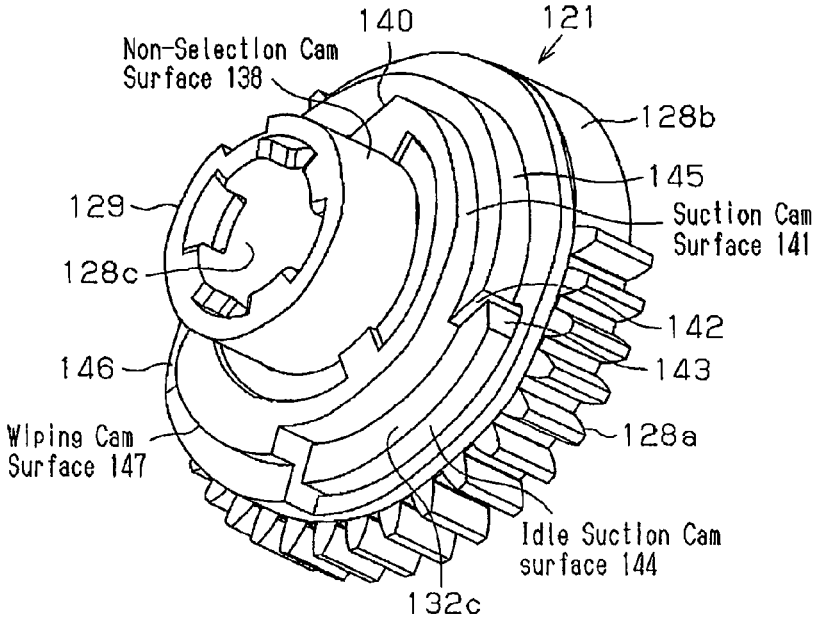
FIG. 22 is a perspective view showing the selection cam as viewed from below.

The cam surface of each selection cam will be explained with reference to FIGS. 20 to 22. FIG. 20 is a perspective view showing the selection cam. FIG. 21 is a side view showing the selection cam. FIG. 22 is a perspective view showing the selection cam as viewed from below in FIG. 20. The radial distance from the axis of the selection cam 121 to the cam surface of the selection cam 121 is defined as the height of the cam surface. The angular range of the selection cam 121 in which the cam follower portion 152*b* is allowed to contact the selection cam 121 is the angular range of approximately 270 degrees defined by the range in which the tooth portion 128*a* is engageable with the intermediate selection gear 37. The cam portion 130 of the selection cam 121 has a cam shape including a non-selection cam surface 138, a suction cam surface 141, and an idle suction cam surface 144. The non-selection cam surface 138 is located at the height equal to that of the outer circumferential surface of the shaft portion 129 of the selection cam 121. The suction cam surface 141 is located rearward from the non-selection cam surface in the axial direction of the selection cam 121. The height of the suction cam surface 141 is greater than the height of the non-selection cam surface 138. The idle suction cam surface 144 is located rearward from the suction cam surface 141 in the axial direction of the selection cam 121. The height of the idle suction cam surface 144 is greater than the height of the suction cam surface 141. A non-selection cam surface 138 formed by the outer circumferential surface of the shaft portion 129 of the selection cam 121 is a cam surface that determines a lowered lift position. The suction cam surface 141 is a cam surface that determines an intermediate lift position. The idle suction cam surface 144 is a cam surface that determines a maximally raised lift position.

As shown in FIG. 19, a spring hooking projection 152*c* projects from the side surface of the lift cam movable plate 152 that dose not face the side surface of the cam portion 130 of the associated selection cam 121 at a position close to the point of support in inclination. An end of a tension spring 163 is hooked onto the projection 152*c*. The opposite end of the tension spring 163 is hooked around a non-illustrated hooking portion projecting from an inner wall surface of the holder 23. The projection 152*c* of the lift cam movable plate 152 is located offset from the point of support in pivoting of the lift cam movable plate 152. Thus, the urging force of the tension spring 163 applies the force to the lift cam movable plate 152 in the direction in which the lift cam movable plate 152 contacts the side surface of the selection cam 121 corresponding to the cam portion 130. The lift cam movable plate 152 is urged by the urging force of the tension spring 163 in the direction (the downward direction) in which the cam follower portion 152*b* approaches the axis of the selection cam 121 and in the direction (the axially rearward direction) in which the cam follower portion 152*b* is pressed against the side surface of the selection cam 121 corresponding to the cam portion 130. Accordingly, the cam follower portion 152*b* is held in contact with and slightly pressed against the outer circumferential surface of the cam portion 130 of the selection cam 121. Also, the cam follower portion 152*b* is urged to be slightly pressed against the side surface of the selection cam 121 that is located axially forward.

With reference to FIG. 20, the initial position of the contact point of the cam follower portion 152*b* with respect to the cam portion 130 of the cam follower portion 152*b* when the selection cam 121 is arranged at the rotational angle corresponding to the standby state is located on the non-selection cam surface 138 formed by the outer circumferential surface of the shaft portion 129. The corresponding initial positions of the second to fourth selection cams 122 to 124 are sequentially located offset from the initial position of the first selection cam 121 by the phases of 20 degrees in a counterclockwise direction.

Figure 23A:
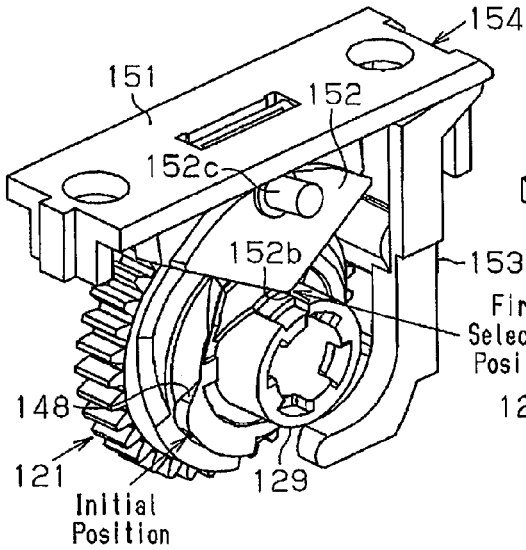
FIGS. 23A to 23D are perspective views each showing a state of a lift unit.

The selection cam 121 is rotated in the counterclockwise direction (in the forward direction) as viewed in FIG. 20 from the position at which the contact point of the cam follower portion 152*b* is located at the initial position. In such rotation, the contact point of the cam follower portion 152*b* passes the non-selection cam surface 138 and the outer circumferential surface of the cam portion 132*a* and, immediately afterward, is located at a first selection position (shown in FIG. 23A). The first selection position is located on the non-selection cam surface 138 formed by the outer circumferential surface of the shaft portion 129. Thus, the height of the cam surface at the first selection position is equal to the height of the cam surface at the initial position. However, the cam follower portion 152*b* is urged rearward in the axial direction of the selection cam 121. This causes the cam follower portion 152*b* to contact a side surface 137*b*, which is located axially rearward from a side surface 137*a* including the inclined surface of the second cam portion 132*b* along which the cam follower portion 152*b* has passed, at the side surface of the selection cam 121 located axially forward, when the cam follower portion 152*b* is located at the first selection position.

When suction is selected, the selection cam 121 is rotated in the reverse direction from the state in which the contact point of the cam follower portion 152*b* is located at the first selection position. In this state, since the cam follower portion 152*b* is urged axially rearward, the cam follower portion 152*b* is prevented from returning to the cam surface (the cam surface corresponding to the side surface 137*a* including the inclined surface of the second cam portion 132*b*) that the cam follower portion 152*b* has previously passed. The cam follower portion 152*b* thus moves along a return surface 139 (shown in FIG. 23C), which is an inclined surface risen in a radially outward direction. The cam follower portion 152*b* then reaches the outer circumferential surface of the second cam portion 132*b*, or the cam surface higher than the non-selection cam surface 138. While ascending the return surface 139, the cam follower portion 152*b* is moved further rearward in the axial direction. If the selection cam 121 starts to rotate in the forward direction in this state, the cam follower portion 152*b* caused to descend the return surface 139 and return. However, the urging force of the tension spring 163 acts to cause the cam follower portion 152*b* to move along a path located axially rearward from the proceeding path along which the cam follower portion 152*b* has moved when ascending the return surface 139. This prevents the cam follower portion 152*b* from returning to the non-selection cam surface 138. Instead, the cam follower portion 152*b* proceeds along an ascending surface 140, or an inclined surface extending from the return path, and reaches the idle suction cam surface 141 (see FIG. 23D). In other words, the ascending surface 140 is formed in the selection cam 121 in such a manner as to incline to form a V shape together with the inclined surface of the return surface 139 as viewed from the side. The width of the ascending surface 140 is approximately a half of the width of the inclined surface of the return surface 139 at the axially rearward side. The position corresponding to the valley between the return surface 139 and the ascending surface 140, which form the V shape as viewed from the side, and located slightly clockwise from the corresponding position in the rotational (circumferential) direction of the selection cam 121 is the first selection position. The first selection position is a reference position used in selection of raising or non-raising of the lift.

When the cam follower portion 152*b* is located at the initial position defined on the non-selection cam surface 138, the selection cam 121 is rotated in the counterclockwise (forward) direction as viewed in FIG. 20. Then, when the cam follower portion 152*b* reaches the first selection position, the selection cam 121 stops rotating and is rotated in the reverse direction by a small amount. The selection cam 121 is then re-rotated in the forward direction. In this state, the cam follower portion 152*b* is urged in the direction in which the cam follower portion 152*b* is pressed against the side surface of the selection cam 121 located axially forward, or in the axially rearward direction. Thus, the cam follower portion 152*b* ascends the return surface 139 from the first selection position and reaches the suction cam surface 141, or the cam surface corresponding to suction, the height (the radius) of which is greater than that of the return surface 139. If raising of the lift is to be selected, operation of the selection cam 121 is controlled in accordance with suspension of rotation, reverse rotation, and forward rotation when the contact point of the cam follower portion 152*b* is located in the vicinity of the selection point, as has been described. In this manner, raising of the lift plate base 151 to the raised position is selected.

In this state, the first cam portion 132*a* and the second cam portion 132*b* of the cam assisting plate 131 are urged by the urging force of the compression spring 133 to be pressed out in an axially forward direction (a direction toward the viewer of FIG. 20). The first cam portion 132*a* and the second cam portion 132*b* are allowed to retreat to axially rearward positions when receiving the load against the urging force of the compression spring 133 that acts rearward in the axial direction of the selection cam 121. Specifically, while sliding from the initial position to the first selection position, the cam follower portion 152*b* are guided by the side surface 137*b* that has the inclined surface of the second cam portion 132*b* of the cam assisting plate 131, in such a manner as to be pressed out in the axially forward direction opposite to the direction in which the cam follower portion 152*b* is urged. The contact pressure of the cam follower portion 152*b* with respect to the side surface 137*a* of the second cam portion 132*b* thus may become excessively great. Although the urging force that acts to press the lift cam movable plate 152 against the axially forward side surface of the selection cam 121 and contact this side surface is set to a relatively small value, such urging force may become slightly greater due to product-to-product variations. Even in this case, the load of the cam follower portion 152*b* acting on the first cam portion 132*a* and the second cam portion 132*b* acts to slightly retract the first and second cam portions 132*a*, 132*b* in the axially rearward direction against the urging force of the compression spring 133. This permits the cam follower portion 152*b* to further reliably move along the path extending in the clockwise direction as viewed in FIG. 20, without being caught by the inclined surface of the side surface 137*a* of the second cam portion 132*b*. In this case, after the cam follower portion 152*b* passes the right end of the outer circumferential surface of the first cam portion 132*a* of the cam assisting plate 131, the first cam portion 132*a* and the second cam portion 132*b*, which have been retracted, are returned to the original positions by the urging force of the compression spring 133. Thus, when the selection cam 121 is rotated in the reverse direction after having been stopped, the cam follower portion 152*b* is allowed to ascend the return surface 139 formed in the second cam portion 132*b*.

Figure 23B:
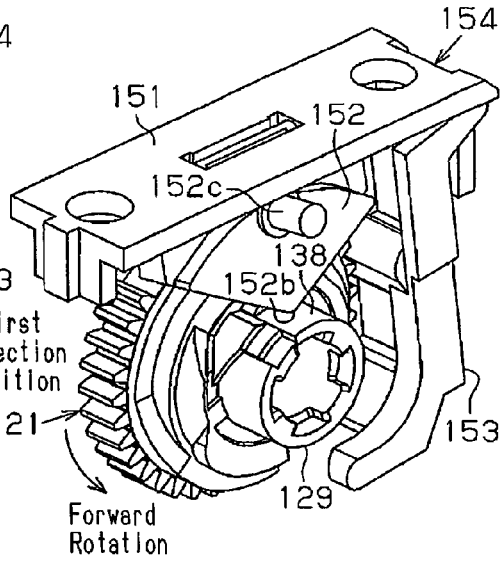
Figure 23C:
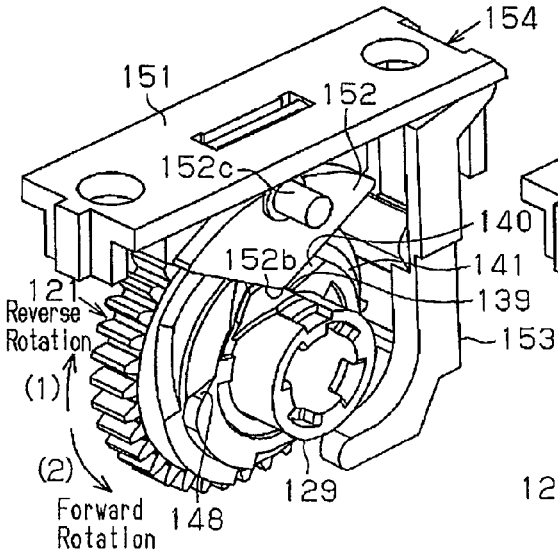
Figure 23D:
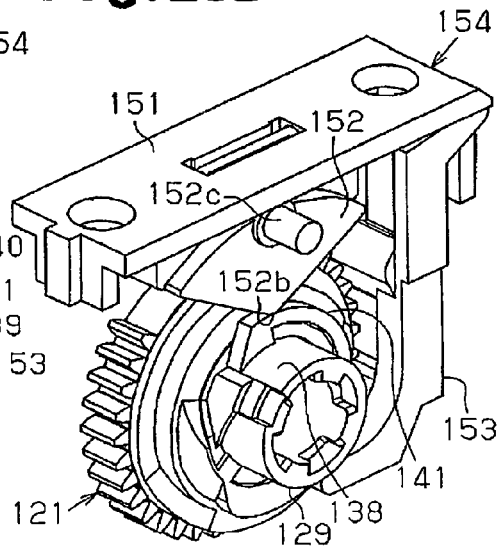

When suction is not selected, rotation of the selection cam 121 in the forward direction is continued without stopping even after the contact point of the cam follower portion 152*b* passes the first selection position (see FIG. 23B). In this manner, it is selected to maintain the lift plate base 151 at the lowered position. In this case, the lift is maintained in a lowered state until the current cycle of maintenance is accomplished.

With reference to FIGS. 20 to 22, the suction cam surface 141 is formed in the range of approximately 180 degrees. A second selection position is set at a position corresponding to a substantially central position of the suction cam surface 141 in the circumferential direction. At the second selection position, switching from a lift raised position to a lift maximally raised position may be selected. In the first embodiment, if raising of the lift is selected at the first selection position, selection of maximal raising of the lift is always selected at the second selection position after suction through the suction cam surface 141 (FIG. 24A) is carried out. The cam structure that allows the selection of maximal raising of the lift at the second selection position is basically identical to the above-described cam structure operated at the first selection position. Specifically, as the selection cam 121 is rotated in the reverse direction, the cam follower portion 152*b* is returned in the counterclockwise direction while being pressed against and caused to contact the axially forward side surface of the selection cam 121. In this state, the contact point of the cam follower portion 152*b* slides on the suction cam surface 141 and reaches the second selection position. The contact point of the cam follower portion 152*b* then starts to ascend the return surface 142 (see FIG. 24B) and reaches a cam surface 145, which extends circumferentially. After such reverse rotation of the selection cam 121, the selection cam 121 is rotated in the forward direction. This causes the contact point of the cam follower portion 152*b* to ascend the ascending surface 143, which is an inclined surface, after the contact point has descended from the return surface 142 at a small distance. The contact point of the cam follower portion 152*b* then reaches the idle suction cam surface 144, or the cam surface corresponding to the lift maximally raised position (see FIG. 24C). The idle suction cam surface 144 is formed in the range of approximately 90 degrees extending in the clockwise direction of the selection cam 121 from the second selection position.

The four selection cams 121 to 124 are connected together with the phases of the selection cams 121 to 124 arranged offset by 20 degrees. Selecting operation (reverse and forward rotation of the selection cams) at the first selection position corresponds to operation in the range of 15 degrees of the rotational angle of each of the selection cams 121 to 124 about the first selection position in the forward and reverse directions. Thus, when any one of the selection cams is performing selecting operation, the remaining ones of the selection cams are prevented from starting selecting operation. The selection cams are thus allowed to carry out selecting operation separately. Further, the second selection position is located in such a manner that, if suction is selected for all of the first to fourth selection cams 121 to 124, the first selection cam 121 is prevented from passing the second selection position until the fourth selection cam 124 completes its selecting operation. In the first embodiment, while the phase of the fourth selection cam 124 and the phase of the first selection cam 121 are offset from each other by approximately 60 degrees, the suction cam surface 141 is formed in the range of approximately 90 degrees and extends to the second selection position. This allows selection of raising of the lift in all of the four selection cams 121 to 124. In this case, selection of maximal raising of the lift is allowed after all of the four cam follower portions 152*b* have contacted the associated suction cam surfaces 141. The angle necessary for performing selecting operation is reduced by increasing the distance from the center of the selection cam to the cam. The phase and the offset angle can also be decreased. That is, such angle may be set to any suitable value as long as the phases of the selection cams are offset without hampering operation of the selection cams.

As the selection cam 121 is rotated in the reverse direction from the state in which the contact point of the cam follower portion 152*b* is located on the idle suction cam surface 144, the cam follower portion 152*b* descends the ascending surface 143 and ascends the return surface 142. The cam follower portion 152*b* then reaches a cam surface 145 formed at a height slightly smaller than the height of the idle suction cam surface 144. The cam surface 145 extends in the counterclockwise direction of the selection cam 121 from the position of the return surface 142 at which ascending of the cam follower portion 152*b* is completed and covers the range of approximately 200 degrees. The portion of the axially forward side surface of the selection cam 121 corresponding to a finishing end area of the cam surface 145 is a pushing surface 146. The pushing surface 146 is an inclined surface projecting in the axially forward direction. The ascending direction of the pushing surface 146 corresponds to the counterclockwise direction as viewed in FIG. 20. A cam surface the height of which is equal to that of the cam surface 145 is formed at a position axially forward from the cam surface 145 and located counterclockwise from the finishing end of the pushing surface 146 as viewed in FIG. 20. The cam surface is a wiping cam surface 147, or a cam surface corresponding to wiping. Specifically, as the selection cam 121 is further rotated in the reverse direction after the cam follower portion 152*b* reaches the cam surface 145, the cam follower portion 152*b* leaves the cam surface 145, passes the pushing surface 146, and reaches the wiping cam surface 147 (FIG. 24D). The wiping cam surface 147 covers the range of approximately 70 degrees in the circumferential direction of the selection cam 121. This allows the four cam follower portions 152*b* to contact the associated wiping cam surfaces 147 simultaneously.

A descending surface 148, or a descending inclined surface, is formed at the finishing end of the wiping cam surface 147 in the clockwise direction as viewed in FIG. 20. Wiping is performed when the cam follower portion 152*b* is held in contact with the wiping cam surface 147. After such wiping is completed, the selection cam 121 is rotated in the forward direction, or the counterclockwise direction as viewed in FIG. 20. This causes the cam follower portion 152*b* to descend the descending surface 148. When the cam follower portion 152*b* descends the descending surface 148, the side surface of the cam follower portion 152*b* contacts (is pressed against) the axially forward side surface of the selection cam 121. Such side surface of the selection cam 121 is configured in such a manner that the cam follower portion 152*b* is pressed in the axially forward direction while being guided by the pushing surface 149, which is gradually inclined in the axially forward direction in the clockwise direction as viewed in FIG. 20, and thus falls onto the non-selection cam surface 138 formed by the outer circumferential surface of the shaft portion 129. At this stage, the selection cam 121 is rotated in the clockwise direction as viewed in FIG. 20, the contact point of the cam follower portion 152*b* is returned to the initial position shown in FIG. 20. The diameters of the cam surfaces of the selection cam 121 are set in such a manner as to satisfy the following expression: "the diameter corresponding to non-selection<the diameter corresponding to suction<the diameter corresponding to wiping<the diameter corresponding to idle suction". The diameter (the height) of the wiping cam surface 147 may be set to any suitable value as long as such value is greater than the diameter at the non-selection position and may be greater than the value corresponding to the idle suction.

<Raising and Lowering Unit>

Figure 25:
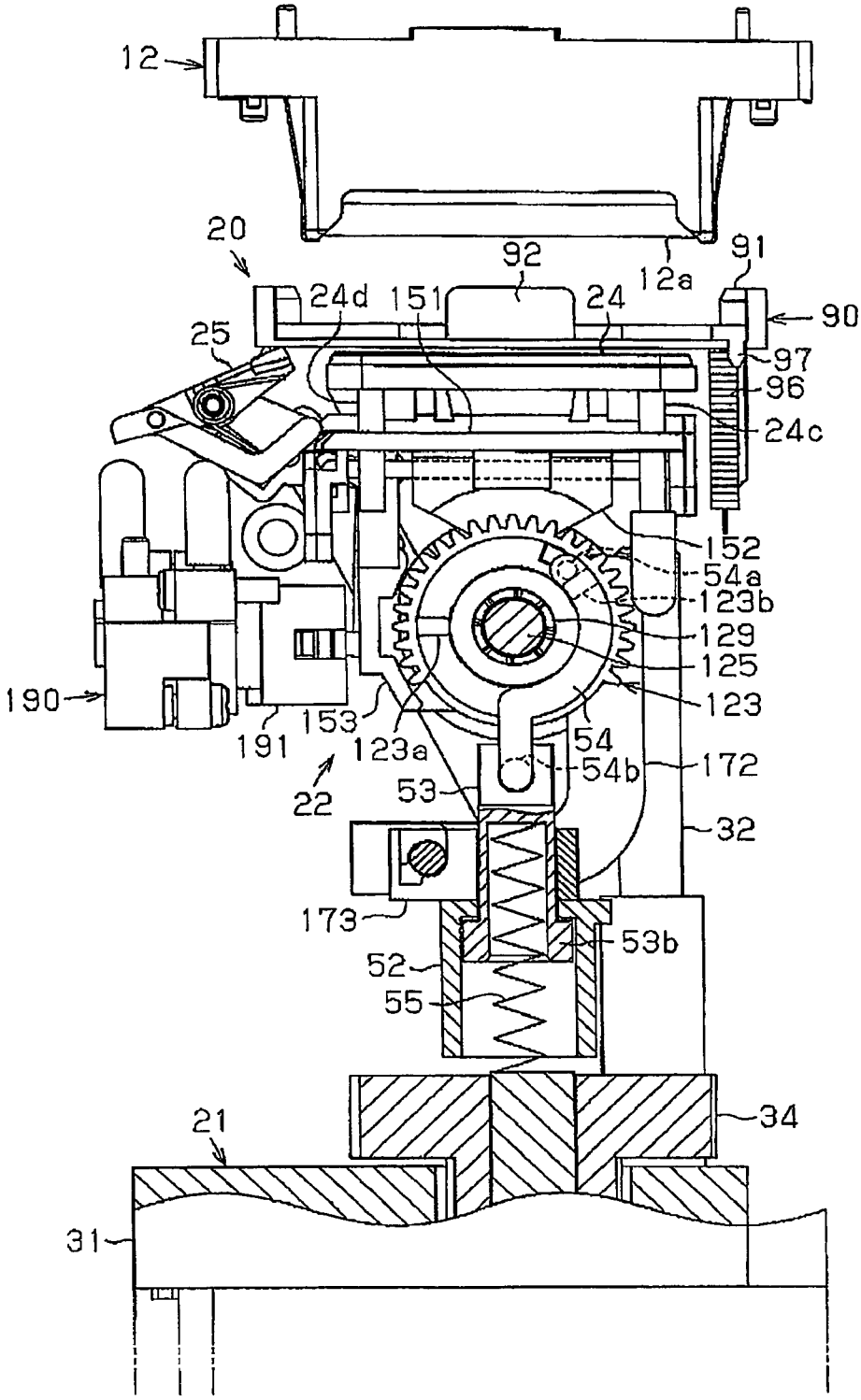
FIG. 25 is a side cross-sectional view showing a cleaning mechanism located at a lowered position.
Figure 26:
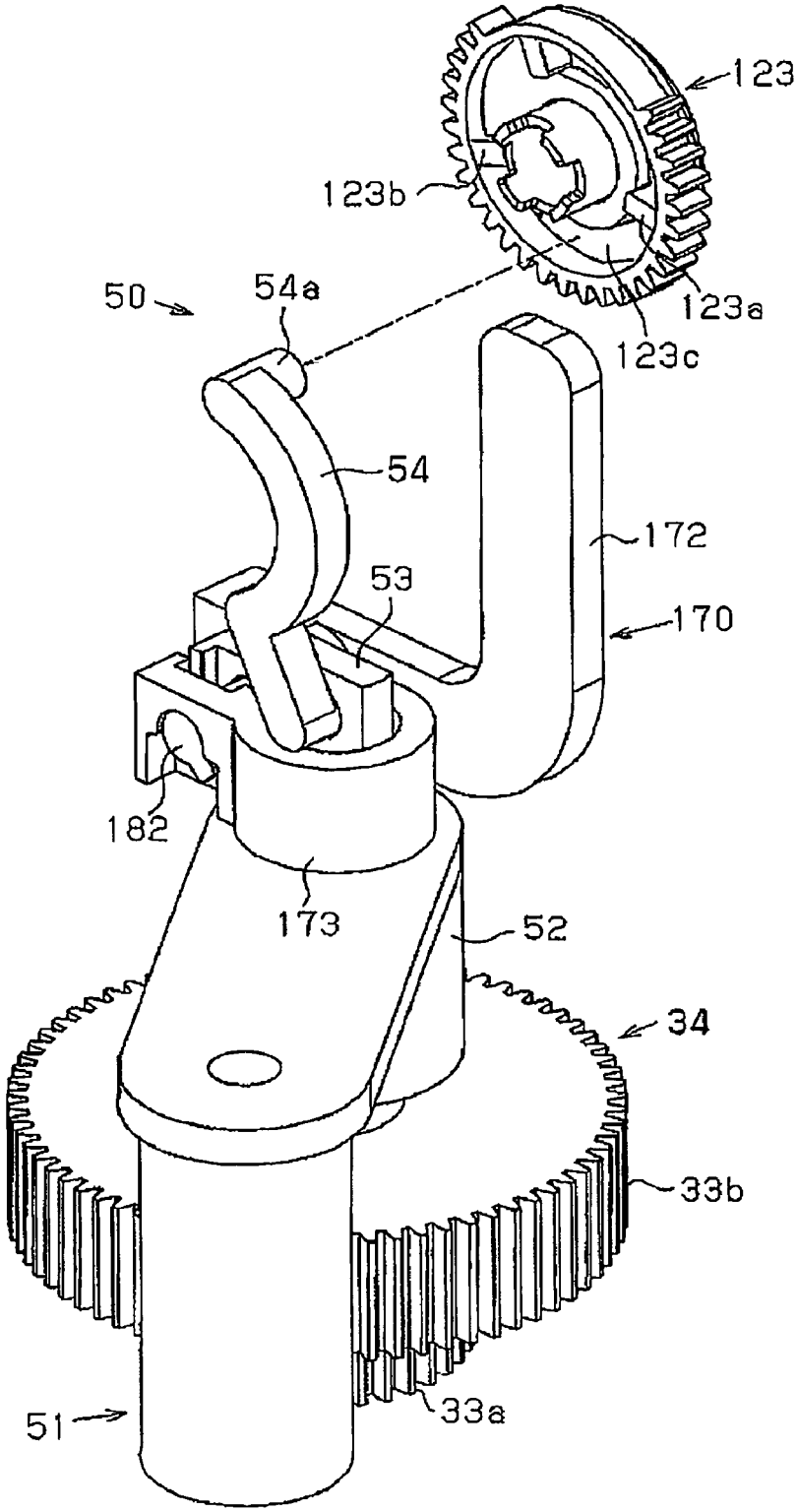
FIG. 26 is a perspective view showing a raising and lowering unit.

Next, the raising and lowering mechanism of the cleaning mechanism 22 will be explained with reference to FIGS. 25 to 33. FIG. 25 is a cross-sectional side view showing the cleaning mechanism 22 and the raising and lowering unit. FIG. 26 is a perspective view showing the raising and lowering unit together with a portion of the lock mechanism.

The raising and lowering unit 50 is a mechanism that selectively raises and lowers the cleaning mechanism 22 relative to the base unit 21 in such a manner that the cleaning mechanism 22 selectively approaches and separates from the recording head 12. The raising and lowering unit 50 is a mechanism that becomes engaged with the third selection cam 123 and thus driven through rotation of the third selection cam 123 to raise or lower the cleaning mechanism 22. Thus, a raising and lowering device is formed by the raising and lowering unit 50, the electric motor 30, the power transmission mechanism 33, and the portion of the selection gear unit 120 that operates to rotate the selection cam 123.

As shown in FIGS. 25 and 26, the raising and lowering unit 50 has the support portion 51 and the pressure adjustment shaft 53. The support portion 51 is arranged on the upper surface of the base frame 31. The pressure adjustment shaft 53 is passed through and supported by the pressure adjustment shaft holder 52, which is formed in the distal portion of the support portion 51, with an upper portion of the pressure adjustment shaft 53 projecting from the pressure adjustment shaft holder 52. In this state, the pressure adjustment shaft 53 is movable in the up-and-down direction. As shown in FIG. 25, the pressure adjustment shaft 53 is urged by a compression spring 55, which is arranged in the pressure adjustment shaft holder 52, in the direction in which the upper portion of the pressure adjustment shaft 53 projects (in an upward direction). A stopper restriction 53*b*, which projects from the proximal portion of the pressure adjustment shaft 53, restricts the maximum projection amount of the pressure adjustment shaft 53 from the pressure adjustment shaft holder 52. The pressure adjustment shaft 53 is shaped like a cylinder with a closed bottom. An upper end portion of the compression spring 55 is passed through an opening defined in the lower surface of the pressure adjustment shaft 53. The lower end of the compression spring 55 is held in contact with the upper surface of the double gear 34.

A connection hole 53*a* (see FIG. 35) is defined in the distal portion of the pressure adjustment shaft 53. A pin portion 54*b*, which projects from the proximal portion of the aforementioned lift lever 54, is passed through the connection hole 53*a*.

The lift lever 54 is thus connected to the pressure adjustment shaft 53 rotationally about the axis of the pin portion 54*b*, which is connected to the pressure adjustment shaft 53. The portion of the lift lever 54 other than the proximal portion is shaped arcuate to avoid interference between the lift lever 54 and the shaft portion 129 of the selection cam. The lift lever 54 is arranged between the second selection cam 122 and the third selection cam 123. Referring to FIGS. 25 and 26, a recess 123*c* is, defined between two projections (a first projection 123*a* and a second projection 123*b*) projecting from a side surface (that is located to be opposed to the side surface in which the cam portion is formed and located closer to the viewer of FIG. 25) of the third selection cam 123. The pin portion 54*a* is received in the recess 123*c* to cause engagement between the lift lever 54 and the third selection cam 123.

In FIG. 25, the cleaning mechanism 22 is located at a lowered position. In this state, the pin portion 54*a* of the lift lever 54 is engaged with the third selection cam 123 at a position higher than the axis of the third selection cam 123. Thus, the cleaning mechanism 22 is located at the lowered position with the axis of the selection cam set 135 arranged closest to the pressure adjustment shaft 53.

Figure 28:
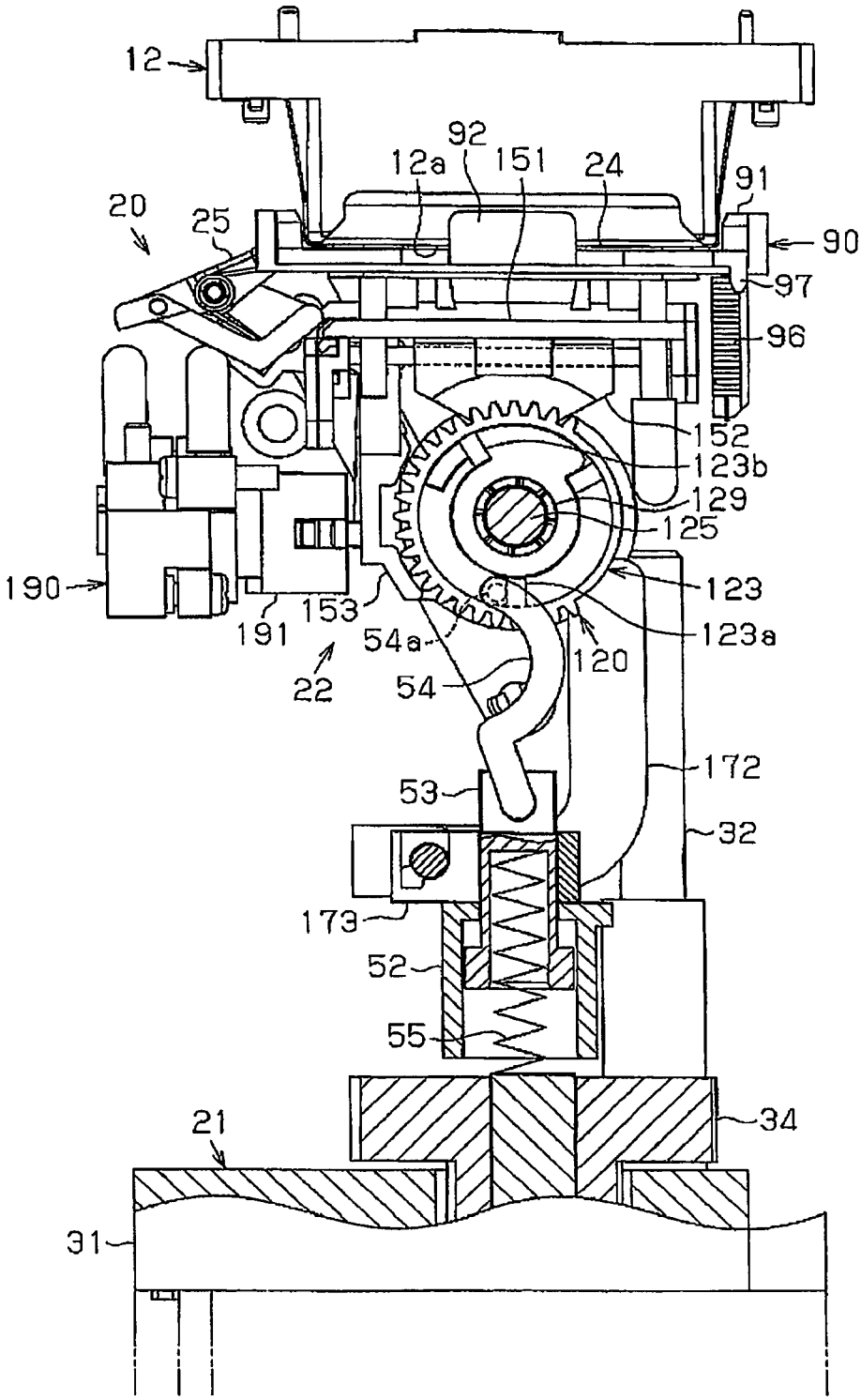
FIG. 28 is a side cross-sectional view showing the cleaning mechanism located at a raised position.

In FIG. 28, the cleaning mechanism 22 is arranged at a raised position. At this position, the guide portions 91, 92 of the head guide unit 90 are engaged with the recording head 12 to position the cleaning mechanism 22 with respect to the recording head 12. In this state, the caps 24 are held in tight contact with the nozzle forming surface 12*a*. The engagement position between the pin portion 54*a* of the lift lever 54 and the third selection cam 123 is located in the vicinity of the lower end of the third selection cam 123. In this state, the cleaning mechanism 22 is located at the raised position with the axis of the selection gear unit 120 and the pressure adjustment shaft 53 maximally spaced from each other in the direction defined by the height. The raised position refers to a position of the cleaning mechanism 22 when the third selection cam 123 and the lift lever 54 are located at the relative positions shown in FIG. 28 and each cap 24 forms a sealed space by contacting the nozzle forming surface 12*a* in such a manner as to encompass the corresponding nozzle rows 13. The raising distance necessary to bring the cap 24 into tight contact with the nozzle forming surface 12*a* depends on the current platen gap. Thus, the height of the cleaning mechanism 22 from the base frame 31 when the cleaning mechanism 22 is located at the maximally raised position varies depending on the platen gap. Specifically, if the platen gap is set to a small value, the position of the recording head 12 is low. Thus, when the cleaning mechanism 22 is arranged at the raised position, the retracted amount of the pressure adjustment shaft 53 into the pressure adjustment shaft holder 52 becomes relatively great. Contrastingly, if the platen gap is set to a great value, the position of the recording head 12 is high. Accordingly, when the cleaning mechanism 22 is located at the raised position, the projection amount of the pressure adjustment shaft 53 from the pressure adjustment shaft holder 52 becomes relatively great.

Operation of the raising and lowering unit will hereafter be explained with reference to FIG. 27.

Figures 27A, 27B, 27C, 27D, 27E:
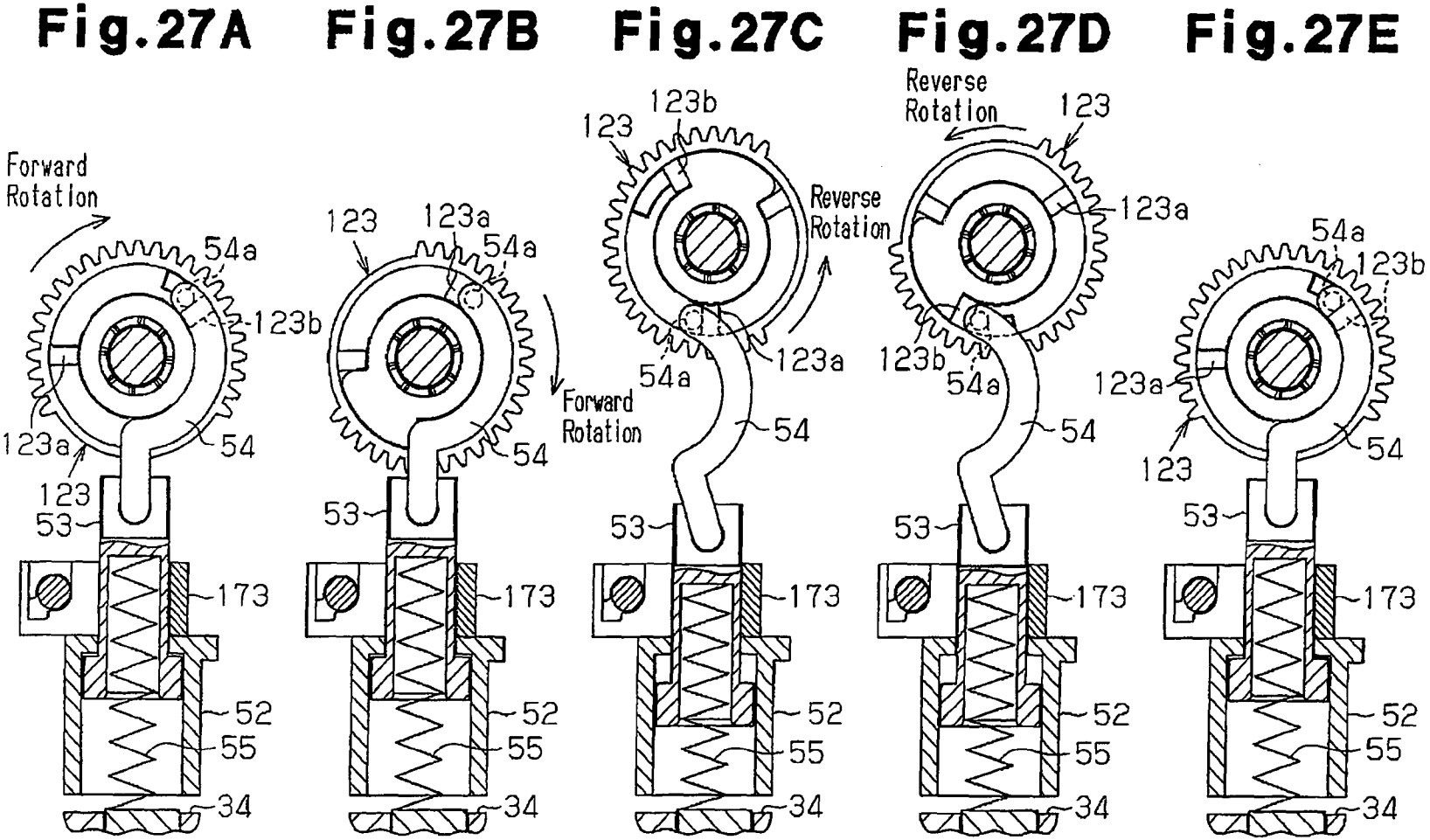
FIGS. 27A to 27E are side cross-sectional views each explaining operation of the raising and lowering unit.

FIG. 27A shows the state of the raising and lowering unit at a lowered position. FIG. 27B shows the state of the raising and lowering unit at a rising stage. FIG. 27C shows the state of the raising and lowering unit at a raised position. FIG. 27D shows the state of the raising and lowering unit at a lowering stage. FIG. 27E shows the state of the raising and lowering unit at a lowered position.

The selection cam 123 is rotated from the state corresponding to the lowered position shown in FIG. 27A in the forward direction, or the clockwise direction as viewed in the drawing. In such rotation, the selection cam 123 is maintained with the height of the selection cam 123 maintained unchanged in a state in which the first projection 123*a* is prevented from becoming engaged with the lift lever 54 for a certain period of time (corresponding to rotation of approximately 130 degrees). The first projection 123*a* then contacts the pin portion 54*a* of the lift lever 54, as illustrated in FIG. 27B. As forward rotation of the selection cam 123 continues, force acts in a direction in which the first projection 123*a* depresses the pin portion 54*a*. However, since the urging force of the compression spring 55 is greater than such force, the selection cam 123 is raised separately from the pressure adjustment shaft 53. At this stage, the cap 24 is raised together with the selection cam 123 and contacts the nozzle forming surface 12*a*. Until this point, the compression spring 55 is maintained in a state substantially equivalent to the state shown in FIG. 27A. When the cap 24 contacts the nozzle forming surface 12*a*, raising of the cleaning mechanism 22 is stopped. However, at this point, the first projection 123*a* of the selection cam 123 has not yet reached the maximally lowered point. Thus, as the selection cam 123 is further rotated, the first projection 123*a* is moved further downward. This depresses the lift lever 54 so that the selection cam set 135 is arranged at the raised position shown in FIG. 27C. At this stage, the first projection 123*a* is located substantially at the maximally lowered point. When the selection cam set 135 is arranged at the raised position, suction and idle suction are performed by the cleaning mechanism 22. In this state, the urging force of the compression spring 55 compressed through depression of the lift lever 54 becomes the force that reliably causes capping. Since the guide rod 32 is passed through the guide cylinder 61 of the holder 23, the cleaning mechanism 22 is moved in a vertical direction as viewed in FIG. 27. In this state, the first projection 123*a* is allowed to move both in the up-and-down direction and the left-and-right direction. Thus, the lift lever 54 is pivotally connected to the pressure adjustment shaft 53 in such a manner that the lift lever 54 becomes movable in accordance with movement of the first projection 123*a*.

Subsequently, the selection cam 123 is rotated in the reverse direction from the state corresponding to the raised position shown in FIG. 27C in the counterclockwise direction as viewed in FIG. 27C. In such rotation, the selection cam 123 is maintained in a state in which the second projection 123*b* is prevented from becoming engaged with the lift lever 54 for a certain period of time (corresponding to rotation by approximately 130 degrees). Then, the pin portion 54*a* contacts the side surface of the groove defined in the selection cam 123 and the selection cam 123 is prevented from rising and lowering. Afterwards, with reference to FIG. 27D, the second projection 123*b* contacts the pin portion 54*a* of the lift lever 54. As the selection cam 123 is continuously rotated in the reverse direction, the second projection 123*b* presses the pin portion 54*a* upward to raise the lift lever 54. The lift lever 54 is connected to the pressure adjustment shaft 53. Thus, after such raising of the lift lever 54 is completed, force acts in a direction in which the second projection 123*b* presses the pin portion 54*a* further upward. However, the stopper restriction 53*b* prevents such further upward pressing of the pin portion 54*a*. In this state, contrastingly, the selection cam set 135 is lowered. As the selection cam 123 is further rotated in the reverse direction, the selection cam set 135 is arranged at the maximally lowered position shown in FIG. 27E. When the selection cam set 135 is located at this position, the cleaning mechanism 22 performs wiping and printing.

<Cap Unit>

Figure 29:
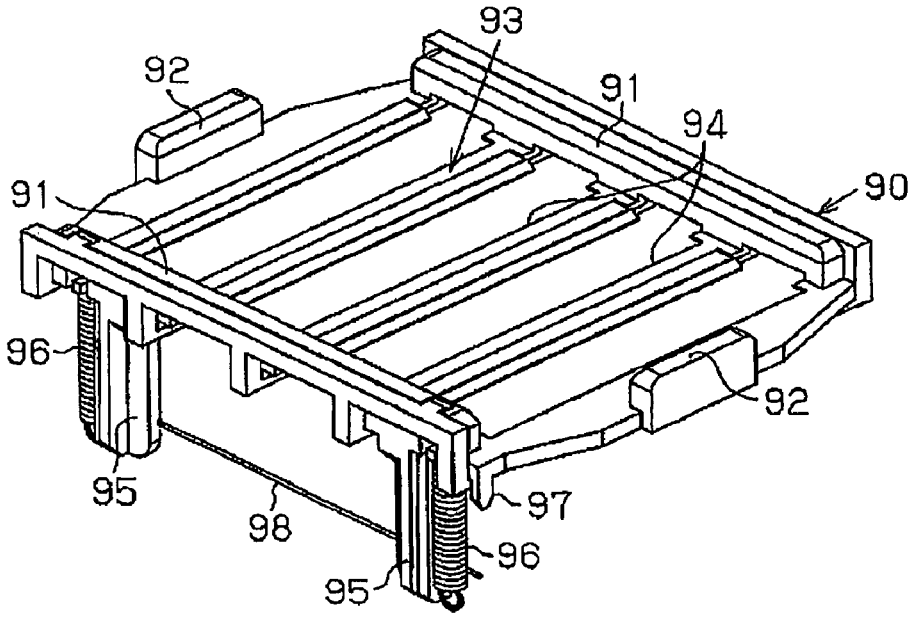
FIG. 29 is a perspective view showing a cap unit and a head guide unit.
Figure 29:
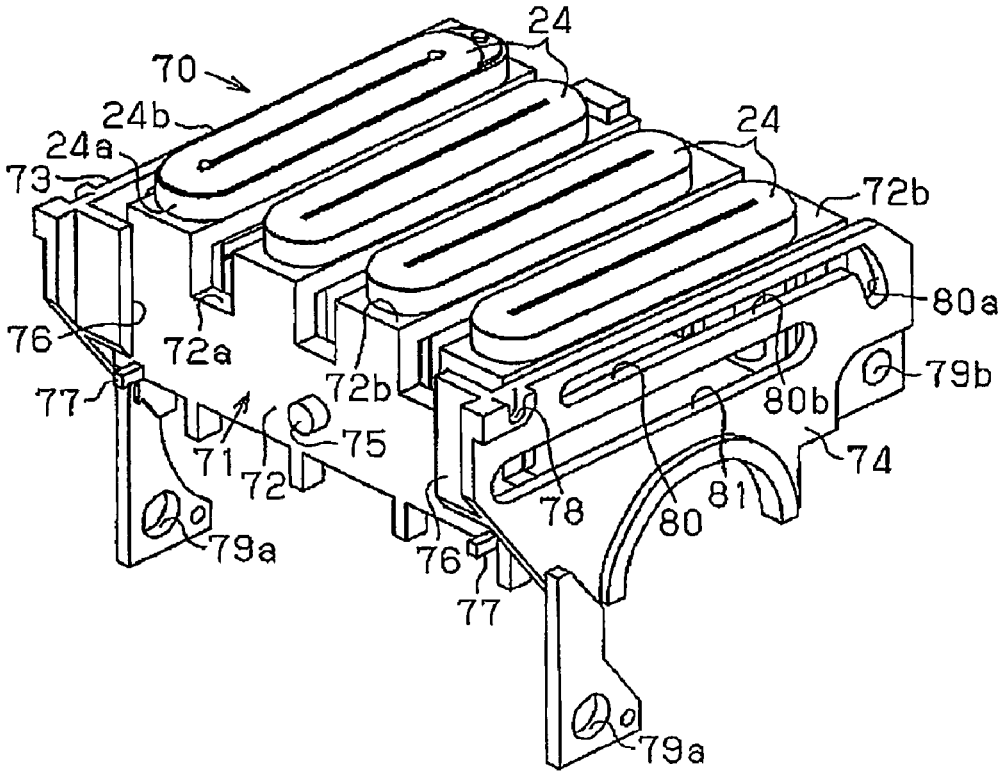

FIG. 29 is a perspective view showing the cap unit and the head guide unit.

The cap unit 70 includes the mounting holder 71 and the four caps 24, which are arranged on the upper surface of the mounting holder 71. The mounting holder 71 includes a cap base frame 72 and two, left and right, side frames 73, 74. The side frames 73, 74 are fixed in such a manner as to cover the opposing left and right sides of the cap base frame 72. The caps 24 are fixed to the upper surface of the cap base frame 72 in such a manner that the longitudinal directions of the caps 24 are parallel with each other and the caps 24 are spaced at equal intervals in a direction perpendicular to the longitudinal direction of each cap 24. A slit 72*a* having an elongated opening is defined in a portion of the cap base frame 72 corresponding to each of the intervals of the caps 24. Each of the slits 72*a* has openings at the opposing longitudinal ends of the slit 72*a*. The cap base frame 72 includes four base plate portions 72*b*. The four caps 24 are fixed to the upper surfaces of the corresponding base plate portions 72*b*. The portion between each adjacent pair of the caps 24 is cut away to a predetermined depth with a predetermined width. Each adjacent pair of the base plate portions 72*b* are spaced from each other by the corresponding one of the slits 72*a*, which are defined at the positions corresponding to the backsides of the base plate portions 72*b*. Each of the caps 24 has a cap base material 24*a* and a cap elastic member 24*b*. The cap base material 24*a* is fixed to the upper surface of the associated base plate portion 72*b*. The cap elastic member 24*b* is formed of elastomer and secured to the upper surface of the cap base material 24*a*.

Left and right pairs of first guide holes 80 and second guide holes 81 are defined at upper positions of the corresponding left and right side frames 73, 74 (only one of the pairs is shown in FIG. 29). Each of the first guide holes 80 and the associated one of the second guide holes 81 are arranged in parallel in the up-and-down direction and extend in the longitudinal direction of each cap. A recess having a semi-circular surface is defined in a lower portion of each of the side frames 73, 74 to accommodate the wiper drive gear 221 and the wiper drive wheel 222. A pair of pin holes 79*a* are each defined in a lower portion of the portion extending downward from the front side (the left side as viewed in FIG. 29) of the associated recess. A fix pin 64, which fixes the cap unit 70 to the support holder 60, is passed through each of the pin holes 79*a*. A pair of pin holes 79*b* are defined in the opposing left and right ends of the backside of the cap base frame 72 to receive corresponding fix pins 65. The support holder 60 and the mounting holder 71 are fixed together at a plurality of positions through a plurality of fix pins 64, 65 (shown in FIG. 7).

As shown in FIG. 29, the head guide unit 90 has a wiper guide 93, which is shaped like a rectangular grid-like plate. The wiper guide 93 is located on the bottom surface of the head guide unit 90 opposing the cap base frame 72. The wiper guide 93 has four openings 94 through which the four caps 24 project and retract. A pair of positioning projections 97 (only one of the pair is shown in FIG. 29) project from the opposing left and right ends at the front side of the head guide unit 90 toward the mounting holder 71. Positioning recesses 78 are defined in the upper ends of the side frames 73, 74 at the positions corresponding to the positioning projections 97. Through engagement of the guide portions 91, 92 of the head guide unit 90 with the recording head 12, the recording head 12 and the head guide unit 90 are positioned with respect to each other. In this state, the holder 23 is raised toward the head guide unit 90 to cause engagement between the positioning projections 97 and the positioning recesses 78. This positions the head guide unit 90 with respect to the holder 23, thus positioning the caps 24 with respect to the recording head.

The guide portions 91, 92 of the head guide unit 90 stably maintain the positions of the recording head 12 and the maintenance device 20, particularly, the positions of the recording head 12 and the caps 24 fixed to the upper surface of the cap base frame 72. This decreases the distance from the distal end of an elastic portion provided on the nozzle forming surface 12*a*, through which the caps 24 are allowed to elastically contact the nozzle forming surface 12*a*, to the nozzle rows 13. This makes it easy to reduce the size of each of the caps 24.

A pair of, left and right, rail guide portions 76, each of which includes a rail groove, extend downward from the opposing left and right ends of the front surface of the head guide unit 90. A pair of guide rail portions 95 extend downward from the opposing left and right ends of the front side of the mounting holder 71. The guide rail portions 95 are received in the rail guide portions 76, which are provided in the mounting holder 71, to secure the head guide unit 90 to the mounting holder 71 in a manner movable in the up-and-down direction. The upper end of a coil spring 96 is secured to the outer side of each of the guide rail portions 9S of the head guide unit 90. The lower end of each of the coil springs 96 is secured to a spring hooking projection 77, which projects from the corresponding one of the opposing left and right sides of the lower end of the front side of the mounting holder 71. The pair of left and right coil springs 96 stop the head guide unit 90 from falling from the holder 23. The head guide unit 90 further includes a linear spring 98, which extends substantially horizontally. The opposite ends of the linear spring 98 are clamped by and fixed to the backsides of the guide rail portions 95. A pillar-like projection 75 projects from the center of the front surface of the mounting holder 71. The head guide unit 90 is positioned at the position at which the linear spring 98 contacts the projection 75 and in a state spaced from the mounting holder 71 (the holder 23) at a predetermined distance. Accordingly, when the caps 24 are separated from the nozzle forming surface 12*a*, the head guide unit 90 and the mounting holder 71 are also spaced from each other.

Positioning and capping are performed on the recording head while the cleaning mechanism 22 is being raised. Such positioning and capping will now be explained with reference to FIGS. 30 to 33. When the cleaning mechanism 22 is arranged at the lowered position shown in FIG. 30, the head guide unit 90 is arranged at the standby position spaced upward from the holder 23. As the cleaning mechanism 22 is raised from the lowered position, the guide portions 91, 92 of the head guide unit 90 first become engaged with the side surfaces of the recording head 12 and thus guide the recording head 12 with reference to FIG. 31. This positions the head guide unit 90 with respect to the recording head 12. As the cleaning mechanism 22 is continuously raised, the portion corresponding to the holder 23 is raised with the head guide unit 90 held in contact with the recording head 12 and restricted from rising, referring to FIG. 32A. This causes the portion corresponding to the holder 23 to approach the head guide unit 90 against the urging force of the linear spring 98. As a result, the positioning projection 97 of the head guide unit 90 become engaged with the positioning recess 78 defined in the holder 23. Through such engagement between the positioning projection 97 and the holder 23, the portion corresponding to the holder 23 is positioned with respect to the recording head 12.

Figure 32B:
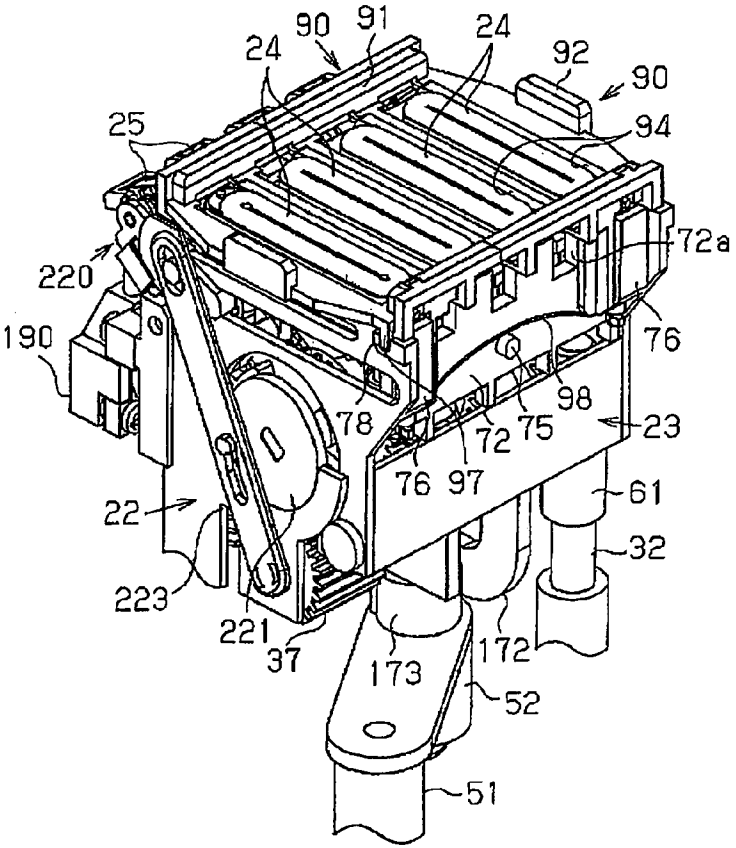
FIGS. 32A and 32B are perspective views each showing the cleaning mechanism arranged at the raised position.
Figure 33:
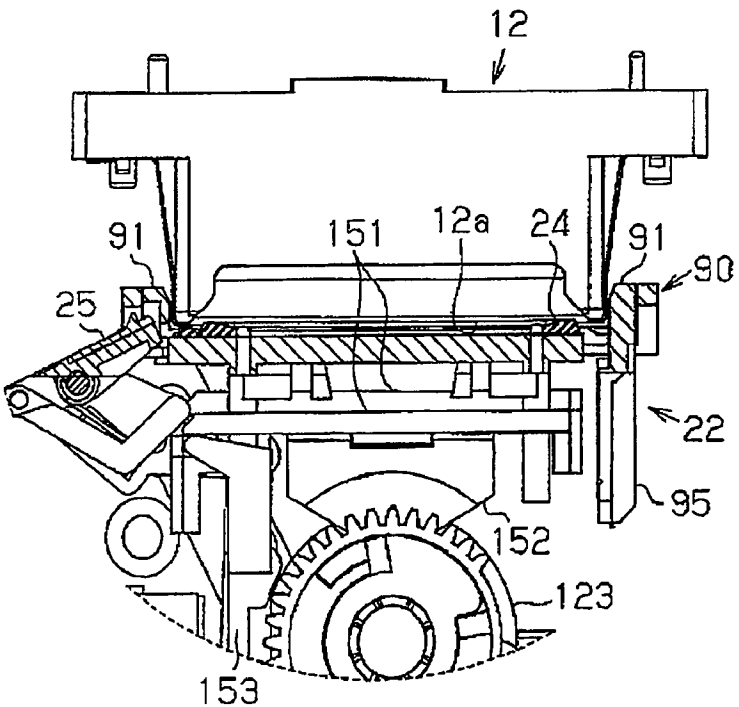
FIG. 33 is a partially exploded side view showing the vicinity of a cap of the cleaning mechanism.

In this state, with reference to FIG. 32B, the four caps 24 slightly project from the corresponding openings 94 of the head guide unit 90. As illustrated in FIG. 33, the projecting caps 24 tightly contact the nozzle forming surface 12*a* of the recording head 12. As has been described, the portion corresponding to the holder 23 is positioned with respect to the recording head 12 through the head guide unit 90. Thus, when the caps 24 are held in tight contact with the nozzle forming surface 12*a*, the caps 24 are allowed to seal the corresponding nozzle rows 13 with improved position accuracy.

<Lock Mechanism>

Figure 34:
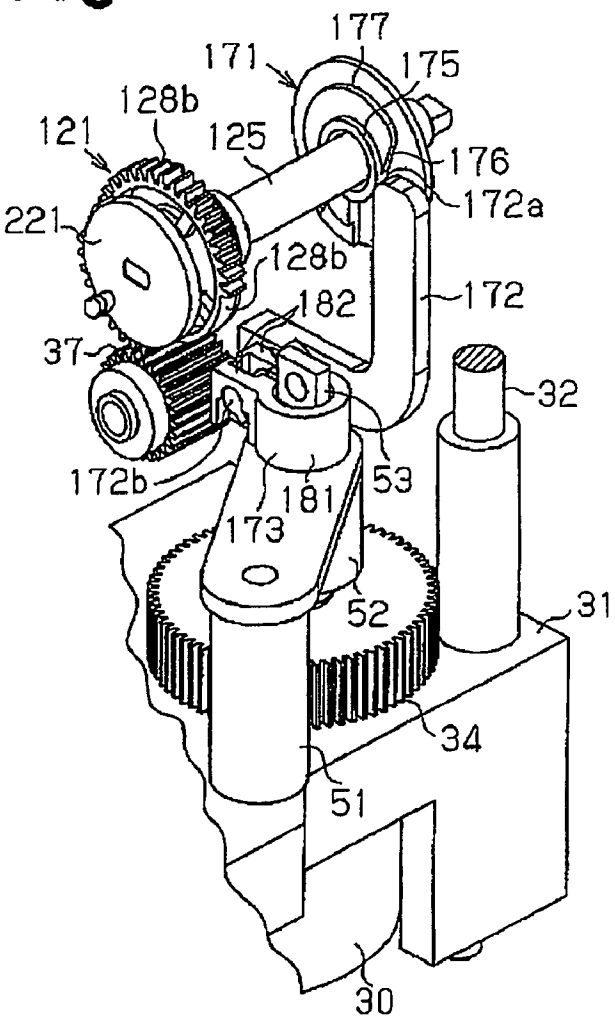
FIG. 34 is a perspective view showing a main portion including a lock mechanism.
Figure 35:
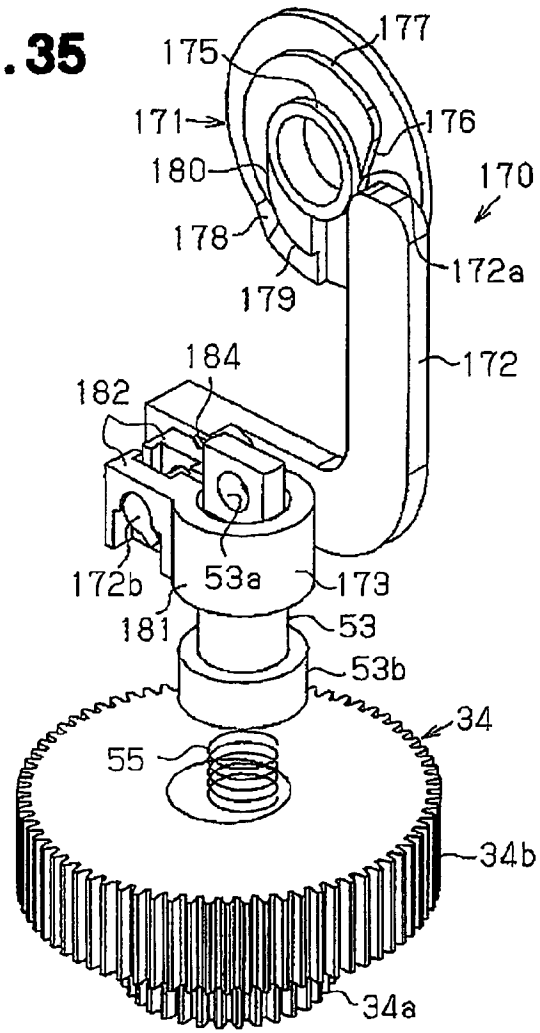
FIG. 35 is a perspective view showing the lock mechanism.

The configuration of the lock mechanism will hereafter be explained with reference to FIGS. 34 to 39. FIG. 34 is a perspective view showing a main portion including the lock mechanism. FIG. 35 is a perspective view showing the lock mechanism.

As shown in FIG. 34, the stopper cam 171 is rotatably connected to the selection cam set 135 as an integral body by the selection cam shaft 125 that is passed through the stopper cam 171. The stopper cam 171 has a cam portion 171*b*, which is formed at a side surface of the stopper cam 171 and has a predetermined shape. An upper portion of the stopper lever 172 is held in contact with and joined with the cam surface formed by the outer circumferential surface of the cam portion 171*b*.

As shown in FIGS. 34 and 35, the stopper lever 172 is a substantially L-shaped lever. The cam follower portion 172*a* contacts the cam surface of the stopper cam 171. The proximal portion of the stopper lever 172 is connected to the choke member 173, which is fixed to the upper surface of the pressure adjustment shaft holder 52 with the pressure adjustment shaft 53 passed through the pressure adjustment shaft holder 52. The inner diameter of the choke member 173 is set in such a manner that the portion of the pressure adjustment shaft 53 projecting from the pressure adjustment shaft holder 52 is passed through the choke member 173. The choke member 173 has a choke ring portion 181 and a pair of plate-like connecting pieces 182. A portion of the choke ring portion 181 is cut away. The connecting pieces 182 extend substantially parallel with each other and from the opposing sides of the cut-away portion of the choke ring portion 181. An insertion shaft 172*b*, which extends perpendicularly from a side surface of the proximal portion of the stopper lever 172, is passed between the connecting pieces 182. This connects the connecting pieces 182 to the proximal portion of the stopper lever 172 in a state in which the interval between the connecting pieces 182 is changeable. The side surface of the proximal portion of the stopper lever 172 is engaged with the outer side surface of the corresponding one of the connecting pieces 182. Regarding such engagement surfaces, an engagement groove 183, which is defined by a V-shaped groove, is defined in the outer side surface of the connecting piece 182. An engagement projection 184 having an inverted V-shaped cross section projects perpendicularly from the side surface of the proximal portion of the stopper lever 172.

When the stopper lever 172 is held in a vertically upright posture as illustrated in FIGS. 34 and 35, the engagement groove 183 is engaged with the engagement projection 184 by a great engagement amount and elasticity of the choke member 173 acts to increase the diameter of the choke ring portion 181. In this state, the pressure adjustment shaft 53 is loosely received in the choke ring portion 181 and maintained in an unlocked state in which the pressure adjustment shaft 53 is permitted to axially move relative to the choke ring portion 181. The stopper lever 172 is switched to an inclined posture by contacting a locking cam surface 177 of the stopper cam 171. In this state, the amount of engagement between the engagement groove 183 and the engagement projection 184 becomes smaller. The engagement projection 184 of the stopper lever 172 thus presses the corresponding one of the connecting pieces 182 in a direction approaching the other one of the connecting pieces 182. This decreases the diameter of the choke ring portion 181, causing the choke ring portion 181 to clamp the distal end of the pressure adjustment shaft 53 from outside and thus lock the pressure adjustment shaft 53.

Figure 36:
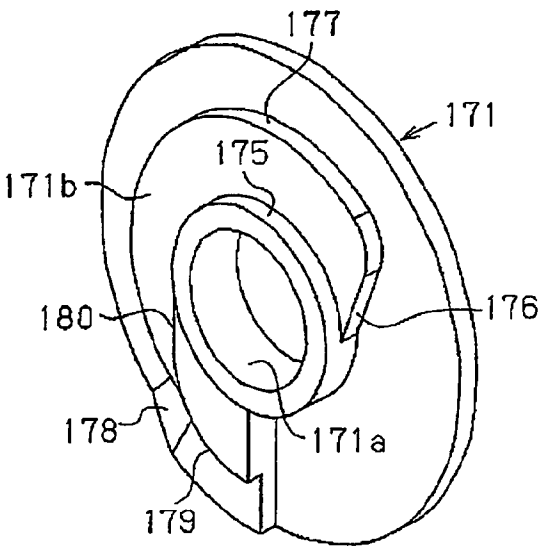
FIG. 36 is a perspective view showing a stopper cam.

FIG. 36 is a perspective view showing the stopper cam. As shown in FIG. 36, the stopper cam 171 has a shaft hole 171*a* through which the selection cam shaft 125 is passed through. A cam portion 171*b*, which is two-stepped in an axial direction, projects from a side surface of the stopper cam 171. The cam portion 171*b* has a cam surface corresponding to unlocking (hereinafter, referred to as a "non-locking cam surface 175") and a cam surface corresponding to locking (hereinafter, referred to as a "locking cam surface 177"). The non-locking cam surface 175 has a minimum radius from the axis of the cam portion 171*b*. The locking cam surface 177 is located sideways from the non-locking cam surface 175 with respect to the axial direction. The radius of the locking cam surface 177 from the axis of the cam portion 171*b* is greater than the corresponding radius of the non-locking cam surface 175. The non-locking cam surface 175 and the locking cam surface 177 are connected continuously by an inclined surface 176. The inclined surface 176 is inclined in such a manner that the radius of the inclined surface 176 becomes gradually greater in the counterclockwise direction as viewed in FIG. 36. A pushing guide surface 178 is formed by a finishing end portion of the locking cam surface 177 in the vicinity of an opposing side of the inclined surface 176 with respect to the axis. The side surface of the pushing guide surface 178 is bulging to form an inclined surface extending along an axially outward direction. The pushing guide surface 178 guides the stopper lever 172 to press the stopper lever 172 in an axially outward direction of the stopper cam 171. The stopper lever 172 is thus received by a cam surface 179, which is provided at a position outward from the pushing guide surface 178 in the axial direction of the stopper cam 171. The radius of the cam surface 179 is substantially equal to that of the locking cam surface 177. In wiping, the stopper lever 172 contacts the cam surface 179. An inclined surface 180 is formed at a position clockwise from the cam surface 179 for wiping as viewed in FIG. 36. The radius of the inclined surface 180 becomes gradually smaller from the position corresponding to the cam surface 179 to the position corresponding to the non-locking cam surface 175.

Figure 37A:
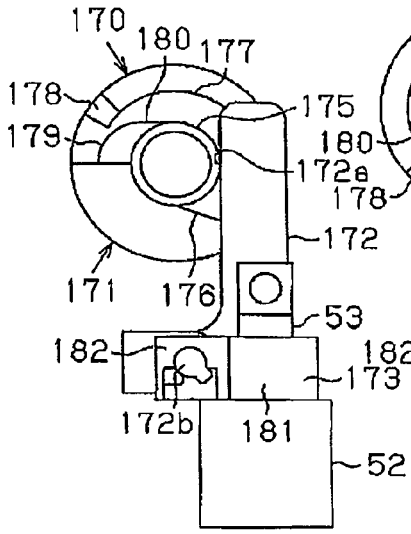
FIGS. 37A to 37C are side views each explaining operation of the lock mechanism.
Figure 37B:
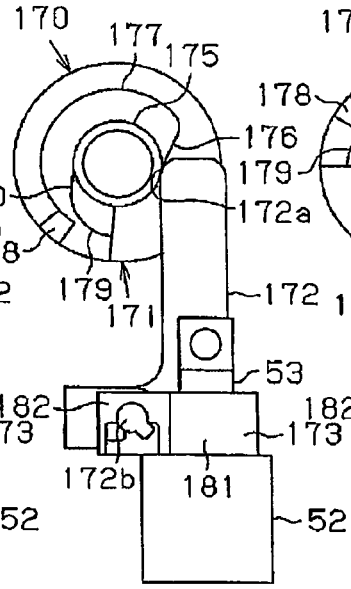
Figure 37C:
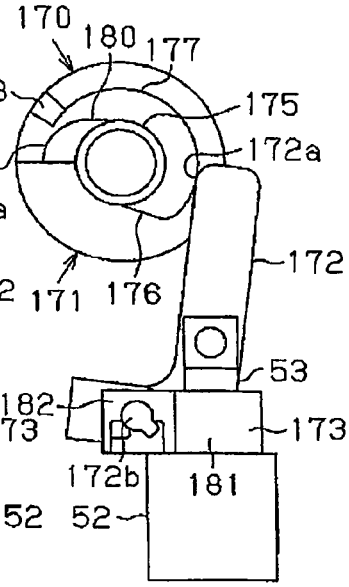

FIG. 37 is a side view representing the relationship between the pivoted position of the stopper cam and the inclined position of the stopper lever. FIG. 37A shows a state in which the stopper lever 172 is held in contact with the non-locking cam surface 175. FIG. 37B shows a state in which reverse rotation of the stopper cam is to cause the stopper lever to ascend the inclined surface 176. FIG. 37C shows a state in which the stopper lever contacts the locking cam surface 177.

As shown in FIG. 37A, when the stopper lever 172 is held in contact with the non-locking cam surface 175 of the stopper cam 171, the stopper lever 172 is maintained substantially in a vertically upright state. In this state, as the stopper cam 171 is rotated counterclockwise as viewed in FIG. 37A, the stopper lever 172 is switched to the position relative to the stopper cam 171 as viewed in FIG. 37B. In this state, reverse, or clockwise, rotation of the stopper cam 171 is to cause ascending of the inclined surface 176 by the cam follower portion 172*a*. Specifically, if the stopper cam 171 is rotated clockwise, or in a reverse direction, in this state, the cam follower portion 172*a* of the stopper lever 172 ascends the inclined surface 176 to contact the locking cam surface 177, as shown in FIG. 37C. While the stopper lever 172 ascends the inclined surface 176 to reach the locking cam surface 177, the stopper lever 172 is switched from the vertically upright state to the inclined posture in which the stopper lever 172 is inclined at a predetermined angle with respect to the upright state.

Figure 38A:
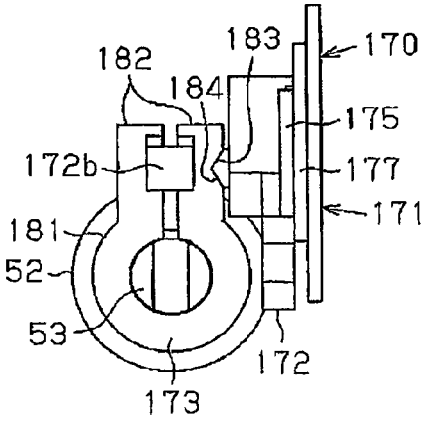
FIGS. 38A to 38B are plan views each explaining operation of the lock mechanism.
Figure 38B:
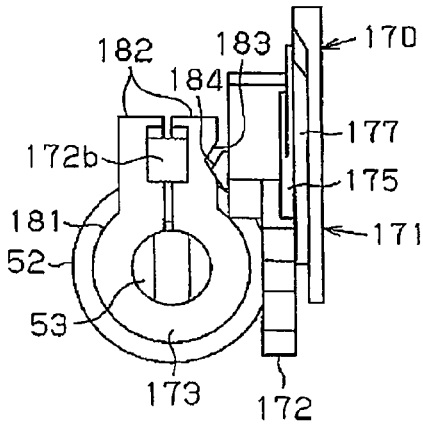

FIGS. 38A and 38B are plan views for explaining operation of the lock mechanism. FIG. 38A shows a unlocked state and FIG. 38B shows a locked state of the lock mechanism.

As shown in FIG. 38A, when the stopper lever 172 contacts the non-locking cam surface 175, the engagement projection 184 is engaged with the engagement groove 183 and the connecting pieces 182 of the choke member 173 are spaced from each other. In this state, the pressure adjustment shaft 53 is loosely passed through the choke ring portion 181, or the choke ring portion 181 is held in an increased diameter state.

Subsequently, when the stopper lever 172 contacts the locking cam surface 177, with reference to FIG. 38B, the stopper lever 172 is inclined and engagement between the engagement projection 184 and the engagement groove 183 becomes loose. In this state, the engagement projection 184 presses the corresponding connecting piece 182 in the direction in which the interval between the connecting pieces 182 is decreased. Through such pressing, the diameter of the choke ring portion 181 is decreased to cause the choke ring portion 181 to choke the pressure adjustment shaft 53. This locks the pressure adjustment shaft 53 in the state corresponding to the current projecting amount of the pressure adjustment shaft 53. As has been described, when the stopper lever 172 is held in the vertically upright state as shown in FIG. 37A, the lock mechanism 170 is held in the unlocked state. When the stopper lever 172 is inclined as illustrated in FIG. 37C, the lock mechanism 170 is maintained in the locked state.

FIG. 39 is a side view representing the relationship between the pivoted position of the stopper cam and the inclined position of the stopper lever. Specifically, FIG. 39A shows a standby state in which the stopper cam is located at an initial position. FIG. 39B shows the state after cleaning is started. FIG. 39C shows the positions when suction/idle suction is performed. FIG. 39D shows the locked state. FIG. 39E shows the state in which wiping is performed and the state after cleaning is completed.

Figure 39A:
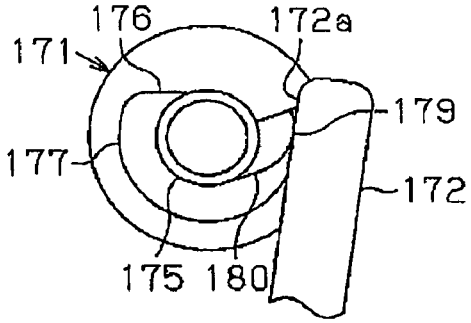
FIGS. 39A to 39E are side views each showing a main portion of the lock mechanism and explaining operation of the lock mechanism.
Figure 39D:
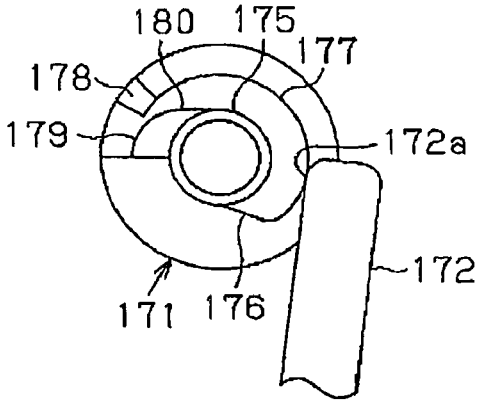
Figure 39B:
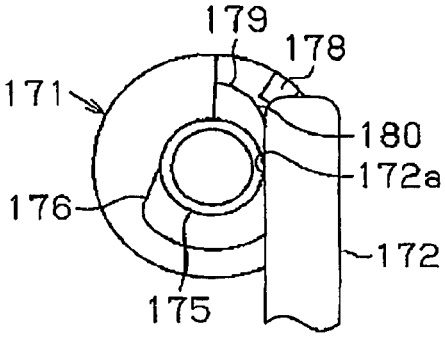
Figure 39E:
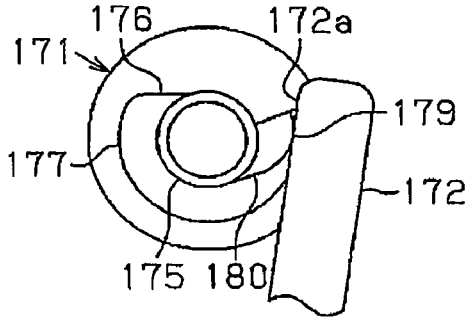
Figure 39C:
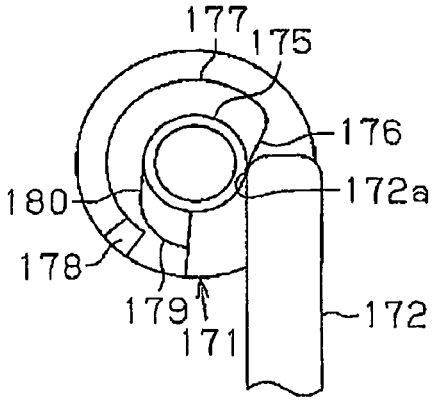

When the stopper cam 171 is (or the selection cams 121 to 124 are) located at the initial position shown in FIG. 39A, the stopper lever 172 is held in contact with the cam surface 179 of the stopper cam 171 corresponding to the initial position. When the selection cams 121 to 124 and the stopper cam 171 start to rotate in the forward directions toward the positions at the rotation angle corresponding to suction, the stopper lever 172 moves along the inclined surface 180 and is received by the non-locking cam surface 175 as illustrated in FIG. 39B. In this state, or while being held in contact with the non-locking cam surface 175, the stopper lever 172 is rotated in the forward direction until the stopper lever 172 reaches the rotation angle position corresponding to suction. When such suction is performed as illustrated in FIG. 39C, the stopper lever 172 is held in contact with the non-locking cam surface 175 of the stopper cam 171 and maintained in the vertically upright posture. After the suction is completed, the selection cams 121 to 124 are rotated in the reverse directions and then in the forward directions. The selection cams 121 to 124 are thus returned to the original rotation angle positions, or the states corresponding to idle cleaning. The idle cleaning is performed in the state of FIG. 39C. After the idle cleaning is completed, the selection cams 121 to 124 and the stopper cam 171 are rotated in the reverse directions. This causes the stopper lever 172 to ascend the inclined surface 176 and switch to the locked state shown in FIG. 39D, in which the stopper lever 172 is held in contact with the locking cam surface 177. In this locked state, the stopper lever 172 is inclined as illustrated in FIG. 39D, reducing the diameter of the choke ring portion 181. The choke ring portion 181 thus chokes the pressure adjustment shaft 53 and locks the pressure adjustment shaft 53 with the projecting amount of the pressure adjustment shaft 53 from the pressure adjustment shaft holder 52 maintained at the current level. Such locking is carried out when the selection cams 121 to 124 and the stopper cam 171 are rotated in the reverse directions to the rotation angle positions corresponding to wiping. Such reverse rotation is stopped in the state shown in FIG. 39E. The wiping is performed in this state and cleaning is completed when the wiping is ended. At this stage, the state of the stopper lever 172 corresponds to the original standby state (FIG. 39A). In this manner, by the time one cycle of cleaning is completed, the states corresponding to the original standby position are restored. After the wiping is completed, the selection cams 121 to 124 and the stopper cam 171 may be rotated in the forward directions by a small amount as long as the locked state of the stopper lever 172 is maintained.

Figure 40A:
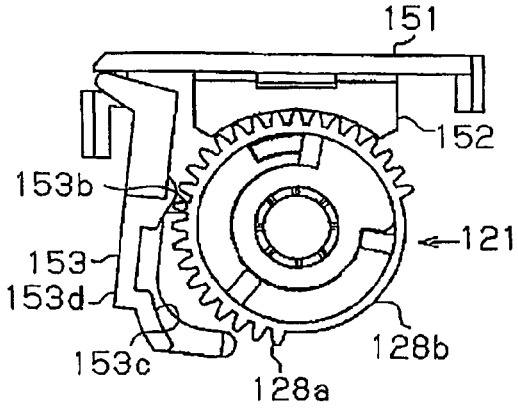
FIG. 40A is a left side view showing the lift unit in a non-selection state.
Figure 40B:
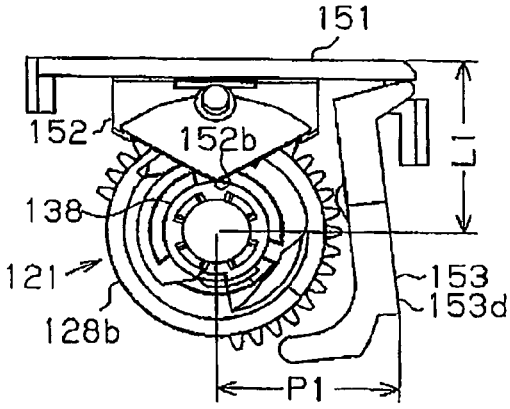
FIG. 40B is a right side view showing the lift unit in the non-selection state.
Figure 41A:
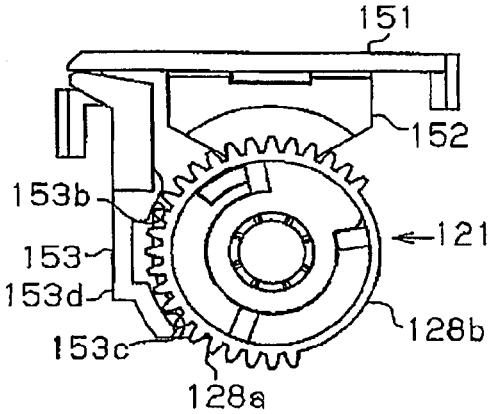
FIG. 41A is a left side view showing the lift unit when suction is selected.
Figure 41B:
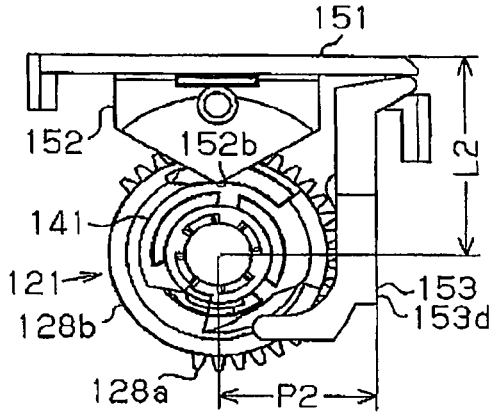
FIG. 41B is a right side view showing the lift unit when suction is selected.
Figure 42A:
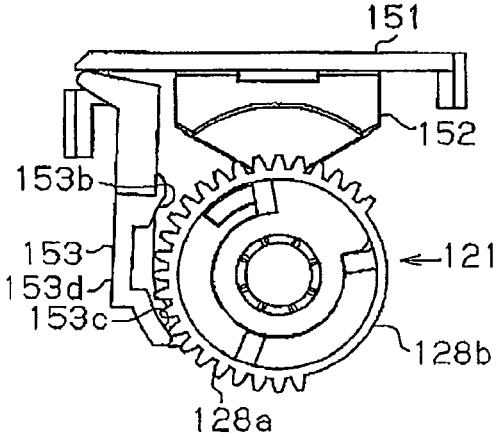
FIG. 42A is a left side view showing the lift unit when idle suction is selected.
Figure 42B:
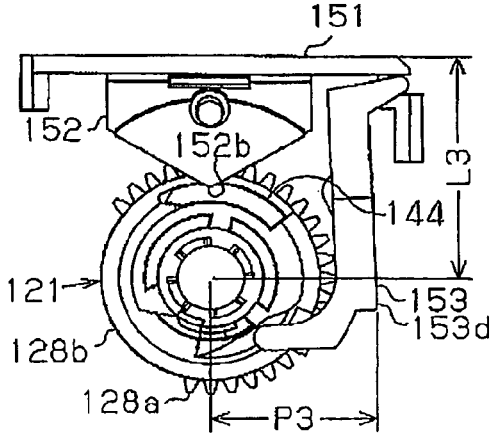
FIG. 42B is a right side view showing the lift unit when idle suction is selected.

FIGS. 40 to 42 are side views each showing the lift unit. Specifically, FIGS. 40A, 41A, and 42A are left side views showing the lift unit. FIGS. 40B, 41B, and 42B are right side views showing the lift unit. FIG. 40 shows the state of the lift unit in which the nozzle rows are not selected. FIG. 41 shows the state of the lift unit in which the nozzle rows are selected. FIG. 42 shows the state of the lift unit in which idle suction is performed.

When the lift cam movable plate 152 is held in contact with the non-selection cam surface 138 maintained in a lowered state as illustrated in FIG. 40B, the lift plate base 151 is arranged at the lowered position. In this state, the height from the axis of the selection cam 121 to the upper surface (the lift surface) of the lift plate base 151 is a value L1. With reference to FIGS. 40 to 42, the valve lever 153 is engaged with and supported by the lift plate base 151. The inner surface of the valve lever 153 opposed to the selection cam 121 is shaped in such a manner that the inner surface is held in contact with and pressed against the outer circumferential surface (the tooth portion 128*a*) of the selection cam 121 to allow inclination of the valve lever 153 about the engagement portion defined in the upper end of the valve lever 153. Thus, when the lift plate base 151 is arranged at the lowered position shown in FIG. 40, a first lever cam portion 153*b*, which projects from the vicinity of an intermediate step of the inner surface of the valve lever 153 in the direction defined by the height, contacts the tooth portion. This inclines the lower end of the valve lever 153 about the engagement portion at the upper end of the valve lever 153 separately from the selection cam. In this manner, the backside of the valve lever 153 is pressed outwardly by a great amount. A lower end of the backside of the valve lever 153 is a pressing surface 153*d* that presses the valve pressurizing body 191 of the valve unit 190, which will be described later.

When the lift cam movable plate 152 is held in contact with the suction cam surface 141 corresponding to suction referring to FIG. 41B, the lift plate base 151 is located at the raised position. The height from the axis of the selection cam 121 to the upper surface (the lift surface) of the lift plate base 151 is a value L2 (>L1). Thus, referring to FIGS. 41A and 41B, when the lift plate base 151 is located at the raised position, the first lever cam portion 153*b* is also raised and contacts the outer circumferential surface (the tooth portion 128*a*) of the selection cam 121 without being pressed against such surface. A second lever cam portion 153*c* is defined in a lower portion of the inner surface of the valve lever 153. The tooth portion 128*a* is received in the second lever cam portion 153*c*, causing the valve lever 153 to switch to the posture vertical with respect to the engagement portion at the upper end of the valve lever 153. The pressing surface 153*d* of the valve lever 153 is thus prevented from being pressed outward.

When the lift cam movable plate 152 is held in contact with the idle suction cam surface 144 corresponding to idle suction, referring to FIG. 42B, the lift plate base 151 is arranged at the maximally raised position. The height from the axis of the selection cam 121 to the upper surface (the lift surface) of the lift plate base 151 is a value L3 (>L2). Thus, when the lift plate base 151 is located at the maximally raised position as illustrated in FIGS. 42A and 42B, the second lever cam portion 153*c* of the inner surface of the valve lever 153 contacts the tooth portion 128*a*. This inclines the lower end of the valve lever 153 about the engagement portion at the upper end of the valve lever 153 to slightly separate the valve lever 153 from the selection cam. The pressing surface 153*d* is thus pressed outward by a small amount.

As has been described, the pressed amount of the valve lever 153 becomes "maximum" (great) when the lift plate base 151 is arranged at the lowered position corresponding to the state in which rows to be subjected to suction are not selected. Such amount becomes "minimum" (0) when the lift plate base 151 is located at the raised position corresponding to suction. The amount becomes "middle" (small) when the lift plate base 151 is located at the maximally raised position corresponding to idle suction. In other words, the valve lever 153 is capable of pressing the valve pressurizing body 191 in accordance with the three levels of pressed amounts corresponding to the selected lift positions of the lift plate base 151.

<Valve Unit>

The configuration of the valve unit will be explained in the following with reference to FIGS. 43 to 47.

Figure 43:
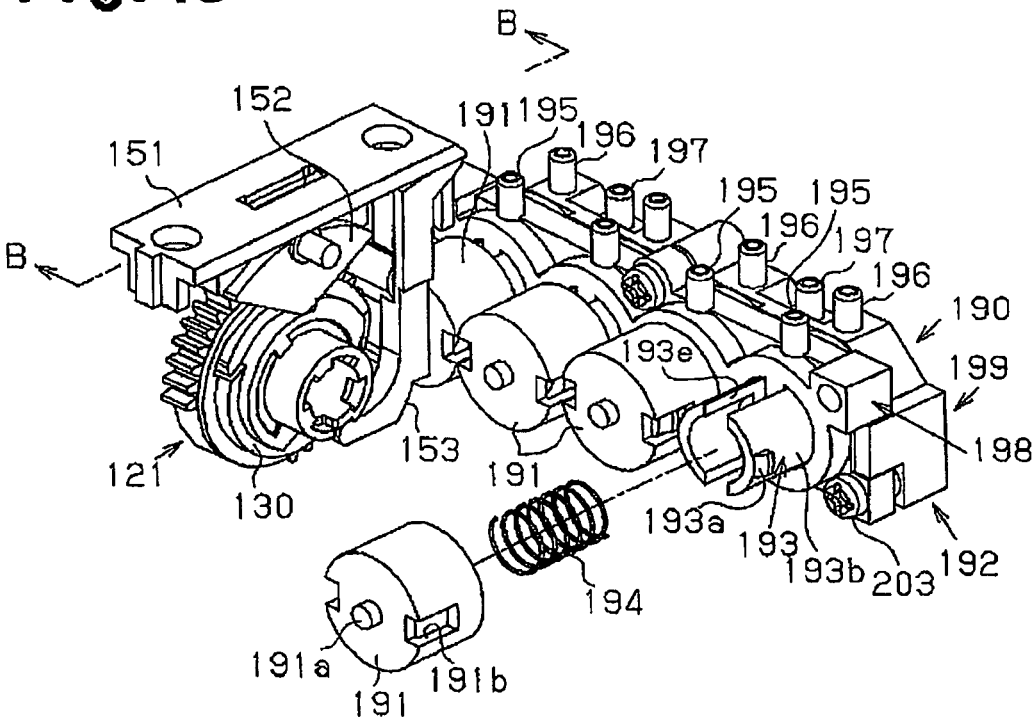
FIG. 43 is a perspective view showing the lift mechanism and a valve unit.
Figure 44:
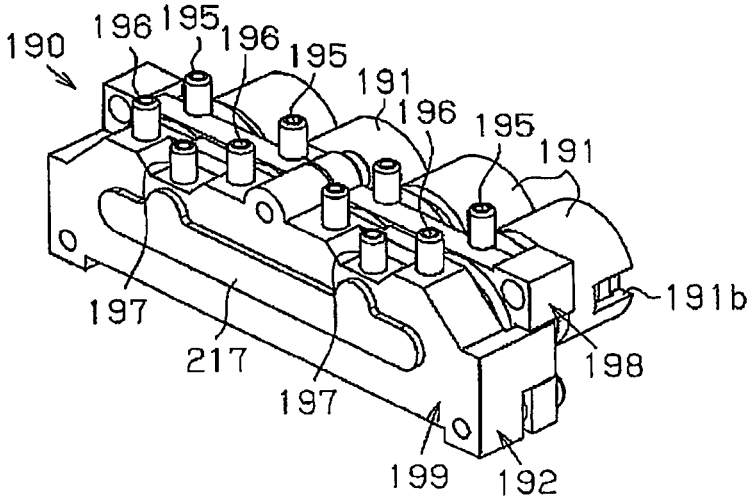
FIG. 44 is a rear perspective view showing the valve unit.

FIG. 43 is a perspective view showing the valve unit, which is illustrated together with the lift mechanism, as viewed from the front. FIG. 44 is a perspective view showing the valve unit as viewed from the rear.

A valve unit body 192 includes an atmospheric air valve body 198 and a suction valve body 199, which are joined together. Four atmospheric air pipes 195 project from the upper surface of the atmospheric air valve body 198. Four suction pipes 196 and two pump pipes 197 project from the upper surface of the suction valve body 199. As shown in FIG. 44, a seal film 217 is deposited on the backside of the valve unit 190 to seal the passages provided in the valve unit 190.

Figure 45:
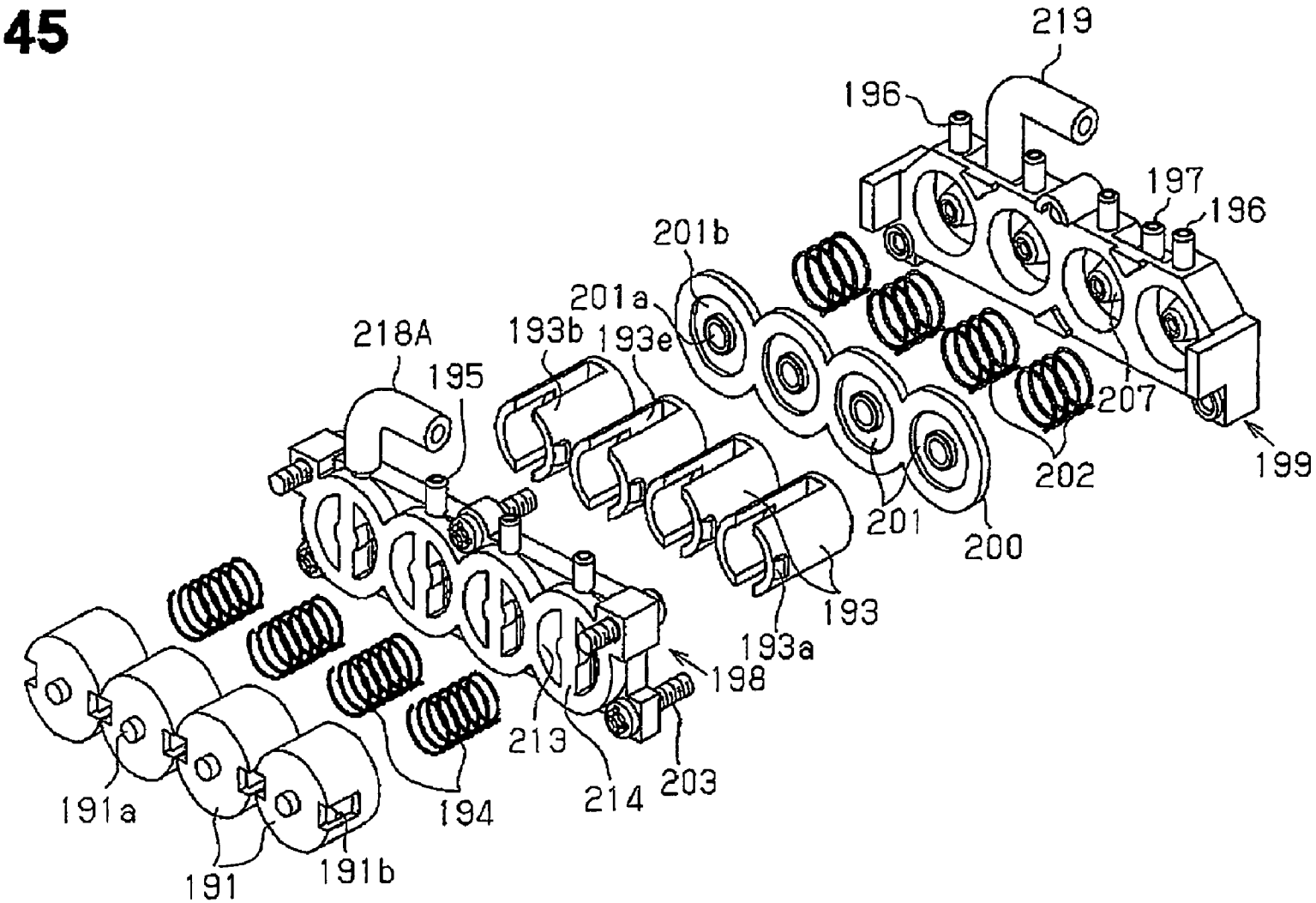
FIG. 45 is an exploded perspective view showing the valve unit.

FIG. 45 is an exploded perspective view showing the valve unit. As shown in FIG. 45, the valve unit 190 has the atmospheric air valve body 198, the suction valve body 199, a multiple type valve plate 200, four valve pressing bodies 193, four valve pressurizing bodies 191, pressurizing springs 194, and atmospheric air blocking valve springs 202. In the valve plate 200, four circular valve body portions 201 are connected together and aligned along a line.

The valve pressing bodies 193, the valve plate 200, and the atmospheric air blocking valve springs 202 are arranged between the atmospheric air valve body 198 and the suction valve body 199 in this order and joined together. In this state, the atmospheric air valve body 198 and the suction valve body 199 are fixed and fastened together by springs 203. The valve pressurizing bodies 191 are secured to the corresponding valve pressing bodies 193, which project from the front surface of the valve unit body 192 in the assembled state, through the pressurizing springs 194. In the valve unit 190 that has been assembled in this manner, four passage valves 204 are defined in the valve unit body 192.

As shown in FIG. 45, each pair of the projections 193*a* is formed integrally with the distal end of the outer circumferential surface of a cylindrical portion 193*b* of the associated one of the valve pressing bodies 193. A slit 193*e* is defined in each of the valve pressing bodies 193 at the position corresponding to a partition 214. Each of the slits 193*e* radially extends through the associated one of the cylindrical portions 193*b* over the range from the end corresponding to the projections 193*a* toward a position in the vicinity of the bottom. This allows insertion of each cylindrical portion 193*b* into a through hole 213 from inside to outside without causing interference between the cylindrical portion 193*b* and the partition 214 referring to FIG. 43.

Each of the valve pressurizing bodies 191 is shaped like a cylinder with a closed bottom. A pillar-like pressurizing shaft 191*a* projects from the center of the end surface of each valve pressurizing body 191. A guide hole 191*b* having a predetermined length is defined axially in the valve pressurizing body 191 at the position corresponding to each of the projections 193*a* of the associated valve pressing body 193. Each valve pressurizing body 191 is inserted into the cylindrical portion 193*b* of the associated valve pressing body 193 with the corresponding pressurizing spring 194 arranged between the valve pressurizing body 191 and the valve pressing body 193. The valve pressurizing body 191 is joined with the valve pressing body 193 with the projections 193*a* of the cylindrical portion 193*b* engaged with and guided by the guide holes 191*b* of the valve pressurizing body 191. This maintains the valve pressurizing body 191 in a state urged by the corresponding pressurizing spring 194 in an axially outward direction (toward the associated valve lever 153). If the valve pressurizing body 191 is pressed in the direction opposite to the direction in which the urging force of the pressurizing spring 194 acts, the projections 193*a* are relatively moved in the guide holes 191*b*. This presses the valve pressurizing body 191 in accordance with a predetermined stroke to change the position of the valve pressurizing body 191.

Figure 46:
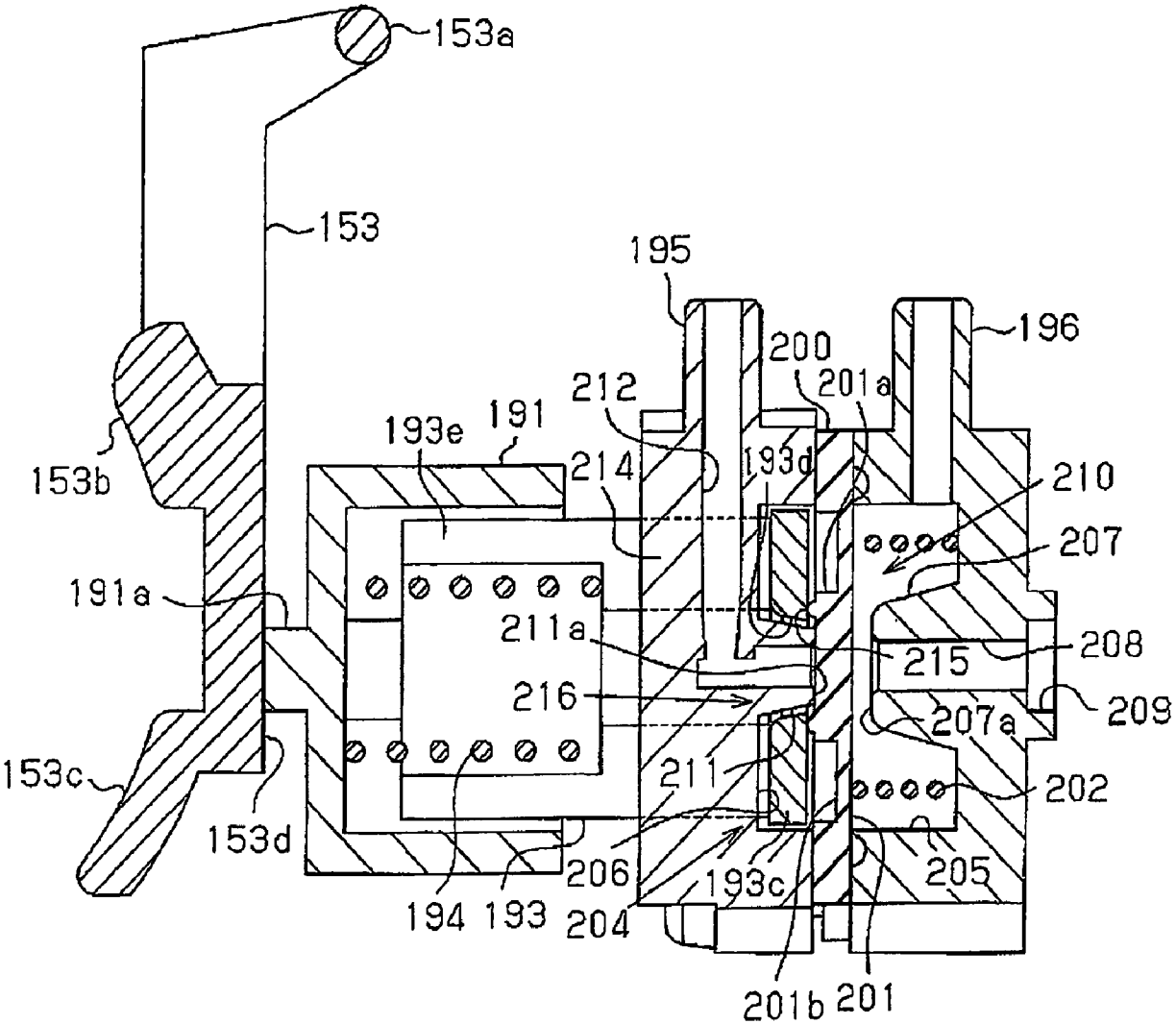
FIG. 46 is a cross-sectional view showing the lift mechanism and the valve unit taken along line B-B of FIG. 43.
Figure 47:
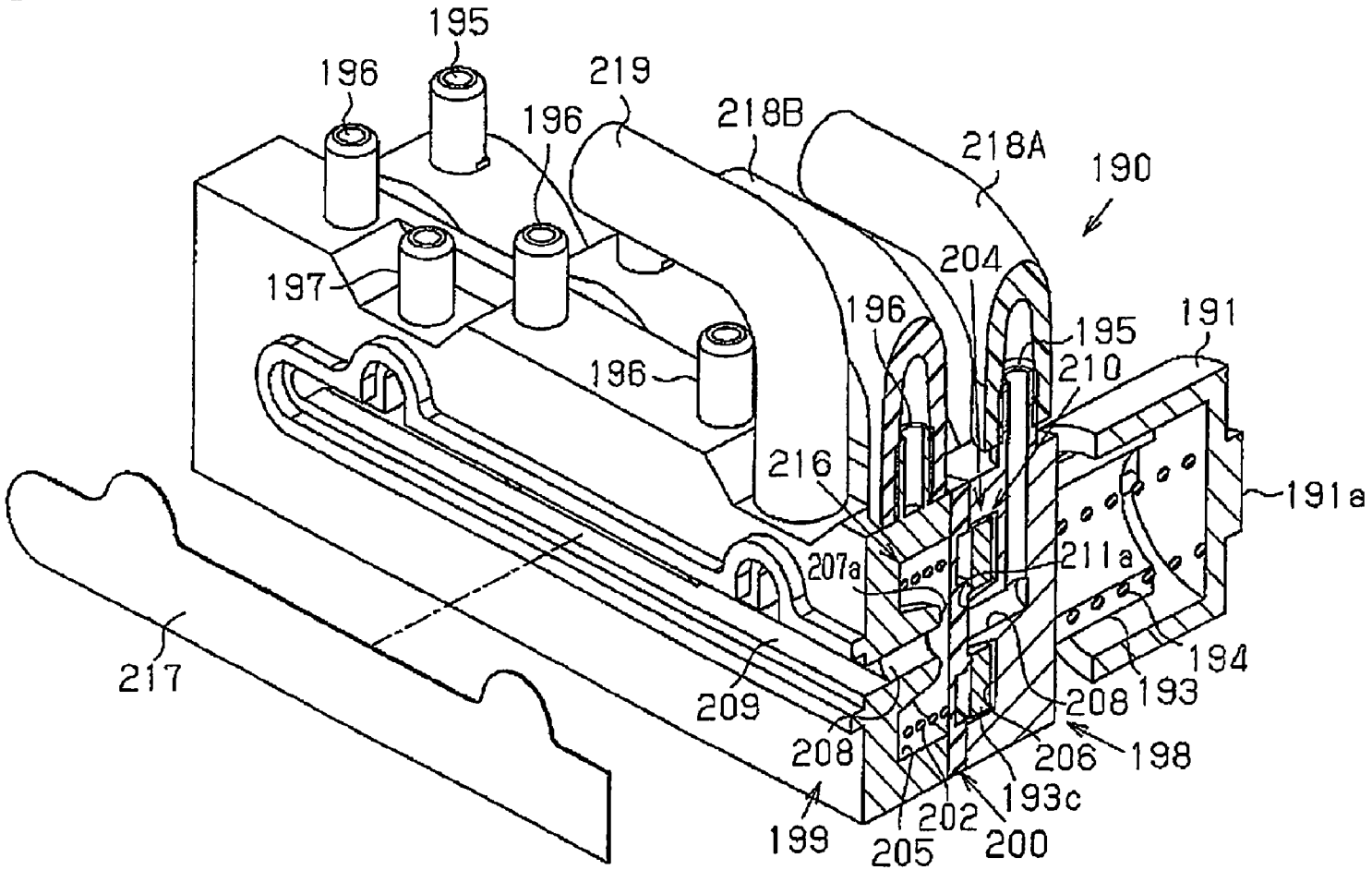
FIG. 47 is a perspective view showing the valve unit as viewed along line B-B of FIG. 43.

FIG. 46 is a cross-sectional view taken along line B-B of FIG. 43. FIG. 47 is a perspective view showing the valve unit as viewed along line B-B of FIG. 43.

As shown in FIG. 46, a suction chamber 205 (a negative pressure chamber) and an atmospheric air chamber 206 are defined in each of the passage valves 204 at the opposing sides of a valve body portion 201, which forms a valve plate 200. The valve body portion 201 has a substantially circular shape. A circumferential portion of the valve body portion 201 that is clamped between the atmospheric air valve body 198 and the suction valve body 199 has increased thickness. A disk-like valve portion 201*a* projects from a central portion of the surface of the valve body portion 201 opposed to the valve pressing body 193. This central portion also has increased thickness. An annular thin portion 201*b* is formed around the valve portion 201*a* in a flexibly deformable film-like manner. Such flexible deformation of the thin portion 201*b* moves the valve portion 201*a* in the direction defined by the thickness while maintaining the disk-like shape of the valve portion 201*a*. The valve plate 200 is formed of elastic material such as elastomer or rubber.

A valve seat portion 207 having a substantially truncated trapezoidal shape projects from the inner surface of the wall of the suction chamber 205 at the backside of the suction valve body 199 toward the valve plate 200. The distal surface of the valve seat portion 207 is a valve seat 207*a*. The valve portion 201*a* can contact and separate from the valve seat 207*a*. A suction passage 208, which has an opening defined at the center of the valve seat 207*a* and extends through the backside of the suction valve body 199, is defined in the suction valve body 199. Four suction passages 208, each of which forms the corresponding one of the passage valves 204, communicate with a common passage 209. The common passage 209 is defined in the backside of the suction valve body 199 and shaped in a linear shape extending in the longitudinal direction of the suction valve body 199. Two pump connecting pipes (hereinafter, referred to as "pump pipes 197") project from the common passage 209 and communicate with the common passage 209. Each of the pump tubes 197 is connected to the corresponding one of two tubes 219 (see FIG. 47), which extend from the suction pump 40. As shown in FIG. 47, the seal film 217 is secured to the backside of the suction valve body 199 to tightly seal the common passage 209 from the exterior. A total of four suction connecting pipes (hereinafter, referred to as "suction pipes 196") project from the upper surface of the suction valve body 199 and communicate with the corresponding suction chambers 205. The tubes 218B (one of which is shown in FIG. 47), which are connected to the suction pipes 196, are connected to the connection pipes 24*d* (shown in FIG. 25) projecting from the backside (the lower surface) of the corresponding caps 24.

Each valve body portion 201 is arranged in such a manner that the atmospheric air blocking valve spring 202, which is accommodated in the associated suction chamber 205 in a compressed state, contacts the thin portion 201*b*. The elastic force of the atmospheric air blocking valve spring 202 urges the valve body portion 201 separately from the valve seat 207*a*. When the valve portion 201*a* is spaced from the valve seat 207*a* (see FIG. 46), the suction passage valve 210, which forms a portion of each passage valve 204, is open. When the valve portion 201*a* tightly contacts the valve seat 207*a* and blocks the opening of the suction passage 208, the suction passage valve 210 is closed.

In each atmospheric air chamber 206, a valve seat portion 211 having a substantially truncated trapezoidal shape projects from the inner surface of the associated suction valve body 199 opposed to the valve seat 207*a* in the suction passage valve 210. A valve seat 211*a* is formed by the distal end surface of the valve seat portion 211. The valve seat portion 211 projects by a length that allows the valve seat 211*a* to tightly contact the valve portion 201*a* when the valve body portion 201 is released from flexible deformation (the state shown in FIG. 46). When the valve portion 201*a* contacts the valve seat 211*a* (the state shown in FIG. 46), the atmospheric air passage valve 216 is closed. When the valve portion 201*a* is pressed by the associated valve pressing body 193 and separated from the valve seat 211*a*, the atmospheric air passage valve 216 is open. An atmospheric air passage 212, which has an opening at the center of the valve seat 211*a* and communicates with the atmospheric air pipe 195, extends through the atmospheric air valve body 198. The tubes 218A (one of which is shown in FIG. 47), which are connected to the atmospheric air pipes 195, are connected to the connection pipes 24*c* (shown in FIG. 25) projecting from the backsides (the lower surfaces) of the corresponding caps 24.

Through holes 213 are defined in the portions of the atmospheric air valve body 198 corresponding to the atmospheric air chambers 206. The through holes 213 are used in joining of the valve pressing bodies 193 with the atmospheric air valve body 198 with the cylindrical portions 193*b* projecting outward from the side corresponding to the atmospheric air chambers 206. The plate-like partition 214, in which the atmospheric air passage 212 is defined, is provided in the portion of each atmospheric air valve body 198 through which the cylindrical portion 193*b* is passed. The partition 214 separates the through hole 213 in the axial direction of the atmospheric air pipe 195 into two portions. The through hole 213 is defined by two semi-circular openings provided at the opposing sides of the partition 214 in such a manner as to avoid the partition 214. The inner diameter of each through hole 213 is slightly greater than the outer diameter of the cylindrical portion 193*b* of each valve pressing body 193.

A through hole 193*d* is defined at the center of a bottom 193*c*, which is the portion of each valve pressing body 193 accommodated in the atmospheric air chamber 206, at the position corresponding to the valve seat portion. The valve seat portion 211 extends through the valve pressing body 193 via the through hole 193*d* and contacts the valve portion 201*a* of the valve body portion 201. The bottom 193*c* of the valve pressing body 193 contacts the outer circumferential portion of the valve portion 201*a* at a bottom portion corresponding to the circumference of the through hole 193*d*. Specifically, a projection 215, which has, for example, an annular shape, projects from the surface of the valve portion 201*a* of the valve body portion 201 in such a manner as to encompass the portion of the valve portion 201*a* with which the valve seat portion 211 is held in contact. The bottom 193*c* of the valve pressing body 193 contacts the projection 215.

Each atmospheric air chamber 206 communicates with the exterior of the valve unit 190 through the space between the walls of the through hole 213 and the cylindrical portion 193*b*. The atmospheric air passage valve 216, which selectively opens and closes the atmospheric air passage 212 through contact and separation between the valve portion 201*a* and the valve seat 211*a*, is defined in the valve unit 190 at the position closer to the atmospheric air chamber 206 with respect to the valve plate 200, as a portion of the passage valve 204. That is, the valve unit 190 includes the suction passage valve 210 and the atmospheric air passage valve 216, which are located at the opposing sides of the common valve plate 200.

In FIG. 46, the valve lever 153 is held in the state in which suction is selected (the state shown in FIG. 41 with the pressed amount maintained at "minimum") and the valve lever 153 is maintained in the vertically upright posture. In this state, the valve lever slightly contacts or presses a pressurizing shaft. At this stage, the urging force of the atmospheric air blocking valve spring 202 is greater than the urging force of the pressurizing spring 194. The valve portion of the valve body portion is thus held in tight contact with the valve seat portion in the atmospheric air chamber. This closes the atmospheric air valve and opens a negative pressure valve.

When the valve lever 153 is maintained in the inclined posture corresponding to idle suction, as shown in FIG. 42, the pressed amount of the valve lever 153 becomes "middle" and the valve pressurizing body 191 is pressed halfway. In this halfway pressed state, the urging force of the pressurizing spring 194 held in a compressed state is slightly greater than the urging force of the atmospheric air blocking valve spring 202. This causes the valve pressing body 193 to press the valve portion 201*a* and slightly separate the valve portion 201*a* from the valve seat 211*a* in the atmospheric air chamber 206. The valve portion 201*a* is thus separated both from the valve seats 207*a*, 211*a* to open the atmospheric air passage valve 216 and the suction passage valve 210.

When the valve lever 153 is held in the inclined state in which suction is not selected, as illustrated in FIG. 40, the pressed amount of the valve lever 153 becomes "maximum" and the valve pressurizing body 191 is fully pressed. In this fully pressed state, the urging force of the pressurizing spring 194 is greater than the urging force of the atmospheric air blocking valve spring 202. This causes the valve pressing body 193 to press the valve portion 201*a*. The valve portion 201*a* is thus separated from the valve seat 211*a* in the atmospheric air chamber 206 and held in tight contact with the valve seat 207*a* in the suction chamber 205. This opens the atmospheric air passage valve 216 and closes the suction passage valve 210.

<Wiping Device>

Next, the wiping device provided in the maintenance device will be explained with reference to FIGS. 48 to 64. The wiping device of the first embodiment has the electric motor 30, the power transmission mechanism 33, the selection unit 110, the wiper drive unit 220, the mounting holder 71, and the head guide unit 90. The selection unit 110 selects the wiper 25 corresponding to the row that is to be wiped. The wiper drive unit 220 drives the wipers 25 to reciprocate. The head guide unit 90 prohibits contact of the wipers 25 with the nozzle forming surfaces 12*a* when the wipers 25 proceed and permits such contact when the wipers 25 return.

The configuration of the wiper drive unit 220 will be first explained.

Figure 48:
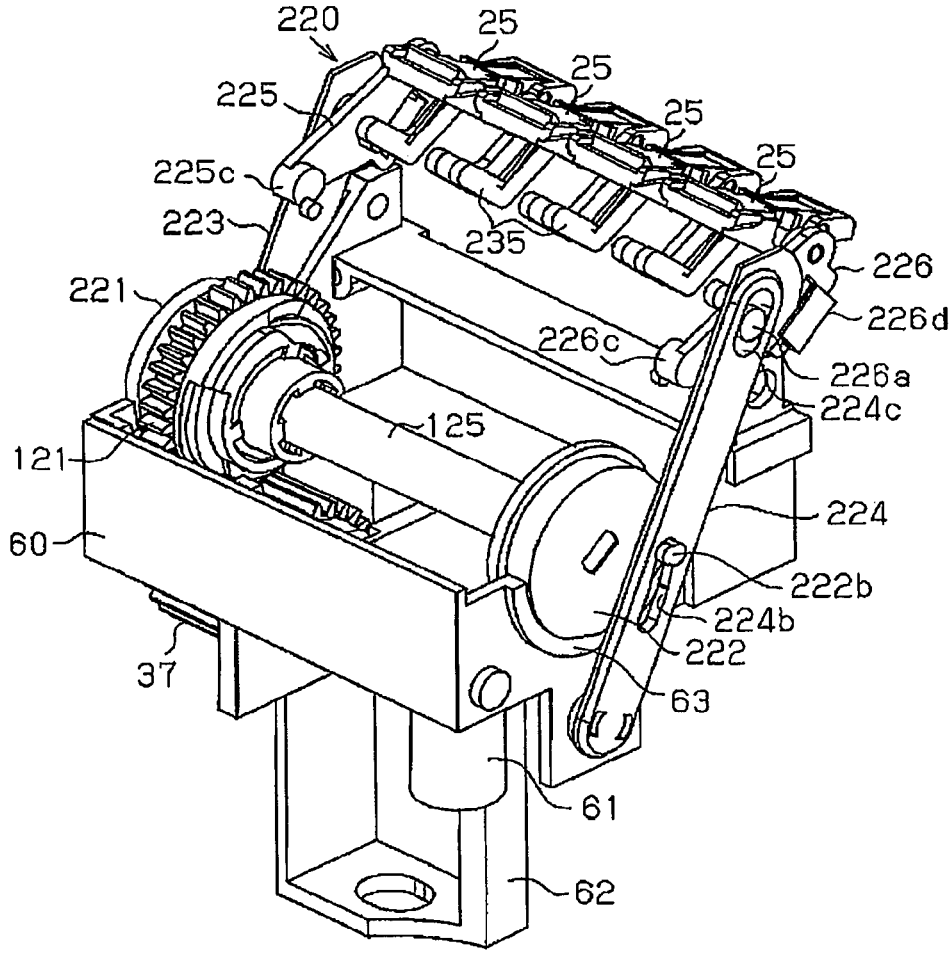
FIG. 48 is a perspective view showing a wiper drive unit joined with a support holder.
Figure 49:
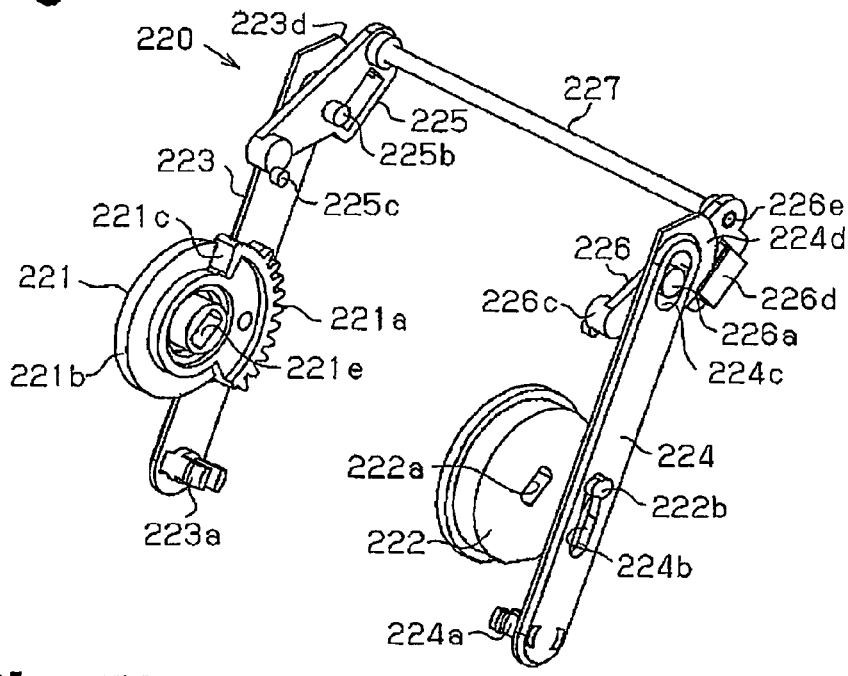
FIG. 49 is a perspective view showing the wiper drive unit without a wiper.
Figure 50:
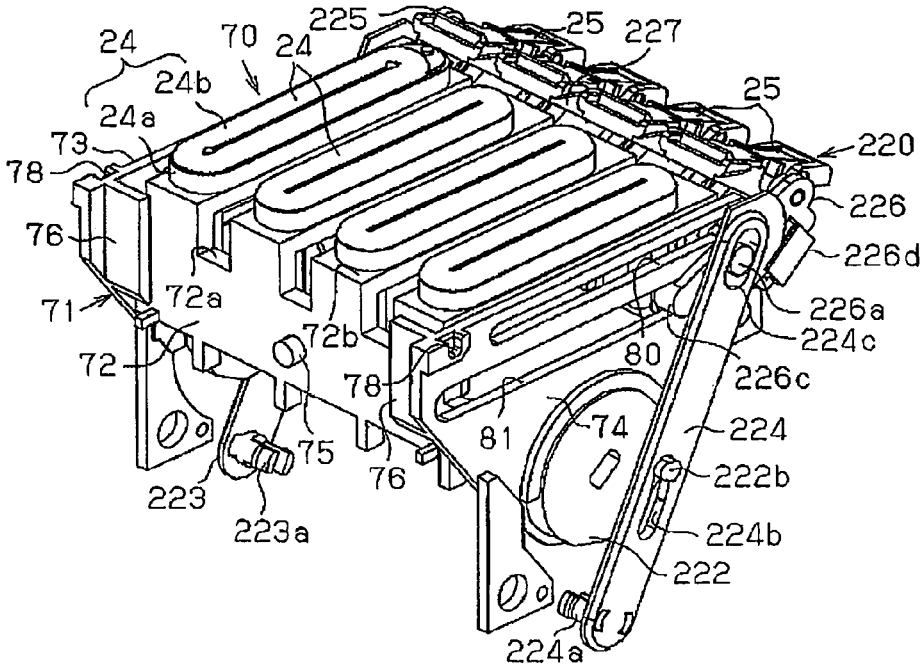
FIG. 50 is a perspective view showing the wiper drive unit joined with a mounting holder.

FIG. 48 is a perspective view showing the wiper drive unit joined with the support holder 60. FIG. 49 is a perspective view showing the wiper drive unit without the wipers. FIG. 50 is a perspective view showing the wiper drive unit joined with the mounting holder.

As shown in FIG. 48, the wiper drive gear 221 and the wiper drive wheel 222, which are fixedly connected to the opposite ends of the selection cam shaft 125, are supported by the support holder 60 slidably in recesses 63 defined in the upper surfaces of the sides of the support holder 60. A projection 221*d* (see FIG. 51) projects from an outer side surface of the wiper drive gear 221 and a projection 222*b* projects from an outer side surface of the wiper drive wheel 222. A pair of left and right wiper drive levers 223, 224 are provided. An elongated hole 223*b* is defined in the wiper drive lever 223 at a position slightly lower than the longitudinal center of the wiper drive lever 223. An elongated hole 224*b* is defined in the wiper drive lever 224 at a position slightly lower than the longitudinal center of the wiper drive lever 224. The projection 221*d* and the projection 222*b* are engaged with the elongated hole 223*b* and the elongated hole 224*b*, respectively. Each of the wiper drive levers 223, 224 is joined with the support holder 60 with the lower end of the wiper drive lever 223, 224 pivotally supported by the lower end of the corresponding one of the left and right side surfaces of the support holder 60 through a shaft. Through pivoting reciprocation of the wiper drive gear 221 and that of the wiper drive wheel 222, the wiper drive lever 223 and the wiper drive lever 224, respectively, are each pivoted about the lower end of the wiper drive lever 223, 224 in accordance with a cycle of reciprocation. An elongated hole 223*c* and an elongated hole 224*c* are defined in the distal end of the wiper drive lever 223 and the distal end of the wiper drive lever 224, respectively. A pair of left and right wiper drive cam bodies 225, 226 are provided. The wiper drive cam body 225 and the wiper drive cam body 226 are engaged with the elongated hole 223*c* and the elongated hole 224*c*, respectively. The four wipers 25 are connected together and coaxially aligned between the wiper drive cam bodies 225, 226. Each of the wiper drive cam bodies 225, 226 is connected to the corresponding one of the wiper drive levers 223, 224 in a manner relatively movable in the longitudinal direction of the wiper drive lever 223, 224 and pivotal about the projection 225*a*, 226*a* in the range in which the projection 225*a*, 226*a* are allowed to move in the elongated hole 223*c*, 224*c* along the longitudinal direction of the elongated hole 223*c*, 224*c*. Thus, as the wiper drive levers 223, 224 are pivoted in accordance with a cycle of reciprocation, the wipers 25 are reciprocated in the extending direction of each nozzle row.

The wiper drive gear 221 has a tooth portion 221*a* (see FIG. 49) engageable with the intermediate selection gear 37. However, when the selection cam 121 is engaged with the intermediate selection gear 37, the tooth portion 221*a* is prevented from becoming engaged with the intermediate selection gear 37 except for a short period of time at the final stage of engagement between the selection cam 121 and the intermediate selection gear 37. That is, when selecting operation is performed by the selection cams 121 to 124, the wipers 25 are prevented from operating. A rotation transmitting projection 121*a* (shown in FIGS. 15 and 52) projects from a side surface of the selection cam 121. A receiving surface 221*c* for transmission of wiper rotation is formed on a circumferential end surface of the wiper drive gear 221. After all of the cam followers to be selected are arranged on the wiper cam surfaces, the selection cam 121 is rotated further in the reverse direction. This causes the projection 121*a* to contact and press an end of the receiving surface 221*c* at a point in time immediately before the toothless portion of the selection cam 121 prohibits engagement between the selection cam 121 and the intermediate selection gear 37. Thus, the tooth portion 221*a* of the wiper drive gear 221, which has been maintained in a disengaged state, becomes engaged with the intermediate selection gear 37. That is, the selection cam 121 is disengaged from the intermediate selection gear 37 and stopped. Then, reverse rotation of the wiper drive gear 221 is started to carry out wiping. In such wiping, the selection cams 121 to 124 are maintained in stopped states and the selection cam shaft 125 and the wiper drive gear 221 and the wiper drive wheel 222, which are connected to the opposite ends of the selection cam shaft 125, are pivoted in accordance with a cycle of rotation to cover a predetermined angular range (of, for example, 120 degrees).

As shown in FIG. 49, the wiper drive gear 221 includes a cylindrical portion 221*b* and the tooth portion 221*a*, which is a sector gear. The wiper drive gear 221 is slidably supported by the corresponding recess 63 at the cylindrical portion 221*b*. The wiper drive wheel 222, which has a cylindrical shape, is supported slidably by the corresponding recess 63 at the outer circumferential surface of the wiper drive wheel 222. An engagement pin 223*a* and an engagement pin 224*a* project from the lower end of the wiper drive lever 223 and the lower end of the wiper drive lever 224, respectively. The engagement pins 223*a*, 224*a* are engaged with recesses defined in the lower ends of the side surfaces of the support holder 60. This allows the wiper drive levers 223, 224 to pivot about the engagement pins 223*a*, 224*a*.

An arcuate guide plate portion 223*d* and an arcuate guide plate portion 224*d* extend from the distal end of the wiper drive lever 223 and the distal end of the wiper drive lever 224, respectively. A guide extended portion 225*d* (shown in FIG. 52) and a guide extended portion 226*d*, each of which has an L-shaped cross section, extend from the outer side surface of the wiper drive cam body 225 and the outer side surface of the wiper drive cam body 226, respectively. The guide plate portion 223*d* and the guide plate portion 224*d* are received in a recess defined in the guide extended portion 225*d* and a recess defined in the guide extended portion 226*d*, respectively. Each of the wiper drive cam bodies 225, 226 pivots about the projection 225*a*, 225*a*, which is received in the corresponding elongated hole 223*c*, 224*c*. In this state, the guide extended portions 225*d*, 226*d* are guided by the corresponding guide plate portions 223*d*, 224*d* and thus pivoted.

The wiper drive gear 221 has the cylindrical portion 221*b*, which slides on the inner surface of each recess 63, or a receiving surface of the support holder 60. The wiper drive gear 221 also has the tooth portion 221*a*, which is formed by the sector gear formed integrally with the cylindrical portion 221*b* and located adjacently to a side surface (an inner side surface) of the cylindrical portion 221*b*. The tooth portion 221*a* has an arcuate shape and extends in the range of approximately 120 degrees. One of the end surfaces of the arcuate tooth portion is the receiving surface 221*c* used in transmission of rotation. Specifically, after idle suction is completed, reverse rotation of the selection cam set 135 is started. At a point in time immediately before the selection cam set 135 is stopped, the receiving surface 221*c* that transmits the drive force of the wiper drive gear 221 is pressed by the projection 121*a* that transmits the drive force of the first selection cam 121. This causes engagement between the tooth portion 221*a* and the intermediate selection gear 37 to resume the reverse rotation of the wiper drive gear 221, which has been maintained in a stopped state.

Figure 51A:
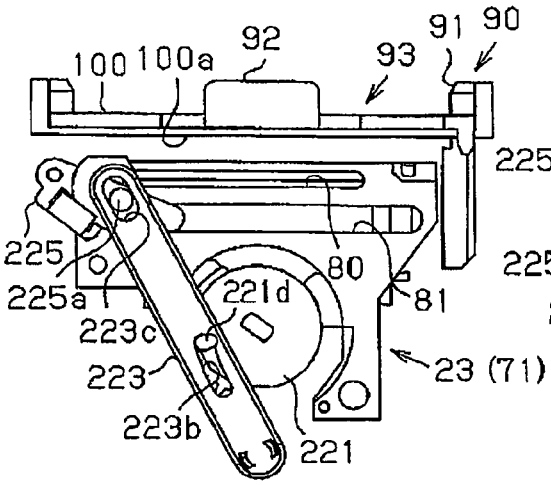
FIGS. 51A to 51D are side views each explaining operation of the wiper drive unit.
Figure 51B:
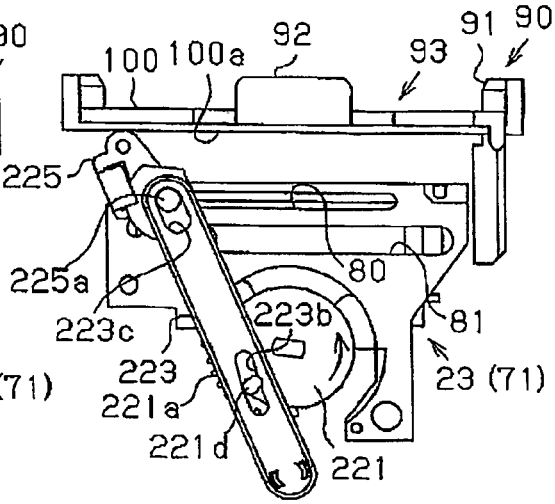
Figure 51C:
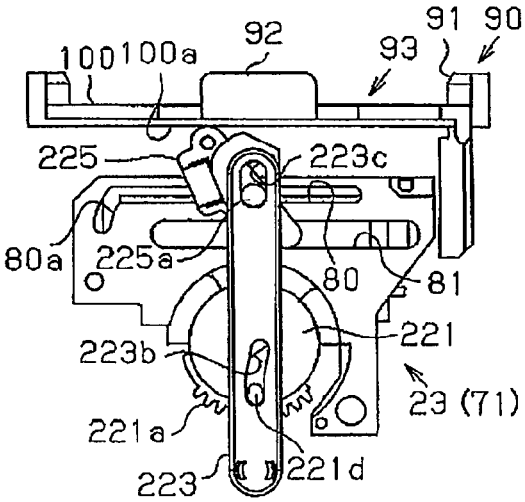

As shown in FIGS. 49 and 50, the first guide holes 80 and the second guide holes 81, which extend parallel with the longitudinal direction of each cap 24, are defined at the positions closer to the upper ends of the left and right side frames 73, 74. Each of the first guide holes 80 receives a first guide shaft 225*b* of the corresponding one of the wiper drive cam bodies 225, 226 and each of the second guide holes 81 receives a second guide shaft 225*c*, 226*c* of the corresponding one of the wiper drive cam bodies 225, 226. The first guide shaft 225*b* and the second guide shafts 225*c*, 226*c* project from the side surfaces of the corresponding wiper drive cam bodies 225, 226 opposed to the side frames 73, 74. The first guide shaft 225*b* is located at the longitudinal center of the wiper drive cam body 225. The second guide shafts 225*c*, 226*c* are arranged at the ends of the corresponding wiper drive cam bodies 225, 226 opposed to a wiper drive shaft 227. Although the first guide shaft of the wiper drive cam body 226 is not shown in FIG. 49 or 50, the first guide shaft of the wiper drive cam body 226 projects from the side surface of the wiper drive cam body 226 opposed to the side frame 74 at the position opposed to the first guide shaft 225*b* of the wiper drive cam body 225. The interval between the first guide shaft 225*b* and the corresponding one of the second guide shafts 225*c*, 226*c* is greater than the interval between each first guide hole 80 and the associated second guide hole 81. Thus, the wiper drive cam bodies 225, 226 are guided by the first and second guide holes 80, 81 and move while maintaining constant postures inclined at a predetermined angle illustrated in FIG. 50. As illustrated in FIG. 51C, an inclined hole 80*a* is defined in each of the first guide holes 80 by the end of the first guide hole 80 that is located at the backside and bent downward. When the wiper drive cam bodies 225, 226 are guided by the inclined holes 80*a*, only the first guide shaft 225*b* of the wiper drive cam bodies 225 are lowered. This inclines the postures of the wiper drive cam bodies 225, 226 in such a manner as to lower the distal ends of the wiper drive cam bodies 225, 226.

Figure 54:
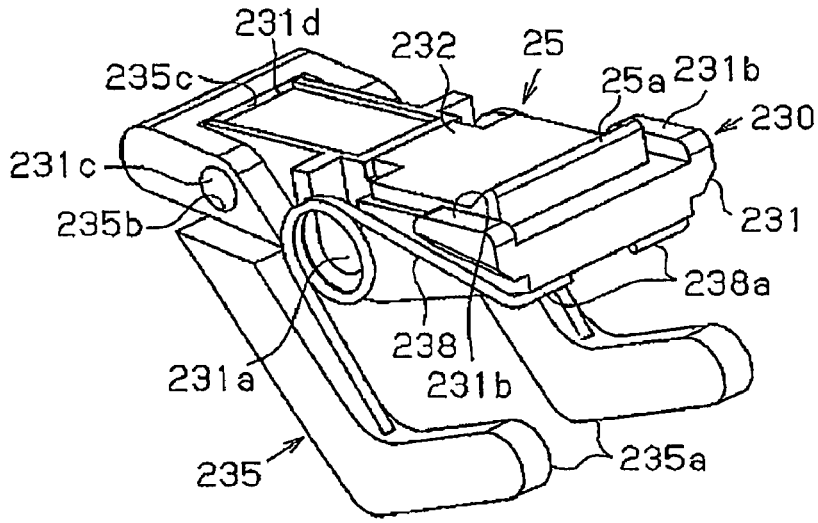
FIG. 54 is a perspective view showing the wiper.
Figure 55:
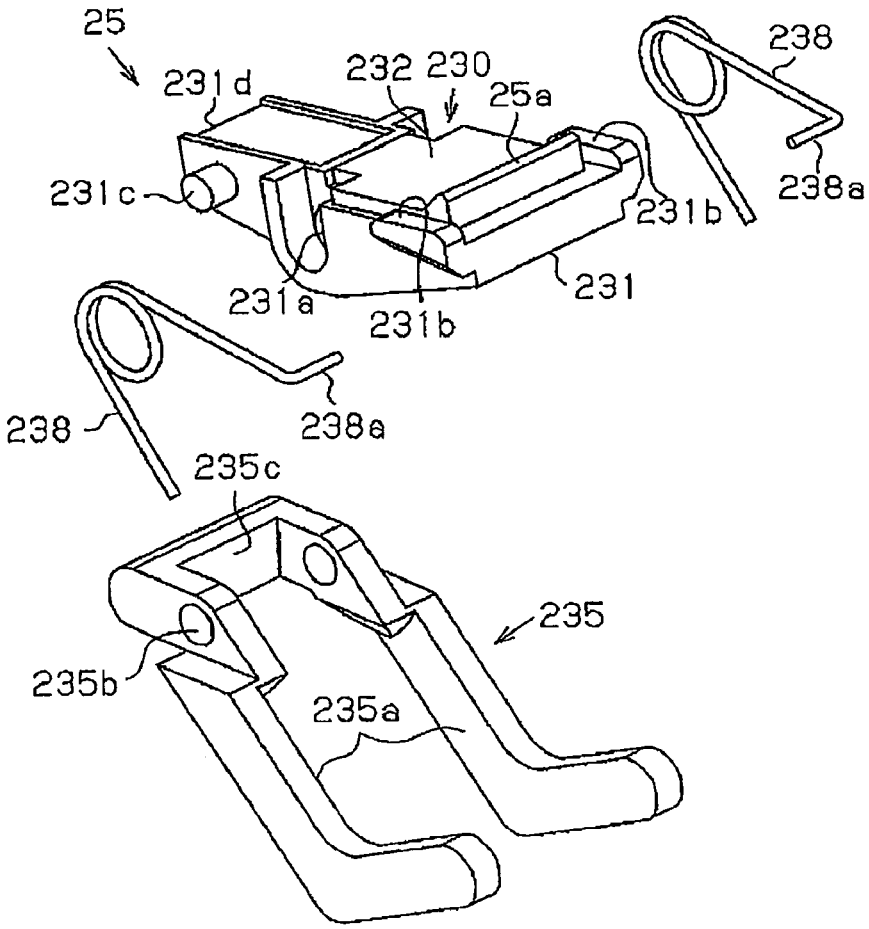
FIG. 55 is an exploded perspective view showing the wiper.

FIG. 54 is a perspective view showing each wiper, and FIG. 55 is an exploded perspective view showing the wiper.

Each wiper 25 includes a wiper body 230, a wiper stopping lever 235, and a wiper pressing spring 238, or an urging member. The wiper body 230 includes a wiper base material 231 formed of resin and a wiper member 232 formed of elastic material. The wiper member 232 is secured to a predetermined area of the upper surface of the wiper base material 231 near the distal end of the wiper base material 231. As the material of the wiper member 232, elastic material such as elastomer or rubber is used. In the first embodiment, the wiper member 232 is formed of elastomer and in two colors together with the resin forming the wiper base material 231. A blade 25*a* projects from the distal end of the wiper member 232. The wiper body 230 has a pair of guided portions 231*b* located at the opposite ends of the blade 25*a* in the direction defined by the width of the blade 25*a*. When the wiper 25 proceeds, the guided portions 231*b* contact the lower surface of the wiper guide 93, which forms the head guide unit 90.

A pair of pillar-like pins 231*c* project from the proximal side surfaces of the wiper body 230. The pins 231*c* are engaged with a pair of holes 235*b*, which are defined in the portions of the wiper stopping lever 235 corresponding to the point of support. A shaft hole 231*a* for the wiper drive shaft is defined substantially at the longitudinal center of the wiper body 230. The shaft hole 231*a* extends through the opposing side surfaces of the wiper body 230. The wiper drive shaft 227 is passed through the shaft hole 231*a*.

Two wiper pressing springs 238 are secured to the opposing sides of the wiper body 230. Each of the wiper pressing springs 238 is a torsion coil spring. An end of each wiper pressing spring 238 is bent substantially perpendicularly to form a hook portion 238*a*. The hook portion 238*a* is secured by the backside of the distal end of the wiper body 230. The opposite end of the wiper pressing spring 238 is held in contact with and secured by the upper surface of a lever portions 235*a* of the wiper stopping lever 235. The wiper body 230 and the wiper stopping lever 235 are urged by the urging force of the wiper pressing springs 238 to separate from each other about the position corresponding to the pins 231*c*, or the points of support. When the opening angle between the wiper body 230 and the wiper stopping lever 235 reaches a predetermined value, a contact surface 231*d* of the wiper body 230 and a contact surface 235*c* of the wiper stopping lever 235 contact each other. This restricts the upper limit of this opening angle to the predetermined angle illustrated in FIG. 54.

The lock mechanism 170 operates in such a manner that the descending amount of the cleaning mechanism 22 by which the cleaning mechanism 22 is lowered to the lowered position after completion of suction cleaning becomes a constant distance determined by subtracting the restoring amount of the linear spring 98 from the descending amount of the cleaning mechanism 22. As a result, the relationship between the positions of each nozzle forming surface 12*a* and the associated lift plate base 151 in the direction defined by the height is maintained substantially constant regardless of variation of the platen gap. This also maintains the contact pressure of each wiper 25 under which the wiper 25 contacts the nozzle forming surface 12*a* substantially at a constant level.

Figure 52:
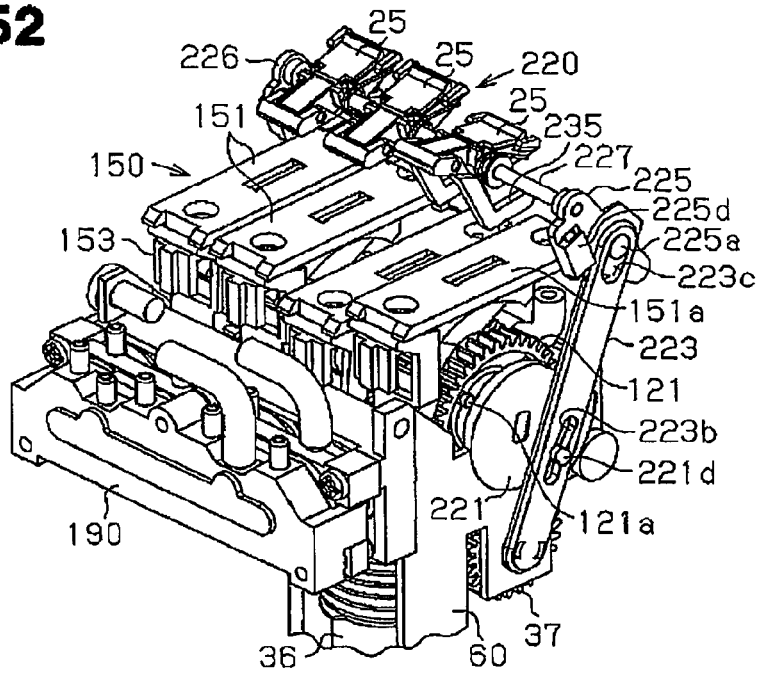
FIG. 52 is a perspective view showing the lift unit and the wiper drive unit as viewed from the rear.
Figure 53:
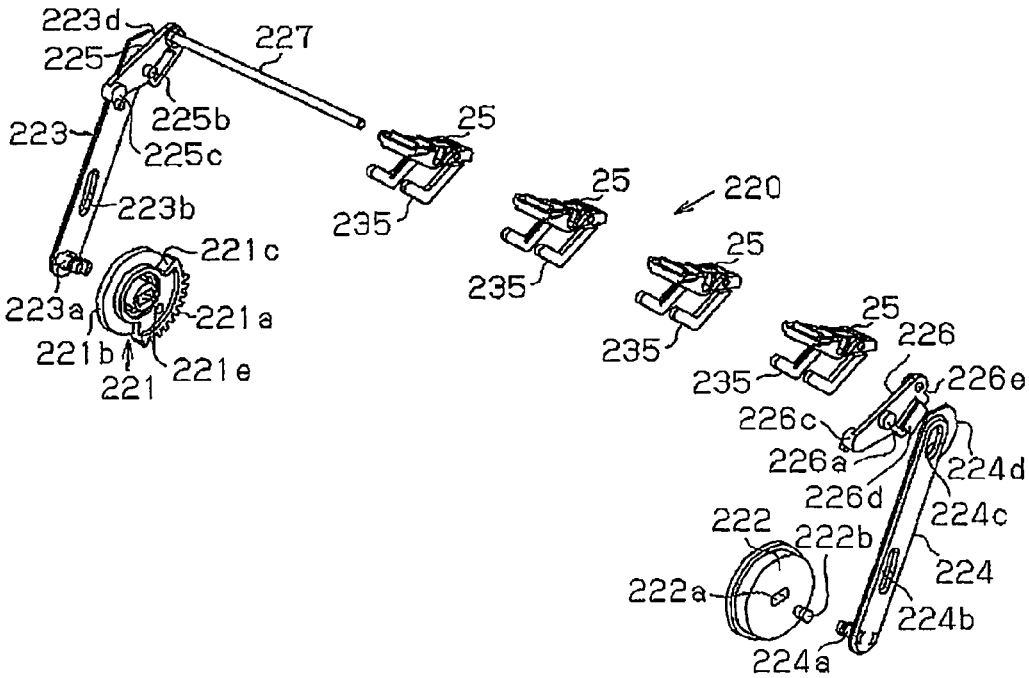
FIG. 53 is an exploded perspective view showing the wiper drive unit.

FIG. 52 is a perspective view showing the lift unit and the wiper drive unit as viewed from the rear. FIG. 53 is an exploded perspective view showing the wiper drive unit. The wiper drive shaft 227, which extends between the distal ends of the wiper drive levers 223, 224, moves parallel with a base surface 151*a* (and the nozzle forming surface 12*a*) at a position above each lift plate base 151. The four wipers 25 are supported with the wiper drive shaft 227 are passed through the wipers 25. The wipers 25 are allowed to pivot about the wiper drive shaft 227. Each wiper 25 has a pair of lever portions 235*a*, which extend downward from the proximal end of the wiper 25. The lever portions 235*a* of each wiper 25 are passed through the slits 72*a*, which are defined at the opposing sides of the associated cap 24, and received in the mounting holder 71. Thus, as shown in FIG. 52, the lever portions 235*a* are arranged to be opposed to the base surface 151*a* of the associated lift plate base 151. As illustrated in FIG. 52, the lift plate base 151 associated with each of the wipers 25 corresponding to the rows selected for suction is raised. In this state, the lever portions 235*a* of these wipers 25 contact the associated base surfaces 151*a* and receive the force acting in an upward direction. This pivots the lever portions 235*a* about the wiper drive shaft 227 and switches the posture of each of the wipers 25 to the upright posture in which the distal end of the wiper 25 from which the blade 25*a* projects is located upward. Contrastingly, the lift plate base 151 associated with the wiper 25 corresponding to a non-selected row is maintained in a lowered state. The lever portions 235*a* of this wiper 25 are thus separate from or held in contact with the associated base surface 151*a*. The wiper 25 is thus held in a horizontal posture or a posture in which the distal end of the wiper 25 is inclined.

The wiper drive shaft 227 is formed integrally with one of the wiper drive cam bodies, or the wiper drive cam body 225. The wiper drive shaft 227 extends perpendicularly from the distal end of the wiper drive cam body 225 and has a length that allows the wiper drive shaft 227 to pass through and support the four wipers 25. A shaft hole 226*e* through which the wiper drive shaft 227 is passed is defined in the distal end of the other one of the wiper drive cam bodies, or the wiper drive cam body 226. The left and right wiper drive cam bodies 225, 226, which form a pair, are mirror images in shape except for the portions corresponding to the wiper drive shaft 227. Also, the left and right wiper drive levers 223, 224 are mirror images in shape.

<Head Guide Unit>

Figure 56A:
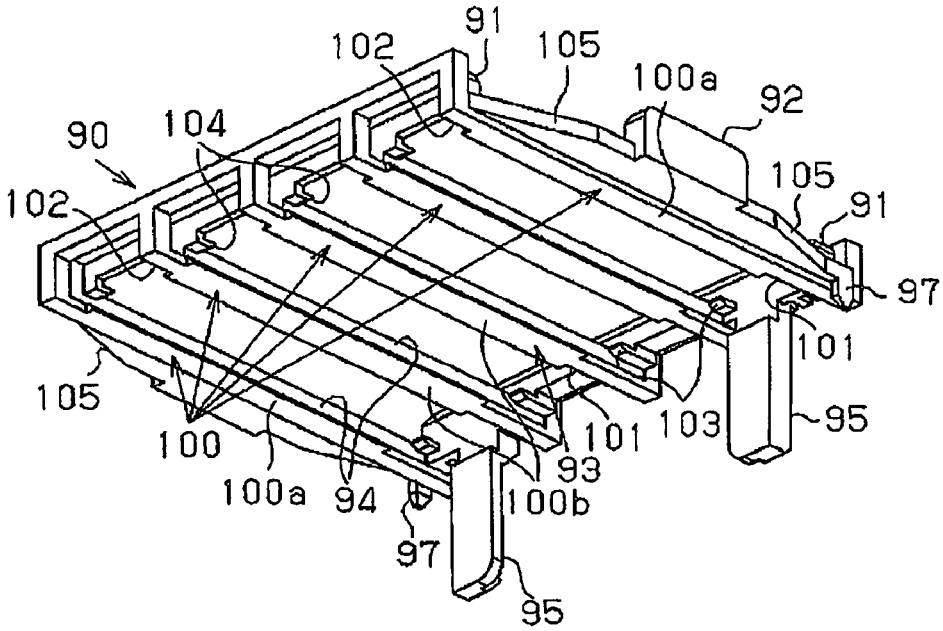
FIGS. 56A and 56B are perspective views each showing the head guide unit.
Figure 56B:
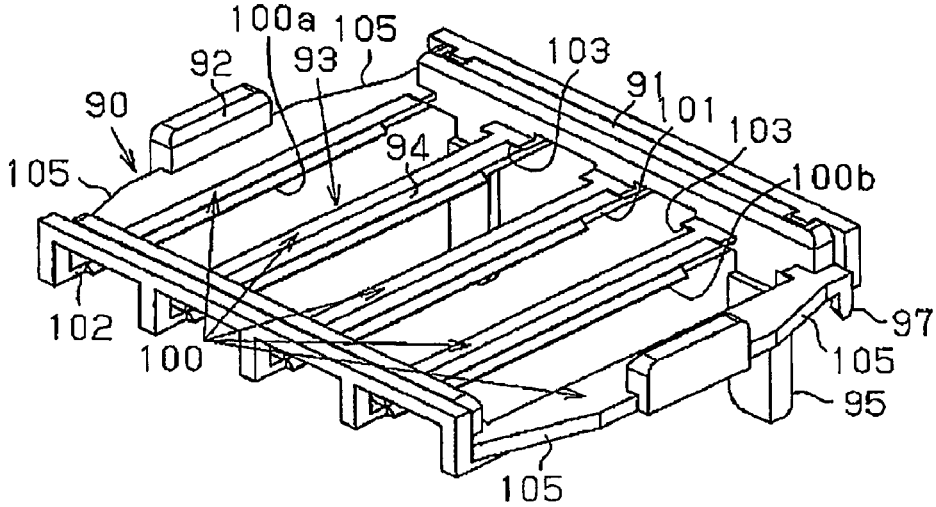

The structure of the head guide unit, which forms a portion of the wiping device, will be explained in the following. FIG. 56 shows the head guide unit. Specifically, FIG. 56A is a perspective view showing the head guide unit as viewed from below and FIG. 56B is a perspective view showing the head guide unit as viewed from above. The wiper guide 93, which is shaped like a rectangular grid-like plate, is joined integrally with the head guide unit 90.

The head guide unit 90 has the wiper guide 93 shaped as the rectangular grid-like plate. The wiper guide 93 has five wiper guide portions 100, which form a grid-like shape and extend parallel with the longitudinal direction of each of the openings 94 at the opposing sides of the openings 94. The portion of each of the wiper guide portions 100 except for the opposing longitudinal ends has an increased width. The width of the narrow portion of each opening 94 located between the corresponding wiper guide portions 100 with the increased width is slightly greater than the opening size that permits projection and retraction of the associated cap 24 through the opening 94, or the width of each base plate portion 72*b* (shown in FIG. 50) to which the cap 24 is fixed, and smaller than the maximal width of the distal end of each wiper 25, or the width of the guided portion 231*b* of the wiper 25. The width of the narrow portion of each opening 94 is greater than the width of each wiper blade 25*a*. The width of each opening 94 is increased at the opposing longitudinal ends of the associated wiper guide portions 100. The portions corresponding to such increased width are openings 101, 102. The width of each of the openings 101, 102 is slightly greater than the maximal width of the distal end of each wiper 25. A wiper restricting surface 100*a* and a wiper restricting surface 100*b* are arranged at the opposing sides of each opening 94. The guided portions 231*b* of each wiper 25 contact the wiper restricting surfaces 100*a*, 100*b* and are thus restricted from further rising. The wiper restricting surfaces 100*a* that are the lower surfaces of the two of the five wiper guide portions 100 located at the opposite ends function also as contact surfaces through which the wiper drive cam body 225 (226) raises the head guide unit 90 when wiping is performed, as illustrated in FIG. 51.

As will be described later, each wiper 25 moves below the associated wiper guide portion 100 when proceeding. At this stage, the guided portions 231*b* of the wiper 25 contact the lower surface of the wiper guide portion 100 and are restricted from rising. The lower surface of the wiper guide portion 100 thus operates as a wiper restricting surface. The lower surfaces of the two of the five wiper guide portions 100 that are located at the opposite ends are referred to as the wiper restricting surfaces 100*a*. The lower surfaces of the remaining three wiper guide portions 100 will be referred to as wiper restricting surfaces 100*b*. As long as the wiper 25 contacts the wiper restricting surface, the blade 25*a* is prevented from contacting the nozzle forming surface 12*a*. Thus, when the wiper 25 proceeds, wiping of the nozzle forming surface 12*a* does not occur. However, as the wiper 25 is raised from the retreat position while being guided by the inclined hole 80*a* and then proceeds while being guided by a horizontal hole 80*b*, the wiper 25 corresponding to the nozzle row selected for suction in returning of the wiper moves above the wiper guide portion 100.

Each opening 101 corresponds to the position at which the associated wiper 25 is located when the wiper 25 starts movement along the return path. Each opening 102 corresponds to the position at which the wiper 25 is located when the wiper 25 finished the movement along the return path. When starting the movement along the return path, each wiper 25 moves the distal end of the wiper 25 through the opening 101 to a position above the wiper guide portion 100 so that the distal end of the wiper 25 is raised to the position at which the distal end can contact the associated nozzle forming surface 12*a*. Once the guide portions 231*b* are raised through the opening 101, the guide portions 231*b* are allowed to move along the return path while maintained above the wiper guide portion 100. When finishing the movement along the return path, the wiper 25 moves the guided portions 231*b* through the opening 102 to a position below the wiper guide portion 100. Thus, only when the wiper 25 is moved along the return path, the wiper 25 is allowed to wipe the nozzle forming surface 12*a*.

Figure 57A:
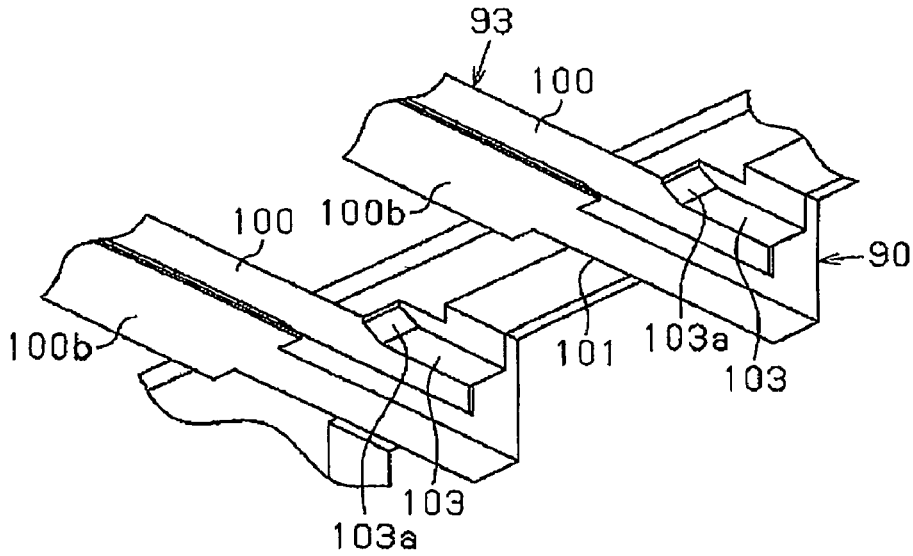
FIGS. 57A and 57B are perspective views each showing a main portion of the head guide unit.
Figure 57B:
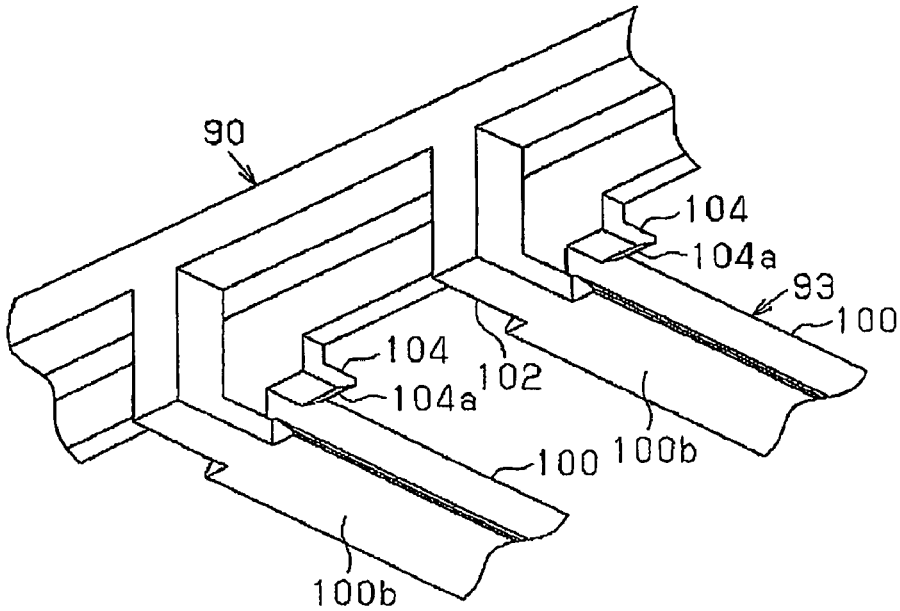

FIG. 57 shows the opposite ends of the wiper guide portion. Specifically, FIG. 57A is a perspective view showing a main portion of the wiper guide portion in the vicinity of a returning start point of the wiper. FIG. 57B is a perspective view showing a main portion of the wiper guide portion in the vicinity of a returning end point of the wiper.

At the opposing longitudinal ends of the wiper guide portions 100, first restricting portions 103 are formed at the positions corresponding to the openings 101 and second restricting portions 104 are arranged at the positions corresponding to the openings 102. The first restricting portions 103 and the second restricting portions 104 are located slightly upward from the wiper restricting surfaces 100*a*, 199*b*. The first restricting portions 103 and the second restricting portions 104 are provided in pairs in correspondence with the associated openings 101, 102 (only one pair is shown in FIG. 57A). The lower surface of each first restricting portion 103 and the lower surface of each second restricting portion 104 are shaped as an inclined surface ascending inwardly. The interval between each pair of the first restricting portions 103 and the corresponding pair of the second restricting portions 104 is smaller than the width of each guided portions 231*b* of the wiper 25.

Thus, when the guide portions 231*b*, which have been restricted by the wiper restricting surfaces 100*a*, 100*b*, or the lower surfaces of the associated wiper guide portion 100, are raised through the opening 101, the guided portions 231*b* contact the first restricting portions 103 and are thus temporarily restricted from further rising. In this state, the blade 25*a* is prevented from contacting the nozzle forming surface. If the wiper 25 becomes upright in the vicinity of the first restricting portion 103 and the blade 25*a* contacts the nozzle forming surface 12*a* of the recording head 12, the blade 25*a* is damaged. If the wiper 25 becomes upright in such a manner that the blade 25*a* is located beside the recording head 12 without contacting the nozzle forming surface 12*a*, the blade 25*a* may contact the edge of the recording head 12 when contacting the nozzle forming surface 12*a* to perform wiping and thus be damaged. In these cases, wiping performance of the wiper 25 is lowered. To solve this problem, when movement of the wiper 25 along the return path is started, the position of the wiper 25 is temporarily restricted. In this state, the wiper 25 is raised slightly and moved along an inclined surface 103*a* to allow the blade 25*a* to gradually come into contact with the nozzle forming surface 12*a*. When the guided portions 231*b* of the wiper 25 move along the inclined surface 103*a*, the blade 25*a* is located not at the position beside the recording head 12 but at the position at which the blade 25*a* contacts the nozzle forming surface 12*a*. This prevents contact between the blade 25*a* and the edge of the recording head 12, making it unnecessary to provide a member that covers the edge of the recording head 12.

After having been temporarily restricted by the first restricting portions 103, the wiper 25 is moved along the returning direction. In such movement, the guided portions 231*b* of the wiper 25 are gradually raised along the inclined surfaces 103*a* of the first restricting portions 103. Immediately after or before the guided portions 231*b* are released from the inclined surfaces 103*a*, the blade 25*a* is allowed to contact the nozzle forming surface 12*a*. This prevents damage to the blade 25*a* caused by rapid contact between the blade 25*a* and the nozzle forming surface 12*a*. Further, since the blade 25*a* contacts the nozzle forming surface 12*a* without being located beside the recording head 12, the blade 25*a* is prevented from hitting the edge of the recording head 12.

When the movement of the wiper 25 along the return path is finished, the guided portions 231*b* of the wiper 25 contact inclined surfaces 104*a* of the second restricting portions 104. Thus, while being slidably guided by the inclined surfaces 104*a*, the wiper 25 pass through the opening 102 and retreat downward. The position of each second restricting portion 104 is set in such a manner that, after wiping of the corresponding nozzle row 13 is completed, the blade 25*a* of the wiper 25 separates from the nozzle forming surface 12*a* immediately before reaching the edge of the recording head 12. Thus, the blade 25*a*, which has been elastically deformed by contacting the nozzle forming surface 12*a* under a predetermined contact pressure, is released from such elastic deformation by the edge of the recording head 12. Splashing of the ink wiped off by the wiper 25 is thus avoided.

Figure 58:
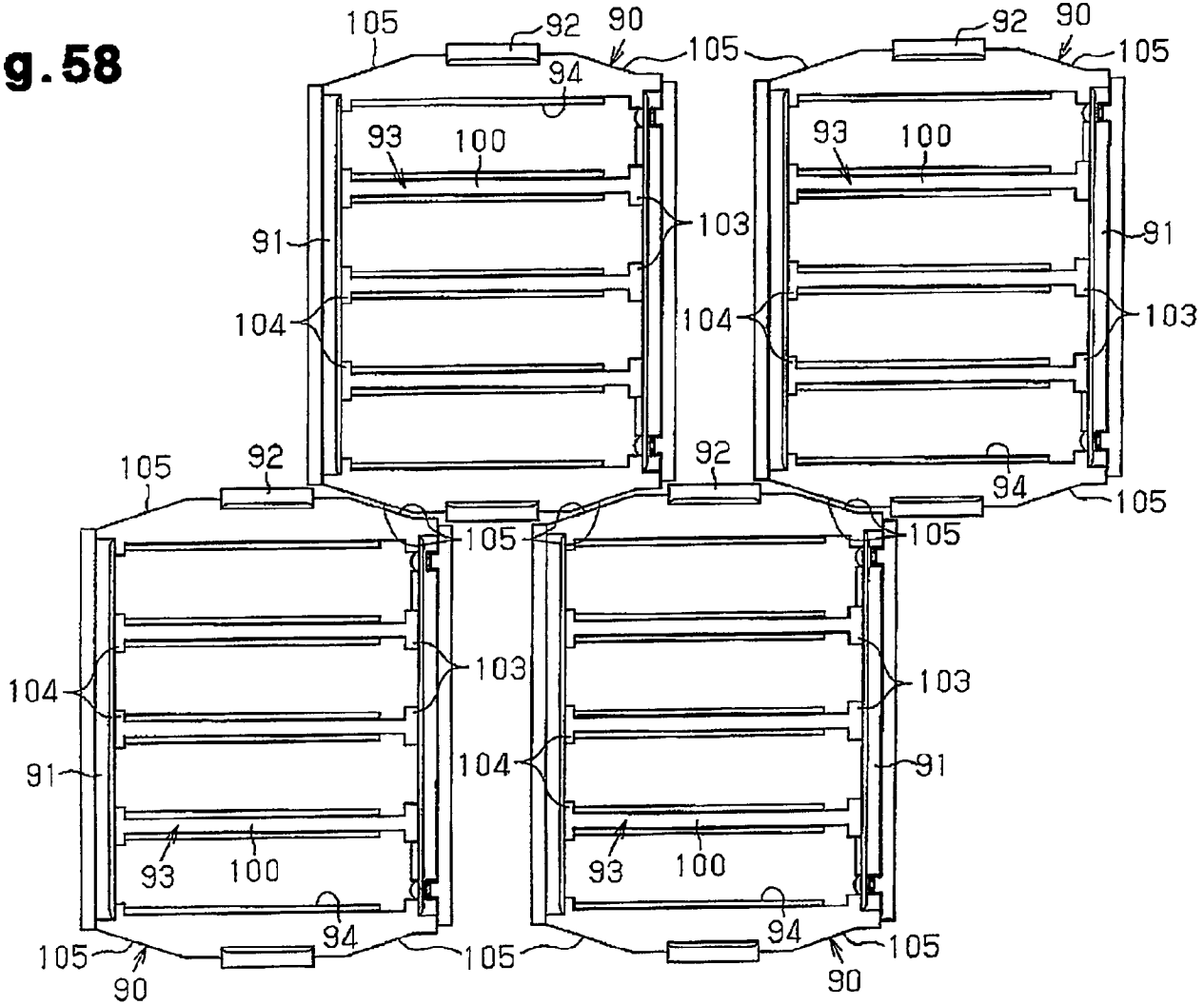
FIG. 58 is a plan view showing the head guide unit.

FIG. 58 is a plan view showing the head guide units that are arranged in a zigzag manner. Each head guide unit 90 is shaped substantially like an octagon with tapered corners as viewed from above. Specifically, the two guide portions 92 project from the portions of the plate-like frame that are opposed to each other and extend in the direction defined by the width perpendicular to the longitudinal direction of each cap 24 (the longitudinal direction of each opening 94). Each of these portions is chamfered in an inclined shape, as viewed from above, in such a manner that the width of the portion becomes smaller from the opposing sides of the associated guide portion 92 toward the opposite ends of this portion to form a chamfered portion 105. As illustrated in FIGS. 2 and 3, the maintenance devices 20 are arranged in the zigzag pattern in accordance with the zigzag arrangement of the recording heads 12. In this state, one of the chamfered portions 105 of each of the head guide units 90 and the corresponding chamfered portion 105 of the one of the head guide units 90 located diagonally forward are opposed to each other and extend parallel with each other, as viewed from above. These chamfered portions 105 are thus arranged close to each other. This reduces the interval between the rows defined by the maintenance devices 20, which are aligned along the two rows in the zigzag pattern. Thus, the rows along which the recording heads 12 are arranged in the zigzag pattern are also arranged close to each other. In other words, the adjacent two chamfered portions 105 of each adjacent pair of the head guide units 90 define a valley-like recess as viewed from above. The adjacent two chamfered portions 105 of each the head guide unit 90 define an inverted V-shaped projection as viewed from above. The recesses are engaged with the corresponding projections in such a manner that the rows defined by the corresponding head guide units 90 are located close to each other. As a result, regardless of that each guide portion is exposed to the exterior from the recording head when each head guide unit 90 is guided by the recording head 12, the recording heads are arranged along the rows that are located close to each other. That is, since the recording heads 12 and the maintenance devices are both arranged along the rows that are located close to each other, the size of the printer of the first embodiment becomes relatively small in the direction defined by the interval between such rows.

Figure 51D:
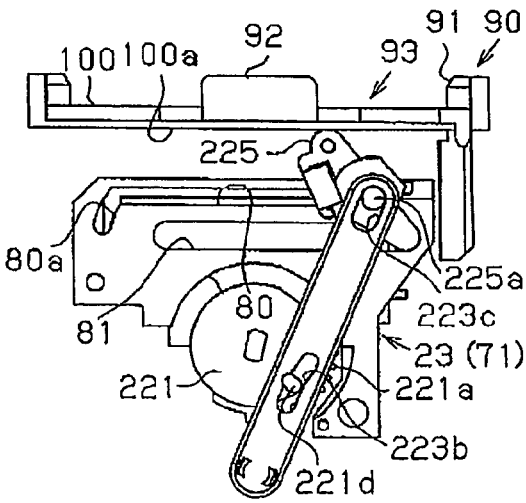

Next, operation of each wiper will be explained. To avoid complication caused by combined illustration of the wiper and a wiper drive unit, operation of the wiper and operation of each wiper drive-unit will be explained with reference to separate drawings. FIGS. 59 and 60 are side views for explaining operation of the wiper when wiping is selected. FIG. 51 is a side view showing the wiper drive unit and the head guide unit. FIG. 51 shows the wiper drive mechanism independently, or without the wiper. Specifically, FIG. 51A shows the standby state of the wiper drive mechanism in which the wiper is located at the retreat position. FIG. 51B, FIG. 51C, and FIG. 51D show the proceeding started state, the proceeding state, and the proceeding ended state, respectively, of the wiper drive mechanism. Hereinafter, the operation of the wiper when suction is selected will be explained.

Figure 59A:
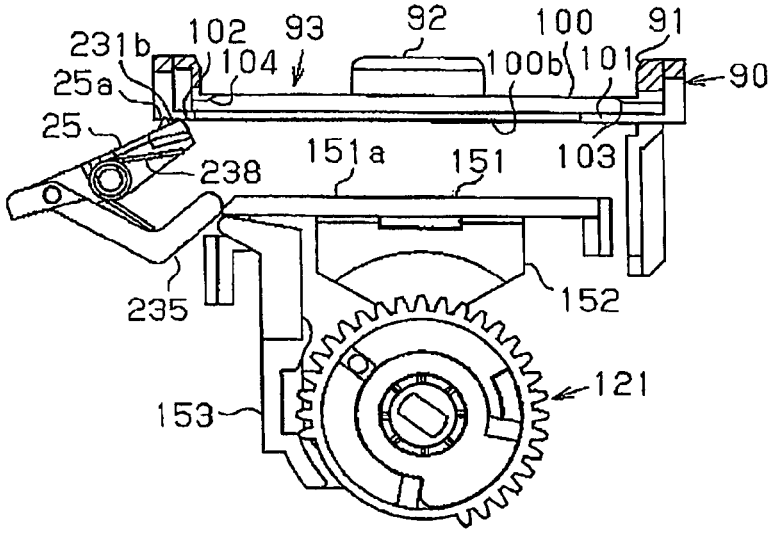
FIGS. 59A to 59C are side views each explaining operation of the wiper when wiping is selected.

The retreat position illustrated in FIGS. 51A and 59A correspond to the state immediately before movement of the wiper 25 is started. The selection cam 121 is arranged at the position at which the lift cam movable plate 152 contacts the wiping cam surface 147 (see FIG. 20). The lift plate base 151 is located at a position close to the maximally raised position. Referring to FIG. 51A, the first guide shaft 225*b* of the wiper drive cam body 225 is arranged at the lower end of the inclined hole 80*a* of the first guide hole 80. Thus, the wiper drive cam body 225 is located at a relatively low position and held in an inclined posture and the wiper drive shaft 227, which is provided at the distal end of the wiper drive cam body 225, is arranged at a low position. As a result, with reference to FIG. 59A, the wiper 25 is arranged outward with respect to the holder 23 in the longitudinal direction of each cap and retracted at a downward position.

Figure 59B:
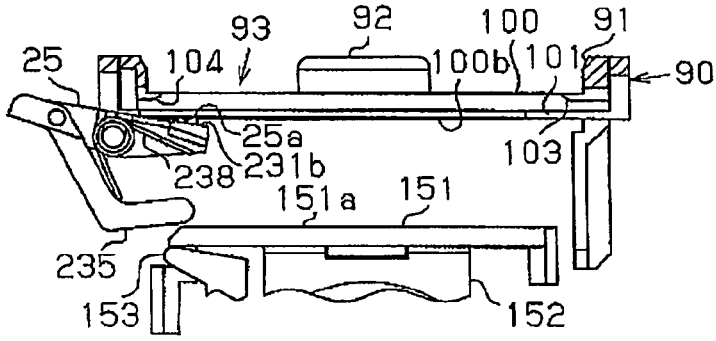

FIG. 59B represents the proceeding start position of the wiper. Referring to FIG. 51B, as the wiper drive gear 221 starts to rotate in a counterclockwise (reverse) direction, the wiper drive lever 223 is pressed by the projection 221*d* to start pivoting about the lower end of the wiper drive lever 223 from the standby position. The wiper drive cam body 225 is thus guided by the inclined hole 80*a* to move relatively upward and switched to an upright posture. At this stage, the wiper drive cam body 225 (226) presses and raises the lower surface (the wiper restricting surface 100*a*) of the head guide unit 90 at a predetermined distance. The amount of such raising substantially corresponds to the stroke at which the holder 23 is lowered after idle suction is completed. Thus, through such raising, the guide portions 91, 92 of the head guide unit 90 become engaged with the recording head 12 and positioned with respect to the recording head 12. In this state, the angle of the posture of the wiper drive cam body 225 (226) that has moved to the proceeding start position is determined in correspondence solely with the relationship between the positions of the first guide hole 80 and the second guide hole 81 and the positions of the first guide shaft 225*b* and the second guide shaft 225*b*, which are received in the first guide hole 80 and the second guide hole 81, respectively.

Thus, referring to FIG. 59B, the wiper is also raised and the wiper stopping lever 235 contacts the base surface 151*a* of the lift plate base 151. In this state, pressurization by the wiper pressing springs 238 urges the wiper 25 to switch to the upright posture in which the distal portion of the wiper 25 (corresponding to the wiper 25*a*) is raised. However, the guided portions 231*b* are held in contact with the wiper restricting surface 100*b* and thus restricted from rising. This maintains the wiper 25 in the inclined posture with the distal portion of the wiper 25 held at a slightly lowered position. The blade 25*a* is thus located at a position lower than the position of the wiper guide portion 100.

Figure 59C:
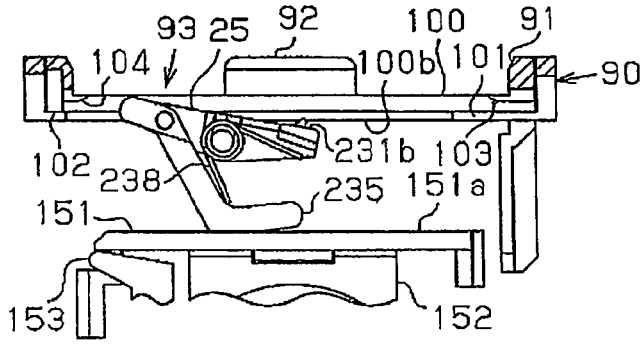

Subsequently, as the wiper drive gear 221 is continuously rotated in the reverse direction, the wiper drive lever 223 is continuously pivoted in the proceeding direction, with reference to FIG. 59C. This causes the wiper drive cam body 225 to proceed along the first and second guide holes 80, 81 substantially in a horizontal direction while a constant angle of the posture is maintained. In this state, referring to FIG. 59C, the wiper 25 proceeds while maintaining the inclined posture with the guided portions 231*b* held in contact with the wiper restricting surface 100*b*. As a result, the wiper 25 proceeds in the posture in which the blade 25*a* is spaced from the nozzle forming surface 12*a*.

By the time the wiper drive gear 221 is rotated in the reverse direction by approximately 120 degrees, the wiper drive lever 223 is inclined to the position shown in FIG. 51D and finishes proceeding. In this state, with reference to FIG. 60A, the wiper 25 is located at the position corresponding to the opening 101. That is, the guided portions 231*b* are disengaged from the wiper restricting surface 100*b* and pressurization by the wiper pressing springs 238 urges the wiper 25 to switch to the upright state to raise the distal portion of the wiper 25. However, the guided portions 231*b* contact the first restricting portions 103.

After the wiper 25 finishes proceeding, the rotating direction of the wiper drive gear 221 is switched to the forward direction. This causes the wiper 25 to return. In returning, the wiper drive lever operates in the manner opposite to the manner in proceeding. In other words, the state of the wiper drive lever is switched from the state in FIG. 51D to the state in FIG. 51C and then to the state in FIG. 51B. The wiper drive lever is thus returned to the retreat position shown in FIG. 51A. From the state in FIG. 51D to the state in FIG. 51B, the posture of the wiper drive cam body 225 (226) is maintained constant. However, since the wiper operates differently from one posture to another, such operation of the wiper will be explained exclusively in the following.

Figure 60A:
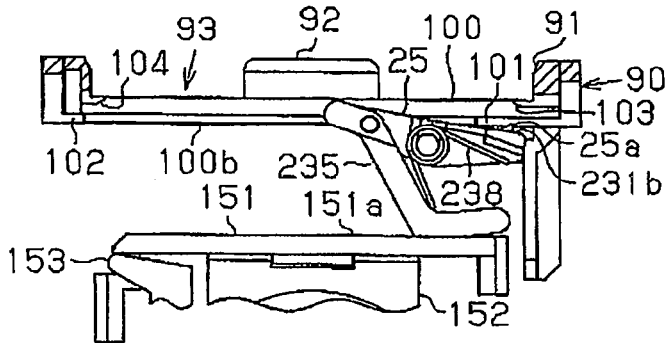
FIGS. 60A to 60D are side views each explaining operation of the wiper when wiping is selected.
Figure 60B:
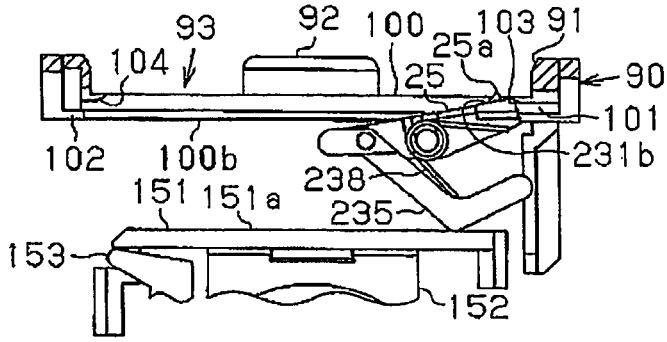

FIG. 60B represents the state of the wiper in which returning of the wiper is started. On starting of such returning, the guided portions 231*b* are held in contact with the lower surfaces of the first restricting portions 103. After the wiper 25 has started to return, pressurization by the wiper pressing springs 238 urges the guided portions 231*b* to move along the lower surfaces of the first restricting portions 103. When the guided portions 231*b* move along the inclined surfaces 103*a* (see FIG. 57A), the wiper 25 gradually becomes upright. This gradually raises the blade 25*a* so that the blade 25*a* projects upward from the upper surface of the wiper guide portion 100 to contact the nozzle forming surface 12*a*. After the guided portions 231*b* are disengaged from the inclined surfaces 103*a*, the blade 25*a* is pressed against the nozzle forming surface 12*a* through pressurization by the wiper pressing springs 238. This holds the blade 25*a* in contact with the nozzle forming surface 12*a* under a substantially constant wiping pressure. Even if the height of the nozzle forming surface 12*a* is increased, the blade 25*a* is movable until the blade 25*a* contacts the nozzle forming surface 12*a*. Also in this case, the blade 25*a* is pressed against the nozzle forming surface 12*a* through the pressurization by the wiper pressing springs 238. The wiping pressure thus becomes substantially constant regardless of the height of the nozzle forming surface 12*a*. Since the wiping pressure is substantially determined in correspondence with the force of the pressurization by the springs, the wiping pressure is not easily influenced by dimension accuracy of the wiper components or product-to-product variation in the hardness of the blade.

Figure 60C:
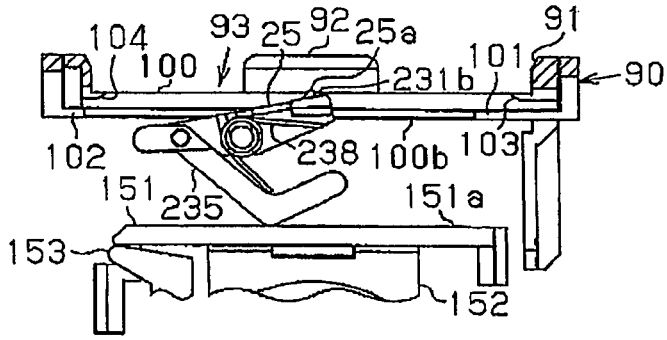

FIG. 60C represents the stage at which the wiper is returning. At this stage, the wiper 25 returns from the right end to the left end as viewed in FIG. 60C while maintaining the upright posture in which the blade 25*a* contacts the nozzle forming surface 12*a* under a substantially constant wiping pressure. Wiping is performed by the wiper 25 in this returning stage to scrape ink off the area around the corresponding nozzle rows 13 defined on the nozzle forming surface 12*a*.

Figure 60D:
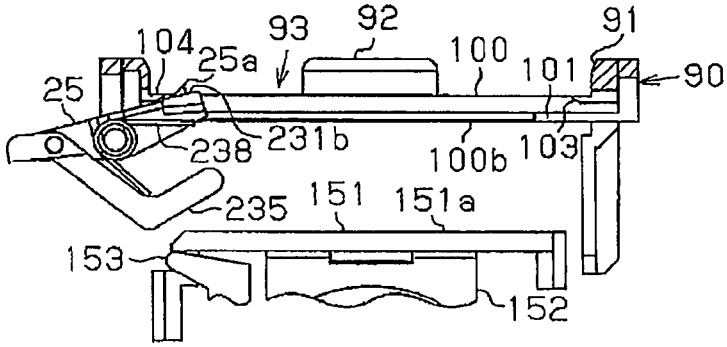

FIG. 60D represents the state of the wiper when the wiper finishes returning. To complete such returning, the guided portions 231*b* are gradually moved downward along the inclined surfaces 104*a* shown in FIG. 57B. This gradually lowers the blade 25*a*, which has finished wiping of the nozzle rows 13. The blade 25*a* separates from the nozzle forming surface 12*a* before reaching the edge of the recording head 12. In the present application, elastic deformation of the blade 25*a* does not occur. This suppresses splashing of ink caused by the blade 25*a* when the blade 25*a* is released from elastic deformation in wiping at the edge of the recording head. The wiper 25 is then guided by and lowered along the inclined hole 80*a* and pivots in such a manner as to raise the distal end of the wiper 25. The wiper 25 thus reaches the retreat position illustrated in FIG. 59A.

The operation of the wiper when suction is not selected will be explained with reference to FIG. 61. The wiper drive unit operates in the same manners regardless of whether suction is selected or not selected. Thus, only the operation of the wiper will be described in the following.

Figure 61A:
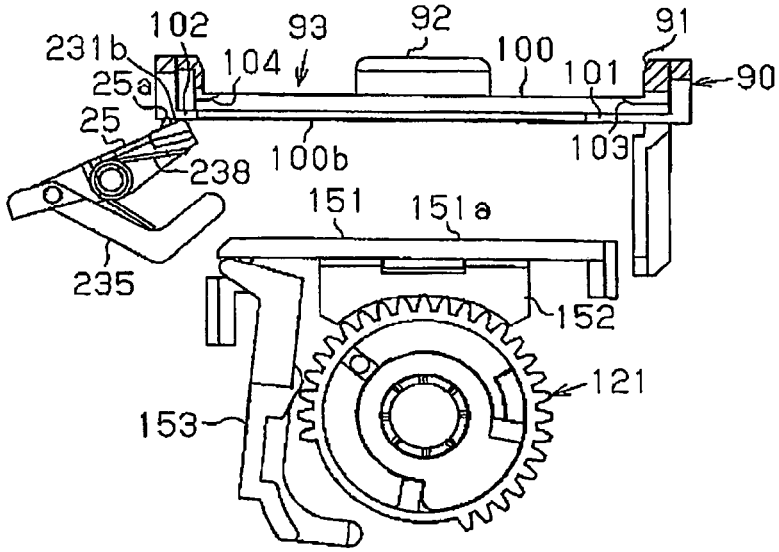
FIGS. 61A to 61C are side views each explaining operation of the wiper in a non-selection state.

FIG. 61A represents the state of the wiper when the wiper is located at the retreat position. The selection cam 121 is arranged at the position at which the lift cam movable plate 152 contacts the non-selection cam surface 138 (see FIG. 40). The lift plate base 151 is located at the lowered position. This relatively increases the interval between the lift plate base 151 and the wiper guide portion 100.

Figure 61B:
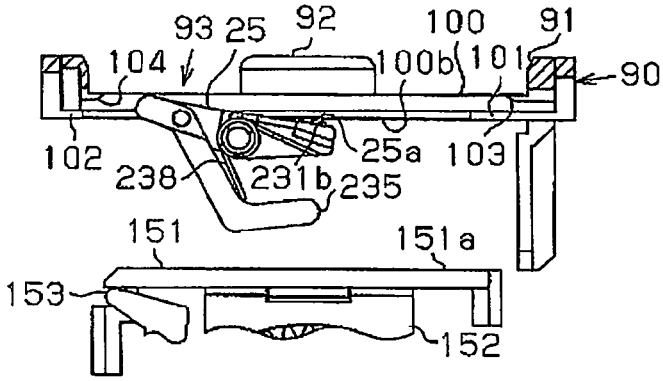

FIG. 61B represents an example of the proceeding stage or the returning stage of the wiper. At the proceeding stage, the wiper stopping lever 235 is separate from the base surface 151*a* of the lift plate base 151. This maintains the wiper 25 in a freely pivotable state. As has been described, the upper limit of the opening angle between the wiper body 230 and the wiper stopping lever 235 is restricted to a predetermined angle. Thus, the wiper 25 proceeds with the guided portions 231*b* maintained separate from or held in slight contact with the wiper restricting surface 100*b*.

Figure 61C:
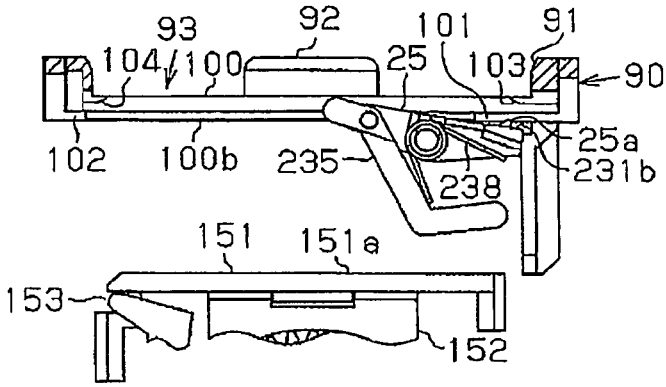
Figure 62B:
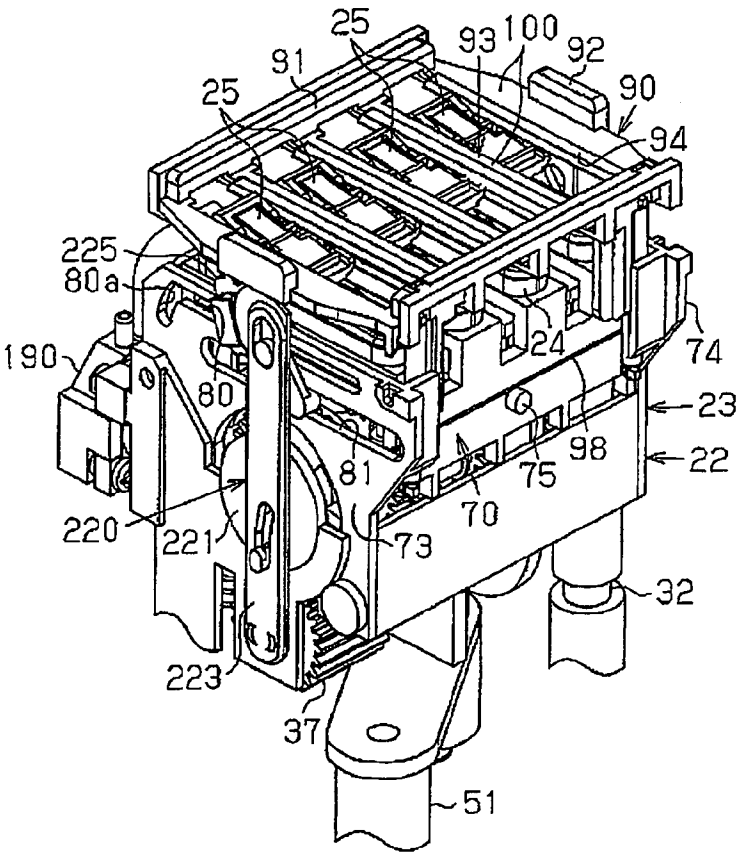
FIG. 62B is a perspective view showing the wiper at a proceeding stage.
Figure 62A:
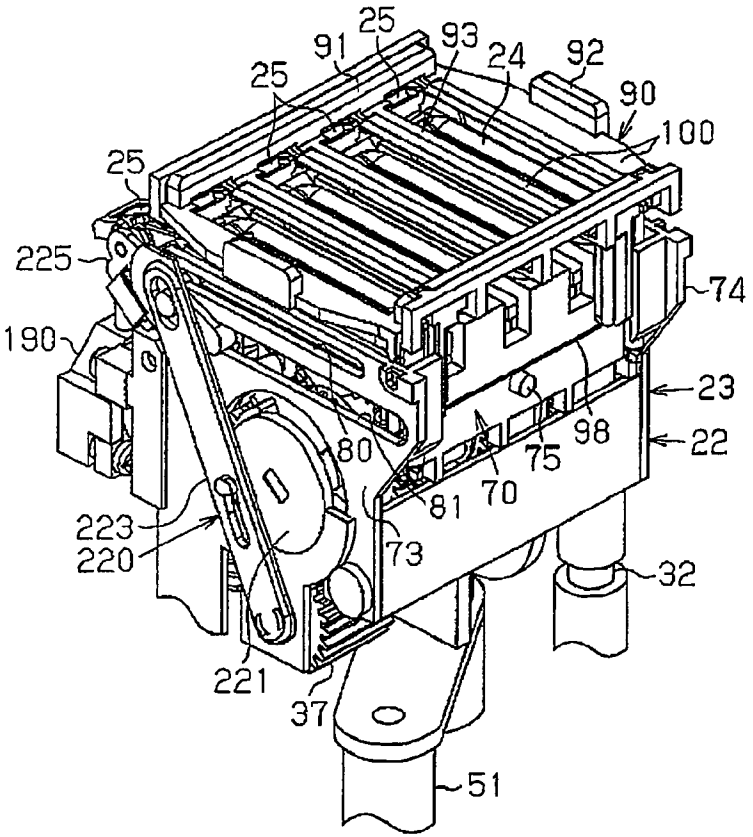
FIG. 62A is a perspective view showing the wiper at a retreat position.
Figure 63B:
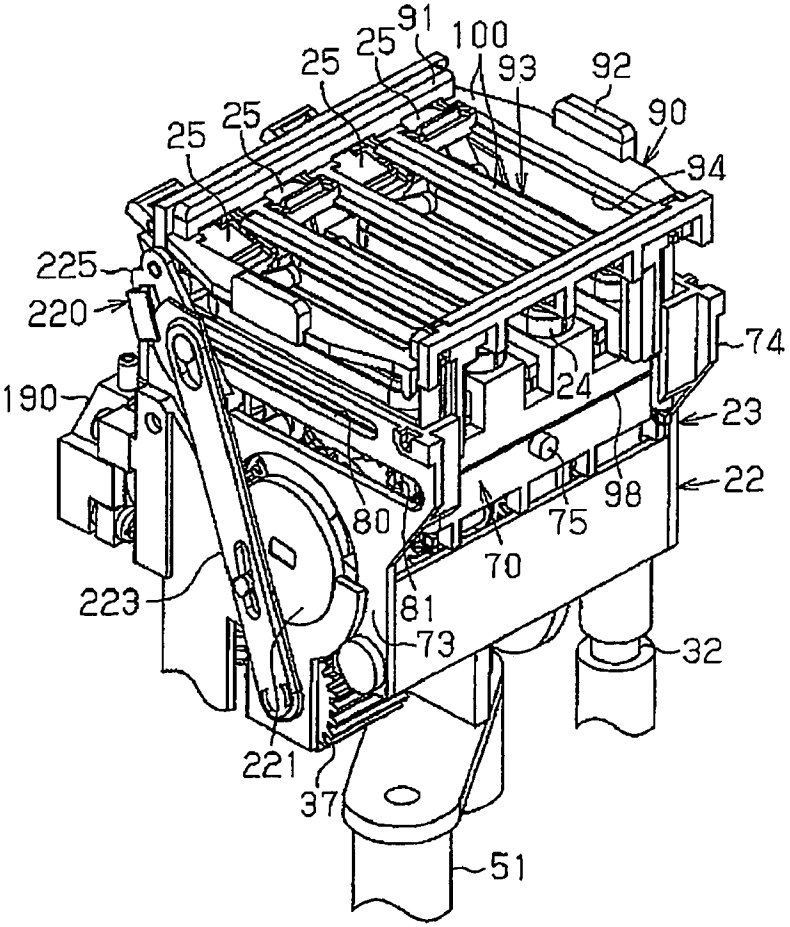
FIG. 63B is a perspective view showing the wiper when the wiper finishes retreating.
Figure 63A:
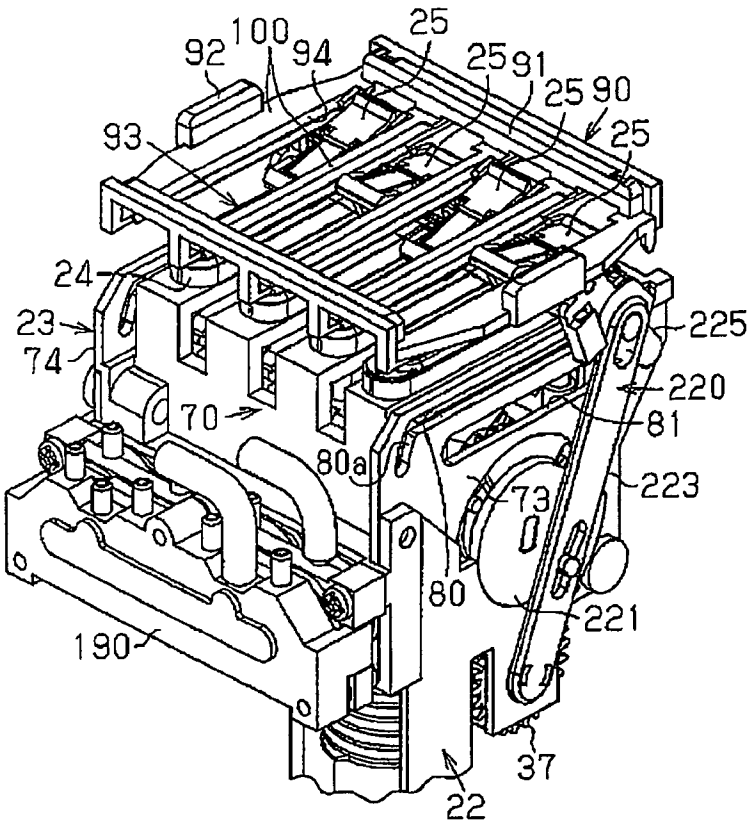
FIG. 63A is a perspective view showing the wiper when the wiper starts retreating.

FIG. 61C represents the state of the wiper when the wiper starts returning. At this point of time, the guided portions 231*b* are located at the positions corresponding to the opening 101. However, the wiper stopping lever 235 is separate from the base surface 151*a*. The wiper 25 is thus free from pressurization and prevented from switching to the upright state. As a result, at the returning stage, the wiper 25 returns with the guided portions 231*b* moving below the wiper restricting surface 100*b*. That is, the wiper 25 returns with the blade 25*a* separated from the nozzle forming surface 12*a*. When such returning is completed, the wiper 25 is guided by the inclined hole 80*a* to return to the retreat position.

<Operation of Maintenance Device>

Figure 64:
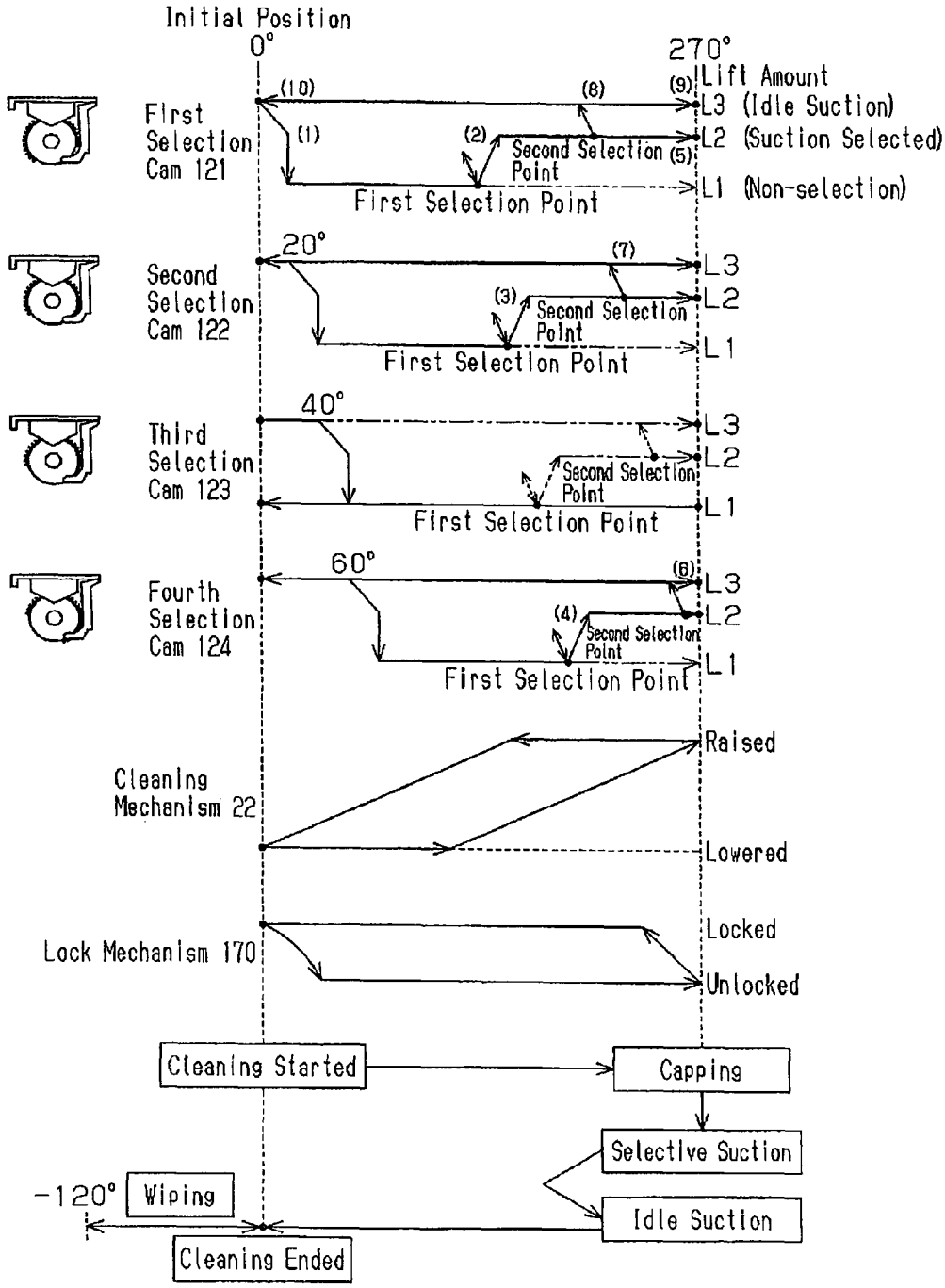
FIG. 64 is a timing chart representing operation of a maintenance device.

FIG. 64 is a timing chart representing selecting operation by the selection unit and operation of the maintenance device. A cycle of cleaning performed by the maintenance device 20 will be explained with reference to FIG. 64.

FIG. 64 represents, by way of example, a case in which the defective ejection nozzle detection device 28 determines that the third pair of the nozzle rows 13 corresponding to the third selection cam 123 are operating normally but the other three of the four pairs of the nozzle rows include defective ejection nozzles. That is, selection of suction is unnecessary for the third pair of the nozzle rows 13 but necessary for the other three pairs of the nozzle rows 13. FIG. 64 illustrates shifting of the contact point of the cam follower portion 152*b* with respect to the cam surface corresponding to each of the selection cams 121 to 124 when pivoting of the selection cams 121 to 124 are controlled. Control of such pivoting is brought about through control of rotation of the electric motor 30 by the controller 27.

In FIG. 64, the axis of abscissas represents the position of each of the selection cams 121 to 124 in the rotational direction as a rotational angle. Specifically, the position at which driving by the first selection cam 121 is ended by the toothless portion is defined as "0 degrees". The positions in the counterclockwise direction (the forward direction) of each selection cam 121 to 124 as viewed in FIG. 19 are represented with plus. The positions of the selection cam 121 to 124 in the clockwise direction (the reverse direction) are represented with minus. The axis of ordinate represents the lift amount of the lift plate base 151 in correspondence with the height of the contact point of each of the cam follower portions 152*b*. Also in FIG. 64, with respect to the axis of abscissas representing the rotation angle of each selection cam 121 to 124, the raised/lowered state of the cleaning mechanism 22 is represented along the axis of ordinate. The axis of ordinates further represents the locked/unlocked state of the lock mechanism 170 with respect to the axis of abscissas. A procedure in one cleaning cycle is represented at the lowermost position in FIG. 64.

Before cleaning is started, the cam surface contacted by the cam follower portion 152*b* of each lift mechanism 154 to 157 corresponds to the non-selection cam surface 138. When the defective ejection nozzles are detected, the cleaning mechanism 22 is maintained in a lowered state without performing capping and the first to fourth selection cams are held in non-selection states. The positions of the selection cams 121 to 124 corresponding to these states shown in FIG. 64 correspond to the initial positions. Since the phases of the cam surface shapes of the selection cams 121 to 124 are sequentially offset by 20°, the initial positions of the selection cams 121 to 124 are sequentially offset by 20°.

As the electric motor 30 is rotated in the forward direction to start cleaning, the selection cam set 135 starts to rotate in the forward direction from the initial positions.

First, the cam follower portion 152*b* (a first cam follower portion) corresponding to the first selection cam 121 reaches the first selection position. Since the first selection cam 121 is a target for which suction is selected, the controller 27 switches the rotational direction of the electric motor 30 from the forward direction to the reverse direction and then back to the forward direction, or performs suction selection control (lift raising selection control) on the first selection cam 121 (as indicated by (2) in FIG. 64). As a result, through control of pivoting of the selection cam 121 corresponding to selection of suction, the cam follower portion 152*b* of the first selection cam 121 is raised to the height at which the cam follower portion 152*b* contacts the suction cam surface 141 through a path indicated by FIGS. 23A, 23C, and 23D in this order.

After completing the suction selection control, the electric motor 30 continuously rotates the electric motor 30 in the forward direction. When the cam follower portion 152*b* corresponding to the second selection cam 122, which is also a target for which suction is selected, reaches the first selection position, the controller 27 re-performs the suction selection control on the electric motor 30. This raises the second cam follower portion 152*b* to the height at which the cam follower portion 152*b* contacts the suction cam surface 141. The electric motor 30 is continuously rotated in the forward direction until the cam follower portion 152*b* corresponding to the third selection cam 123 reaches the first selection position. The nozzle rows 13 corresponding to the third selection cam 123 are operating normal and thus suction is not selected for the third selection cam 123. Thus, the controller 27 continuously rotates the third selection cam 123 in the forward direction without performing the suction selection control. This holds the cam follower portion 152*b* corresponding to the third selection cam 123 in contact with the non-selection cam surface 138 without raising the cam follower portion 152*b* to the suction cam surface 141. Since suction is selected for the fourth selection cam 124, the suction selection control is performed on the fourth selection cam 124 in the same manners as the cases of the first selection cam 121 and the second selection cam 122. This raises the corresponding cam follower portion 152*b* to the height at which the cam follower portion 152*b* contacts the suction cam surface 141.

In this manner, after forward rotation of the selection cam set 135 is started and the first cam follower portion 152*b* reaches the first selection position, the subsequent selection cams reach the first selection position each time the selection cam set 135 is rotated forward by 20 degrees. In the cases in which suction is selected, the suction selection control is carried out at each point in time corresponding to approximately 20 degrees. The suction selection control is performed at a rotational angle of each selection cam that is smaller than 20 degrees. Thus, as long as any one of the selection cams is performing selecting operation, the other selection cams are prevented from initiating such operation. That is, the cam follower portions corresponding to the selection cams that are not performing selecting operation are moved simply along the same cam surfaces. After the first to fourth cam follower portions 152*b* have passed the first selection positions, the electric motor is continuously rotated in the forward direction. When the selection cam 121 becomes disengaged from the intermediate selection gear 37 at the toothless portion 128*b*, forward rotation of the selection cam set 135 is stopped (indicated by (5) in FIG. 64).

When the cam follower portions 152*b* of the first, second, and fourth rows are raised to the suction cam surfaces, the lift plate bases 151 are arranged at the raised positions corresponding to the lift amount L2. Since the cam follower portion 152*b* of the third row is located at the non-selection cam surface 138, the lift plate base 151 is maintained at the lowered position corresponding to the lift amount L1.

With the lift plate base 151 located at the raised position, the valve lever 153 is arranged at the position corresponding to the pressing amount "0" (P2) and thus releases the valve pressurizing body 191 (FIG. 41). This arranges the valve unit 190 at the first position at which the suction passage valve 210 connected to the cap 24 of the row for which suction has been selected is opened and the atmospheric air passage valve 216 is closed. If the lift plate base 151 is located at the lowered position, the valve lever 153 is arranged at the position corresponding to the pressing amount "maximum" (FIG. 40). In this case, the valve unit 190 is held in the state in which the suction passage valve 210 connected to the cap 24 of the row for which suction has not been selected is closed and the atmospheric air passage valve 216 is opened.

<Operation of Raising and Lowering Mechanism>

As a result of forward rotation of the electric motor 30, the cleaning mechanism 22 is raised. As the selection cam set 135 is rotated in the forward direction from the initial position, the first projection 123*a* for transmission of raising and lowering force, which projects from the backside of the third selection cam 123 (the side surface of the third selection cam 123 opposed to the cam portion 130), presses the pin portion 54*a* located at the distal end of the lift lever 54. This separates the height of the axis of the selection cam set 135 from the distal end of the pressure adjustment shaft 53. As a result, the cleaning mechanism 22 as a whole, including the holder 23 in which the selection cam set 135 is arranged, is raised.

Figure 31:
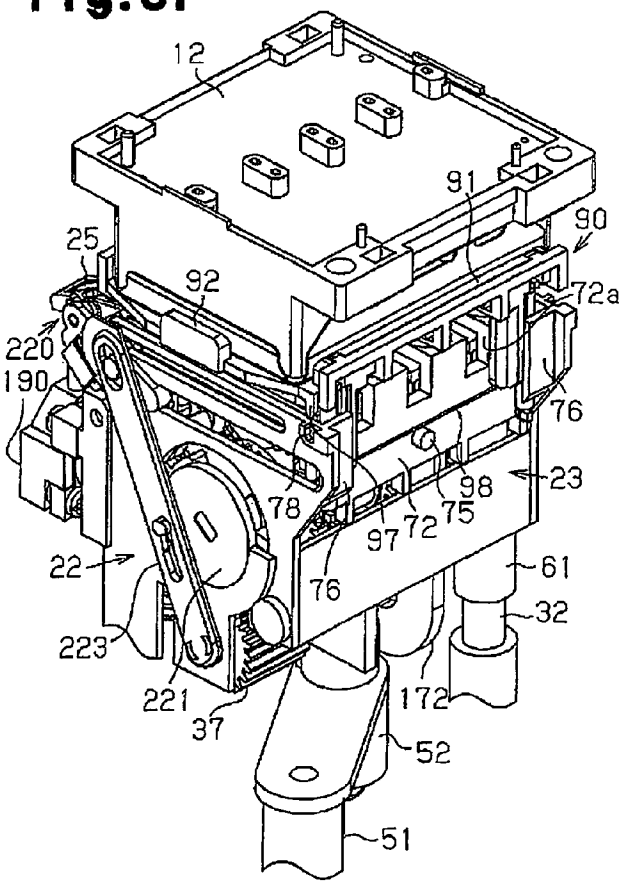
FIG. 31 is a perspective view showing the cleaning mechanism held in contact with a recording head.
Figure 30:
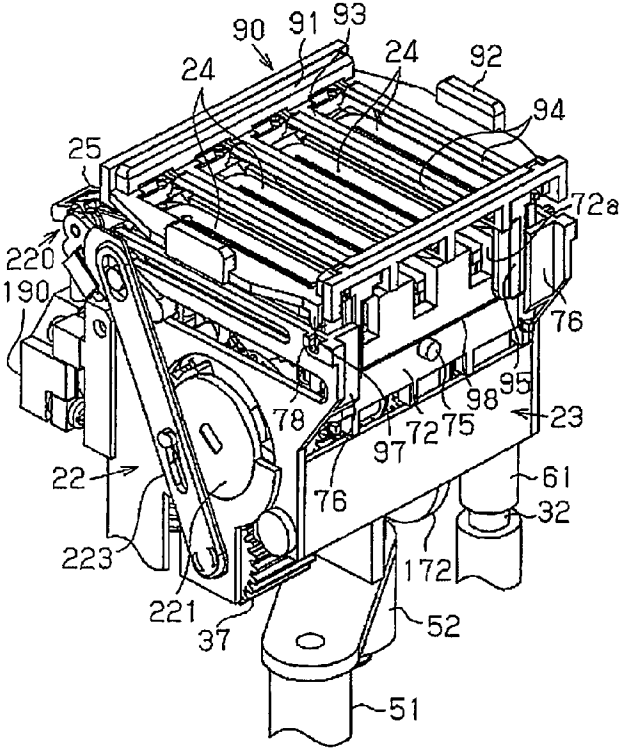
FIG. 30 is a perspective view showing the cleaning mechanism located at the lowered position.
Figure 32A:
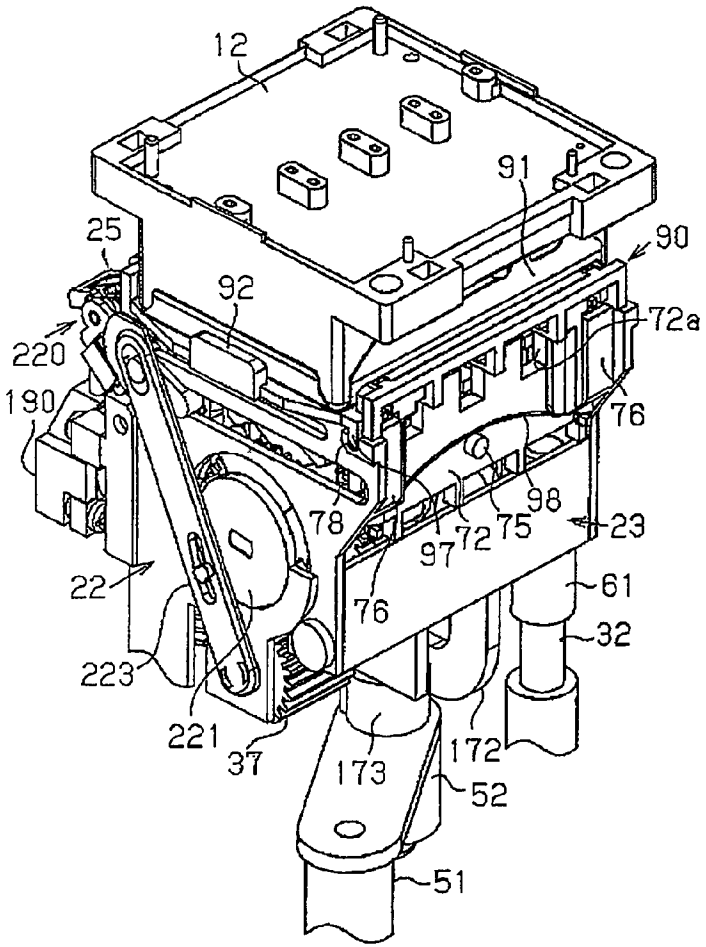

The head guide unit 90 contacts the recording head 12 when the cleaning mechanism 22 is raised to the raised position. This positions the head guide unit 90 with respect to the recording head 12 (FIG. 31). Once the head guide unit 90 contacts the recording head 12, further rising of the head guide unit 90 is restricted. However, the portion of the cleaning mechanism 22 corresponding to the holder 23 is further raised. This projects the four caps 24 upward from the openings 94 of the grid formed by the wiper guide 93 and causes the caps 24 to contact the nozzle forming surface 12*a* (FIGS. 32B and 33). When the caps 24 are held in contact with the recording head 12*a*, the positioning projections 97 of the head guide unit 90 are received in the positioning recess 78 of the holder 23. The cleaning mechanism 22 is thus positioned with respect to the recording head 12 (FIG. 32A).

After the caps 24 contact the nozzle forming surface 12*a*, the force acting to further raise the cleaning mechanism 22 is converted into reactive force. The reactive force acts to press the pressure adjustment shaft 53 into the pressure adjustment shaft holder 52 through the lift lever 54. As a result, the pressure adjustment shaft 53 is pressed downward against the urging force of the compression spring 55 (see FIGS. 27 and 28).

The pressure adjustment shaft 53 is slidable in the pressure adjustment shaft holder 52 in the up-and-down direction. The compression spring 55 between the pressure adjustment shaft 53 and the base frame 31 pressurizes the pressure adjustment shaft 53. Thus, regardless of change of the distance (the gap) between the recording head 12 and the maintenance device 20, interference between the recording head 12 and the maintenance device 20 is absorbed through operation of the pressure adjustment shaft 53. The pressurization force generated by the compression spring 55 acts also as the force that holds the recording head 12 and the caps 24 in mutual tight contact. The recording head 12 is thus reliably capped.

The suction pump 40 is actuated with the four caps 24 held in contact with the nozzle forming surface 12*a* under pressure as has been described. In other words, the suction pump 40 is started through continuous forward rotation of the electric motor 30 after the selection cam 121 is disengaged from the intermediate selection gear 37 and forward rotation of the selection cam set 135 is stopped. Specifically, the delay mechanism is incorporated in the pump gear 40*a* of the suction pump 40 and operates to cause engagement between the electric motor 30 and the corresponding pump shaft after forward rotation of the electric motor 30 by a predetermined amount since staring of such forward rotation is completed.

In this manner, the suction pump 40 is actuated, for example, at a point in time immediately after the caps 24 are brought into tight contact with the nozzle forming surface 12*a*. The four caps 24 are all connected to the common suction pump 40. However, since suction has not been selected for the third nozzle rows, the suction passage valve 210 connected to the corresponding cap 24 is closed. Negative pressure is thus not introduced into the cap 24. Contrastingly, the suction passage valves 210 connected to the caps 24 for which suction has been selected are open. Negative pressure is thus applied to the interiors of these caps 24. This selectively causes ink suction only in the nozzle rows 13 corresponding to the caps 24 for which suction has been selected by the selection unit 110. In such ink suction, as long as the electric motor 30 is continuously rotated in the forward direction, the selection cam set 135 are maintained in stopped states and only the friction gear 126 races.

<Suction→Idle Suction>

After completion of ink suction, forward rotation of the electric motor 30 is stopped and followed by idle suction. The controller 27 controls operation of the electric motor 30 in such a manner that the contact point of the cam follower portion 152*b* corresponding to the row for which suction has been selected moves to the idle suction cam surface 144. The selection cam set 135, which is located at the rotation angle (approximately 270 degrees) corresponding to suction, thus starts to rotate in the reverse direction. At the start of such reverse rotation, the tooth portion of the first selection cam 121 is disengaged from the intermediate selection gear 37. However, the second selection cam 122 receives frictional engagement force from the friction gear 126. The selection cam set 135 thus starts to rotate in the reverse direction with the assistance of the frictional engagement force. This engages the tooth portion of the first selection cam 121 with the intermediate selection gear 37. After the reverse rotation of the selection cam set 135 is started and the four cam follower portions 152*b* pass the corresponding second selection positions, the rotational direction of the selection cam set 135 is switched from the reverse direction to the forward direction.

Figure 24A:
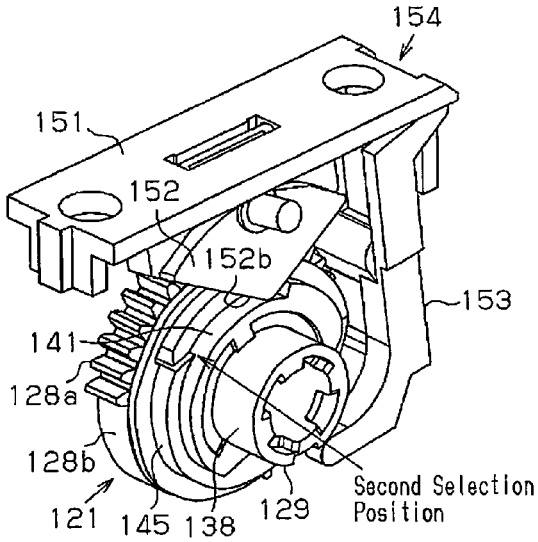
FIG. 24A is a perspective view showing the lift unit when suction is performed.
Figure 24B:
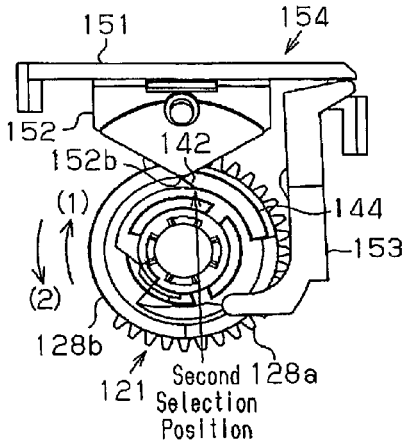
FIG. 24B is a side view showing the lift unit when a contact point of a cam follower portion is located at a second selection position.

Specifically, as the selection cam set 135 is rotated in the reverse direction indicated by arrow (1) in FIG. 24B from the state corresponding to suction represented in FIG. 24A, the cam follower portions 152*b* reach the second selection positions and ascend the return surfaces 142 to the cam surfaces 145. That is, as illustrated in FIG. 64, the fourth cam follower portion 152*b* first reaches the second selection position and ascends the return surface 142. Subsequently, after further reverse rotation by 40°, the second cam follower portion 152*b* reaches the second selection position and ascends the return surface 142. After further reverse rotation by 20°, the first cam follower portion 152*b* ascends the return surface 142. In this manner, at the rotation angle at which the first, second, and fourth cam follower portions 152*b* corresponding to the selected rows are all located at the cam surfaces 145, rotation of the selection cam set 135 is switched to the forward direction indicated by arrow (2) in FIG. 24B (as indicated by (6), (7), and (8) in FIG. 64). Such forward rotation of the selection cam set 135 is maintained until the toothless portion 128*b* of the selection cam 121 opposes the intermediate selection gear 37 and actuation of the selection cam set 135 is suspended. In the forward rotation, the first, second, and fourth cam follower portions 152*b* are raised in this order from the cam surfaces 145 to the idle suction cam surfaces 144 via the return surfaces 142 and the ascending surfaces 143. The third cam follower portion 152*b* corresponding to the non-selected row simply moves on the non-selection cam surface 138.

When the lift plate base 151 is moved from the position corresponding to suction to the position corresponding to idle suction, the selection cam set 135 is rotated in the reverse direction by approximately 70°. However, the cleaning mechanism 22 is maintained at the raised position. Specifically, referring to FIGS. 27C and 27D, in the raising and lowering unit 50, after reverse rotation of the selection cam 123 is started from the raised position shown in FIG. 27C, the reverse rotation of the selection cam 123 must cover approximately 150° to cause contact between the second projection 123*b* and the pin 54*a* of the lift lever 54, as shown in FIG. 27D. Thus, as long as the angle of the reverse rotation of the selection cam 123 is less than approximately 150°, the cleaning mechanism 22 is prevented from being lowered from the raised position.

Figure 24C:
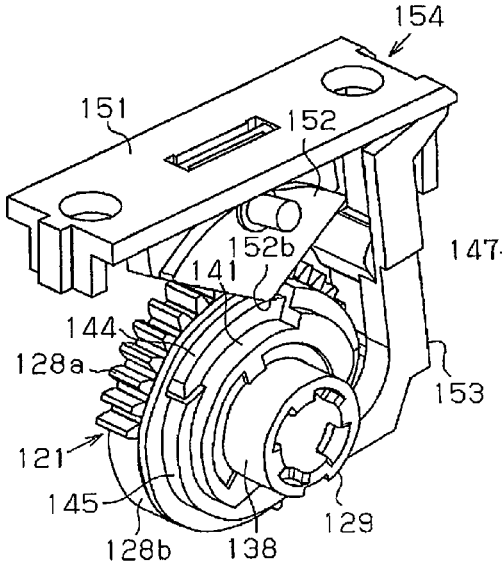
FIG. 24C is a perspective view showing the lift unit when idle suction is performed.
Figure 24D:
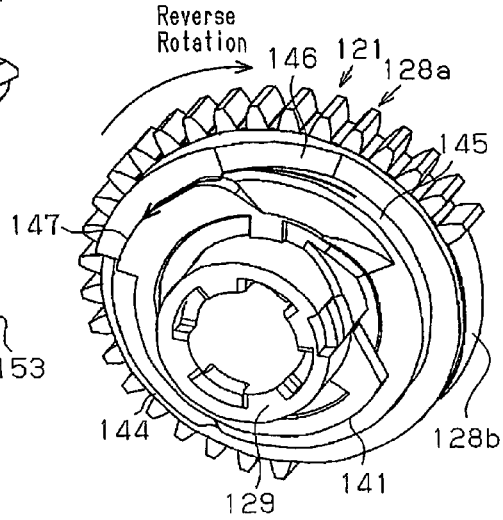
FIG. 24D is a perspective view showing the lift unit in a transitive state in movement to a wiping position.

In this manner, the cam follower portions 152*b* corresponding to the selected rows reach the idle suction cam surfaces 144, which are higher than the suction cam surfaces 141 (FIG. 24C). At this stage, the lift plate base 151 is raised from the raised position to the maximally raised position. The valve lever 153 is thus moved from the position corresponding to the pressing amount "0" to the intermediate position corresponding to the pressing amount "middle" (P3) (FIG. 42). In this state, the valve pressurizing body 191 is located at the second position (the intermediate position). Thus, in the valve unit 190, the suction passage valves 210 connected to the caps 24 corresponding to the rows for which suction has been selected and the atmospheric air passage valves 216 are both open. Contrastingly, the cam follower portion 152*b* corresponding to the rows for which suction has not been selected is maintained in contact with the suction non-selection cam surface 138. Thus, the lift plate base 151 is held at the lowered position and the valve lever 153 is maintained at the position corresponding to the pressing amount "maximum". Accordingly, the suction passage valve 210 connected to the associated cap 24 is closed and the atmospheric air passage valve 216 is open. The cap 24 is thus exposed to the atmospheric air.

When the selection cam set 135 is rotated in the reverse direction by approximately 70° to move the lift plate base 151 from the position corresponding to suction to the position corresponding to idle suction, the cleaning mechanism 22 is maintained at the raised position. Specifically, referring to FIGS. 27C and 27D, in the raising and lowering unit 50, after reverse rotation of the selection cam 123 is started from the raised position shown in FIG. 27C, the reverse rotation of the selection cam 123 must cover approximately 150° to cause contact between the second projection 123*b* and the pin 54*a* of the lift lever 54, as shown in FIG. 27D. Thus, as long as the angle of the reverse rotation of the selection cam 123 is less than approximately 150°, the cleaning mechanism 22 is prevented from being lowered from the raised position.

Since the cleaning mechanism 22 is held at the raised position, the four caps 24 are maintained in contact with the nozzle forming surface 12*a*. After the forward rotation of the selection cam set 135 is stopped, the electric motor 30 is continuously rotated in the forward direction to actuate the suction pump 40. In this state, the suction passage valve 210 connected to the cap 24 for which suction has not been selected is closed. Negative pressure is thus not introduced into the cap 24. Since the suction passage valve 210 connected to each of the caps 24 for which suction has been selected and the atmospheric air passage valve 216 are both open, the interior of each cap is exposed to the atmospheric air while negative pressure is introduced into the cap. Thus, the air drawn from the atmospheric air pipe 195 of the valve unit 190 passes through the suction pipe 196 and is sent to the suction pump 40. In this manner, idle suction, or suction of ink from each cap 24 or the tubes but not from the recording head, is carried out. The ink recovered through such idle suction is collected in a non-illustrated waste liquid tank.

After completion of the idle suction, wiping is carried out to wipe ink off the nozzle forming surface 12*a* of the recording head 12. In the present application, each wiper 25 moves above the associated cap 24 to perform wiping. The cap thus must be lowered for wiping. Further, although all of the wipers 25 are moved, wiping force is applied only to the wipers for which suction has been selected but not to the wiper for which suction has not been selected. Such selective application of the wiping force is performed through the lift plate base 151.

After the idle suction is finished, the selection cam set 135 is rotated in the reverse direction. In this state, transmission of the drive force occurs in the same manner as transmission of the drive force to the selection cam set 135 after completion of the ink suction. The selection cam set 135 is rotated by 270°. Through such operation, the cam follower portions 125*b* for which suction has been selected move from the idle suction cam surfaces 144 to the wiping cam surfaces 147 via the ascending surfaces 143, the return surfaces 142, and the cam surfaces 145. Each wiping cam surface 147 is located at a height slightly smaller than the height of each idle suction cam surface 144. In this state, the lift plate base 151 is arranged at a height slightly smaller than the height at the maximally raised position (a height slightly smaller than the height corresponding to the lift amount L3). At this height, each wiper pressing spring 238 applies an appropriate level of wiping force to the corresponding wiper 25. Contrastingly, since the cam follower portion 152*b* corresponding to the non-selected row simply moves along the non-selection cam surface 138, the associated lift plate base 151 is maintained at the lowered position. The corresponding wiper 25 thus does not receive the wiping force.

<Operation of Lock Mechanism>

Locking operation is performed by the lock mechanism when the selection cam set 135 is rotated by 270°. The stopper cam 171 is pivoted integrally with the selection cam set 135 when the selection cam set 135 is pivoted. When the selection cam set 135 is arranged at the initial position, the stopper lever 172 is held in contact with the cam surface 179 of the stopper cam 171 located at the standby position (see FIG. 39A). When suction is performed, the selection cam set 135 is rotated in the forward direction and moved to the rotation angle at which the cam follower portion 152*b* contacts the suction cam surface 141. In this state, the stopper lever 172 contacts the non-locking cam surface 175 of the stopper cam 171 and is held in a vertically upright posture (see FIG. 39C). The lock mechanism is thus maintained unlocked, or in an unlocked state. Also when idle suction is carried out after suction, the lock mechanism is maintained in the unlocked state.

After the idle suction is completed, the selection cam set 135 is rotated in the reverse direction in such a manner that the contact point of the stopper lever 172 with respect to the stopper cam 171 ascends the inclined surface 176 and reaches the locking cam surface 177 (see FIG. 39D). This inclines the stopper lever 172 to decrease the diameter of the choke ring portion 181 of the choke member 173. The choke ring portion 181 thus locks the pressure adjustment shaft 53. Referring to FIG. 64, locking by the lock mechanism 170 is brought about when the cleaning mechanism 22 is maintained at the raised position, or when the caps 24 are held in tight contact with the recording head 12. The height of the recording head 12 is determined in such a manner that an appropriate platen gap is ensured by a non-illustrated platen gap adjustment mechanism in correspondence with the thickness of the recording paper sheet that is currently used. The projection amount of the pressure adjustment shaft 53 from the pressure adjustment shaft holder 52 with the caps 24 held in tight contact with the recording head depends on the platen gap. Through locking, such projection amount of the pressure adjustment shaft 53 from the pressure adjustment shaft holder 52 becomes fixed. In other words, the compression spring 55 is prohibited from extending or compressing and the pressure adjustment shaft 53 is prohibited from moving. Further, when the selection cam set 135 is temporarily rotated in the reverse direction in shifting from the position corresponding to suction to the position corresponding to idle suction, the pressure adjustment shaft 53 is temporarily locked.

As illustrated in FIG. 64, the selection cam set 135 is further rotated in the reverse direction after the pressure adjustment shaft 53 is locked. This causes the second projection 123*b* of the third selection cam 123 to press the pin 54*a* of the lift lever 54, with reference to FIG. 27D. The cleaning mechanism 22 thus starts descending. Then, the caps 24 are retracted into the openings 94 of the head guide unit 90 and separated from the nozzle forming surface 12*a*. As the linear spring 98 is released from elastic deformation, the head guide unit 90 is spaced from the recording head 12. When the rotation angle of the selection cam 121 reaches a predetermined angle close to approximately 0°, the toothless portion 128*b* is located at the position opposed to the intermediate selection gear 37. The reverse rotation of the selection cam set 135 is then stopped to finish descending of the cleaning mechanism 22. In this state, the pressure adjustment shaft 53 is maintained in the locked state and the compression spring 55 is thus prevented from extending or compressing. The descending amount of the cleaning mechanism 22 is constant regardless of the platen gap. Further, the descending amount of each cap 24 is equal to the descending amount of the cleaning mechanism 22. That is, regardless of the platen gap, the distance between the nozzle forming surface 12*a* of the recording head 12 and each cap 24 is constant.

<Wiping>

Next, wiping will be explained.

At a point in time slightly before the reverse rotation of the selection cam set 135 is stopped, the projection 121*a* for transmission of rotation of the selection cam 121 presses the receiving surface 221*c* of the wiper drive gear 221 to cause engagement between the tooth portion 221*a* of the wiper drive gear 221 and the intermediate selection gear 37. Then, the reverse rotation of the selection cam set 135 is stopped and, instead, reverse rotation of the wiper drive gear 221 is started to initiate wiping. Subsequently, the controller 27 actuates the electric motor 30 to pivot the wiper drive gear 221 in a reciprocating manner by approximately 120°.

In the descending stage of the cleaning mechanism 22 in which the cleaning mechanism 22 is lowered from the raised position corresponding to suction to the lowered position corresponding to wiping, the pressure adjustment shaft 53 is maintained in a locked state to hold the compression spring 55 in a compressed state brought about by contact between the caps 24 and the nozzle forming surface 12*a*. As a result, when the cleaning mechanism 22 is switched from the state corresponding to suction to the state corresponding to wiping, restoration of the compression spring 55 does not occur. Thus, the interval between the nozzle forming surface 12*a* and the lift plate base 151 in wiping becomes constant regardless of the current platen gap. The wiping force of the blade 25*a* thus becomes constant. Also, in the present application, the opening angle between the wiper body 230 and the wiper stopping lever 235 is variable by the wiper pressing spring 238. Accordingly, in wiping, the position of the blade 25*a* is adjusted in correspondence with the height of the nozzle forming surface 12*a*. This allows the blade 25*a* to reliably wipe with stable wiping force.

As illustrated at the lowermost portion of FIG. 64, after the reverse rotation of the selection cam set 135 is ended, the wiper drive gear 221 is rotated in the reverse direction by approximately 120° and then in the forward direction by approximately 120°. In this manner, wiping is performed in accordance with one reciprocation cycle. In such wiping, each wiper 25 does not contact the recording head 12 when moving along the proceeding path but contacts and wipes the recording head 12 when moving along the return path.

Then, after the wiper 25 finishes the return path, the wiper 25 is retracted to the position spaced from the nozzle forming surface 12*a* through guiding of the first guide shaft 225*b* by the inclined hole 80*a* of the first guide hole 80. When wiping is completed, the receiving surface 221*c* of the wiper drive gear 221 presses the projection 121*a* for transmission of rotation immediately before forward rotation of the wiper drive gear 221 is stopped. The tooth portion 128*a* of the selection cam 121 thus becomes engaged with the intermediate selection gear 37. As the selection cams 121 to 124 are further rotated in the forward direction, the group of the cam follower portions 152*b* that have been located at the initial positions on the wiping cam surfaces 147 descend along the descending surfaces 148 and reach the non-selection cam surfaces 138 formed by the outer circumferential surface of the shaft portion 129. In this manner, when the electric motor 30 is stopped, one cycle of cleaning is completed. By this time, the selection cam set 135 restores the states corresponding to the initial position. In this state, since the contact points of all of the four cam followers are located on the cam surfaces at the initial positions, the lock mechanism 170 is held in the locked state.

That is, the pressure adjustment shaft 53 is maintained in the locked state even after cleaning is ended. Thus, when each maintenance device 20 is arranged at the position immediately below the associated recording head 12 in such a manner that the caps 24 become opposed to the corresponding nozzle rows 13 to perform flushing, the interval between the nozzle forming surface 12*a* and each cap 24 is maintained as a constant gap regardless of the value of the platen gap. Since such interval is maintained constant when flushing is performed, an interval (a gap) suitable for flushing is ensured. This lowers the likeliness of leakage of liquid droplets to the exterior through flushing. For example, if the pressure adjustment shaft 53 is not locked, the gap between the nozzle forming surface 12*a* and the cap 24 in flushing varies in correspondence with the platen gap. That is, such gap increases as the platen gap increases, and decreases as the platen gap decreases. Specifically, for example, if flushing is carried out with the increased gap, the correspondingly increased distance between the nozzle forming surface 12*a* and the cap 24 may cause splashing of the liquid droplets in mist forms, which contaminate the interior of the casing body of the printer. Contrastingly, if the flushing is performed with the decreased gap, the liquid droplets may splash onto the caps 24 and contaminate the nozzle forming surface 12*a*. However, in the first embodiment, since the gap is maintained constant, such contamination caused by the flushing is avoided.

The controller 27 selectively actuates the electric motors 30 corresponding to those of the maintenance devices 20 in which defective ejection nozzles have been detected. In this manner, the controller 27 performs cleaning selectively on the nozzle rows 13 including the defective ejection nozzles. However, the controller 27 does not actuate the electric motors 30 corresponding to those of the maintenance devices 20 in which defective ejection nozzles have not been detected.

As has been described in detail, the first embodiment has the following advantages.

(1) The multiple wipers 25 are self-actuated and moved in parallel with each other. Thus, the first embodiment is applicable to wiping of the non-scanning type recording head 12 such as the recording head system 11. Also, the nozzle rows 13 defined in parallel on the nozzle forming surface 12*a* of the recording head 12 are wiped by the different wipers 25 corresponding to the different color inks. Mixing of the color inks is thus easily avoided.

(2) The selection unit 110 selects those of the wipers 25 that are to perform wiping from the multiple wipers 25. This allows selective wiping by the wipers 25 corresponding to the nozzle rows 13 including the defective ejection nozzles. Thus, idle wiping performed on the nozzle rows 13 in which all of the nozzles are effectively operable, which have not been subjected to suction cleaning, is avoided. Accordingly, the nozzle meniscuses are prevented from being deformed inappropriately due to the idle cleaning. Further, the effective ejection nozzles are prevented from becoming disadvantageously ineffective.

(3) The selection unit 110 includes the lift plate bases 151, which are movable in the directions in which the lift plate bases 151 separately press the wipers 25 toward the recording head 12 by the base surfaces 151*a* extending along the movement paths of the corresponding wipers 25. Each of the lift plate bases 151 is movable between the maximally raised position (the first position) and the lowered position (the second position). When the lift plate base 151 is located at the maximally raised position, the base surface 151*a* of the lift plate base 151 is allowed to press the corresponding wiper 25. When the lift plate base 151 is arranged at the lowered position, the base surface 151*a* of the lift plate base 151 is prevented from pressing the wiper 25 to the wiping position. Thus, through selection of the raised/lowered position of the lift plate base 151, the wipers 25 that are to perform wiping are selected. That is, the wipers 25 that are to perform wiping are selected through a relatively simple configuration.

(4) The selection unit 110 has the multiple selection cams 121 to 124, which are provided in correspondence with the wipers 25. Pivoting of the selection cams 121 to 124 are controlled to move the lift plate bases 151 between the maximally raised position and the lowered position through the lift cam movable plates 152 (the cam followers), which are engaged with the selection cams 121 to 124. That is, the selection cams 121 to 124 are pivoted to select the cam surfaces with which the associated lift cam movable plates 152 become engaged. In this manner, the positions at which the associated lift plate bases 151 are to be located are selected.

(5) The selection cams 121 to 124 are arranged coaxially and rotatably in a forward direction and a reverse direction with the phases of the cam portions 130 maintained sequentially offset by 20°. The cam surfaces with which the lift cam movable plates 152 are engaged are selected depending on whether the selection cams 121 to 124 are rotated in the reverse direction at specific rotation angles. In this manner, the heights of the lift plate bases 151 are selected. Since the selection cams 121 to 124 are pivoted integrally, as has been described, selection of those of the wipers 25 that are to perform wiping is performed through control of rotation of the single electric motor 30.

(6) In each wiper 25, the wiper body 230 and the wiper stopping lever 235 are pressurized by the wiper pressing springs 238. The pressurization force generated by the distal end of the wiper 25 with respect to the nozzle forming surface 12*a* is thus stabilized regardless of elasticity of the wiper 25. Wiping is thus carried out effectively.

(7) Only the lift plate bases 151 corresponding to the rows selected for wiping are raised. The wiper stopping levers 235 of the corresponding wipers 25 slide on the base surfaces 151*a* of the lift plate bases 151 that are held at the raised positions. Thus, only the wipers 25 corresponding to the lift plate bases 151 held at the raised positions press the nozzle forming surface 12*a* by the force substantially equal to the force produced by the aforementioned pressurization. Accordingly, the nozzle rows 13 that need cleaning are selectively wiped.

(8) At the proceeding stage (the non-wiping stage) of each wiper 25, the guided portions 231*b* are held in contact with the wiper restricting surfaces 100*a*, 100*b* of the wiper guide portion 100 so that rising of the wiper 25 is restricted. This allows movement of the wiper 25 under pressurization in a state separate from the nozzle forming surface 12*a*. Idle wiping is thus avoided and the nozzle meniscuses are prevented from being deformed by the idle wiping. As a result, the nozzles are maintained in effective states.

(9) At the returning stage (the wiping stage) of each wiper 25, the wiper 25 is moved with the guide portions 231*b* at the distal end of the wiper 25 located above the wiper restricting surfaces 100*a*, 100*b*. In this state, the portion of the wiper body 230 other than the guided portions 231*b* that has a width smaller than the width of each opening between the wiper restricting surfaces 100*a*, 100*b* is passed through the opening 94. That is, returning of the wiper 25 is permitted in a state in which the guided portions 231*b* are located above the wiper restricting surfaces 100*a*, 100*b* to release the wiper 25 from restriction to rising. In this state, the position of the wiper 25 is not restricted in the direction in which the wiper 25 is switched to the upright posture (the urging direction of the wiper pressing springs 238). Thus, the wiper 25 is allowed to move along the return path while maintaining contact with the nozzle forming surface 12*a* through pressurization by the wiper pressing springs 238. This stabilizes wiping pressure.

As has been described, the wiper restricting surface 100*a*, 100*b* are provided. The wiper 25 is released from restriction by the corresponding opening 101 at the switching position between the wiping stage and the non-wiping stage. The wiper 25 is then permitted to move along the return path while maintained in a state released from the restriction. Thus, although the wiper 25 is maintained under pressurization to ensure wiping pressure, the wiper 25 is prevented from contacting the nozzle forming surface 12*a* to avoid idle wiping at the non-wiping stage. As a result, such idle wiping is prevented and wiping pressure is ensured.

(10) Arcuate movement (pivoting) of the wiper drive levers 223, 224 is converted into linear movement of the associated wiper 25 in the wiping area through the first guide holes 80 and the second guide holes 81, which are provided in pairs in the corresponding one of the left and right side frames 73, 74, and the wiper drive cam bodies 225, 226. This allows the wiper 25 to move linearly in parallel with the nozzle forming surface 12*a*. Further, the angle of the posture of the wiper 25 is maintained at a substantially constant value throughout the entire wiping area. As a result, the contact pressure or the contact angle of the wiper 25 with respect to the nozzle forming surface 12*a* is maintained substantially constant. Wiping is thus performed stably.

(11) In the non-wiping area, or the standby area, of each wiper 25, the wiper drive cam bodies 225, 226 are guided by the inclined holes 80*a* of the first guide holes 80. This converts the linear movement of the wiper 25 to the arcuate movement and thus separates the wiper 25 from the recording head 12. As a result, when the cleaning mechanism 22 is raised to carry out suction, the wiper 25 is prevented from contacting the recording head 12 while being raised with the caps 24. This ensures long-term effective wiping performance of the wiper 25.

(12) The longitudinal direction of each cap 24 corresponds to the wiping direction. To perform wiping, the caps 24 are located immediately below the wipers 25. Thus, even if the ink that has been wiped off drops, the ink is collected in the caps 24. This prevents the ink from contaminating the vicinity of the range below the wiping area. Specifically, for example, if the wiped ink drops into the selection unit 110, which is located below the wiping area, the ink may become solid and fixed, and thus increase the sliding resistance of the slidable portions of the selection cams 121 to 124, the lift cam movable plates 152, and the valve levers 153, causing defective operation of the maintenance device 20. However, such defective operation is suppressed in the first embodiment.

(13) The wipers 25 that are to perform wiping are selected depending on whether the selection cams 121 to 124 are pivoted in the reverse directions. Thus, even if an increased number of wipers 25 are provided, the first embodiment is easily applicable to this case simply by increasing the diameter of each selection cam 121 to 124 to increase the diameter (the circumferential length) of the associated cam surface. Specifically, when the cam follower portion 152*b* is located at the first selection position, the cam follower portion 152*b* descends the return surface 139 and ascends the ascending surface 140 to reach the cam surface higher than the ascending surface 140 in accordance with a certain circumferential length of the cam surface. As long as the selection cams 121 to 124 are mutually offset by the amount corresponding to this circumferential length of the cam surface, any suitable modification may be carried out on the selection cams 121 to 124. In the first embodiment, the phases of the selection cams 121 to 124 are offset by 20° in correspondence with the diameter of each selection cam 121 to 124. However, if the diameter of the selection cam 121 to 124 is increased to increase the diameter (the circumferential length) of the associated cam surface, the offset angle of the phases of the selection cams 121 to 124 is decreased. That is, the offset amount of the phases is decreased. If this is the case, a correspondingly increased number of selection cams can be provided. Thus, the present invention is relatively easily applied to the case in which an increased number of wipers 25 and a correspondingly increased number of rows, or targets of selection, are employed.

(14) In wiping, the guide portions 91, 92 of the head guide unit 90 become engaged with the recording head 12 to position the four wipers 25 with respect to the recording head 12. Thus, the wiper guide 93, which forms a portion of the head guide unit 90, is accurately positioned with respect to the recording head 12. This allows positioning of the wiping position, which is determined through guiding of the wiper 25 by the wiper guide 93, at an appropriate position on the nozzle forming surface 12*a*. Specifically, the relationship between the position of each cap 24 and the position of the associated wiper 25 may be varied by a mechanical deterioration of a movement drive system of the recording head 12 or varied installment positions of the recording head 12 and the maintenance device 20. However, regardless of such varied position relationship, the accuracy of the cleaning position with respect to the nozzle forming surface 12*a* is improved. This makes it unnecessary to set the capping area and the wiping area to areas larger than needed. Thus, if the wiping start position is set at a position on the nozzle forming surface 12*a* slightly inward from the edge of the recording head 12, wiping by the wiper 25 is started accurately from the set start position. Also, if the wiping end position, at which the wiper 25 separates from the nozzle forming surface 12*a*, is set at a position on the nozzle forming surface 12*a* slightly inward from the edge of the recording head 12, the wiper 25 is separated from the nozzle forming surface 12*a* accurately at the set wiping end position.

(15) The head guide unit 90 is formed as an integral type functioning both as positioning means and guide means and includes the guide portions 91, 92 and the wiper guide 93. Thus, despite the multiple functions of the head guide unit 90, the thickness of the head guide unit 90 is decreased.

(16) Each first restricting portion 103 is provided in the portion of the wiper guide 93 at the position corresponding to the wiping start position of the associated wiper 25. The guided portions 231*b*, which are located at the opposing sides of the distal end of the wiper 25, are guided by the inclined surfaces 103*a* of the first restricting portion 103. In this manner, guiding of the wiper 25 is performed in such a manner that the wiping start position at which the blade 25*a* of the wiper 25 first comes into contact with the recording head 12 is located at the position on the nozzle forming surface 12*a* slightly inward from the edge of the recording head 12. This prevents the blade 25*a* of the wiper 25 from hitting the edge of the recording head 12 when wiping is started, suppressing damage to the blade 25*a* caused by such hitting. As a result, the wiper 25 is allowed to maintain improved wiping performance for an elongated period of time.

(17) Each second restricting portion 104 is provided in the wiper guide 93 at the position corresponding to the wiping end position of each wiper 25. The guided portions 231*b*, which are arranged at the opposing sides of the distal end of the wiper 25, are guided by the inclined surfaces 104*a* of the second restricting portion 104. The wiper 25 is thus separated from the nozzle forming surface 12*a* immediately before reaching the edge of the recording head 12. This prevents ink splashing caused by a quick posture change of the wiper 25 that has passed the edge of the recording head 12 or rapid elastic shape restoration of the blade 25*a* that has been elastically deformed through wiping.

(18) After the head guide unit 90 contacts the recording head 12, the head guide unit 90 is continuously urged to move farther. However, the raising and lowering unit 50 absorbs such urging by its elastic support function. Thus, even if the height of the recording head 12 is changed through adjustment of the platen gap, positioning of the caps 24 is carried out. In this state, suction cleaning is performed. After such suction cleaning is completed, the lock mechanism 170 is locked with the caps 24 held in contact with the nozzle forming surface 12*a*. In this manner, while the compression spring 55 of the raising and lowering unit 50 is maintained (locked) in a compressed state corresponding to capping, the cleaning mechanism 22 is lowered. Thus, the cleaning mechanism 22 is constantly spaced from the recording head 12 at the distance corresponding to the raising and lowering stroke of the raising and lowering unit 50. This ensures a constant distance between the nozzle forming surface 12*a* and the cleaning mechanism 22 in wiping regardless of the current value of the platen gap. Thus, regardless of that the raising stroke of the head guide unit 90 in the reciprocation stage of the wiper 25 is substantially constant, the guide portions 91, 92 reliably become engaged with the side surfaces of the recording head 12. Further, regardless of the value of the platen gap, each wiper 25 is reliably positioned with respect to the recording head 12. Also, the distance between the holder 23 to which the wiper 25 is secured and the nozzle forming surface 12*a* is also maintained constant. Thus, the contact pressure by which the wiper 25 corresponding to the selected row contacts the nozzle forming surface 12*a* becomes substantially constant. As a result, wiping is performed under stable contact pressure.

The configuration of an alternative maintenance system will be explained with reference to FIGS. 65 to 72.

In the first embodiment, the maintenance devices are arranged along the two rows in the zigzag manner in correspondence with the recording heads, which are also arranged along the two rows in the zigzag manner. This embodiment provides maintenance devices that can be arranged along three or more rows in a zigzag manner. The maintenance devices thus may be used for recording heads that are arranged along three or more rows in a zigzag manner.

In the first embodiment, which employs two-row zigzag arrangement, each suction pump 40 is provided adjacent to the corresponding cleaning mechanism 22 to decrease the height of the maintenance device 20. In this state, as viewed from above, the suction pump 40 is exposed from the corresponding recording head 12. Contrastingly, in this embodiment, the electric motor 30, the suction pump 40, and the cleaning mechanism 22 are arranged in series in the direction opposed to the recording head. The projected surface area of each maintenance device in the direction perpendicular to the nozzle forming surface is thus reduced both in direction X and direction Y.

Figure 65:
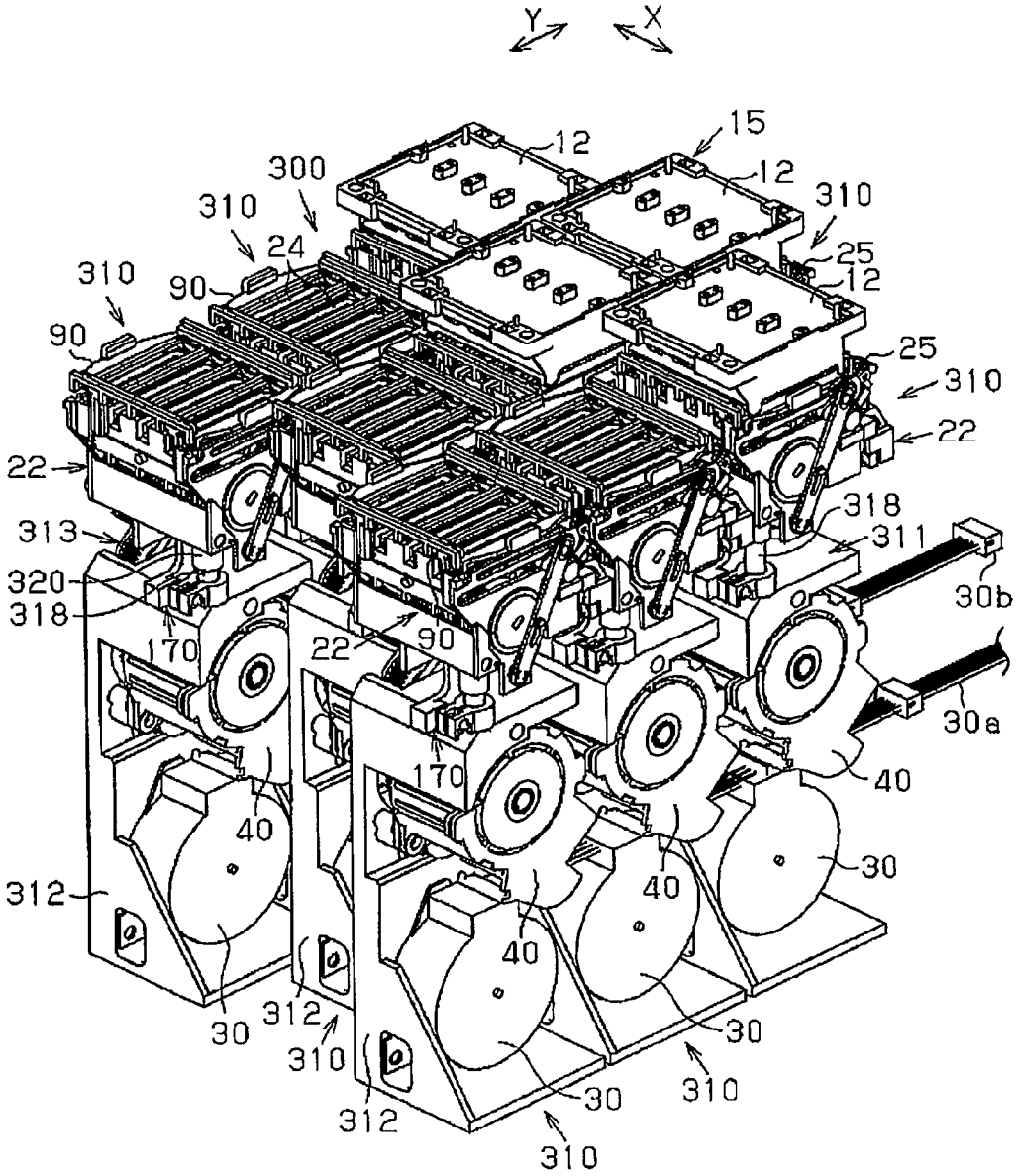
FIG. 65 is a front perspective view showing a maintenance system according to a second embodiment of the present invention.
Figure 66:
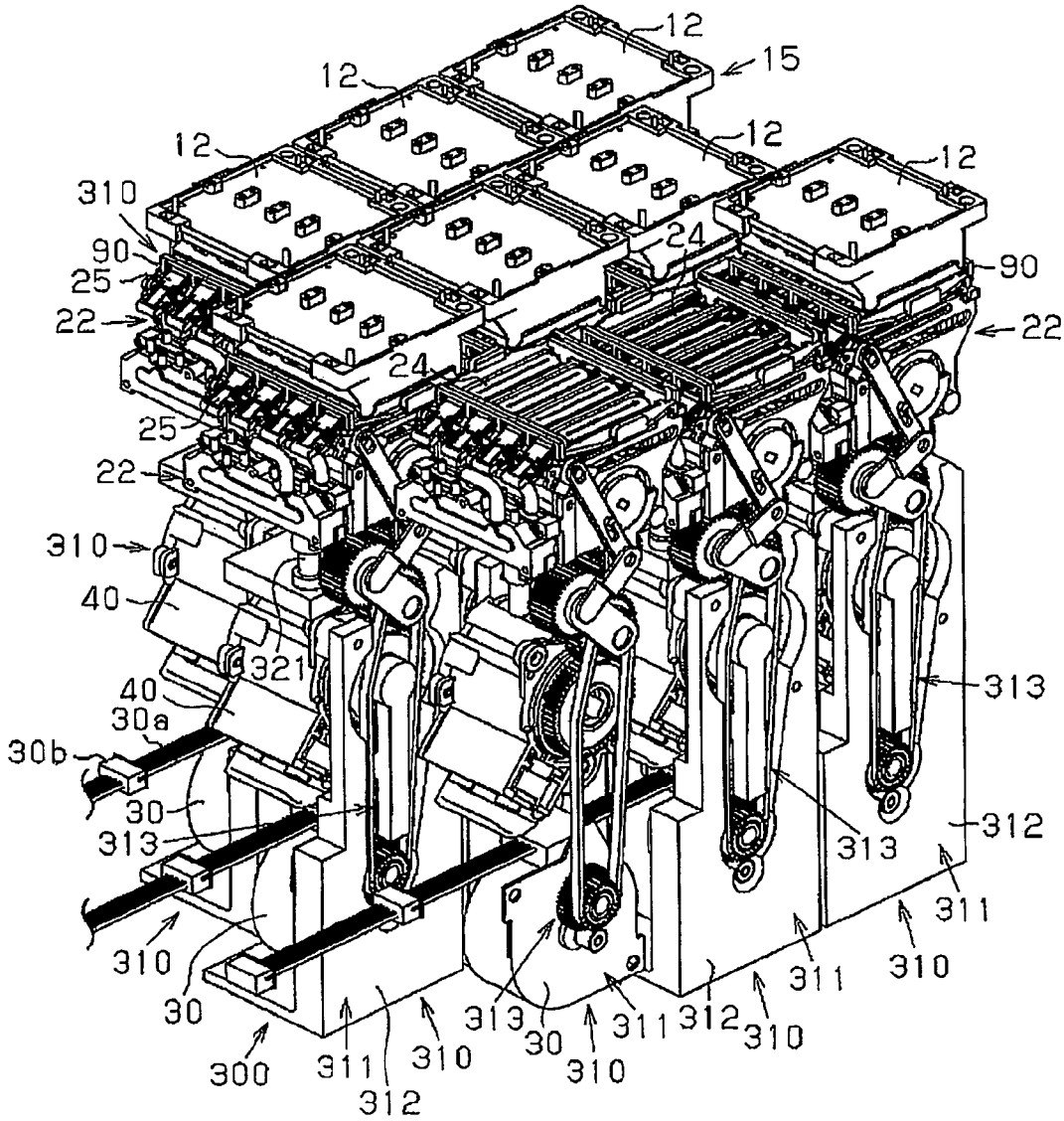
FIG. 66 is a rear perspective view showing the maintenance system shown in FIG. 65.
Figure 67:
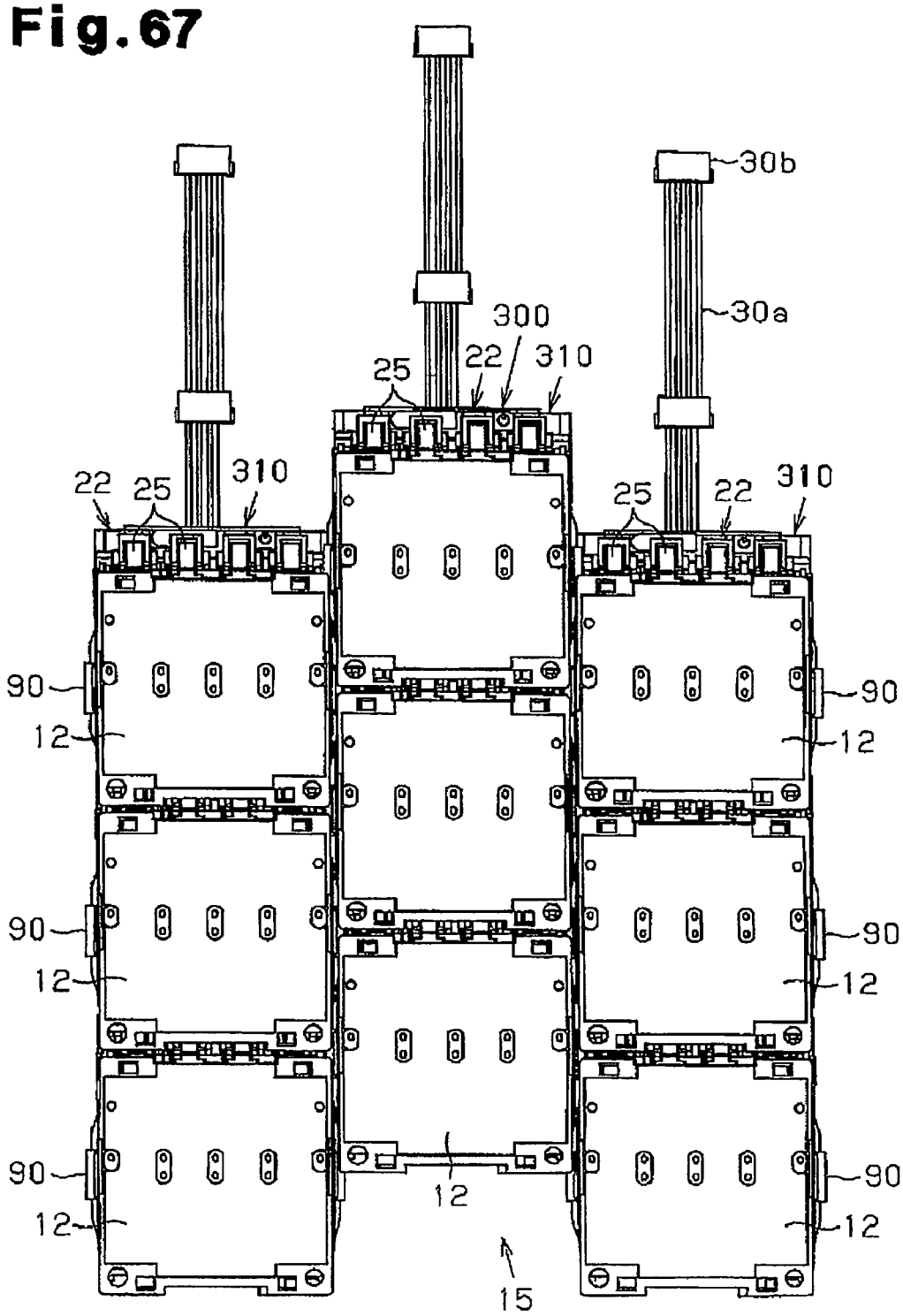
FIG. 67 is a plan view showing the maintenance system shown in FIG. 65.
Figure 68:
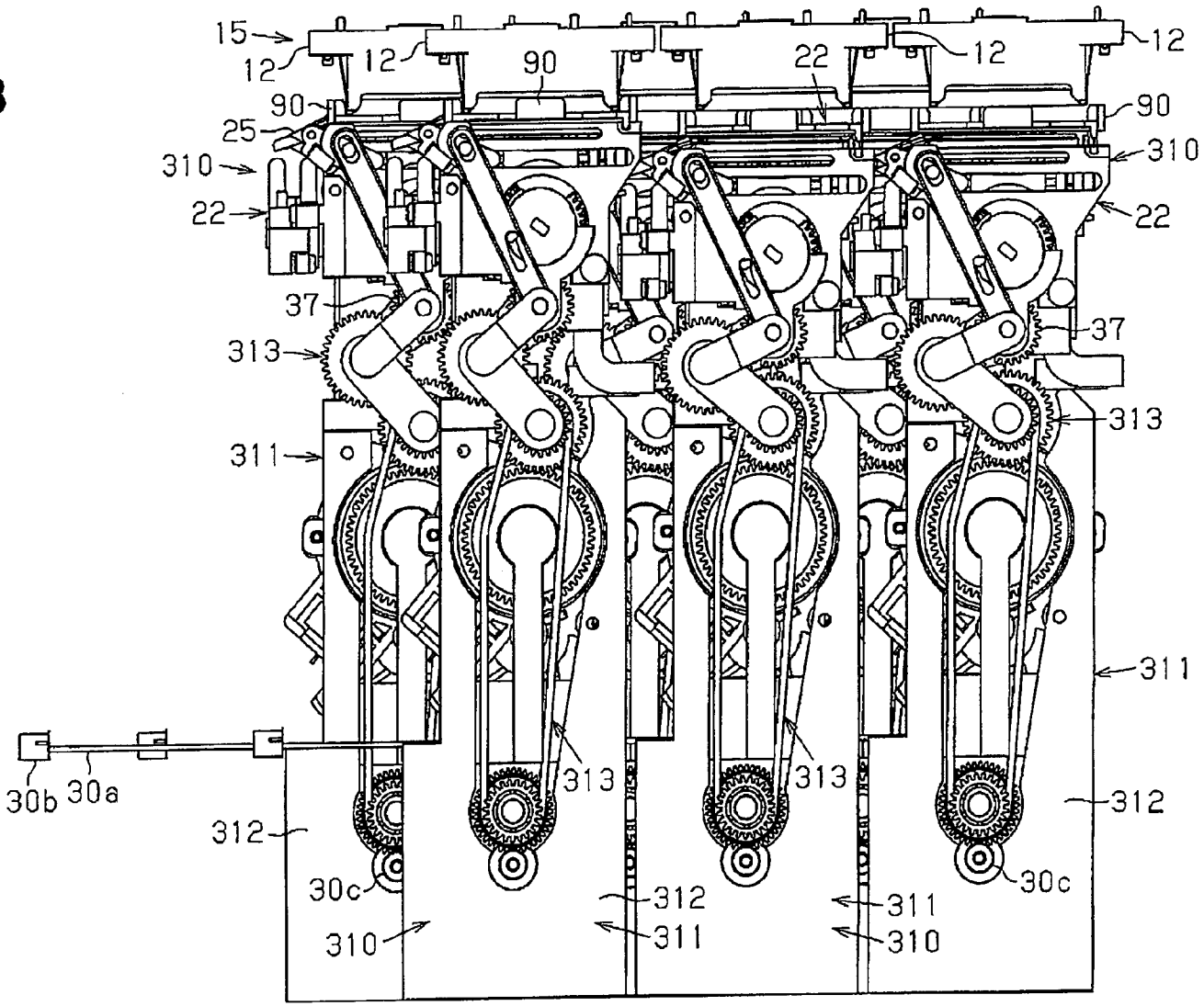
FIG. 68 is a left side view showing the maintenance system shown in FIG. 65.
Figure 69:
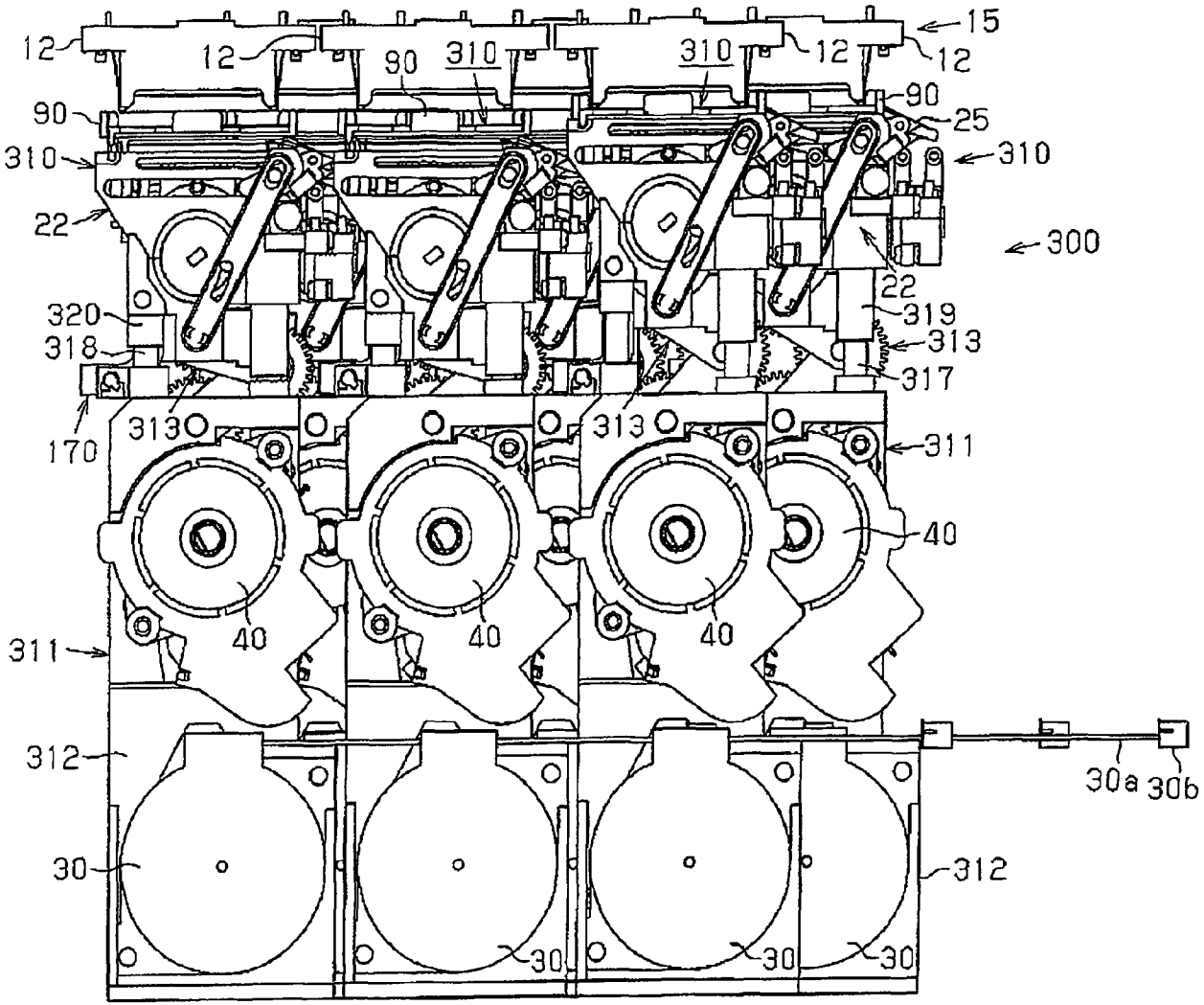
FIG. 69 is a right side view showing the maintenance system shown in FIG. 65.
Figure 70:
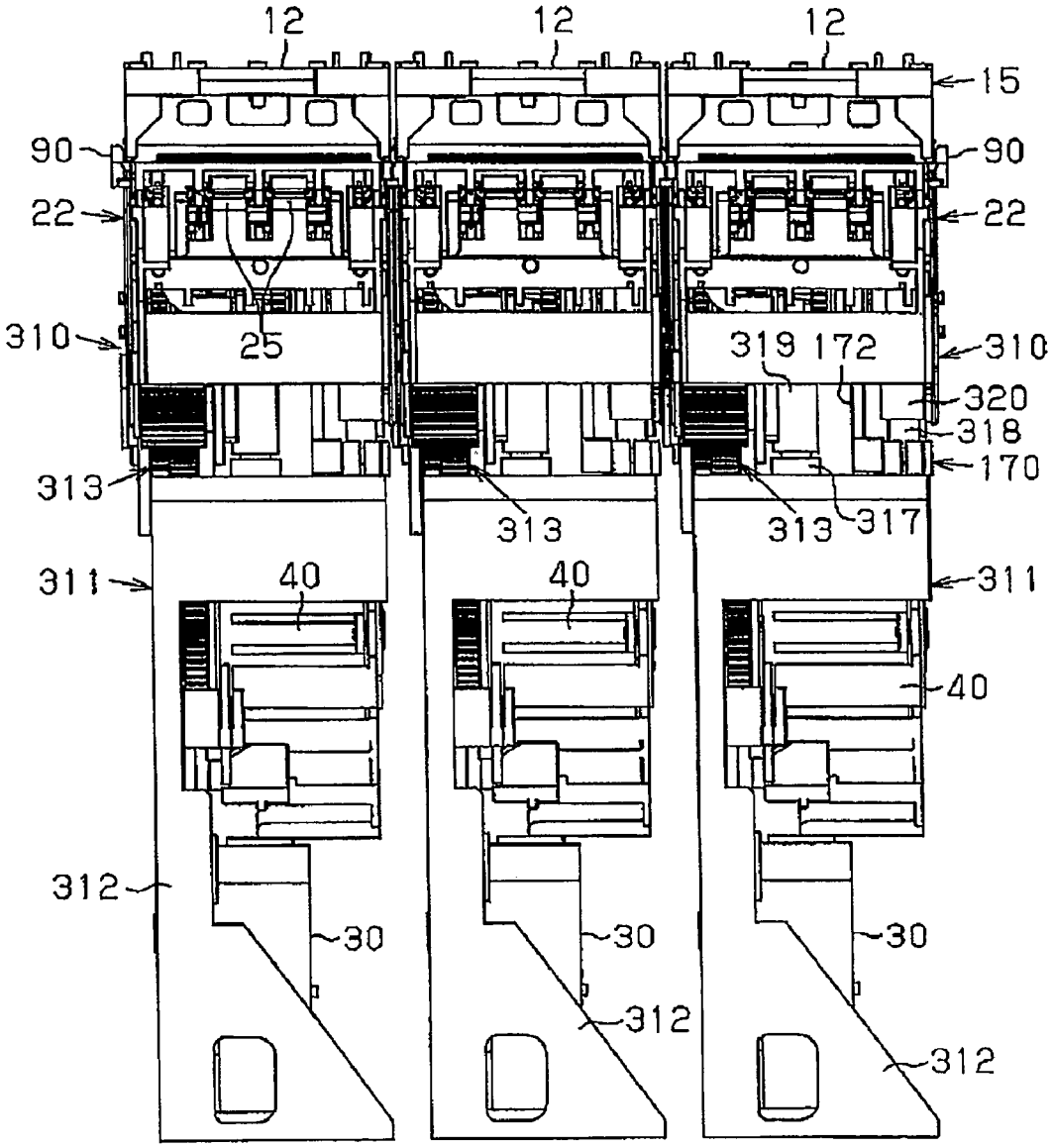
FIG. 70 is a front view showing the maintenance system shown in FIG. 65.

FIGS. 65 to 70 show the maintenance system of a second embodiment. FIG. 65 is a front perspective view, and FIG. 66 is a rear perspective view. FIG. 67 is a plan view, FIG. 68 is a left side view, and FIG. 70 is a right side view.

As shown in FIGS. 65 to 70, a recording head system 11 of this embodiment has a plurality of recording heads 12 that are aligned along three rows in a zigzag manner. A maintenance system 300 includes a plurality of maintenance devices 310 that are provided at the positions immediately below and corresponding to the recording heads 12, which form the recording head system 15. The maintenance devices 310 are arranged in a zigzag manner in correspondence with the recording heads.

In each of the maintenance devices 310, the electric motor 30, the suction pump 40, and the cleaning mechanism 22 are arranged in series in this order from below in such a manner that the projected shape of the maintenance device 310 in the direction perpendicular to the nozzle forming surface becomes substantially identical to that of each recording head 12 and the projected surface area of the maintenance device 310 in the aforementioned direction becomes substantially equal to that of the recording head 12. That is, the maintenance devices 310 are arranged immediately below the recording heads 12, which are arranged along the three rows in the zigzag manner, and along the three rows in the zigzag manner in correspondence with the recording heads.

Each maintenance device 310 has a base unit 311 and the cleaning mechanism 22, which is selectively raised and lowered with respect to the base unit 311. The electric motor 30 and the suction pump 40 are arranged in series in this order from below and fixed to the base frame 312 forming the base unit 311.

As shown in FIGS. 69 and 70, two guide rods 317, 318 project vertically from the upper surface of a base frame 312. The guide rods 317, 318 are passed through two guide cylinders 319, 320, which project downward from each cleaning mechanism 22. This allows the cleaning mechanism 22 to be selectively raised and lowered with respect to the base frame 312. In the first embodiment, the lock mechanism 170 is secured to the pressure adjustment shaft 53 of the raising and lowering unit. In this embodiment, the lock mechanism 170 is secured to one of the two guide rods 318.

With reference to FIGS. 66 and 68, a power transmission mechanism 313, which transmits the power of each electric motor 30 to the associated cleaning mechanism 22, is provided at a left side surface of each maintenance device 310. The power transmission mechanism 313 is a timing belt type that transmits power from the electric motor 30 located at the lower end of the maintenance device 310 to the cleaning mechanism 22 provided at the upper end of the maintenance device 310. In this embodiment, the power transmission mechanism 313 functions also as a raising and lowering device that selectively raises and lowers the cleaning mechanism 22 with respect to the base frame 312.

The cleaning mechanism 22 of this embodiment and the cleaning mechanism 22 of the first embodiment have identical configurations but employ different raising and lowering methods. Specifically, the rotational force that has been transmitted to the intermediate selection gear 37 is transmitted to the selection unit 110 (shown in FIGS. 71 and 72) provided in the holder 23. In this manner, cleaning is performed only on the nozzle rows of the recording head 12 including defective ejection nozzles. In the following, a power transmission system and a raising and lowering system will be explained but the cleaning mechanism 22, which has the identical configuration with that of the first embodiment, will not be described.

Figure 71:
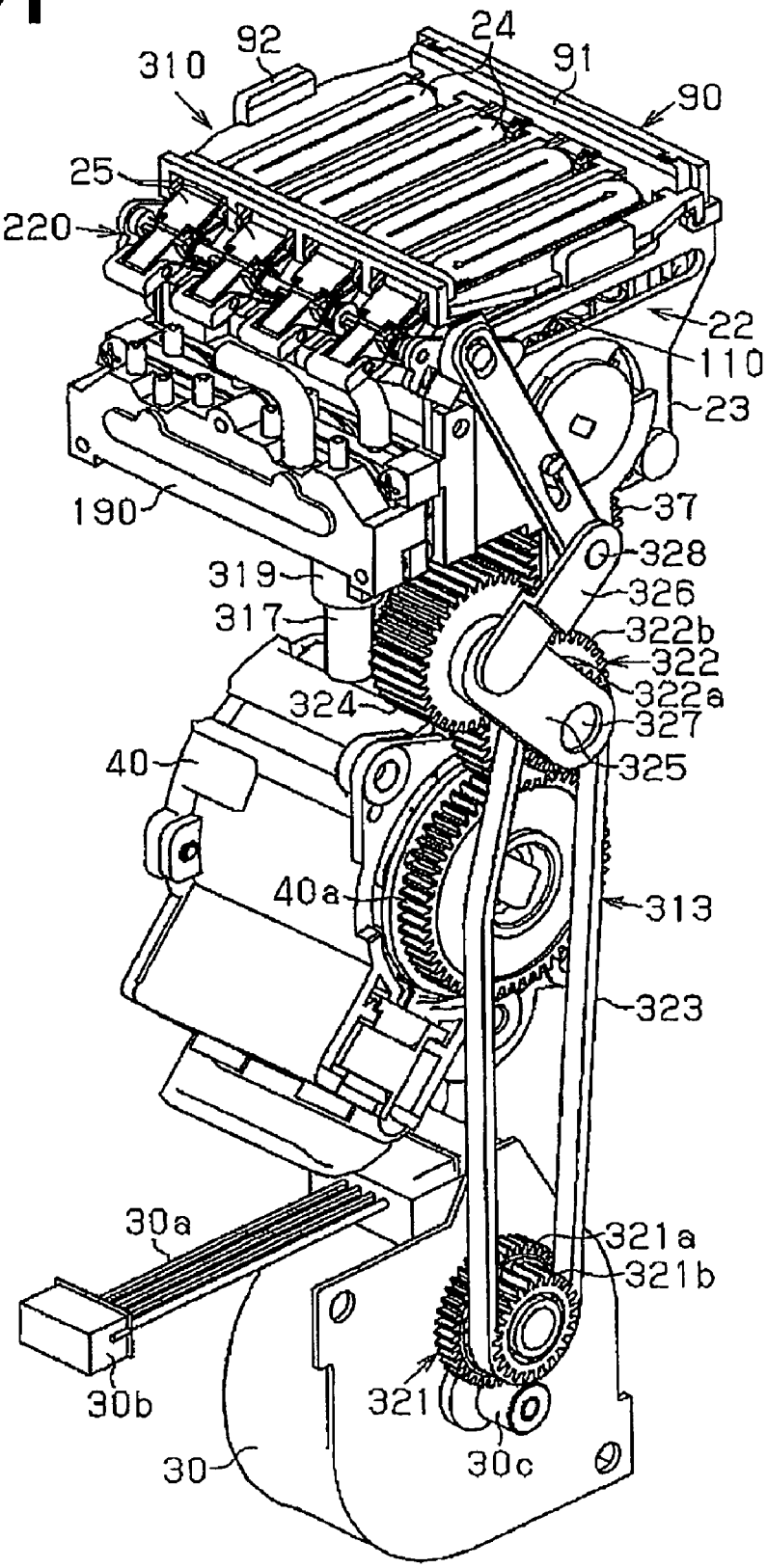
FIG. 71 is a perspective view showing the maintenance device shown in FIG. 65 without a frame.
Figure 72A:
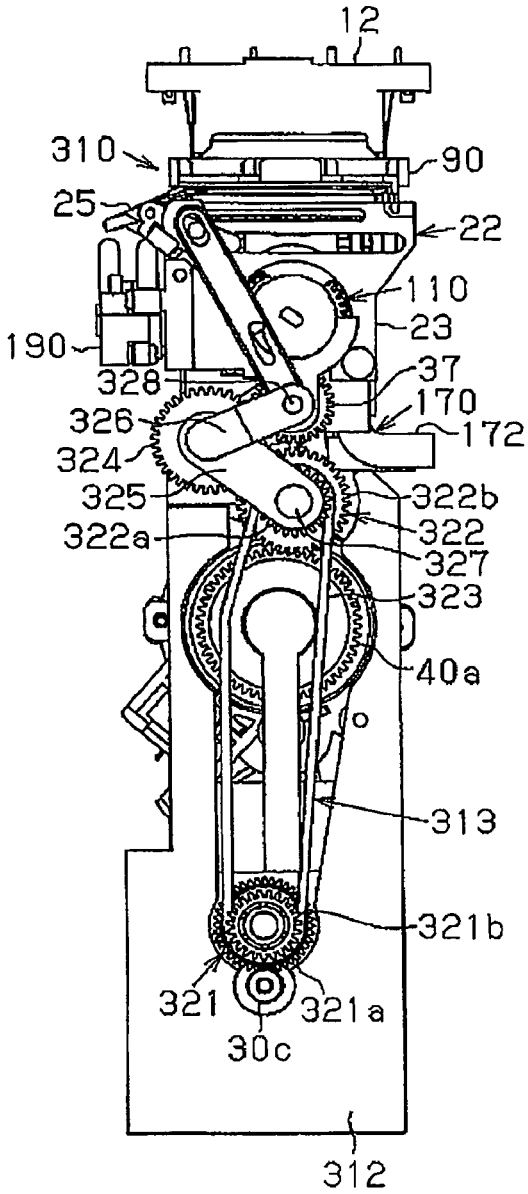
FIG. 72A is a left side view showing the maintenance device with a cleaning mechanism located at a lowered position.

FIG. 71 is a perspective view showing the maintenance device without the base frame. FIG. 72 is a rear view showing the maintenance device. Specifically, FIG. 72A represents a lowered state of the maintenance device in which the cleaning mechanism 22 is located at the lowered position. FIG. 27B represents a raised state of the maintenance device in which the cleaning mechanism 22 is located at the raised position.

The power transmission mechanism 313 is provided at the left side surface of each maintenance device 310. The power transmission mechanism 313 transmits the rotational drive force of a pinion 30*c* secured to the drive shaft of the electric motor 30 to the selection unit 110, which is accommodated in the holder 23 in a state operably connected to the intermediate selection gear 37. The power transmission mechanism 313 includes the pinion 30*c*, a double gear 321, a double gear 322, a timing belt 323, an intermediate gear 324, the intermediate selection gear 37, a link lever 325, and a link lever 326. The timing belt 323 is wound around the double gears 321, 322. The link lever 325 links the shaft of the double gear 322 to the shaft of the intermediate gear 324. The link lever 326 links the shaft of the intermediate gear 324 to the shaft of the intermediate selection gear 37.

The pinion 30*c* is engaged with a large gear portion 321*a* of the double gear 321. The double gear 322 is provided above and near the suction pump 40. A large gear portion 322*b* of the double gear 322 is engaged with the pump gear 40*a*. The double gear 322 is fixed to a rotary shaft 327, which is rotatably supported by the base frame 312. The timing belt 323 is wound around a small gear portion 321*b* of the double gear 321 and a small gear portion 322*a* of the double gear 322.

An end of the link lever 325 is pivotally connected to the rotary shaft 327 of the double gear 322. The opposite end of the link lever 325 supports a support shaft (not shown) that rotatably supports the intermediate gear 324. An end of the link lever 326 is pivotally connected to this opposite end of the link lever 325. The opposite end of the link lever 326 is pivotally connected to a connection shaft 328, which is arranged at the position corresponding to the shaft of the intermediate selection gear 37. The distance between the shaft of the intermediate gear 324 and the shaft of the double gear 322 is maintained as a constant value that allows engagement between the intermediate gear 324 and the double gear 322 through the link lever 325, which links the shafts of the intermediate gear 324 and the double gear 322 to each other. The distance between the shaft of the intermediate gear 324 and the shaft of the intermediate selection gear 37 is maintained as a constant value that allows engagement between the intermediate gear 324 and the intermediate selection gear 37 through the link lever 326, which links the shafts of the intermediate gear 324 and the intermediate selection gear 37 to each other.

When the electric motor 30 is driven by the controller to rotate in the forward direction with the cleaning mechanism 22 located at the lowered position as illustrated in FIG. 72A, rotation of the electric motor 30 is transmitted to the double gear 322 through the pinion 30*c*, the double gear 321, and the timing belt 323. Such rotation is then transmitted to the intermediate selection gear 37 through the intermediate gear 324, which is engaged with the double gear 322. In this state, as the double gear 322 is rotated in the forward direction and the link lever 325 is pivoted clockwise about the rotary shaft 327, the angle between the link lever 325 and the link lever 326 is increased. This applies the force acting upward to the connection shaft 328 to increase the distance between the shaft of the double gear 322 and the shaft of the intermediate selection gear 37. The cleaning mechanism 22 is thus raised.

Figure 72B:
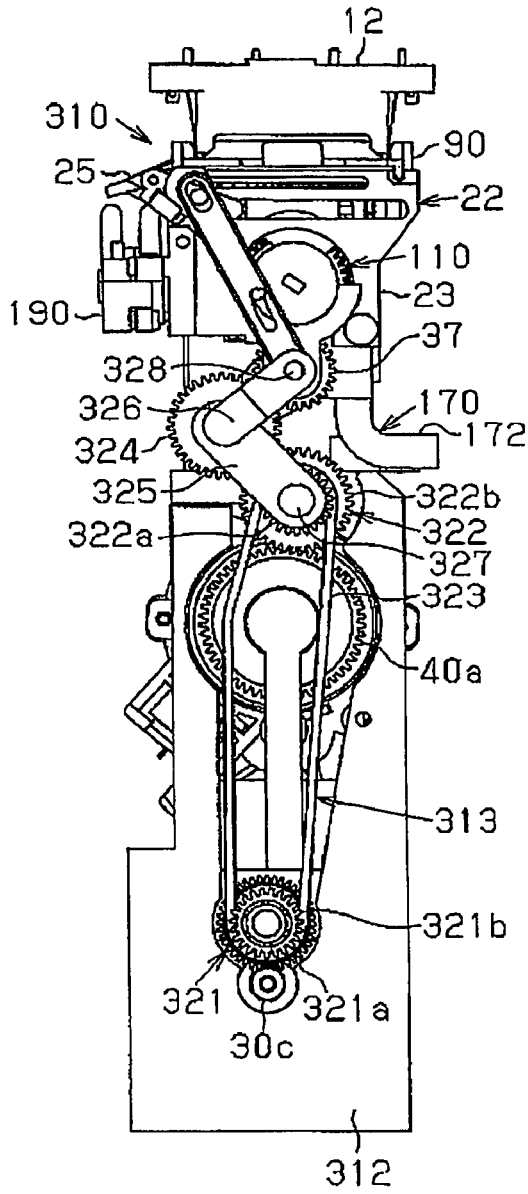
FIG. 72B is a left side view showing the maintenance device with the cleaning mechanism located at a raised position.

When the electric motor 30 is driven by the controller to rotate in a reverse direction with the cleaning mechanism located at the raised position as illustrated in FIG. 72B, rotation of the electric motor 30 is transmitted to the double gear 322 through the pinion 30*c*, the double gear 321, and the timing belt 323. Such rotation is then transmitted to the intermediate selection gear 37 through the intermediate gear 324, which is engaged with the double gear 322. In this state, as the double gear 322 is rotated in a reverse direction and the link lever 325 is pivoted counterclockwise about the rotary shaft 327, the angle between the link lever 325 and the link lever 326 is decreased. This applies the force acting downward to the connection shaft 328 to decrease the distance between the shaft of the double gear 322 and the shaft of the intermediate selection gear 37. The cleaning mechanism 22 is thus lowered.

The present invention is not restricted to the illustrated embodiments but may be embodied in the following forms.

In each of the illustrated embodiments, the following control method may be employed. Specifically, ink may be splashed through wiping and thus contaminate the nozzle forming surface 12*a* of the adjacent one of the recording heads 12. To avoid this, when wiping is to be performed by any one of the maintenance devices 20, the controller 27 operates to raise the cleaning mechanism 22 of the adjacent one of the maintenance devices 20 that is located forward in the wiping direction. The controller 27 then operates the caps 24 of this cleaning mechanism 22 to perform capping by sealing the corresponding nozzle forming surface 12*a*. In this state, the controller 27 operates the aforementioned maintenance device 20 to carry out wiping. In other words, for wiping, the cleaning mechanism 22 of the maintenance device 20 located adjacent to the maintenance device 20 that is to perform wiping and downstream in the wiping direction is raised. The nozzle rows 13 of the correspondingly adjacent recording head 12 is thus capped by the caps 24 of this adjacent maintenance device 20 and protected.

Thus, if the ink that has been wiped off by the wiper 25 is splashed to a downstream portion in the wiping direction, the nozzle forming surface 12*a* corresponding to the adjacent maintenance device 20, which is protected by the caps 24, is shielded from the splashed ink. This prevents the splashed ink from adhering to the nozzle forming surface 12*a* and thus deforming the nozzle meniscus. Further, the traveling path of the ejected liquid droplets is easily prevented from becoming offset due to adhesion of the splashed ink to the nozzle forming surface 12*a*.

In this case, sequence control in which every other recording head 12 in the extending direction of the nozzle row is synchronously operated may be employed. That is, it is desired that the maintenance system be operated through such sequence control in such a manner that wiping is carried out by certain ones of the maintenance devices when suction is performed by the adjacent ones of the maintenance devices with the caps 24 held in contact with the nozzle forming surfaces 12*a*. In an alternative sequence control method, the maintenance devices are operated synchronously altogether until suction is completed. Then, wiping is performed by every other one of the maintenance devices in the extending direction of each nozzle. Specifically, if wiping is to be performed by certain ones of the maintenance devices, for example, the electric motors 30 of the adjacent ones of the maintenance devices in the extending direction of each nozzle are prevented from rotating in the reverse directions after idle suction. This maintains the associated caps 24 at the raised positions to allow the caps 24 to protect the corresponding nozzle rows 13. The nozzle rows 13 are thus protected from the ink splashed by the wiper 25 of the adjacent maintenance devices in wiping. After such wiping is ended, the electric motors 30 of those of the maintenance devices 20 in which the caps 24 have been maintained at the raised positions are rotated in the reverse directions to lower the caps 24. Wiping is then performed by these maintenance devices 20. At this point of time, the electric motors 30 of those of the maintenance devices 20 that have finished wiping are rotated in the forward directions to raise the associated caps 24 and protect the nozzle forming surface 12*a* by means of the caps 24. This prevents the nozzle forming surfaces 12*a* of these maintenance devices 20 from receiving ink splashed from the adjacent maintenance devices performing wiping. In such wiping, the electric motors 30 of these adjacent maintenance devices 20 are rotated continuously in the forward directions without switching to the reverse directions. The caps 24 are thus maintained in a state exposed to the atmospheric air through cam selection of the selection unit 110 corresponding to non-selection. Further, after capping is ended, the electric motors 30 are stopped before the suction pumps 40 are actuated. As a result, even though the maintenance devices 20 are operated to perform capping after having finished wiping, deformation of nozzle meniscus does not occur. When wiping by the certain maintenance devices 20 is finished, the electric motors 30 of the adjacent maintenance devices 20 are rotated in the reverse directions to lower the cleaning mechanisms 22 from the raised positions corresponding to the capping state. The electric motors 30 are stopped immediately before wiping is started.

In the illustrated embodiment, the maintenance system 10 is formed by the multiple maintenance devices 20. However, the maintenance system 10 may be configured by a single maintenance device.

In the illustrated embodiments, the wipers 25 are reciprocated and the caps are raised or lowered when cleaning is not selected. However, the present invention is not restricted to this. For example, drive systems for wipers and caps may be provided separately. In this case, while the wipers corresponding to non-selected rows are maintained in a standby state at the retreat positions, the wipers 25 corresponding to selected rows are reciprocated along a wiping path. Also, while the caps corresponding to non-selected rows are maintained in a standby state at the lowered positions, the caps 24 corresponding to selected rows are raised.

The chamfered portion does not necessarily have to be an inclined surface but may be a curved surface. As long as one of the opposing chamfered portions is a curved and inverted V-shaped projection and the other is a curved V-shaped recess, the engagement amount effective for reducing the distance between the centers of the guide members is ensured.

Although the caps 24 and the wipers 25 are both provided as cleaning means in each of the embodiments, the invention is not restricted to this. For example, each maintenance device may include only a wiping device that has the self-actuated wipers 25.

Although the maintenance devices are used in cleaning of the non-scanning type recording head system 11 in the illustrated embodiments, the maintenance devices may be employed in a line head. In this case, the maintenance system for the nozzles may be used in a scanning type liquid ejection head or scanning type liquid ejection heads. The maintenance devices of the present invention may be used also in cleaning of a scanning type recording head.

In each of the illustrated embodiments, the maintenance devices 20 are located below the recording heads 12 and the maintenance devices 20 selectively raises and lowers the cleaning mechanisms 22. However, the orientation of each maintenance device 20 may be set in any suitable manner in correspondence with the orientation of the associated recording head 12. For example, if the recording head 12 is oriented in such a manner that the nozzle forming surface 12*a* extends vertically, the maintenance device 20 is oriented in such a manner that the cleaning mechanism 22 is reciprocated in a lateral direction. In this case, each lift plate base 151, or the movable body, is in a horizontal direction in which the lift plate base 151 approaches or separates from the nozzle forming surface. Alternatively, the movable body may be moved in any other suitable direction other than the up-and-down direction and the horizontal direction.

In the illustrated embodiments, each cleaning mechanism 22 is selectively raised and lowered by the raising and lowering unit 50. However, the cleaning mechanism may be fixed to the base unit 21. In this case, capping by the caps is performed by moving (raising or lowering) the recording head system.

The wiper 25 is not restricted to a pivoting type that changes the angle of posture of the wiper 25. A plurality of wipers may be selectively raised and lowered independently from each other.

In the illustrated embodiments, the wiper 25 does not contact the nozzle forming surface 12*a* when moving along the proceeding path but contacts the nozzle forming surface 12*a* when moving along the return path. However, the present invention is not restricted to this. For example, the wiper 25 may contact and wipe the nozzle forming surface 12*a* when moving along the proceeding path and return to the retreat position in a state separate from the nozzle forming surface 12*a* when moving along the returning path.

In the illustrated embodiments, the lift plate base 151, which forms the movable body, is moved in the up-and-down direction. However, the movement direction of the movable body is not restricted to this direction. For example, for a liquid ejection head having a nozzle forming surface extending vertically to allow ejection of liquid in a horizontal direction, the movable body may be moved in a horizontal direction in which the movable body approaches and separates from the nozzle forming surface. Alternatively, the movement direction of the movable body may be any suitable direction other than the up-and-down direction and the horizontal direction.

Although the wipers 25 are arranged in parallel in each of the illustrated embodiments, the wipers 25 may be arranged in series. In this case, the wipers can separately wipe the respective ones of a plurality of divided wiping areas defined through division of an elongated wiping range of, for example, a multiple head or a line head in the extending direction of each nozzle row. The wiping stroke of each of the wipers is shortened in this case. Thus, if the wipers are operated synchronously or at partially overlapping timings, the time spent for wiping is shortened, compared to the case in which the entire range in the extending direction of each nozzle row is wiped by a singe wiper.

In the illustrated embodiments, the four wipers 25 are provided in such a manner that the nozzle rows 13 are wiped by the different wipers 25 in correspondence with the colors of the ink. However, the number of the wipers 25 that wipe a single one of the recording heads 12 may be changed as needed. For example, two wipers 25 may be provided and each of the wipers 25 wipes two of the nozzle rows 13. Also, a single recording head does not necessarily have to be wiped by multiple wipers 25. For example, in elongated recording heads having a single nozzle row, each of the wipers may wipe the corresponding one of the recording heads. Also, for a relatively large-sized recording head such as a line head, a plurality of maintenance devices may wipe a single recording head. That is, for example, each maintenance device includes a plurality of wipers and the wipers wipe some of the nozzle rows defined in the recording head.

In the illustrated embodiments, the liquid ejection apparatus is embodied by the inkjet type recording apparatus used in printing. However, the present invention is not restricted to this. That is, the maintenance system of the invention may be used in a liquid ejection apparatus that ejects liquid other than ink. The liquid ejection apparatus may be, for example, a liquid ejection apparatus that ejects a liquefied body containing material used in the manufacture of liquid crystal displays, EL (electroluminescence) displays, and surface emitting displays, such as electrode material and color material, which are dispersed or dissolved in the liquefied body, or a liquid ejection apparatus that ejects bioorganic matter used in the manufacture of biochips, or a sample ejection apparatus as a precision pipette. The present invention may be embodied as a maintenance system provided in these liquid ejection apparatuses to clean the liquid ejection heads.

What is claimed is:

1. A maintenance device mounted in a liquid ejection apparatus having a liquid ejection head including nozzles that ejects liquid, the maintenance device maintaining the liquid ejection head, the device comprising:

a plurality of wipers capable of wiping a nozzle forming surface of the liquid ejection head in which the nozzles are formed;

a selecting portion that selects at least one of the wipers and applies a wiping force, which allows wiping of the nozzle forming surface, to the selected wiper but not to the wipers other than the selected wiper when the plurality of wipers are opposed to the nozzle forming surface; and a driver that drives a first wiper selected by the selecting portion and a second wiper not selected by the selecting portion movably in a wiping direction parallel with the nozzle forming surface in a state in which the first wiper and the second wiper are opposed to the nozzle forming surface.

2. The maintenance device according to claim 1, wherein the driver drives the wipers altogether to move in the wiping direction simultaneously.

3. The maintenance device according to claim 1, wherein the selecting portion includes a plurality of movable bodies each corresponding to one of the wipers, each movable body being movable between a first position, at which the movable body allows the corresponding wiper to wipe the nozzle forming surface when the wiper moves in the wiping direction, and a second position, at which the movable body prohibits the corresponding wiper from wiping the nozzle forming surface when the wiper moves in the wiping direction, and wherein the selecting portion moves the movable body corresponding to the selected wiper to cause the selected wiper to perform wiping.

4. The maintenance device according to claim 3, wherein each of the wipers includes:

a wiper body having a wiper member capable of sliding on the nozzle forming surface when the wiper moves in the wiping direction;

a stopping lever pivotably connected to the wiper body, wherein an upper limit of an opening angle of the stopping lever and the wiper body is restricted;

an urging member that urges the stopping lever and the wiper body in a direction in which the opening angle increases; and a wiper drive shaft that is moved in the wiping direction when driven by the driver, wherein, when the wiper drive shaft moves in the wiping direction, the stopping lever slides on the movable body to cause the wiper member to slide on and wipe the nozzle forming surface.

5. The maintenance device according to claim 4, wherein, when each movable body is arranged at the first position, the movable body presses the stopping lever of the corresponding wiper to decrease the opening angle.

6. The maintenance device according to claim 4, wherein the selecting portion includes a plurality of rotational cams each corresponding to one of the wipers and a plurality of cam followers engageable with the rotational cams, wherein each movable body is moved between the first position and the second position by the associated cam follower when the corresponding rotational cam rotates.

7. The maintenance device according to claim 6, wherein each of the rotational cams includes a cam portion having a plurality of cam surfaces with different radii, the rotational cams being supported coaxially in a state in which the phases of the cam portions are arranged mutually offset and in a manner integrally pivotable in a forward direction and a reverse direction, and wherein, based on the rotational direction of each rotational cam at a specific rotation angle position of the rotational cam, the selecting portion selects one of the cam surfaces with which one of the cam followers becomes engaged, thereby selecting the position of the corresponding one of the movable bodies moved through the cam follower.

8. The maintenance device according to claim 1, wherein each wiper is movable in the wiping direction and a non-wiping direction opposite to the wiping direction, and wherein the maintenance device further comprises a restricting portion that, when the wiper moves in the non-wiping direction, restricts movement of each wiper to a wiping position at which the wiper is allowed to contact the liquid ejection head.

9. The maintenance device according to claim 8, further comprising a restriction canceling portion, wherein, when each wiper moves in the wiping direction, the restriction canceling portion permits the wiper to move in a state released from the restriction by the restricting portion.

10. A maintenance device mounted in a liquid ejection apparatus having a liquid ejection head including nozzles that eject liquid, the maintenance device maintaining the liquid ejection head, the device comprising:

a plurality of wipers capable of wiping a nozzle forming surface of the liquid ejection head in which the nozzles are formed;

a driver that drives the wipers movably in a wiping direction parallel with the nozzle forming surface; and a selecting portion that selects at least one of the wipers and causes the selected wiper to wipe the nozzle forming surface when the wiper moves in the wiping direction, wherein the selecting portion includes a plurality of moveable bodies each corresponding to one of the wipers, each moveable body being moveable between a first position, at which the moveable body allows the corresponding wiper to wipe the nozzle forming surface when the wiper moves in the wiping direction, and a second position, at which the moveable body prohibits the corresponding wiper from wiping the nozzle forming surface when the wiper moves in the wiping direction, and wherein the selecting portion moves the moveable body corresponding to the selected wiper to cause the selected wiper to perform wiping, wherein each of the wipers includes:

a wiper body having a wiper member capable of sliding on the nozzle forming surface when the wiper moves in the wiping direction;

a stopping lever pivotably connected to the wiper body, wherein an upper limit of an opening angle of the stopping lever and the wiper body is restricted;

an urging member that urges the stopping lever and the wiper body in a direction in which the opening angle increases; and a wiper drive shaft that is moved in the wiping direction when driven by the driver, wherein, when the wiper drive shaft moves in the wiping direction, the stopping lever slides on the moveable body to cause the wiper member to slide on and wipe the nozzle forming surface.

* * * * *